US010518143B1

(12) United States Patent
Greaney et al.

(10) Patent No.: US 10,518,143 B1
(45) Date of Patent: Dec. 31, 2019

(54) GOLF CLUB HEAD

(71) Applicant: Taylor Made Golf Company, Inc., Carlsbad, CA (US)

(72) Inventors: Mark Vincent Greaney, Vista, CA (US); Kraig Alan Willett, Fallbrook, CA (US); Joe Hoffman, Carlsbad, CA (US); Todd P. Beach, Encinitas, CA (US); Connor Mark Halberg, San Clemente, CA (US); Andrew Kickertz, San Diego, CA (US); Joseph Yu, Kaohsiung (TW); Bing-Ling Chao, San Diego, CA (US)

(73) Assignee: Taylor Made Golf Company, Inc., Carlsbad, CA (US)

( * ) Notice: Subject to any disclaimer, the term of this patent is extended or adjusted under 35 U.S.C. 154(b) by 0 days.

(21) Appl. No.: 16/160,974

(22) Filed: Oct. 15, 2018

Related U.S. Application Data

(60) Provisional application No. 62/687,143, filed on Jun. 19, 2018.

(51) Int. Cl.
*A63B 53/04* (2015.01)
*A63B 53/08* (2015.01)
*A63B 102/32* (2015.01)

(52) U.S. Cl.
CPC ..... *A63B 53/047* (2013.01); *A63B 53/08* (2013.01); *A63B 2053/0408* (2013.01); *A63B 2053/0458* (2013.01); *A63B 2102/32* (2015.10)

(58) Field of Classification Search
CPC ..... A63B 53/047; A63B 53/08; A63B 2053/0408; A63B 2053/0458; A63B 2102/32
See application file for complete search history.

(56) References Cited

U.S. PATENT DOCUMENTS 1,674,173 A 6/1928 Haupt
2,023,885 A 12/1935 Hinckley
(Continued)

OTHER PUBLICATIONS

Covey, "Ultimate Review—Adams Speedline Tech," https://mygolfspy.com/adams-speedline-tech-driver-review/, retrieved Feb. 27, 2018; 23 pages (Aug. 28, 2012).
(Continued)

*Primary Examiner* — Stephen L Blau
(74) *Attorney, Agent, or Firm* — Klarquist Sparkman, LLP

(57) ABSTRACT

An iron-type golf club head has a hosel portion, a heel portion, a sole portion, a toe portion, a topline portion, and a striking face including a center face location. A toe side topline-to-sole contour of the striking face is more lofted than a center face topline-to-sole contour of the striking face, a heel side topline-to-sole contour of the striking face is less lofted than the center face topline-to-sole contour, a topline side toe-to-heel contour of the striking face is more open than a center face toe-to-heel contour of the striking face, and a sole side toe-to-heel contour of the striking face is more closed than the center face toe-to-heel contour. The toe side topline-to-sole contour, the center face topline-to-sole contour, the heel side topline-to-sole contour, the topline side toe-to-heel contour, the center face toe-to-heel contour, and the sole side toe-to-heel contour are straight line contours.

21 Claims, 58 Drawing Sheets

(56) References Cited

U.S. PATENT DOCUMENTS

| | | | | |
|---|---|---|---|---|
| 2,395,837 | A * | 3/1946 | Baymiller | A63B 53/04 473/330 |
| 3,625,518 | A | 12/1971 | Solheim | |
| 4,367,878 | A | 1/1983 | Schmidt | |
| 4,471,961 | A | 9/1984 | Masghati | |
| 4,521,022 | A | 6/1985 | Schmidt | |
| 4,725,062 | A | 2/1988 | Kinney | |
| 5,098,103 | A * | 3/1992 | MacKeil | A63B 53/04 473/330 |
| 5,141,231 | A | 8/1992 | Cox | |
| 5,310,185 | A | 5/1994 | Viollaz | |
| 5,322,285 | A | 6/1994 | Turner | |
| 5,415,405 | A | 5/1995 | Vincent | |
| 5,857,920 | A | 1/1999 | Hong | |
| 6,093,115 | A | 7/2000 | Murtland | |
| 6,139,445 | A | 10/2000 | Werner et al. | |
| 6,402,639 | B1 | 6/2002 | Iwata et al. | |
| 6,428,426 | B1 | 8/2002 | Helmstetter et al. | |
| 6,454,664 | B1 | 9/2002 | Long | |
| 6,582,322 | B2 | 6/2003 | Long et al. | |
| 7,056,227 | B2 | 6/2006 | Giraldi | |
| 7,059,972 | B2 | 6/2006 | Miyamoto | |
| 7,066,830 | B2 | 6/2006 | Day | |
| 7,153,220 | B2 | 12/2006 | Lo | |
| 7,789,766 | B2 | 9/2010 | Morris et al. | |
| 7,850,538 | B1 | 12/2010 | Yoon | |
| 7,881,431 | B2 | 2/2011 | Beach et al. | |
| 7,887,431 | B2 | 2/2011 | Beach et al. | |
| 8,012,039 | B2 | 9/2011 | Greaney et al. | |
| 8,147,350 | B2 | 4/2012 | Beach et al. | |
| 8,152,652 | B2 | 4/2012 | Curtis et al. | |
| 8,167,737 | B2 | 5/2012 | Oyama | |
| 8,388,459 | B2 | 3/2013 | Chuck | |
| 8,496,544 | B2 | 7/2013 | Curtis | |
| 9,814,944 | B1 | 11/2017 | Greaney et al. | |
| 2006/0094532 | A1 | 5/2006 | Seeley | |
| 2007/0275791 | A1 | 11/2007 | Shear | |
| 2011/0263349 | A1 | 10/2011 | Kodama | |
| 2013/0029780 | A1 | 1/2013 | Beno et al. | |
| 2013/0079175 | A1 | 3/2013 | Lee | |
| 2014/0349777 | A1 | 11/2014 | Beno et al. | |
| 2018/0065003 | A1 | 3/2018 | Greaney et al. | |
| 2018/0318659 | A1 | 11/2018 | Greaney et al. | |
| 2018/0318660 | A1 | 11/2018 | Greaney et al. | |
| 2018/0318661 | A1 | 11/2018 | Greaney et al. | |
| 2018/0318662 | A1 | 11/2018 | Greaney et al. | |

OTHER PUBLICATIONS

Declaration of Steven M. Nesbit in Support of Petition for Post-Grant Review of U.S. Pat. No. 9,814,944, filed Jul. 6, 2018, 84 pages.

Golf Digest, 57(1), 7 pages (Jan. 2006).

Petition for Post Grant Review of U.S. Pat. No. 9,814,944, Case No. PGR2018-00074, filed Jul. 6, 2018, 73 pages.

Statement by Applicant in corresponding U.S. Appl. No. 15/811,430; 5 pages (executed on May 29, 2018).

Decision Granting Institution of Post-Grant Review of U.S. Pat. No. 9,814,944, Case No. PGR2018-00074, filed Jan. 24, 2019, 47 pages.

* cited by examiner

MODE1

FREQUENCY (Hz)
3056
GV (m/s)
12.07
KE (mJ)
1498
DAMPING
0.025
TAU (ms)
6.5

GOLF CLUB HEAD

CROSS REFERENCE TO RELATED APPLICATION

This application claims the benefit of U.S. Provisional Application No. 62/687,143, filed on Jun. 19, 2018, which is incorporated herein by reference in its entirety.

In addition to the incorporations discussed further herein, other patents and patent applications concerning golf clubs, such as U.S. application Ser. No. 15/811,430 and U.S. Pat. No. 9,814,944, are incorporated herein by reference in their entirety.

FIELD

The present disclosure relates to a golf club head. More specifically, the present disclosure relates to an iron-type golf club head having a unique face construction.

BACKGROUND

When a golf club head strikes a golf ball, a force is seen on the club head at the point of impact. If the point of impact is aligned with the center face of the golf club head in an area of the club face typically called the sweet spot, then the force has minimal twisting or tumbling effect on the golf club. However, if the point of impact is not aligned with the center face, outside the sweet spot for example, then the force can cause the golf club head to twist around the center face. This twisting of the golf club head causes the golf ball to acquire spin. For example, if a typical right handed golfer hits the ball near the toe of the club this can cause the club to rotate clockwise when viewed from the top down. This in turn causes the golf ball to rotate counter-clockwise which will ultimately result in the golf ball curving to the left. This phenomenon is what is commonly referred to as "gear effect."

Bulge and roll are golf club face properties that are generally used to compensate for this gear effect. The term "bulge" on a golf club typically refers to the rounded properties of the golf club face from the heel to the toe of the club face.

The term "roll" on a golf club typically refers to the rounded properties of the golf club face from the crown to the sole of the club face. When the club face hits the ball, the ball acquires some degree of backspin. Typically this spin varies more for shots hit below the center line of the club face than for shots hit above the center line of the club face.

FIG. 1 illustrates the problem to be solved by the present invention. FIG. 1 shows a ball location with respect to the intended target when the golf ball is struck with a club having a constant bulge and roll radius. The nine rectangles indicate the ball location when struck in the respective heel, toe, center, high, center, low combinations. The fairway 124 is separated from the rough 126 by a fairway edge 120,122. The final ball location is shown with respect to an intended target line 118. The intended target line 118 is the line along which the golf club head center is aimed when the golf is at the address position. When the golf ball is struck in the high position, the golf ball tends to have a "left tendency" which means the ball's final resting position will be left of the target line 118. As illustrated by points 100, 102, and 104 shown in FIG. 1. When the golf ball is struck in the low position, the golf ball tends to have a "right tendency" which means the ball's final resting position will likely be to the right of the target line 118 as illustrated by points 112, 114,116 shown in FIG. 1. When a golf ball impacts the ball in the central horizontal portion of the face, the ball tends to come to rest on target relative to the target line 118 as illustrated by points 106,108,110 shown in FIG. 1.

A golf club design is needed to counteract the left and right tendency that a player encounters when the ball impacts a high or low position on the club head striking face.

The problems noted above are equally applicable to iron-type golf clubs or "irons." While all clubs in a golfer's bag are important, both scratch and novice golfers rely on the performance and feel of their irons for many commonly encountered playing situations.

Irons are generally configured in a set that includes clubs of varying loft, with shaft lengths and clubhead weights selected to maintain an approximately constant "swing weight" so that the golfer perceives a common "feel" or "balance" in swinging both the low irons and high irons in a set. The size of an iron's "sweet spot" is generally related to the size (i.e., surface area) of the iron's striking face, and iron sets are available with oversize club heads to provide a large sweet spot that is desirable to many golfers.

Conventional "blade" type irons have been largely displaced (especially for novice golfers) by so-called "perimeter weighted" irons, which include "cavity-back" and "hollow" iron designs. Cavity-back irons have a cavity directly behind the striking plate, which permits club head mass to be distributed about the perimeter of the striking plate, and such clubs tend to be more forgiving to off-center hits. Hollow irons have features similar to cavity-back irons, but the cavity is enclosed by a rear wall to form a hollow region behind the striking plate. Perimeter weighted, cavity back, and hollow iron designs permit club designers to redistribute club head mass to achieve intended playing characteristics associated with, for example, placement of club head center of gravity or a moment of inertia.

In addition, even with perimeter weighting, significant portions of the club head mass, such as the mass associated with the hosel, topline, or striking plate, are unavailable for redistribution. The striking plate must withstand repeated strikes both on the driving range and on the course, requiring significant strength for durability.

Golf club manufacturers are consistently attempting to design golf clubs that are easier to hit and offer golfers greater forgiveness when the ball is not struck directly upon the sweet spot of the striking face. As those skilled in the art will certainly appreciate, many designs have been developed and proposed for assisting golfers in learning and mastering the very difficult game of golf.

With regard to iron type club heads, cavity back club heads have been developed. Cavity back golf clubs shift the weight of the club head toward the outer perimeter of the club. By shifting the weight in this manner, the center of gravity of the club head is pushed toward the sole of the club head, thereby providing a club head that is easier to use in striking a golf ball. In addition, weight is shifted to the toe and heel of the club head, which helps to expand the sweet spot and assist the golfer when a ball is struck slightly off center.

Shifting weight to the sole lowers the center of gravity (CG) of the club resulting in a club that launches the ball more easily and with greater backspin. Golf club designers may measure the vertical CG of the golf club relative to the ground when the golf club is soled and in the proper address position, this CG measurement will be referred to as Zup or Z-up or CG Z-up. Decreasing Z-up as opposed to increasing it is preferable. Golf club designers can use a golf club with a low Z-up to design clubs for both low and high handicap golfers by either making a golf club that maintains similar launch angles but increases ball speed and distance or a club that launches the ball more easily in the air. Higher handicap golfers typically have trouble launching the ball in the air so a club that gets the ball in the air more easily is a great benefit. For lower handicap golfers, launching the ball in the air is not typically an issue. For lower handicap golfers, golf club designers may strengthen the loft of the golf club to maintain similar launch conditions and similar amounts of backspin, but resulting in greater ball speed and distance gains of several yards. The result is better golfers may now use one less club when approaching a green, such as, for example, a golfer may now use a 7-iron instead of a 6-iron to hit a green. Placing weight at the toe increases the moment of inertia (MOI) of the golf club resulting in a club that resists twisting and is thereby easier to hit straight even on mishits.

As club manufacturers have learned to assist golfers by shifting the center of gravity toward the sole of the club head, a wide variety of designs have been developed. Unfortunately, many of these designs substantially alter the appearance of the club head while attempting to shift the center of gravity toward the sole and perimeter of the club head. For example, one method of lowering the CG is to simply decrease the face height at the toe and make it closer in height to the face height at the heel of the club resulting in a very untraditional looking club. This is highly undesirable as golfers become familiar with a certain style of club head and alteration of that style often adversely affects their mental outlook when standing above a ball and aligning the club head with the ball. As such, a need exists for an improved club head which achieves the goal of shifting the center of gravity further toward the sole and perimeter of the club head without substantially altering the appearance of a traditional cavity back club head with which golfers have become comfortable. The present invention provides such a club head.

Unfortunately, an additional problem arises from relocating mass on a golf club in that the acoustical properties of the golf club head is often negatively impacted. The acoustical properties of golf club heads, e.g., the sound a golf club head generates upon impact with a golf ball, affect the overall feel of a golf club by providing instant auditory feedback to the user of the club. For example, the auditory feedback can affect the feel of the club by providing an indication as to how well the golf ball was struck by the club, thereby promoting user confidence in the club and himself.

The sound generated by a golf club is based on the rate, or frequency, at which the golf club head vibrates and the duration of the vibration upon impact with the golf ball. Generally, for iron-type golf clubs, a desired first mode frequency is generally around 3,000 Hz and preferably greater than 3,200 Hz. A frequency less than 3,000 Hz may result in negative auditory feedback and thus a golf club with an undesirable feel. Additionally, the duration of the first mode frequency is important because a longer duration results in a ringing sound and/or feel, which feels like a mishit or a shot that is not solid. This results in less confidence for the golfer even on well struck shots. Generally, for iron-type golf clubs, a desired first mode frequency duration is generally less than 10 ms and preferably less than 7 ms.

Accordingly, it would be desirable to reduce the topline weight to shift the CG to the sole and/or toe while maintaining acceptable vibration frequencies and durations. Such a club would be easier to hit because it would launch the ball more easily (low CG) and/or hit the ball straighter even on mishits (increased MOI), and the club would still provide desirable feel through positive auditory feedback. Accordingly, there exists a need for iron-type golf club heads with a strong and lightweight topline.

Golf clubs are typically manufactured with standard lie and loft angles. Some golfers prefer to modify the lie and loft angles of their golf clubs in order to improve the performance and consistency of their golf clubs and thereby improve their own performance.

In some cases, golf club heads, particularly iron-type golf club heads, can be adjusted by being plastically bent in a post-manufacturing process. In such a bending process, it can be difficult to plastically bend the material of the club head in a desired manner without adversely affecting the shape or integrity of the hosel bore, the striking face, or other parts of the club head. In addition, advancements in materials and manufacturing processes, such as extreme heat treatments, have resulted in club heads that are stronger and harder to bend and have more sensitive surface finishes. This increases the difficulty in accurately bending a club head in a desired manner without adversely affecting the club head. Additionally, the iron-type club heads must have a hosel design that will allow for bending. Bending bars are used for bending golf club heads to a golfer's preferred loft and lie. The bending process requires a significant amount of force and/or torque to plastically deform the iron-type club head. It can be difficult to plastically bend the club head in a desired manner without adversely affecting the shape or integrity of the hosel bore, the striking face, or other parts of the club head. As a result the hosel must have significant structural integrity to withstand multiple bending sessions and repeated strikes at the range and the golf course. The risk of club failure makes for a challenging design problem and makes the mass associated with the hosel largely unavailable for redistribution.

Accordingly, there exists a need for iron-type golf club heads with strong and lightweight hosels, centers of gravity shifted toward the sole, and/or a strong lightweight topline that can counteract the left and right tendency that a player encounters when the ball impacts a high or low position on the club head striking face.

SUMMARY

Certain embodiments of the disclosure pertain to iron-type golf club heads with twisted striking faces. In one representative embodiment, an iron-type golf club head comprises a hosel portion, a heel portion, a sole portion, a toe portion, a topline portion, and a striking face having a center face location. A center face vertical plane passes through the center face location, extends from adjacent the topline portion to adjacent the sole portion and intersects with the striking face surface to define a center face topline-to-sole contour. A toe side vertical plane is spaced away from the center face vertical plane by 14 mm toward the toe portion, extends from adjacent the topline portion to adjacent the sole portion and intersects with the striking face surface to define a toe side topline-to-sole contour. A heel side vertical plane is spaced away from the center face vertical plane by 14 mm toward the heel portion, extends from adjacent the topline portion to adjacent the sole portion and intersects with the striking face surface to define a heel side topline-to-sole contour. A center face horizontal plane passes through the center face location, extends from adjacent the toe portion to adjacent the heel portion and intersects with the striking face surface to define a center face toe-to-heel contour. A topline side horizontal plane is spaced away from the center face horizontal plane by 15 mm toward the topline portion, extends from adjacent the toe portion to adjacent the heel portion and intersects with the striking face surface to define a topline side toe-to-heel contour. A sole side horizontal plane is spaced away from the center face horizontal plane by 15 mm toward the sole portion, extends from adjacent the toe portion to adjacent the heel portion and intersects with the striking face surface to define a sole side toe-to-heel contour. The toe side topline-to-sole contour is more lofted than the center face topline-to-sole contour, the heel side topline-to-sole contour is less lofted than the center face topline-to-sole contour, the topline side toe-to-heel contour is more open than the center face toe-to-heel contour, and the sole side toe-to-heel contour is more closed than the center face toe-to-heel contour. The toe side topline-to-sole contour, the center face topline-to-sole contour, the heel side topline-to-sole contour, the topline side toe-to-heel contour, the center face toe-to-heel contour, and the sole side toe-to-heel contour are straight line contours.

In some embodiments, a critical point located at 15 mm above the center face location has a LA° Δ that is substantially unchanged relative to a 0° twist golf club head.

In some embodiments, a critical point located at 15 mm above the center face location has a FA° Δ of between 0.1° and 4° relative to the center face location.

In some embodiments, a critical point located at 15 mm above the center face location has a FA° Δ of between 0.25° and 3° relative to the center face location.

In some embodiments, a critical point located at 15 mm below the center face location has a FA° Δ of between −0.1° and −4° relative to the center face location.

In some embodiments, a critical point located at 15 mm below the center face location has a FA° Δ of between −0.25° and −3° relative to the center face location. In some embodiments, an average FA° Δ of an upper toe quadrant of the striking face is between 0.275° to 4.4°.

In some embodiments, a toe side point located at a x-z coordinate of (14 mm, 15 mm) has a LA° Δ relative to the center face location that is between 0.23° and 2.8°, and a heel side point located at a x-y coordinate of (−14 mm, −15 mm) has a LA° Δ relative to the center face location that is between 0.23° and −2.8°.

In some embodiments, an average LA° Δ of an upper toe quadrant of the striking face is between 0.245° to 3°.

In some embodiments, the striking face has a degree of twist that is between 0.1° and 5° when measured between two critical locations located at 15 mm above the center face location and 15 mm below the center face location.

In another representative embodiment, an iron-type golf club head comprises a hosel portion, a heel portion, a sole portion, a toe portion, a topline portion, and a striking face having a center face location. A center face vertical plane passes through the center face location, extends from adjacent the topline portion to adjacent the sole portion and intersects with the striking face surface to define a center face topline-to-sole contour. A toe side vertical plane is spaced away from the center face vertical plane by 14 mm toward the toe portion, extends from adjacent the topline portion to adjacent the sole portion and intersects with the striking face surface to define a toe side topline-to-sole contour. A heel side vertical plane is spaced away from the center face vertical plane by 14 mm toward the heel portion, extends from adjacent the topline portion to adjacent the sole portion and intersects with the striking face surface to define a heel side topline-to-sole contour. A center face horizontal plane passes through the center face location, extends from adjacent the toe portion to adjacent the heel portion and intersects with the striking face surface to define a center face toe-to-heel contour. A topline side horizontal plane is spaced away from the center face horizontal plane by 15 mm toward the topline portion, extends from adjacent the toe portion to adjacent the heel portion and intersecting with the striking face surface to define a topline side toe-to-heel contour. A sole side horizontal plane is spaced away from the center face horizontal plane by 15 mm toward the sole portion, extends from adjacent the toe portion to adjacent the heel portion and intersects with the striking face surface to define a sole side toe-to-heel contour. The toe side topline-to-sole contour is more lofted than the center face topline-to-sole contour, the heel side topline-to-sole contour is less lofted than the center face topline-to-sole contour, the topline side toe-to-heel contour is more open than the center face toe-to-heel contour, and the sole side toe-to-heel contour is more closed than the center face toe-to-heel contour, and a club head depth of the of the iron-type golf club head is between about 10 mm and about 50 mm.

In some embodiments, a critical point located at 15 mm above the center face location has a LA° Δ that is substantially unchanged relative to a 0° twist golf club head.

In some embodiments, a critical point located at 15 mm above the center face location has a FA° Δ of between 0.1° and 4° relative to the center face location.

In some embodiments, a critical point located at 15 mm above the center face location has a FA° Δ of between 0.25° and 3° relative to the center face location.

In some embodiments, an average FA° Δ of an upper toe quadrant of the striking face is between 0.275° to 4.4°.

In some embodiments, a toe side point located at a x-z coordinate of (14 mm, 15 mm) has a LA° Δ relative to the center face location that is between 0.23° and 2.8°, and a heel side point located at a x-y coordinate of (−14 mm, −15 mm) has a LA° Δ relative to the center face location that is between 0.23° and −2.8°.

In some embodiments, an average LA° Δ of an upper toe quadrant of the striking face is between 0.245° to 3°.

In some embodiments, the striking face has a degree of twist that is between 0.1° and 5° when measured between two critical locations located at 15 mm above the center face location and 15 mm below the center face location.

In another representative embodiment, an iron-type golf club head comprises a hosel portion, a heel portion, a sole portion, a toe portion, a topline portion, and a striking face having a center face location; A center face vertical plane passes through the center face location, extends from adjacent the topline portion to adjacent the sole portion and intersects with the striking face surface to define a center face topline-to-sole contour. A toe side vertical plane is spaced away from the center face vertical plane by 14 mm toward the toe portion, extends from adjacent the topline portion to adjacent the sole portion and intersects with the striking face surface to define a toe side topline-to-sole contour. A heel side vertical plane is spaced away from the center face vertical plane by 14 mm toward the heel portion, extends from adjacent the topline portion to adjacent the sole portion and intersects with the striking face surface to define a heel side topline-to-sole contour. A center face horizontal plane passes through the center face location, extends from adjacent the toe portion to adjacent the heel portion and intersects with the striking face surface to define a center face toe-to-heel contour. A topline side horizontal plane is spaced away from the center face horizontal plane by 15 mm toward the topline portion, extends from adjacent the toe portion to adjacent the heel portion and intersecting with the striking face surface to define a topline side toe-to-heel contour. A sole side horizontal plane is spaced away from the center face horizontal plane by 15 mm toward the sole portion, extends from adjacent the toe portion to adjacent the heel portion and intersects with the striking face surface to define a sole side toe-to-heel contour. The toe side topline-to-sole contour is more lofted than the center face topline-to-sole contour, the heel side topline-to-sole contour is less lofted than the center face topline-to-sole contour, the topline side toe-to-heel contour is more open than the center face toe-to-heel contour, and the sole side toe-to-heel contour is more closed than the center face toe-to-heel contour, and the iron-type golf club head has a volume less than 110 cc.

In some embodiments, the iron-type golf club head has a volume of between about 30 cc and about 100 cc.

In some embodiments, the iron-type golf club head comprises a titanium alloy including 6.75% to 9.75% aluminum by weight and 0.75% to 3.25% molybdenum by weight.

The foregoing and other objects, features, and advantages of the disclosure will become more apparent from the following detailed description, which proceeds with reference to the accompanying figures.

BRIEF DESCRIPTION OF THE DRAWINGS

The technology of the present application is illustrated by way of example and not limitation in the figures of the accompanying drawings in which like references indicate similar elements.

DETAILED DESCRIPTION

First Representative Embodiment

Various embodiments and aspects of the inventions will be described with reference to details discussed below, and the accompanying drawings will illustrate the various embodiments. The following description and drawings are illustrative of the invention and are not to be construed as limiting the invention. Numerous specific details are described to provide a thorough understanding of various embodiments of the present invention. However, in certain instances, well-known or conventional details are not described in order to provide a concise discussion of embodiments of the present inventions.

Figure 2A:
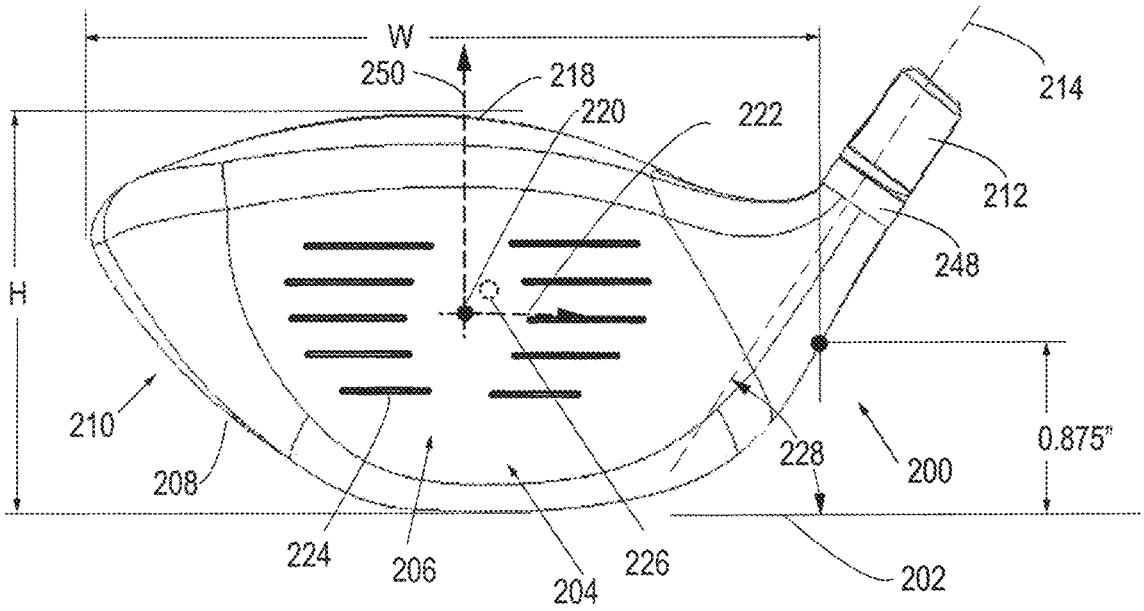
FIG. 2*a* is an elevated front view of a golf club head.

FIG. 2*a* illustrates a golf club head having a front portion 204, a heel portion 200, a toe portion 210, a crown portion 218, a hosel portion 248, a sole portion 208, a hosel axis 214, a lie angle 228, and a hosel insert 212. The golf club head has a width dimension W, a height dimension H, and a depth dimension D measured when the golf club head is positioned in an address position. The address position is defined as the golf club head in a lie angle of fifty-seven degrees and the loft of the club adjusted to the designated loft of the club head. Unless otherwise stated, all the measured dimensions described herein are evaluated when the club head is oriented in the address position. If the club head at a fifty-seven degree lie angle visually appears to be unlevel from a front face perspective, an alternative lie angle called the "scoreline lie" may be used. The scoreline lie is defined as the lie angle at which the substantially horizontal face scorelines are parallel to a perfectly flat ground plane. The width dimension W is not greater than 5 inches, and the depth dimension D is not greater than the width dimension W. The height dimension H is not greater than 2.8 inches. In some embodiments, the depth dimension D or the width dimension W is less than 4.4", less than 4.5", less than 4.6", less than 4.7", less than 4.8", less than 4.9", or less than 5". In some embodiments the height dimension H is less than 2.7", less than 2.6", less than 2.5", less than 2.4", less than 2.3", less than 2.2", less than 2.1", less than 2", less than 1.9" or less than 1.8". In certain embodiments, the club head height is between about 63.5 mm to 71 mm (2.5" to 2.8") and the width is between about 116.84 mm to about 127 mm (4.6" to 5.0"). Furthermore, the depth dimension is between about 111.76 mm to about 127 mm (4.4" to 5.0").

These dimensions are measured on horizontal lines between vertical projections of the outermost points of the heel and toe, face and back, and sole and crown. The outermost point of the heel is defined as the point on the heel that is 0.875" above the horizontal ground plane 202.

FIG. 2*a* further illustrates a face center 220 location. This location is found by utilizing the USGA Procedure for Measuring the Flexibility of a Golf Clubhead, Revision 2.0 published on Mar. 25, 2005, herein incorporated by reference in its entirety. Specifically, the face center 220 location is found by utilizing the template method described in section 6.1.4 and FIG. 6.1 described in the USGA document mentioned above.

A coordinate system for measuring CG location is located at the face center 220. In one embodiment, the positive x-axis 222 is projecting toward the heel side of the club head, the positive z-axis 250 is projecting toward the crown side of the club head, and the positive y-axis 216 is projecting toward the rear of the club head parallel to a ground plane.

In some embodiments, the golf club head can have a CG with a CG x-axis coordinate between about −5 mm and about 10 mm, a CG y-axis coordinate between about 15 mm and about 50 mm, and a CG z-axis coordinate between about −10 mm and about 5 mm. In yet another embodiment, the CG y-axis coordinate is between about 20 mm and about 50 mm.

Scorelines 224 are located on the striking face 206. In one exemplary embodiment, a projected CG location 226 is shown on the striking face and is considered the "sweet spot" of the club head. The projected CG location 226 is found by balancing the clubhead on a point. The projected CG location 226 is generally projected along a line that is perpendicular to the face of the club head. In some embodiments, the projected CG location 226 is less than 2 mm above the center face location, less than 1 mm above the center face, or up to 1 mm or 2 mm below the center face location 220.

Figure 2B:
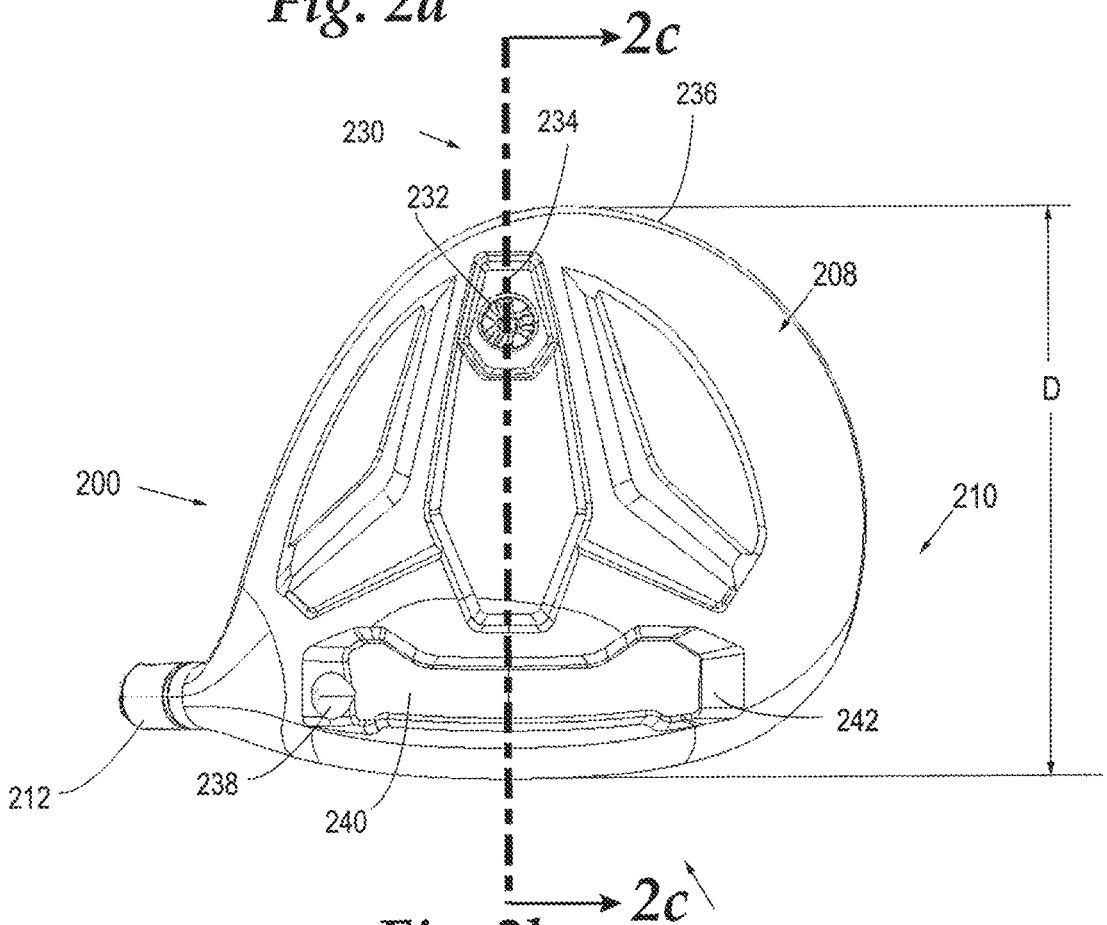
FIG. 2*b* is a sole view of a golf club head.

FIG. 2*b* illustrates a sole view of the club head showing the back portion 230 and an edge 236 between the crown 218 and sole 208 portions. In one embodiment, the club is provided with a weight port 234 and an adjustable weight 232 located in the weight port 234. In addition, a flexible recessed channel portion 240 having a channel sidewall 242 is provided in the front half of the club head sole portion 208 proximate to the striking face 206. Within the channel portion 240, a fastener opening 238 is provided to allow the insertion of a fastening member 268, such as a screw, for engaging with the hosel insert 212 for attaching a shaft to the club head and to allow for an adjustable loft, lie, and/or face angle. In one embodiment, the hosel insert 212 is configured to allow for the adjustment of at least one of a loft, lie or face angle.

Figure 2C:
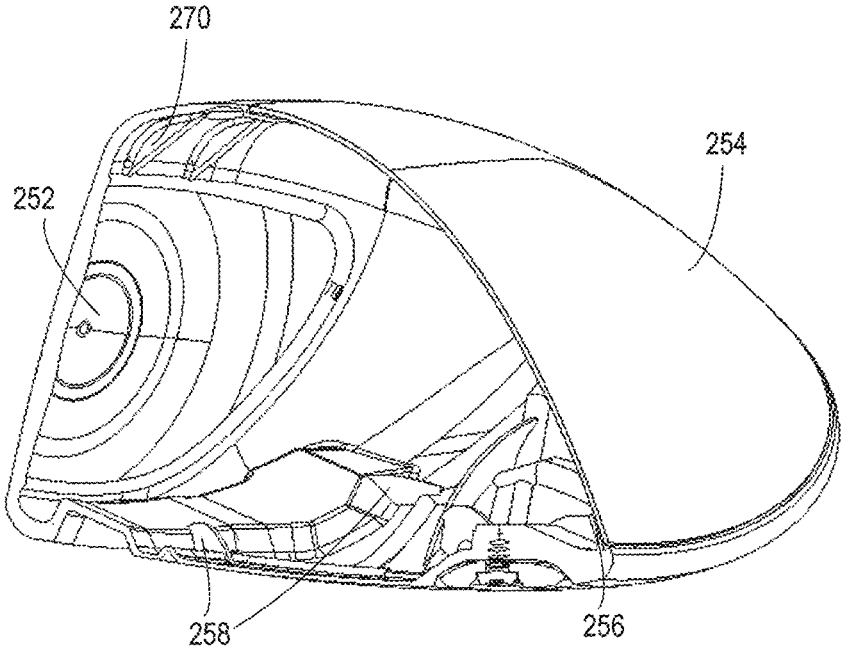
FIG. 2*c* is an isometric cross-sectional view taken along section lines 2*c*-2*c* in FIG. 2*b*.

FIG. 2*c* illustrates a cross-sectional view taken along lines 2*c*-2*c* in FIG. 2*b*. In one embodiment, a machined face insert 252 is welded to a front opening on the club head. The face insert 252 has a variable face thickness having an inverted recess in the center portion of the back surface of the face insert 252. In addition, a composite crown 254 is bonded to the crown portion 218 and rests on a bonding ledge 256. In one embodiment, the bonding ledge is between 1-7 mm, 1-5 mm, or 1-3 mm and continuously extends around a circumference of the opening to support the crown. A plurality of ribs 258 are connected to the interior portion of the channel 240 to improve the sound of the club upon impact with a golf ball.

Figure 2D:
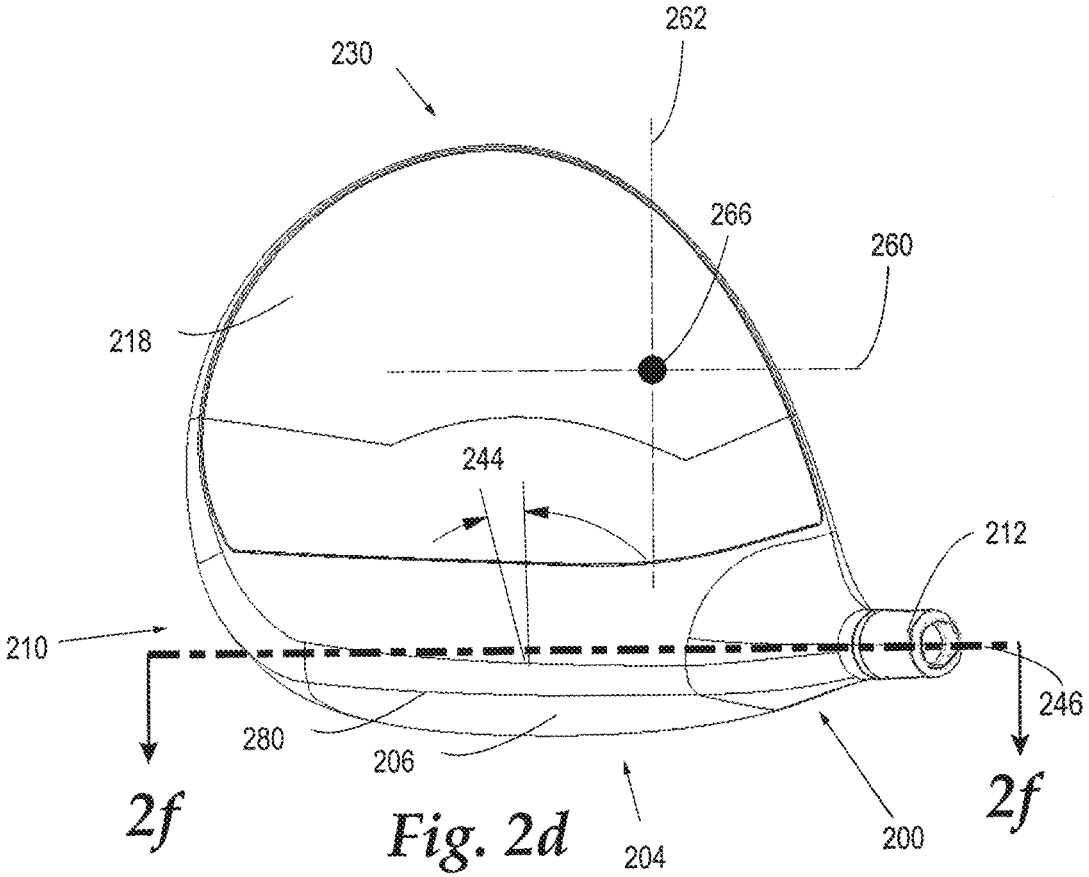
FIG. 2*d* is a top view of a golf club head.

FIG. 2*d* illustrates a top view of the golf club head in the address position. A hosel plane 246 is shown being perpendicular to the ground plane and containing the hosel axis 214. In addition, a center face nominal face angle 244 is shown which can be adjusted by the hosel insert 212. A positive face angle indicates the golf club face is pointed to the right of a center line target at a given measured point. A negative face angle indicates the golf club face is pointed to the left of a centerline target at a given measured point. A topline 280 is also shown. The topline 280 is defined as the intersection of the crown and the face of the golf club head. Often the paint line of the crown stops at the topline 280.

FIG. 2*d* also shows golf club head moments of inertia defined about three axes extending through the golf club head CG 266 including: a CG z-axis 264 (see FIG. 2*e*) extending through the CG 266 in a generally vertical direction relative to the ground 202 when the club head is at address position, a CG x-axis 260 extending through the CG 266 in a heel-to-toe direction generally parallel to the striking surface 206 and generally perpendicular to the CG z-axis 264, and a CG y-axis 262 extending through the CG 266 in a front-to-back direction and generally perpendicular to the CG x-axis 260 and the CG z-axis 264. The CG x-axis 260 and the CG y-axis 262 both extend in a generally horizontal direction relative to the ground 202 when the club head 200 is at the address position.

The moment of inertia about the golf club head CG x-axis 260 is calculated by the following equation:

$$I_{CGx}=\int(y^2+z^2)dm$$

In the above equation, y is the distance from a golf club head CG xz-plane to an infinitesimal mass dm and z is the distance from a golf club head CG xy-plane to the infinitesimal mass dm. The golf club head CG xz-plane is a plane defined by the CG x-axis 260 and the CG z-axis 264. The CG xy-plane is a plane defined by the CG x-axis 260 and the CG y-axis 262.

Moreover, a moment of inertia about the golf club head CG z-axis 264 is calculated by the following equation:

$$I_{CGx}=\int(y^2+z^2)dm$$

In the equation above, x is the distance from a golf club head CG yz-plane to an infinitesimal mass dm and y is the distance from the golf club head CG xz-plane to the infinitesimal mass dm. The golf club head CG yz-plane is a plane defined by the CG y-axis 262 and the CG z-axis 264.

In certain implementations, the club head can have a moment of inertia about the CG z-axis, between about 450 $kg\cdot mm^2$ and about 650 $kg\cdot mm^2$, and a moment of inertia about the CG x-axis between about 300 $kg\cdot mm^2$ and about 500 $kg\cdot mm^2$, and a moment of inertia about the CG y-axis between about 300 $kg\cdot mm^2$ and about 500 $kg\cdot mm^2$.

Figure 2E:
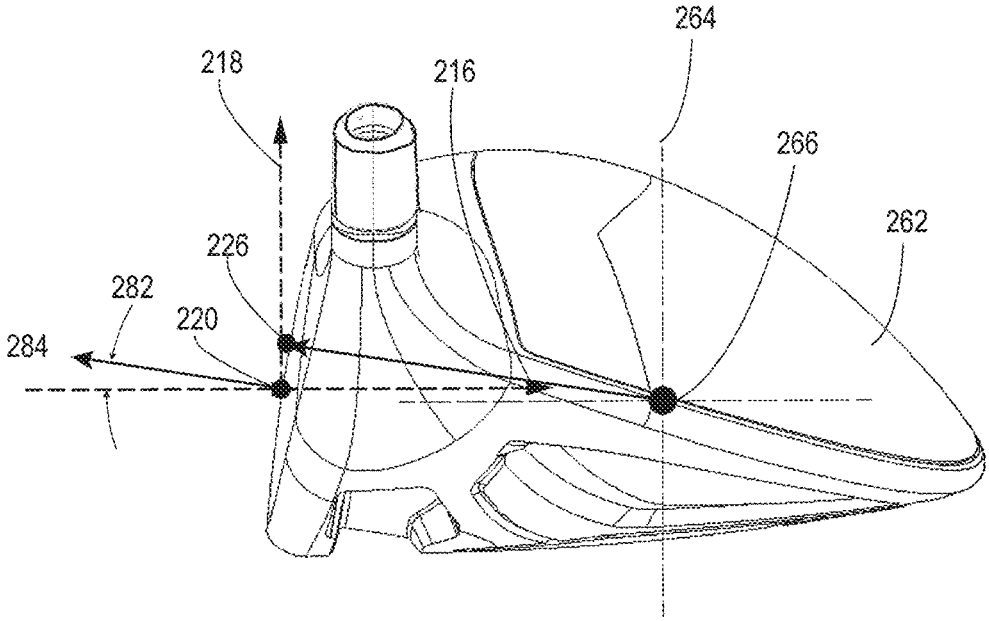
FIG. 2*e* is an elevated heel perspective view of a golf club head.

FIG. 2*e* shows the heel side view of the club head and provides a side view of the positive y-axis 216 and how the CG 266 is projected onto the face at a projected CG location 226 previously described. A nominal center face loft angle 282 is shown to be the angle created by a perpendicular center face vector 284 relative to a horizontal plane parallel to a ground plane.

Figure 2F:
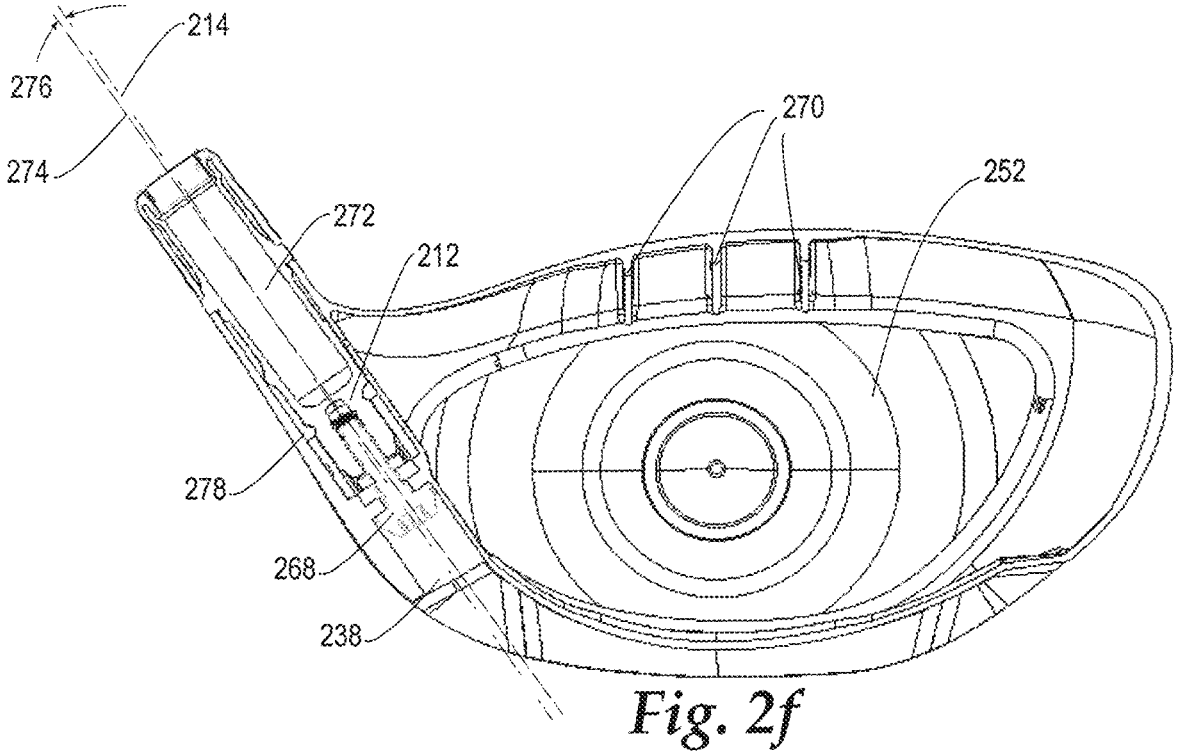
FIG. 2*f* is a cross-sectional view taken along section lines 2*f*-2*f* in FIG. 2*d*.

FIG. 2*f* illustrates a cross-sectional view taken along lines 2*f*-2*f* shown in FIG. 2*d*. The mechanical fastener 268 is more easily seen being inserted into the opening 238 for threadably engaging with the sleeve 212. The sleeve includes a sleeve bore 272 for allowing the shaft to be inserted for adhesive bonding with the sleeve 212. A plurality of crown ribs 270 are also shown in the face to crown transition portion.

Figure 3:
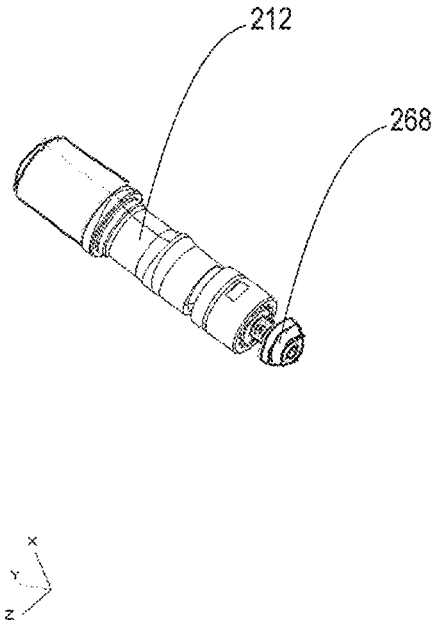
FIG. 3 is an isometric view of a shaft tip sleeve.

FIG. 3 illustrates the sleeve 212 and mechanical fastener 268 when removed from the golf club head. The embodiments described above include an adjustable loft, lie, or face angle system that is capable of adjusting the loft, lie, or face angle either in combination with one another or independently from one another. For example, a portion of the sleeve 212, the sleeve bore 272, and the shaft collectively define a longitudinal axis 274 of the assembly. In one embodiment, the longitudinal axis 274 of the assembly is co-axial with the sleeve bore 272. A portion of the hosel sleeve is effective to support the shaft along the longitudinal axis 274 of the assembly, which is offset from a longitudinal axis 214 of the interior hosel tube bore 278 by offset angle 276. The longitudinal axis 214 is co-axial with the interior hosel tube bore 278. The sleeve can provide a single offset angle that can be between 0 degrees and 4 degrees, in 0.25 degree increments. For example, the offset angle can be 1.0 degree, 1.25 degrees, 1.5 degrees, 1.75 degrees, 2.0 degrees, 2.25 degrees, 2.5 degrees, 2.75 degrees, or 3.0 degrees. The offset angle of the embodiment shown in FIG. 2*f* is 1.5 degrees.

Figure 4A:
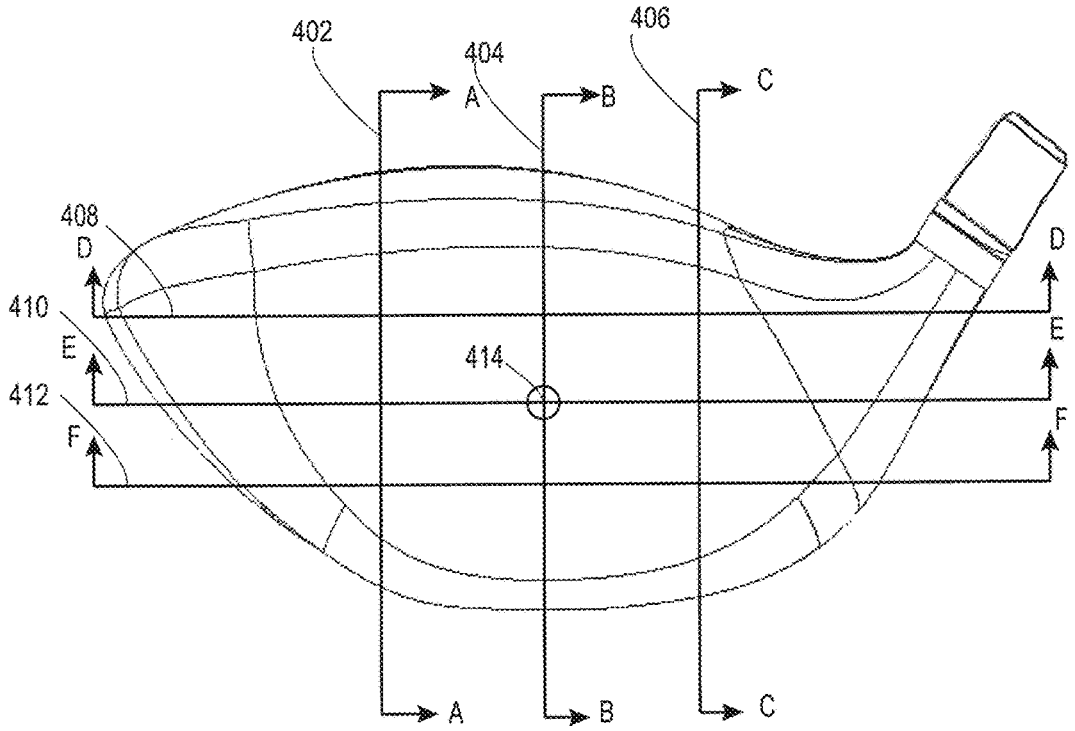
FIG. 4*a* is an elevated front view of a golf club according to an embodiment.

FIG. 4*a* illustrates a plurality of vertical planes 402,404, 406 and horizontal planes 408,410,412. More specifically, the toe side vertical plane 402, center vertical plane 404 (passing through center face), and heel vertical plane 406 are separated by a distance of 30 mm as measured from the center face location 414. The upper horizontal plane 408, the center horizontal plane 410 (passing through center face 414), and the lower horizontal plane 412 are spaced from each other by 15 mm as measured from the center face location 414.

Figure 4B:
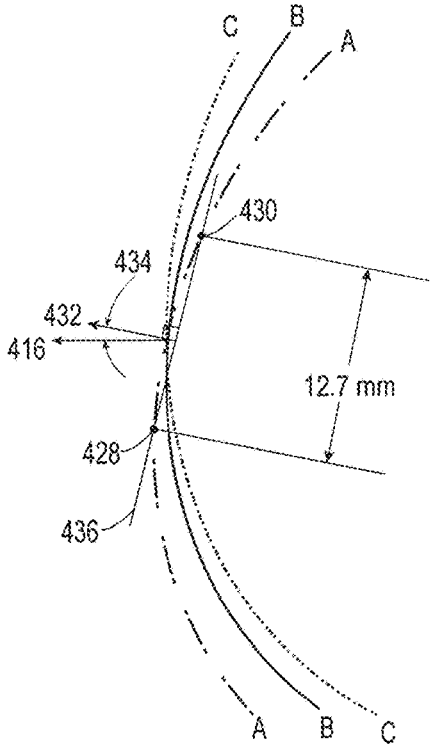
FIG. 4*b* is an exaggerated comparative view of face surface contours taken along section lines A-A, B-B, and C-C as seen from a heel view.

FIG. 4*b* illustrates all three striking face surface roll contours A,B,C that are overlaid on top of one another as viewed from the heel side of the golf club. The three face surface contours are defined as face contours that intersect the three vertical planes 402,404, 406. Specifically, toe side contour A, represented by a dashed line, is defined by the intersection of the striking face surface and vertical plane 402 located on the toe side of the striking face. Center face vertical contour B, represented by a solid line, is defined by the intersection of the striking face surface and center face vertical plane 404 located at the center of the striking face. Heel side contour C, represented by a finely dashed line, is defined by the intersection of the striking face surface a vertical plane 406 located on the heel side of the striking face. Roll contours A,B,C are considered three different roll contours across the striking face taken at three different locations to show the variability of roll across the face. The toe side vertical contour A is more lofted (having positive LA° Δ) relative to the center face vertical contour B. The heel side vertical contour C is less lofted (having a negative LA° Δ) relative to the center face vertical contour B.

FIG. 4*b* shows a loft angle change 434 that is measured between a center face vector 416 located at the center face 414 and the toe side roll curvature A having a face angle vector 432. The vertical pin distance of 12.7 mm is measured along the toe side roll curvature A from a center location to a crown side and a sole side to locate a crown side measurement 430 point and sole side measurement points 428. A segment line 436 connects the two points of measurement. A loft angle vector 432 is perpendicular to the segment line 436. The loft angle vector 432 creates a loft angle 434 with the center face vector 416 located at the center face point 414. As described, a more lofted angle indicates that the loft angle change (LA° Δ) is positive relative to the center face vector 416 and points above or higher relative to the center face vector 416 as is the case for the roll curvature A.

Figure 4C:
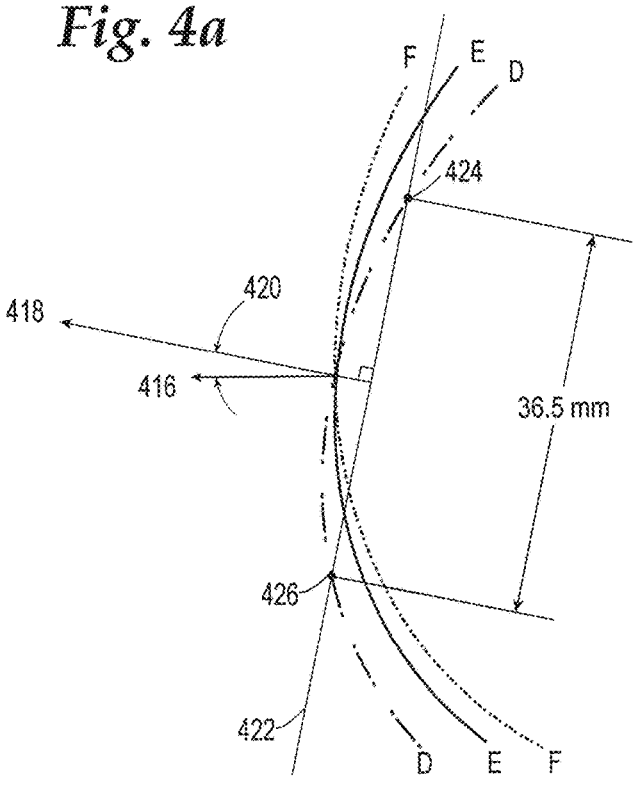
FIG. 4*c* is an exaggerated comparative view of face surface contours taken along section lines D-D, E-E, and F-F as seen from a top view.

FIG. 4*c* further illustrates three striking face surface bulge contours D,E,F that are overlaid on top of one another as viewed from the crown side of the golf club. The three face surface contours are defined as face contours that intersect the three horizontal planes 408,410, 412. Specifically, crown side contour D, represented by a dashed line, is defined by the intersection of the striking face surface and upper horizontal plane 408 located on the upper side of the striking face toward the crown portion. Center face contour E, represented by a solid line, is defined by the intersection of the striking face surface and horizontal plane 408 located at the center of the striking face. Sole side contour F, represented by a finely dashed line, is defined by the intersection of the striking face surface a horizontal plane 412 located on the lower side of the striking face. Bulge contours D,E,F are considered three different bulge contours across the striking face taken at three different locations to show the variability of bulge across the face. The crown side bulge contour D is more open (having a positive FA° Δ, defined below) when compared to the center face bulge contour E. The sole side bulge contour F is more closed (having a negative FA° Δ when measured about the center vertical plane).

With the type of "twisted" bulge and roll contour defined above, a ball that is struck in the upper portion of the face will be influenced by horizontal contour D. A typical shot having an impact in the upper portion of a club face will influence the golf ball to land left of the intended target. However, when a ball impacts the "twisted" face contour described above, horizontal contour D provides a general curvature that points to the right to counter the left tendency of a typical upper face shot.

Likewise, a typical shot having an impact location on the lower portion of the club face will land typically land to the right of the intended target. However, when a ball impacts the "twisted" face contour described above, horizontal contour F provides a general curvature that points to the left to counter the right tendency of a typical lower face shot. It is understood that the contours illustrated in FIGS. 4*b* and 4*c* are severely distorted in order for explanation purposes.

In order to determine whether a 2-D contour, such as A,B,C,D,E, or F, is pointing left, right, up, or down, two measurement points along the contour can be located 18.25 mm from a center location or 36.5 mm from each other. A first imaginary line can be drawn between the two measurement points. Finally, a second imaginary line perpendicular to the first imaginary line can be drawn. The angle between the second imaginary line of a contour relative to a line perpendicular to the center face location provides an indication of how open or closed a contour is relative to a center face contour. Of course, the above method can be implemented in measuring the direction of a localized curvature provided in a CAD software platform in a 3D or 2D model, having a similar outcome. Alternatively, the striking surface of an actual golf club can be laser scanned or profiled to retrieve the 2D or 3D contour before implementing the above measurement method. Examples of laser scanning devices that may be used are the GOM Atos Core 185 or the Faro Edge Scan Arm HD. In the event that the laser scanning or CAD methods are not available or unreliable, the face angle and the loft of a specific point can be measured using a "black gauge" made by Golf Instruments Co. located in Oceanside, Calif. An example of the type of gauge that can be used is the M-310 or the digital-manual combination C-510 which provides a block with four pins for centering about a desired measurement point. The horizontal distance between pins is 36.5 mm while the vertical distance between the pins is 12.7 mm.

When an operator is measuring a golf club with a black gauge for loft at a desired measurement point, two vertical pins (out of the four) are used to measure the loft about the desired point that is equidistant between the two vertical pins that locate two vertical points. When measuring a golf club with a black gauge for face angle at a desired measurement point, two horizontal pins (out of the four) are used to measure the face angle about the desired point. The desired point is equidistant between the two horizontal points located by the pins when measuring face angle.

FIG. 4*c* shows a face angle 420 that is measured between a center face vector 416 located at the center face 414 and the crown side bulge curvature D having a face angle vector 418. The horizontal pin distance of 18.25 mm is measured along the crown side bulge curvature D from a center location to a heel side and a toe side to locate a heel side measurement 426 point and toe side measurement points 424. A segment line 422 connects the two points of measurement. A face angle vector 418 is perpendicular to the segment line 422. The face angle vector 418 creates a face angle 420 with the center face vector 416 located at the center face point 414. As described, an open face angle indicates that the face angle change (FA° Δ) is positive relative to the center face vector 416 and points to the right as is the case for the bulge curvature D.

Figure 5:
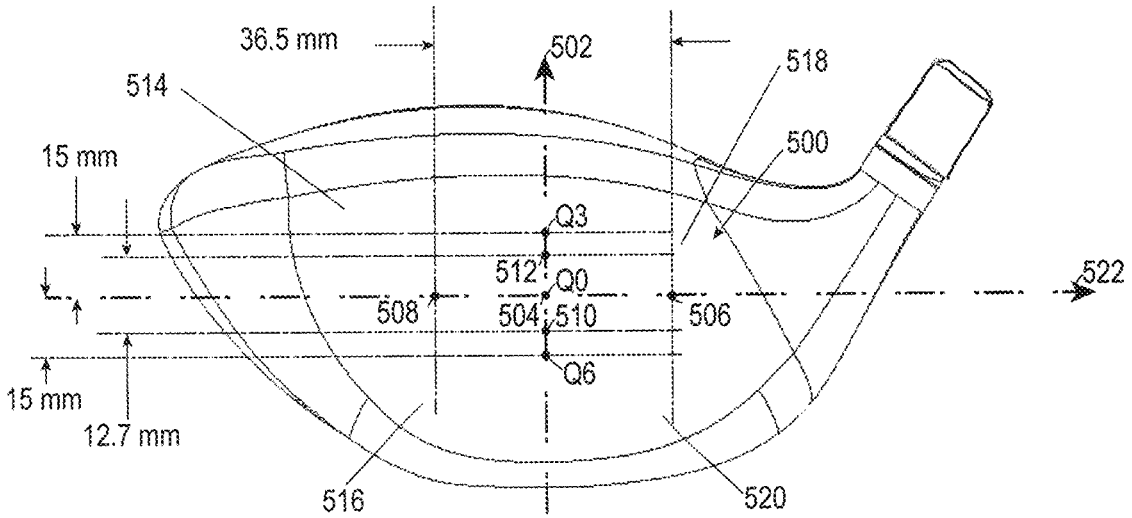
FIG. 5 is a front view of a golf club face with multiple measurement points and four quadrants.

FIG. 5 shows a desired measurement point Q0 located at the center of the striking face 500. A horizontal plane 522 and a vertical plane 502 intersect at the desired measurement point Q0 and divide the striking face 500 into four quadrants. The upper toe quadrant 514, the upper heel quadrant 518, the lower heel quadrant 520, and the lower toe quadrant 516 all form the striking face 500, collectively. In one embodiment, the upper toe quadrant 514 is more "open" than all the other quadrants. In other words, the upper toe quadrant 514 has a face angle pointing to the right, in the aggregate. In other words, if a plurality of evenly spaced points (for example a grid with measurement points being spaced from one another by 5 mm) covering the entire upper toe quadrant 514 were measured, it would have an average face angle that points right of the intended target more than any other quadrant.

The term "open" is defined as having a face angle generally pointing to the right of an intended target at address, while the term "closed" is defined as having a face angle generally pointing to the left of an intended target ad address. In one embodiment, the lower heel quadrant 520 is more "closed" than all the other quadrants, meaning it has a face angle, in the aggregate, that is pointing more left than any of the other quadrants.

If the edge of the striking surface 500 is not visually clear, the edge of the striking face 500 is defined as a point at which the striking surface radius becomes less than 127 mm. If the radius is not easily computed within a computer modeling program, three points that are 0.1 mm apart can be used as the three points used for determining the striking surface radius. A series of points will define the outer perimeter of the striking face 500. Alternatively, if a radius is not easily obtainable in a computer model, a 127 mm curvature gauge can be used to detect the edge of the face of an actual golf club head. The curvature gauge would be rotated about a center face point to determine the face edge.

In one illustrative example in FIG. 5, the face angle and loft are measured for a center face point Q0 when an easily measureable computer model method is not available, for example, when an actual golf club head is measured. A black gauge is utilized to measure the face angle by selecting two horizontal points 506,508 along the horizontal plane 522 that are 36.5 mm apart and centered about the center face point Q0 so that the horizontal points 506,508 are equidistant from the center face point Q0. The two pins from the black gauge engage these two points and provide a face angle measurement reading on the angle measurement readout provided. Furthermore, a loft is measured about the Q0 point by selecting two vertical points 512,510 that are spaced by a vertical distance of 12.7 mm apart from each other. The two vertical pins from the black gauge engage these two vertical points 512,510 and provide a loft angle measurement reading on the readout provided.

The positive x-axis 522 for face point measurements extends from the center face toward the heel side and is tangent to the center face. The positive y-axis 502 for face point measurements extends from the center face toward the crown of the club head and is tangent to the center face. The x-y coordinate system at center face, without a loft component, is utilized to locate the plurality of points P0-P36 and Q0-Q8, as described below. The positive z-axis 504 extends from the face center and is perpendicular to the face center point and away from the internal volume of the club head. The positive z-axis 504 and positive y-axis 502 will be utilized as a reference axis when the face angle and loft angle are measured at another x-y coordinate location, other than center face.

FIG. 5 further shows two critical points Q3 and Q6 located at coordinates (0 mm, 15 mm) and (0 mm,-15 mm), respectively. As used herein, the terms "1° twist" and "2° twist" are defined as the total face angle change between these two critical point locations at Q3 and Q6. For example, a "1° twist" would indicate that the Q3 point has a 0.5° twist relative to the center face, Q0, and the Q6 point has a −0.5° twist relative to the center face, Q0. Therefore, the total degree of twist as an absolute value between the critical points Q3,Q6 is 1°, hence the nomenclature "1° twist".

Figure 6A:
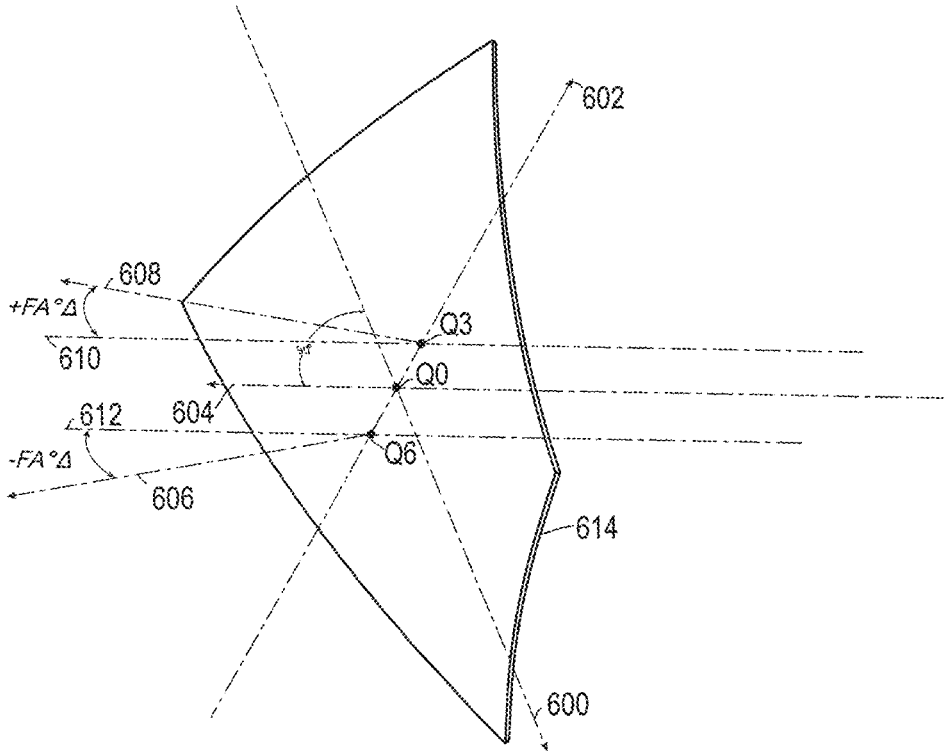
FIG. 6*a* is an isometric view of an exemplary twisted face surface plane.

To further the understanding of what is meant by a "twisted face", FIG. 6*a* provides an isometric view of an over-exaggerated twisted striking surface plane 614 of "10° twist" to illustrate the concept as applied to a golf club striking face. Each point located on the golf club face has an associated loft angle change (defined as "LA° Δ") and face angle change (defined as "FA° Δ"). Each point has an associated loft angle change (defined as "LA° Δ") and face angle change (defined as "FA° Δ").

FIG. 6*a* shows the center face point, Q0, and the two critical points Q3,Q6 described above, and a positive x-axis 600, positive z-axis 604, and positive y-axis 602 located on a twisted plane in an isometric view. The center face has a perpendicular axis 604 that passes through the center face point Q0 and is perpendicular to the twisted plane 614. Likewise, the critical points Q3 and Q6 also have a reference axis 610, 612 which is parallel to the center face perpendicular axis 604. The reference axes 610, 612 are utilized to measure a relative face angle change and loft angle change at these critical point locations. The critical points Q3, Q6 each have a perpendicular axis 608, 606 that is perpendicular to the face. Thus, the face angle change is defined at the critical points as the change in face angle between the reference axis 610,612 and the relative perpendicular axis 608, 606.

Figure 6B:
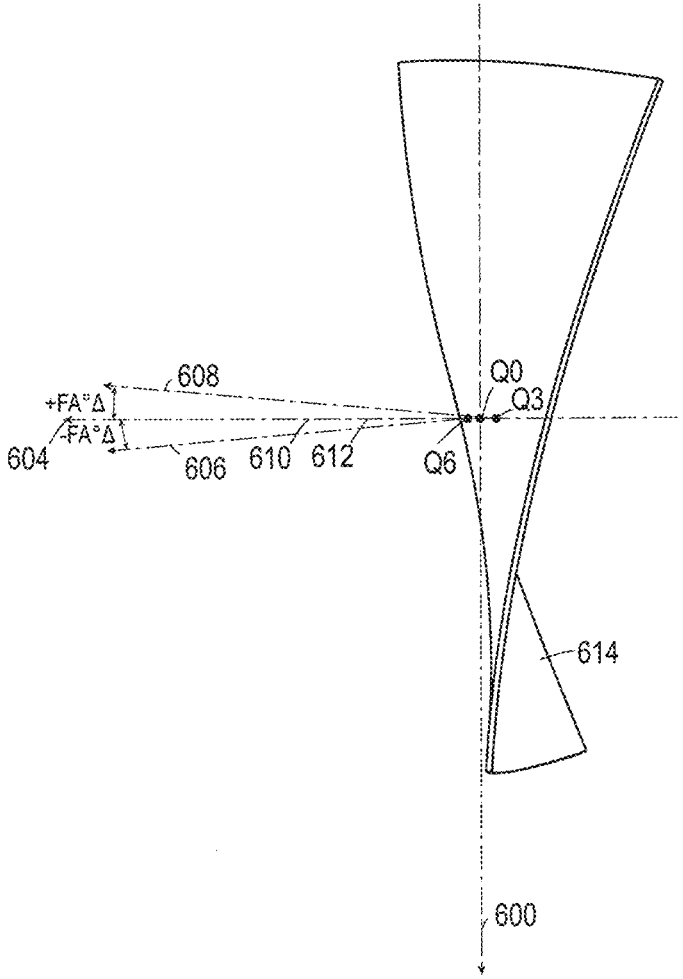
FIG. 6*b* is a top view of an exemplary twisted face surface plane.

FIG. 6*b* shows a top view of the twisted plane 614 and further illustrates how the face angle change is measured between the perpendicular axes 608, 606 at the critical points and the reference axes 610, 612 that are parallel with the center face perpendicular axis 604. A positive face angle change +FA° Δ indicates a perpendicular axis at a measured point that points to the right of the relative reference axis. A negative face angle change −FA° Δ indicates a perpendicular axis that points to the left of the relative reference axis. The face angle change is measured within the plane created by the positive x-axis 600 and positive z-axis 604.

Figure 6C:
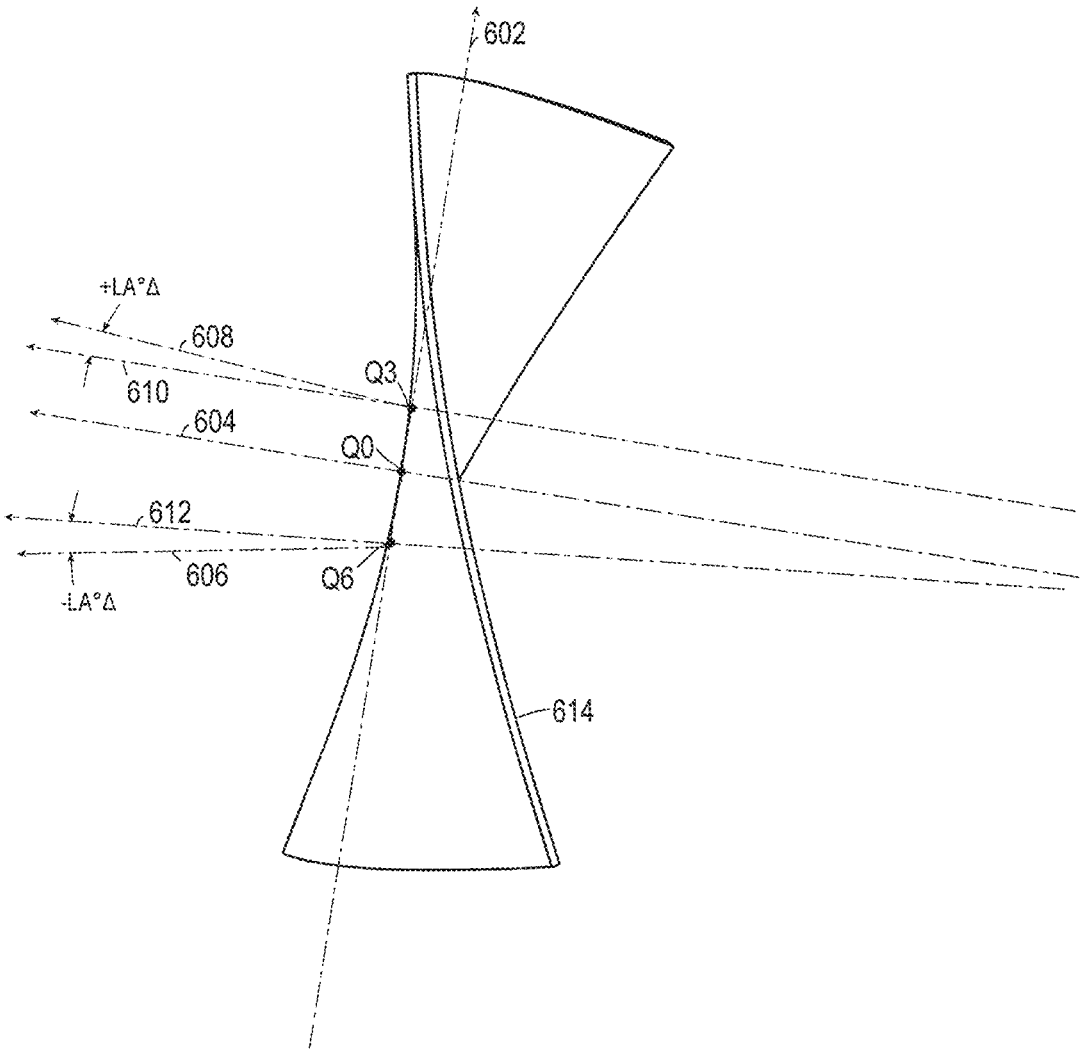
FIG. 6*c* is an elevated heel view of an exemplary twisted face surface plane.

FIG. 6*c* shows a heel side view of a twisted plane 614 and the loft angle change between the perpendicular axes 608, 606 and the reference axes 610,612 at the critical point locations. A positive loft angle change +LA° Δ indicates a perpendicular axis at a measured point that points above the relative reference axis. A negative loft angle change −LA° Δ indicates a perpendicular axis that points below the relative reference axis. The loft angle is measured within the plane created by the positive z-axis 604 and positive y-axis 602 for a given measured point.

Figure 7:
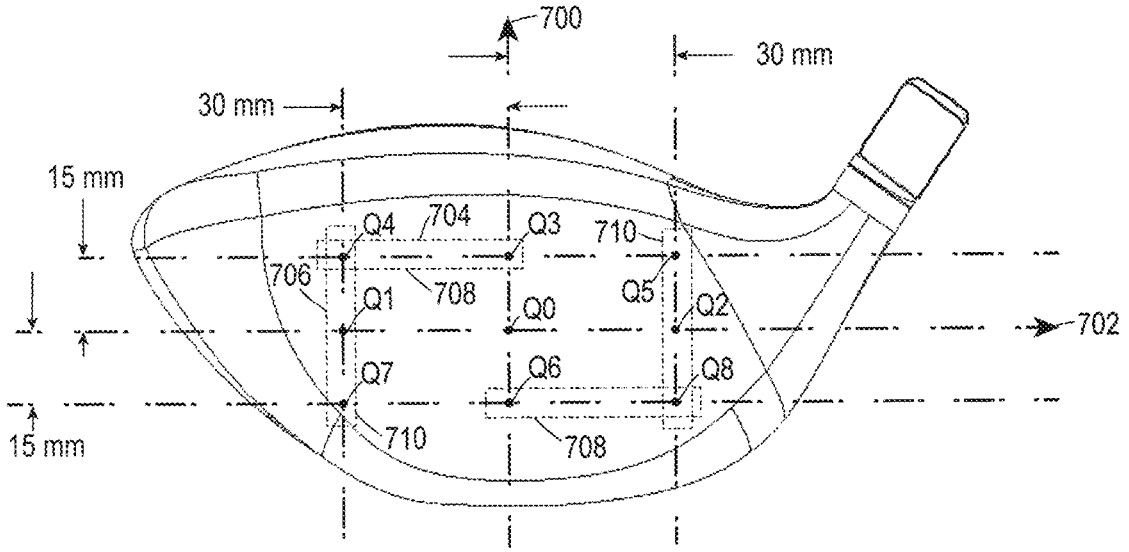
FIG. 7 illustrates a front view of a golf club with a predetermined set of measurement points.

FIG. 7 shows an additional plurality of points Q0-Q8 that are spaced apart across the striking face in a grid pattern. In addition to the critical points Q3,Q6 described above, heel side points Q5,Q2,Q8 are spaced 30 mm away from a vertical axis 700 passing through the center face. Toe side points Q4,Q1,Q7 are spaced 30 mm away from the vertical axis 700 passing through the center face. Crown side points Q3,Q4,Q5 are spaced 15 mm away from a horizontal axis 702 passing through the center face. Sole side points Q6,Q7, Q8 are spaced 15 mm away from the horizontal axis 702. Point Q5 is located in an upper heel quadrant at a coordinate location (30 mm, 15 mm) while point Q7 is located in a lower toe quadrant at a coordinate location (−30 mm, −15 mm). Point Q4 is located in an upper toe quadrant at a coordinate location (−30 mm, 15 mm) while point Q8 is located in a lower heel quadrant at a coordinate location (30 mm, −15 mm).

It is understood that many degrees of twist are contemplated and the embodiments described are not limiting. For example, a golf club having a "0.25° twist", "0.75° twist", "1.25° twist", "1.5° twist", "1.75° twist", "2.25° twist", "2.5° twist", "2.75° twist, "3° twist", "3.25° twist", "3.5° twist", "3.75° twist", "4.25° twist", "4.5° twist", "4.75° twist", "5° twist", "5.25° twist", "5.5° twist", "5.75° twist", "6° twist", "6.25° twist", "6.5° twist", "6.75° twist", "7° twist", "7.25° twist", "7.5° twist", "7.75° twist", "8° twist", "8.25° twist", "8.5° twist", "8.75° twist", "9° twist", "9.25° twist", "9.5° twist", "9.75° twist", and "10° twist" are considered other possible embodiments of the present invention. A golf club having a degree of twist greater than 0°, between 0.25° and 5°, between 0.1° and 5°, between 0° and 5°, between 0° and 10°, or between 0° and 20° are contemplated herein.

Utilizing the grid pattern of FIG. 7, a plurality of embodiments having a nominal center face loft angle of 9.5°, a bulge of 330.2 mm, and a roll of 279.4 mm were analyzed having a "0.5° twist", "1° twist", "2° twist", and "4° twist". A comparison club having "0° twist" is provided for reference in contrast to the embodiments described.

Table 1 shows the LA° Δ and FA° Δ relative to center face for points located along the vertical axis 700 and horizontal axis 702 (for example points Q1, Q2, Q3, and Q6). With regard to points located away from the vertical axis 700 and horizontal axis 702, the LA° Δ and FA° Δ are measured relative to a corresponding point located on the vertical axis 700 and horizontal axis 702, respectively.

For example, regarding point Q4, located in the upper toe quadrant of the golf club head at a coordinate of (−30 mm, 15 mm), the LA° Δ is measured relative to point Q3 having the same vertical axis 700 coordinate at (0 mm, 15 mm). In other words, both Q3 and Q4 have the same y-coordinate location of 15 mm. Referring to Table 1, the LA° Δ of point Q4 is 0.4° with respect to the loft angle at point Q3. The LA° Δ of point Q4 is measured with respect to point Q3 which is located in a corresponding upper toe horizontal band 704.

In addition, regarding point Q4, located in the upper toe quadrant of the golf club head at a coordinate of (−30 mm, 15 mm), the FA° Δ is measured relative to point Q1 having the same horizontal axis 702 coordinate at (−30 mm, 0 mm). In other words, both Q1 and Q4 have the same x-coordinate location of −30 mm. Referring to Table 1, the FA° Δ of point Q4 is 0.2° with respect to the face angle at point Q1. The FA° Δ of point Q4 is measured with respect to point Q1 which is located in a corresponding upper toe vertical band 706.

To further illustrate how LA° Δ and FA° Δ are calculated for points located within a quadrant that are away from a vertical or horizontal axis, the LA° Δ of point Q8 is measured relative to a loft angle located at point Q6 within a lower heel quadrant horizontal band 708. Likewise, the FA° Δ of point Q8 is measured relative to a face angle located at point Q2 within a lower heel quadrant vertical band 710.

In summary, the LA° Δ and FA° Δ for all points that are located along either a horizontal 702 or vertical axis 700 are measured relative to center face Q0. For points located within a quadrant (such as points Q4, Q5, Q7, and Q8) the LA° Δ is measured with respect to a corresponding point located in a corresponding horizontal band, and the FA° Δ of a given point is measured with respect to a corresponding point located in a corresponding vertical band. In FIG. 7, not all bands are shown in the drawing for the improved clarity of the drawing.

The reason that points located within a quadrant have a different procedure for measuring LA° Δ and FA° Δ is that this method eliminates any influence of the bulge and roll curvature on the LA° Δ and FA° Δ numbers within a quadrant. Otherwise, if a point located within a quadrant is measured with respect to center face, the LA° Δ and FA° Δ numbers will be dependent on the bulge and roll curvature. Therefore utilizing the horizontal and vertical band method of measuring LA° Δ and FA° Δ within a quadrant eliminates any undue influence of a specific bulge and roll curvature. Thus the LA° Δ and FA° Δ numbers within a quadrant should be applicable across any range of bulge and roll curvatures in any given head. The above described method of measuring LA° Δ and FA° Δ within a quadrant has been applied to all examples herein.

The relative LA° Δ and FA° Δ can be applied to any lofted driver, such as a 9.5°, 10.5°, 12° lofted clubs or other commonly used loft angles such as for drivers, fairway woods, hybrids, irons, or putters.

TABLE 1

| | | | Relative to Center Face and Bands | | | | | | | | | |
|---|---|---|---|---|---|---|---|---|---|---|---|---|
| | X-axis | Y-Axis | Example 1 0.5° twist | | Example 2 1° twist | | Example 3 2° twist | | Example 4 4° twist | | 0° twist | |
| Point | (mm) | (mm) | LA° Δ | FA° Δ | LA° Δ | FA° Δ | LA° Δ | FA° Δ | LA° Δ | FA° Δ | LA° Δ | FA° Δ |
| Q0 | 0 | 0 | 0 | 0 | 0 | 0 | 0 | 0 | 0 | 0 | 0 | 0 |
| Q1 | −30 | 0 | 0.5 | 5.7 | 1 | 5.7 | 2 | 5.6 | 4 | 5.6 | 0 | 5.7 |
| Q2 | 30 | 0 | −0.5 | −5.7 | −1 | −5.7 | −2 | −5.6 | −4 | −5.6 | 0 | −5.7 |
| Q3 | 0 | 15 | 3.4 | 0.25 | 3.4 | 0.5 | 3.4 | 1 | 3.4 | 2 | 3.4 | 0 |
| Q4 | −30 | 15 | 0.4 | 0.2 | 0.9 | 0.4 | 1.9 | 1 | 3.9 | 2 | 0 | 0 |
| Q5 | 30 | 15 | −0.5 | 0.3 | −1 | 0.5 | −2 | 0.9 | −4 | 1.9 | 0 | 0 |
| Q6 | 0 | −15 | −3.4 | −0.25 | −3.4 | −0.5 | −3.4 | −1 | −3.4 | −2 | −3.4 | 0 |
| Q7 | −30 | −15 | 0.5 | −0.3 | 1 | −0.5 | 2 | −0.9 | 4 | −2 | 0 | 0 |
| Q8 | 30 | −15 | −0.5 | −0.2 | −1 | −0.4 | −2 | −1 | −4.1 | −2 | 0 | 0 |

In Examples 1-4 of Table 1, the critical point Q3 has a LA° Δ of +3.4° with respect to the center face. In some embodiments, a LA° Δ at Q3 is between 0° and 7°, between 1° and 5°, between 2° and 4°, or between 3° and 4°. A FA° Δ of greater than zero at the critical point Q3 (15 mm above the center face) is shown. The FA° Δ at the critical point Q3 can be between 0° and 5°, between 0.1° and 4°, between 0.2° and 4°, or between 0.2° and 3°, in some embodiment. In addition, the critical point Q6 has a LA° Δ of −3.4°, or less than zero, with respect to the center face for Examples 1-4. In some embodiments, a LA° Δ at Q6 is between 0° and −7°, between −1° and −5°, between −2° and −4°, or between −3° and −4°. A FA° Δ of less than zero at the critical point Q6 (−15 mm below the center face) is shown. In some embodiments, the FA° Δ at the critical point Q6 can be between 0° and −5°, between −0.1° and −4°, between −0.2° and −4°, or between −0.2° and −3°. In Examples 1-4, the loft angle remains constant relative to center face at the critical points Q3,Q6 while the face angle changes relative to center face as the degree of twist is changed.

Examples 1-4 of Table 1 further show a heel side point Q2 located at a x-y coordinate (30 mm, 0 mm) where the LA° Δ relative to center is −0.5°, −1°, −2°, and −4°, respectively, for each example. Therefore, a LA° Δ of less than zero at the point Q2 is shown. In some embodiments, the LA° Δ at the Q2 point is between 0° and −8°. In addition, Examples 1-4 at Q2 show a FA° Δ of less than −4° relative to center face as the degree of twist gets larger. In some embodiments, the FA° Δ at Q2 is between −0.2° and −10°, between −0.3° and −9°, or between −1° and −8°.

Examples 1-4 of Table 1 further show a toe side point Q1 located at a coordinate (−30 mm, 0 mm) where the LA° Δ relative to center is 0.5°, 1°, 2°, and 4°, respectively. Therefore, a LA° Δ of greater than zero at the point Q1 is shown. In some embodiments, the LA° Δ at the Q1 point is between 0° and 8°, between 0.1° and 7°, between 0.2° and 6°, or between 0.3° and 5°. In addition, a FA° Δ at Q1 can be between 1° and 8°, between 2° and 7°, or between 3° and 6°.

Examples 1-4 of Table 1 further show at least one upper heel quadrant point Q5 having a FA° Δ relative to point Q2 that is greater than 0.1°, greater than 0.2° or 0.3°. For instance, at point Q5, Examples 1, 2, 3, and 4 show a FA° Δ relative to point Q2 of 0.3°, 0.5°, 0.9°, and 1.9°, respectively, which are all greater than 0.1°. Examples 1-4 of Table 1 also show at least one upper heel quadrant point Q5 having a LA° Δ relative to point Q3 that is less than −0.2°. For instance, at point Q5, Examples 1, 2, 3, and 4 show a LA° Δ relative to point Q3 of −0.5°, −1°, −2°, and −4°, respectively, which are all less than −0.1°, less than −0.3, or less than −0.4.

Examples 1-4 of Table 1 further show at least one upper toe quadrant point Q4 having a FA° Δ relative to point Q1 that is greater than 0.1°. For instance, at point Q5, Examples 1, 2, 3, and 4 show a FA° Δ relative to point Q1 of 0.2°, 0.4°, 1°, and 2°, respectively, which are all greater than 0.15°. Examples 1-4 of Table 1 also show at least one upper toe quadrant point Q4 having a LA° Δ relative to point Q1 that is greater than 0.1°. For instance, at point Q4, Examples 1, 2, 3, and 4 show a LA° Δ relative to point Q1 of 0.4°, 0.9°, 1.9°, and 3.9°, respectively, which are all greater than 0.2° or greater than 0.3°.

Examples 1-4 of Table 1 further show at least one lower heel quadrant point Q8 having a FA° Δ relative to point Q2 that is less than −5.7°. For instance, at point Q8, Examples 1, 2, 3, and 4 show a FA° Δ relative to point Q2 of −0.2°, −0.4°, −1°, and −2°, respectively, which are all less than −0.1°. Examples 1-4 of Table 1 also show at least one lower heel quadrant point Q8 having a LA° Δ relative to point Q6 that is less than −0.1°. For instance, at point Q8, Examples 1, 2, 3, and 4 show a LA° Δ relative to point Q6 of −0.5°, −1°, −2°, and −4.1°, respectively, which are all less than −0.2°, less than 0.3° or less than 0.4°.

Examples 1-4 of Table 1 further show at least one lower toe quadrant point Q7 having a FA° Δ relative to point Q1 that is less than −0.1°. For instance, at point Q7, Examples 1, 2, 3, and 4 show a FA° Δ relative to center of −0.3°, −0.5°, −0.9°, and −2°, respectively, which are all less than −0.2°. Examples 1-4 of Table 1 also show at least one lower heel quadrant point Q7 having a LA° Δ relative to point Q6 that is greater than 0.2°. For instance, at point Q7, Examples 1, 2, 3, and 4 show a LA° Δ relative to point Q6 of 0.5°, 1°, 2°, and 4°, respectively, which are all greater than 0.3° or greater than 0.4°.

Table 2 shows the same embodiments of Table 1 but provides the difference in LA° Δ and FA° Δ when compared to the golf club head with "0° twist" as the base comparison. Example 1 has up to +/−0.5° of LA° Δ and up to +/−0.3 FA° Δ when compared to the golf club head with "0° twist". Example 2 has up to +/−1° of LA° Δ and up to +/−0.5 FA° Δ when compared to the golf club head with "0° twist". Example 3 has up to +/−2° of LA° Δ and up to +/−1 FA° Δ when compared to the golf club head with "0° twist". Example 4 has up to +/−4.1° of LA° Δ and up to +/−2.1 FA° Δ when compared to the golf club head with "0° twist".

In Examples 1-4, the LA° Δ and FA° Δ relative to center face remains unchanged at the center face location (0 mm, 0 mm) when compared to the "0° twist" head. However, all other points away from the center face location in Examples 1-4 have some non-zero amount of either LA° Δ or FA° Δ.

TABLE 2

| Relative to Zero Degree Twist | | | | | | | | | | |
|---|---|---|---|---|---|---|---|---|---|---|
| | X-axis | Y-Axis | Example 1 0.5° twist | | Example 2 1° twist | | Example 3 2° twist | | Example 4 4° twist | |
| Point | (mm) | (mm) | LA° Δ | FA° Δ | LA° Δ | FA° Δ | LA° Δ | FA° Δ | LA° Δ | FA° Δ |
| Q0 | 0 | 0 | 0 | 0 | 0 | 0 | 0 | 0 | 0 | 0 |
| Q1 | −30 | 0 | 0.5 | 0 | 1 | 0 | 2 | −0.1 | 4 | −0.1 |
| Q2 | 30 | 0 | −0.5 | 0 | −1 | 0 | −2 | 0.1 | −4 | 0.1 |
| Q3 | 0 | 15 | 0 | 0.25 | 0 | 0.5 | 0 | 1 | 0 | 2 |
| Q4 | −30 | 15 | 0.4 | 0.2 | 0.9 | 0.4 | 1.9 | 1 | 3.9 | 2 |
| Q5 | 30 | 15 | −0.5 | 0.3 | −1 | 0.5 | −2 | 0.9 | −4 | 1.9 |
| Q6 | 0 | −15 | 0 | −0.25 | 0 | −0.5 | 0 | −1 | 0 | −2 |
| Q7 | −30 | −15 | 0.5 | −0.3 | 1 | −0.5 | 2 | −0.9 | 4 | −2 |
| Q8 | 30 | −15 | −0.5 | −0.2 | −1 | −0.4 | −2 | −1 | −4.1 | −2 |

Figure 8:
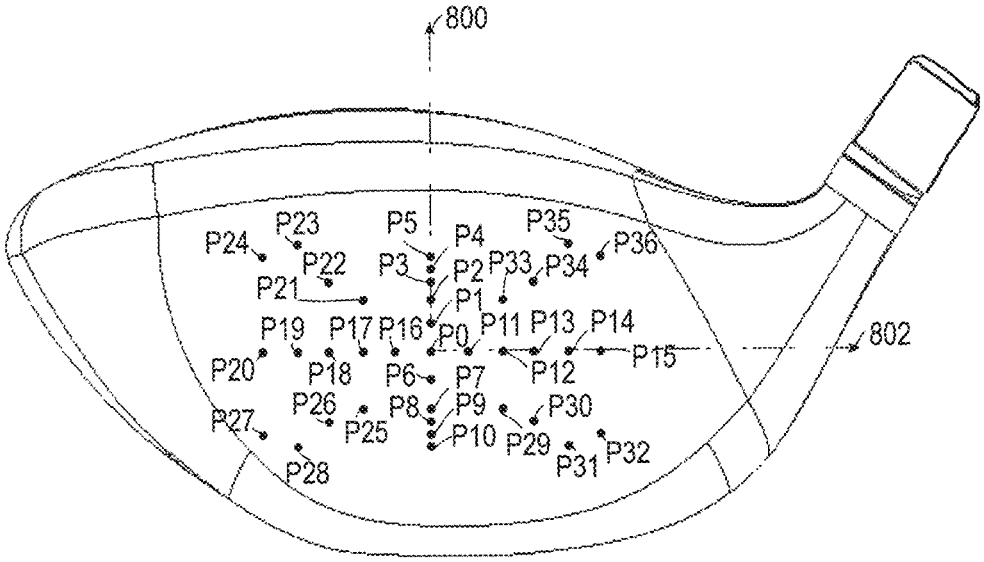
FIG. 8 illustrates a front view of a golf club with a predetermined set of measurement points.

FIG. 8 illustrates a plurality of points P0-P36 at which the face angle and loft angle are measured in a computer model. However, these same points can be measured on an actual golf club head utilizing the methods described above. Table 3 below provides the exact measurement of FA° Δ and LA° Δ at the thirty-seven plurality points spread across the golf club face. The FA° Δ and LA° Δ of each point is provided for two different embodiments having a 1° twist and 2° twist and a nominal center face loft angle of 9.2°, a bulge of 330.2 mm, and a roll of 279.4 mm are identified as Examples 5 and 6, respectively. Examples 5 and 6 are provided next to a golf club face that has 0° of twist for comparison purposes.

TABLE 3

| Relative to Center Face and Bands | | | | | | | | |
|---|---|---|---|---|---|---|---|---|
| | X-axis | Y-axis | Example 5 1° twist | | Example 6 2° twist | | 0° twist | |
| Point | (mm) | (mm) | LA° Δ | FA° Δ | LA° Δ | FA° Δ | LA° Δ | FA° Δ |
| P0 | 0 | 0 | 0.000 | 0.000 | 0.000 | 0.000 | 0.000 | 0.000 |
| P1 | 0 | 5 | 1.025 | 0.167 | 1.025 | 0.333 | 1.025 | 0.000 |
| P6 | 0 | −5 | −1.025 | −0.167 | −1.025 | −0.333 | −1.025 | 0.000 |
| P2 | 0 | 10 | 2.051 | 0.333 | 2.051 | 0.667 | 2.051 | 0.000 |
| P7 | 0 | −10 | −2.051 | −0.333 | −2.051 | −0.667 | −2.051 | 0.000 |
| P3 | 0 | 12 | 2.462 | 0.400 | 2.462 | 0.800 | 2.462 | 0.000 |
| P8 | 0 | −12 | −2.462 | −0.400 | −2.462 | −0.800 | −2.462 | 0.000 |
| P4 | 0 | 15 | 3.077 | 0.500 | 3.077 | 1.000 | 3.077 | 0.000 |
| P9 | 0 | −15 | −3.077 | −0.500 | −3.077 | −1.000 | −3.077 | 0.000 |
| P5 | 0 | 20 | 4.105 | 0.667 | 4.105 | 1.333 | 4.105 | 0.000 |
| P10 | 0 | −20 | −4.105 | −0.667 | −4.105 | −1.333 | −4.105 | 0.000 |
| P11 | 5 | 0 | −0.167 | −0.868 | −0.333 | −0.868 | 0.000 | −0.868 |
| P16 | −5 | 0 | 0.167 | 0.868 | 0.333 | 0.868 | 0.000 | 0.868 |
| P12 | 10 | 0 | −0.333 | −1.735 | −0.667 | −1.735 | 0.000 | −1.735 |
| P17 | −10 | 0 | 0.333 | 1.735 | 0.667 | 1.735 | 0.000 | 1.735 |
| P13 | 18 | 0 | −0.600 | −3.125 | −1.200 | −3.125 | 0.000 | −3.125 |
| P18 | −18 | 0 | 0.600 | 3.125 | 1.200 | 3.125 | 0.000 | 3.125 |
| P14 | 25 | 0 | −0.833 | −4.342 | −1.667 | −4.342 | 0.000 | −4.342 |
| P19 | −25 | 0 | 0.833 | 4.342 | 1.667 | 4.342 | 0.000 | 4.342 |
| P15 | 30 | 0 | −1.000 | −5.213 | −2.000 | −5.213 | 0.000 | −5.213 |
| P20 | −30 | 0 | 1.000 | 5.213 | 2.000 | 5.213 | 0.000 | 5.213 |
| P33 | 10 | 10 | −0.333 | 0.333 | −0.667 | 0.667 | 0.000 | 0.000 |
| P34 | 18 | 12 | −0.600 | 0.400 | −1.200 | 0.800 | 0.000 | 0.000 |
| P35 | 25 | 20 | −0.833 | 0.667 | −1.667 | 1.333 | 0.000 | 0.000 |
| P36 | 30 | 15 | −1.000 | 0.500 | −2.000 | 1.000 | 0.000 | 0.000 |
| P21 | −10 | 10 | 0.333 | 0.333 | 0.667 | 0.667 | 0.000 | 0.000 |
| P22 | −18 | 12 | 0.600 | 0.400 | 1.200 | 0.800 | 0.000 | 0.000 |
| P23 | −25 | 20 | 0.833 | 0.667 | 1.667 | 1.333 | 0.000 | 0.000 |
| P24 | −30 | 15 | 1.000 | 0.500 | 2.000 | 1.000 | 0.000 | 0.000 |
| P29 | 10 | −10 | −0.333 | −0.333 | −0.667 | −0.667 | 0.000 | 0.000 |
| P30 | 18 | −12 | −0.600 | −0.400 | −1.200 | −0.800 | 0.000 | 0.000 |
| P31 | 25 | −20 | −0.833 | −0.667 | −1.667 | −1.333 | 0.000 | 0.000 |
| P32 | 30 | −15 | −1.000 | −0.500 | −2.000 | −1.000 | 0.000 | 0.000 |
| P25 | −10 | −10 | 0.333 | −0.333 | 0.667 | −0.667 | 0.000 | 0.000 |
| P26 | −18 | −12 | 0.600 | −0.400 | 1.200 | −0.800 | 0.000 | 0.000 |
| P28 | −25 | −20 | 0.833 | −0.667 | 1.667 | −1.333 | 0.000 | 0.000 |
| P27 | −30 | −15 | 1.000 | −0.500 | 2.000 | −1.000 | 0.000 | 0.000 |

Table 3 shows the same nine key points of measurement shown in Table 1. Specifically, points P0, P4, P9, P15, P20, P24, P27, P32, and P36 correspond to the locations of points Q0-Q8 in Table 1. However, additional points have been measured to provide a higher resolution of the twisted face in Examples 5 and 6.

Point P5 located at x-y coordinate (0 mm, 20 mm) and point P10 located at x-y coordinate (0 mm, −20 mm) are helpful in determining the extreme face angle changes further away from the center face. In Example 5 of Table 3 at point P5, the FA° Δ is between 0.1° and 4°, between 0.2° and 3.5°, between 0.3° and 3°, between 0.4° and 3°, or between 0.5° and 2°. The LA° Δ at point P5 is between 1° and 10°, between 2° and 8°, between 3° and 7°, or between 3° and 6°.

In Example 5 of Table 3 at point P10, the FA° Δ is between −0.1° and −4°, between −0.2° and −3.5°, between −0.3° and −3°, between −0.4° and −3°, or between −0.5° and −2°. The LA° Δ at point P10 is between −1° and −10°, between −2° and −8°, between −3° and −7°, or between −3° and −6°.

Table 3 and FIG. 8 also show a plurality of points located in each quadrant. The upper toe quadrant has at least four measured points P21, P22, P23, P24. The lower toe quadrant has at least four measured points P25, P26, P27, P28. The upper heel quadrant has at least four measured points P33, P34, P35, P36. The lower heel quadrant has at least four measured points P29, P30, P31, P32.

The average of the FA° Δ and LA° Δ of the four points described in each quadrant are shown in Table 4 below.

TABLE 4

| Average in Quadrants | | | | | | |
|---|---|---|---|---|---|---|
| | Example 5 1° twist | | Example 6 2° twist | | 0° twist | |
| | Avg. LA° Δ | Avg. FA° Δ | Avg. LA° Δ | Avg. FA° Δ | Avg. LA° Δ | Avg. FA° Δ |
| Upper Toe Quadrant | 0.692 | 0.475 | 1.383 | 0.950 | 0.000 | 0.000 |
| Upper Heel Quadrant | −0.692 | 0.475 | −1.383 | 0.950 | 0.000 | 0.000 |
| Lower Toe Quadrant | 0.692 | −0.475 | 1.383 | −0.950 | 0.000 | 0.000 |
| Lower Heel Quadrant | −0.692 | −0.475 | −1.383 | −0.950 | 0.000 | 0.000 |

Table 4 shows that average FA° Δ in Example 5 for the upper toe quadrant and the upper heel quadrant are more open (more positive) than the 0° twist golf club head by more than 0.1°, more than 0.2°, more than 0.3°, or more than 0.4°. In some embodiments the upper toe quadrant and upper heel quadrant have an average FA° Δ more open than the 0° twist golf club by between 0.1° to 0.8°, 0.2° to 0.6°, or 0.3° to 0.5° more open. The lower toe quadrant and lower heel quadrant of Example 5 has a FA° Δ that is more closed (more negative) than the 0° twist golf club head. In some embodiments, the FA° Δ relative to a 0° twist club head in the lower toe quadrant and lower heel quadrant is less than −0.1°, less than −0.2, less than −0.3, or less than −0.4. In some embodiments, the FA° Δ relative to a 0° twist club head in the lower toe quadrant and lower heel quadrant is between −0.1° to −0.8°, −0.2° to −0.6°, or −0.3° to −0.5°. Table 4 shows that average FA° Δ in Example 6 for the upper toe quadrant and the upper heel quadrant are more open (more positive) than the 0° twist golf club head by more than 0.6°, more than 0.7°, more than 0.8°, or more than 0.9°. In some embodiments the upper toe quadrant and upper heel quadrant are more open than the 0° twist golf club by between 0.6° to 1.2°, 0.7° to 1.1°, or 0.8° to 1° more open. The lower toe quadrant and lower heel quadrant of Example 6 has a FA° Δ that is more closed (more negative) than the 0° twist golf club head. In some embodiments, the FA° Δ relative to a 0° twist club head in the lower toe quadrant and lower heel quadrant is less than −0.6°, less than −0.7, less than −0.8, or less than −0.9. In some embodiments, the FA° Δ relative to a 0° twist club head in the lower toe quadrant and lower heel quadrant is between −0.6° to −1.2°, −0.7° to −1.1°, or −0.8° to −1°.

Table 4 shows that average LA° Δ in Example 5 for the upper toe quadrant and lower toe quadrant are more lofted (more positive) than the 0° twist golf club head by more than 0.2°, more than 0.3°, more than 0.4°, more than 0.5°, or more than 0.6°. In some embodiments, the upper toe quadrant and lower toe quadrant have a LA° Δ between 0.2° to 1°, between 0.3° to 0.9°, between 0.4° to 0.8°, or between 0.5° to 0.7° more lofted. The average LA° Δ of the upper heel quadrant and lower heel quadrant of Example 5 relative to a 0° twist club head are less lofted (more negative) than the 0° twist golf club head by less than −0.2° less than −0.3°, less than −0.4°, less than −0.5°, or less than −0.6°. In some embodiments, the upper heel quadrant and lower heel quadrant have a LA° Δ between −0.2° to −1°, between −0.3° to −0.9°, between −0.4° to −0.8°, or between −0.5° to −0.7° less lofted. The lower toe quadrant and upper toe quadrant of Example 5 are more lofted (more positive) than the 0° twist golf club head by more than 0.1° or between 0° to 1.5° more lofted. The lower heel quadrant and upper heel quadrant of Example 5 are less lofted (more negative) than the 0° twist golf club head by less than −0.1° or between 0° to −1° less lofted.

Table 4 shows that average LA° Δ in Example 6 for the upper toe quadrant and lower toe quadrant are more lofted (more positive) than the 0° twist golf club head by more than 0.5°, more than 0.6°, more than 0.7°, more than 0.8°, or more than 0.9°. In some embodiments, the upper toe quadrant and lower toe quadrant have a LA° Δ between 0.5° to 2.5°, between 0.6° to 2°, between 0.7° to 1.8°, or between 0.9° to 1.5° more lofted. The average LA° Δ of the upper heel quadrant and lower heel quadrant of Example 6 is less lofted (more negative) than the 0° twist golf club head by less than-0.5° less than −0.6°, less than −0.7°, less than −0.8°, or less than −0.9°. In some embodiments, the upper heel quadrant and lower heel quadrant have an average LA° Δ relative to 0° twist club head of between −0.5° to −2.5°, between −0.6° to −2°, between −0.7° to −1.8°, or between −0.9° to −1.5° less lofted. The lower toe quadrant and upper toe quadrant of Example 6 are more lofted (more positive) than the 0° twist golf club head by more than 0.1° or between 0° to 2.5° more lofted. The lower heel quadrant and upper heel quadrant of Example 6 are less lofted (more negative) than the 0° twist golf club head by less than −0.1° or between 0° to −2.5° less lofted.

Therefore, Examples 5 and 6 show a golf club head having four quadrants where the FA° Δ is more open (more positive) in the upper heel and toe quadrants and more closed (more negative) in the lower heel and toe quadrants. Examples 5 and 6 also show a golf club head having four quadrants where the LA° Δ is more lofted (more positive) in the upper toe quadrant and lower toe quadrant while being less lofted (more negative) in the upper heel quadrant and lower heel quadrant when compared to a 0° twist golf club head.

Figure 9:
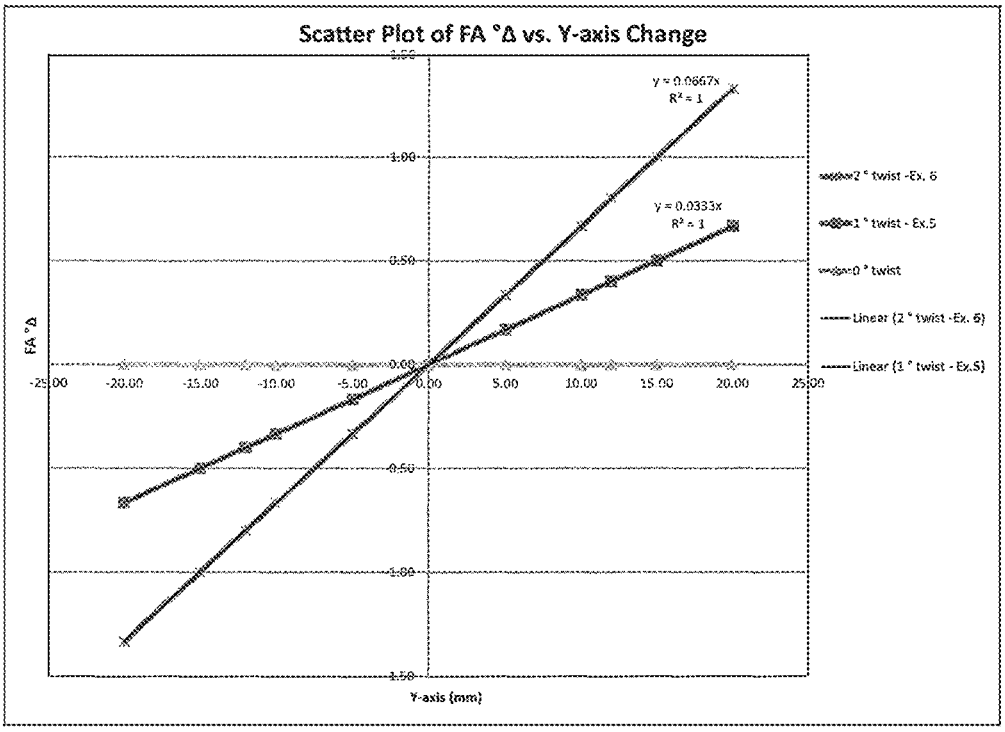
FIG. 9 is a graph showing a FA° Δ along a y-axis location.

FIG. 9 provides a chart showing the rate of change of FA° Δ relative to a y-axis 800 change with zero x-axis 802 change. In other words, FIG. 9 graphs the points P0-P10 shown in Table 3 above. It is noted that the points P0-P10 lie along the y-axis 800 only and have no x-axis 802 component. The rate of change is shown by the trend line fit to the measurements of Examples 5 and 6. The FA° Δ for Example 5 and 6 have a trend line defined as:

$$y=0.0333x \quad \text{(Eq. 1) Example 5}$$

$$y=0.0667x \quad \text{(Eq. 2) Example 6}$$

Equation 1 illustrates that for every 1 mm in movement along the y-axis 800, there is a relative FA° Δ of 0.0333° for a "1° twist" golf club head. Equation 2 shows that for every 1 mm in movement along the y-axis 800, there is a corresponding relative FA° Δ of 0.0667° for a "2° twist" golf club head. The slope of the equation describes the rate of change of the FA° Δ relative to the measurement point as it is moved along the y-axis 800. Therefore, the rate of change can be represented as a x/mm where x is the FA° Δ (in units of ° Δ).

In some embodiments, the FA° Δ to y-axis rate of change is greater than zero, greater than 0.01° Δ/mm, greater than 0.02° Δ/mm, greater than 0.03° Δ/mm, greater than 0.04° Δ/mm, greater than 0.05° Δ/mm, or greater than 0.6° Δ/mm. In some embodiments, the FA° Δ to y-axis rate of change is between 0.005° Δ/mm and 0.2° Δ/mm, between 0.01° Δ/mm and 0.1° Δ/mm, between 0.02° Δ/mm and 0.09° Δ/mm, or between 0.03° Δ/mm and 0.08° Δ/mm.

Figure 10:
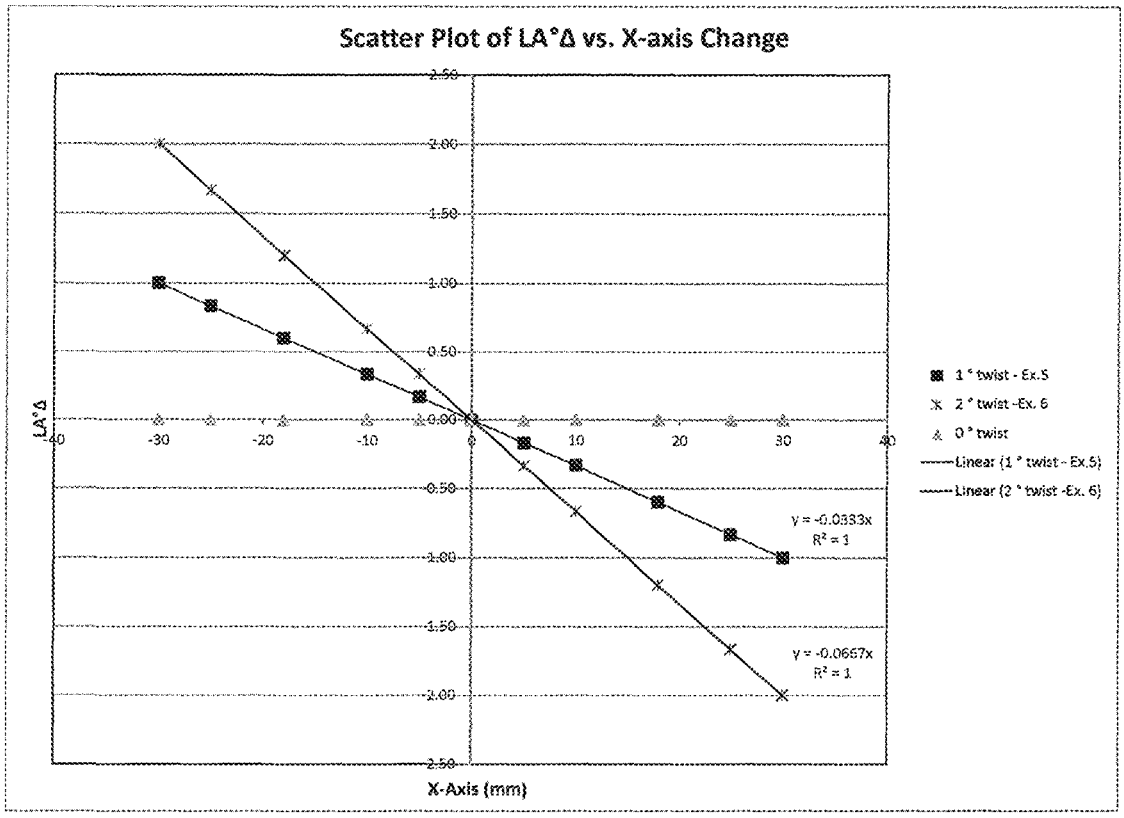
FIG. 10 is a graph showing a LA° Δ along a x-axis location.

FIG. 10 shows a chart illustrating the rate of change of the LA° Δ relative to a x-axis 802 change with zero y-axis 800 change. In other words, FIG. 10 graphs the points P11-P20 shown in Table 3 above. It is noted that the points P11-P20 lie along the x-axis 802 only and have no y-axis 800 component.

The LA° Δ for Example 5 and 6 have a trend line defined as:

$$y=-0.0333x \quad \text{(Eq. 3) Example 5}$$

$$y=-0.0667x \quad \text{(Eq. 4) Example 6}$$

Equation 3 illustrates that for every 1 mm in movement along the x-axis 802, there is a relative LA° Δ of −0.0333° for a "1° twist" golf club head. Equation 2 shows that for every 1 mm in movement along the x-axis 802, there is a corresponding relative LA° Δ of −0.0667° for a "2° twist" golf club head. The rate of change for the LA° Δ is negative for every positive movement along the x-axis 802.

In some embodiments, the LA° Δ to x-axis rate of change is less than zero for every millimeter, less than −0.01° Δ/mm, less than −0.02° Δ/mm, less than −0.03° Δ/mm, less than −0.04° Δ/mm, less than −0.05° Δ/mm, or less than −0.06° Δ/mm.

In some embodiments, the LA° Δ to x-axis rate of change is between −0.005° Δ/mm and −0.2° Δ/mm, between −0.01° Δ/mm and −0.1° Δ/mm, between −0.02° Δ/mm and −0.09° Δ/mm, or between −0.03° Δ/mm and −0.08° Δ/mm.

TABLE 5

| Relative to Zero Degree Twist | | | | | | |
|---|---|---|---|---|---|---|
| | X-axis | Y-axis | Example 5 1° twist | | Example 6 2° twist | |
| Point | (mm) | (mm) | LA° Δ | FA° Δ | LA° Δ | FA° Δ |
| P0 | 0 | 0 | 0.000 | 0.000 | 0.000 | 0.000 |
| P1 | 0 | 5 | 0.000 | 0.167 | 0.000 | 0.333 |
| P6 | 0 | −5 | 0.000 | −0.167 | 0.000 | −0.333 |
| P2 | 0 | 10 | 0.000 | 0.333 | 0.000 | 0.667 |
| P7 | 0 | −10 | 0.000 | −0.333 | 0.000 | −0.667 |
| P3 | 0 | 12 | 0.000 | 0.400 | 0.000 | 0.800 |

TABLE 5-continued

| Relative to Zero Degree Twist | | | | | | |
|---|---|---|---|---|---|---|
| | X-axis | Y-axis | Example 5 1° twist | | Example 6 2° twist | |
| Point | (mm) | (mm) | LA° Δ | FA° Δ | LA° Δ | FA° Δ |
| P8 | 0 | −12 | 0.000 | −0.400 | 0.000 | −0.800 |
| P4 | 0 | 15 | 0.000 | 0.500 | 0.000 | 1.000 |
| P9 | 0 | −15 | 0.000 | −0.500 | 0.000 | −1.000 |
| P5 | 0 | 20 | 0.000 | 0.667 | 0.000 | 1.333 |
| P10 | 0 | −20 | 0.000 | −0.667 | 0.000 | −1.333 |
| P11 | 5 | 0 | −0.167 | 0.000 | −0.333 | 0.000 |
| P16 | −5 | 0 | 0.167 | 0.000 | 0.333 | 0.000 |
| P12 | 10 | 0 | −0.333 | 0.000 | −0.667 | 0.000 |
| P17 | −10 | 0 | 0.333 | 0.000 | 0.667 | 0.000 |
| P13 | 18 | 0 | −0.600 | 0.000 | −1.200 | 0.000 |
| P18 | −18 | 0 | 0.600 | 0.000 | 1.200 | 0.000 |
| P14 | 25 | 0 | −0.833 | 0.000 | −1.667 | 0.000 |
| P19 | −25 | 0 | 0.833 | 0.000 | 1.667 | 0.000 |
| P15 | 30 | 0 | −1.000 | 0.000 | −2.000 | 0.000 |
| P20 | −30 | 0 | 1.000 | 0.000 | 2.000 | 0.000 |
| P33 | 10 | 10 | −0.333 | 0.333 | −0.667 | 0.667 |
| P34 | 18 | 12 | −0.600 | 0.400 | −1.200 | 0.800 |
| P35 | 25 | 20 | −0.833 | 0.667 | −1.667 | 1.333 |
| P36 | 30 | 15 | −1.000 | 0.500 | −2.000 | 1.000 |
| P21 | −10 | 10 | 0.333 | 0.333 | 0.667 | 0.667 |
| P22 | −18 | 12 | 0.600 | 0.400 | 1.200 | 0.800 |
| P23 | −25 | 20 | 0.833 | 0.667 | 1.667 | 1.333 |
| P24 | −30 | 15 | 1.000 | 0.500 | 2.000 | 1.000 |
| P29 | 10 | −10 | −0.333 | −0.333 | −0.667 | −0.667 |
| P30 | 18 | −12 | −0.600 | −0.400 | −1.200 | −0.800 |
| P31 | 25 | −20 | −0.833 | −0.667 | −1.667 | −1.333 |
| P32 | 30 | −15 | −1.000 | −0.500 | −2.000 | −1.000 |
| P25 | −10 | −10 | 0.333 | −0.333 | 0.667 | −0.667 |
| P26 | −18 | −12 | 0.600 | −0.400 | 1.200 | −0.800 |
| P28 | −25 | −20 | 0.833 | −0.667 | 1.667 | −1.333 |
| P27 | −30 | −15 | 1.000 | −0.500 | 2.000 | −1.000 |

Table 5 shows the same embodiments of Table 3 but provides the difference in LA° Δ and FA° Δ when compared to the golf club head with "0° twist" as the base comparison. Example 5 has up to about +/−1° of LA° Δ or up to about +/−0.7 FA° A when compared to the golf club head with "0° twist". Example 6 has up to about +/−2° of LA° Δ and up to +/−1.4 FA° Δ when compared to the golf club head with "0° twist".

In Examples 5 and 6, the LA° Δ and FA° Δ relative to center face remains unchanged at the center face location (0 mm, 0 mm) when compared to the "0° twist" head. However, all other points away from the center face location in Examples 5 and 6 also have some non-zero amount of change in either LA° Δ or FA° Δ.

The numbers provided in the Tables above show loft angle change or face angle change relative to center face location or relative to a key point within a band. However, the actual nominal face angle or loft angle can be calculated quantitatively for a desired point using the below equation:

$$LA = CFLA + \arcsin\left(\frac{YLOC}{\text{Roll}}\right) * \left(\frac{180}{Pl}\right) - XLOC * \left(\frac{DEG}{30}\right) \quad \text{Eq. 5}$$

$$FA = CFFA - \arcsin\left(\frac{XLOC}{\text{Bulge}}\right) * \left(\frac{180}{Pl}\right) + YLOC * \left(\frac{DEG}{30}\right) \quad \text{Eq. 6}$$

In Eq. 5 and Eq. 6 above, the variables are defined as:
Roll=Roll Radius (mm)
Bulge=Bulge Radius (mm)
LA=Nominal Loft Angle (°) at a desired point
FA=Nominal Face Angle (°) at a desired point
CFLA=Center Face Loft Angle (°)

CFFA=Center Face Face Angle (°)

YLOC=y-coordinate location on the y-axis of the predetermined point (mm)

XLOC=x-coordinate location on the x-axis of the predetermined point (mm)

DEG=degree of twist in the club head being measured (°)

By way of example, assume a golf club having a 1° twist, CFLA of 9.2°, a CFFA of 0°, a bulge of 330.2 mm, and a roll of 279.4 mm is provided, similar to Example 5 described in Table 3. In order to calculate the LA° Δ and FA° Δ at critical point P4 located at an x-y coordinate of (0 mm, 15 mm), 0 mm is utilized as the XLOC value and 15 mm as the YLOC value. The DEG value is 1°. When these variables are entered into Equation 5 above, a LA value of 12.277° and a FA value of 0.500° is calculated for critical point P4.

The LA° Δ is the nominal loft at the critical point P4 minus the center face loft. In this case, the CFLA is 9.2°. Therefore the LA° Δ is 12.277° minus 9.2° which equals 3.077° as shown in Table 3 at the critical point P4 in Example 5.

Likewise, Equation 6 yields the FA value of 0.500°. The FA° Δ is the nominal face angle, FA, at the critical point P4 minus the center face face angle. In this case, the CFFA is 0° (which is likely always the case). Therefore, the FA° Δ at critical point P4 is 0.500° minus 0° which equals 0.500° as shown in Table 3.

Thus, the FA° Δ and LA° Δ can be calculated at any desired x-y coordinate by calculating the nominal FA and LA values in Equations 5 and 6 above utilizing the necessary variables.

It is also possible to use the above equation to set bounds on the desired face shape for a given head. For example, if a head has a bulge radius (Bulge), and roll radius (Roll), it is possible to define two bounding surfaces for the desired twisted face surface by specifying two different twist amounts (DEG). In order to bound the example above, we can use a CFLA of 9.2°, a bulge of 330.2 mm, and a roll of 279.4 mm, then specify a range of twist of, for example 0.5°<DEG<1.5°. Then, preferably at least 50% of the face surface would have a FA and LA within the bounds of the equations using DEG=0.5° and DEG=1.5°. More preferably at least 70% of the face surface would have a FA and LA within the bounds of the equations using DEG=0.5° and DEG=1.5°. Most preferably at least 90% of the face surface would have a FA and LA within the bounds of the equations using DEG=0.5° and DEG=1.5°.

Similarly, if the target twist is, DEG=2.0°, then the upper/lower limits could be 1.5°<DEG<2.5°, and preferably 50%, or more preferably 70%, or most preferably 90% of the face surface would have a FA and LA within the bounds of the equations using those angles.

To make the upper/lower bound FA and LA equations more general for any driver with any bulge and roll, the process would be to define the amount of twist (i.e., 1°, 2°, 3°, etc.), then determine the desired CFLA, CFFA, Bulge and Roll, then define the upper bound equation using those parameters and a twist, DEG+, which is 0.5° higher than the target twist, DEG, and a lower bound with a twist, DEG−, which is 0.5° lower than the target twist, DEG. In this way, preferably 50%, or more preferably 70%, or most preferably 90% of the face surface would have a FA and LA within the bounds of the equations using DEG+ and DEG- and the desired CFLA, CFFA, Bulge and Roll.

For example, the range of CFLA can be between 7.5° and 16.0°, preferably 10.0°, the range of CFFA can be between −3.0° and +3.0°, preferably 0.0°, the range of Bulge can be between 228.6 mm to 457.2 mm, preferably 330.2 mm, and the range of Roll can be between 228.6 mm to 457.2 mm, preferably 279.4 mm. Any combination of these parameters within these ranges can be used to define the nominal FA and LA values over the face surface, and ranges of twist can range from 0.5° to 4.0°, preferably 1.0°.

Although the embodiments above describe a twisted face that has a generally open (more positive) FA° Δ in the upper toe and heel quadrant, it is also possible to create a golf club head with a closed (more negative) FA° Δ in the upper toe and heel quadrants. In other words, the twisting direction could be in the opposite direction of the embodiments described herein.

Because the twisted face described herein has a generally more open (more positive) face angle, the topline 280, shown in FIG. 2*d*, may appear more open or positive face angle to the golfer. For many golfers, this is a useful alignment feature which gives the golfer the confidence that the ball will not fly too far let. Thus, a twisted face golf club that is more open has the advantage of having a more open topline alignment appearance when the paint line of the crown ends at the intersection of the face and the crown at the topline 280.

In contrast, it is possible to have a golf club with a more negative or closed face twist in which case the topline 280 will have a more closed or negative face angle appearance to the golfer when the paint line occurs at the topline 280 of the face and crown intersection.

Second Representative Embodiment

Various representative embodiments of iron type golf club heads will now be described. Typically, iron type golf club heads include a head body and a striking plate. The head body includes a heel portion, a toe portion, a topline portion, a sole portion, and a hosel configured to attach the club head to a shaft. In various embodiments, the head body defines a front opening configured to receive the striking plate at a front rim formed around a periphery of the front opening. In various embodiments, the striking plate is formed integrally (such as by casting) with the head body.

Various embodiments and aspects will be described with reference to details discussed below, and the accompanying drawings will illustrate the various embodiments. The following description and drawings are illustrative and are not to be construed as limiting on the scope of the disclosure. Numerous specific details are described to provide a thorough understanding of various embodiments of the present disclosure. However, in certain instances, well-known or conventional details are not described in order to provide a concise discussion of the various embodiments described herein.

1. Iron Type Golf Club Heads

Figure 11A:
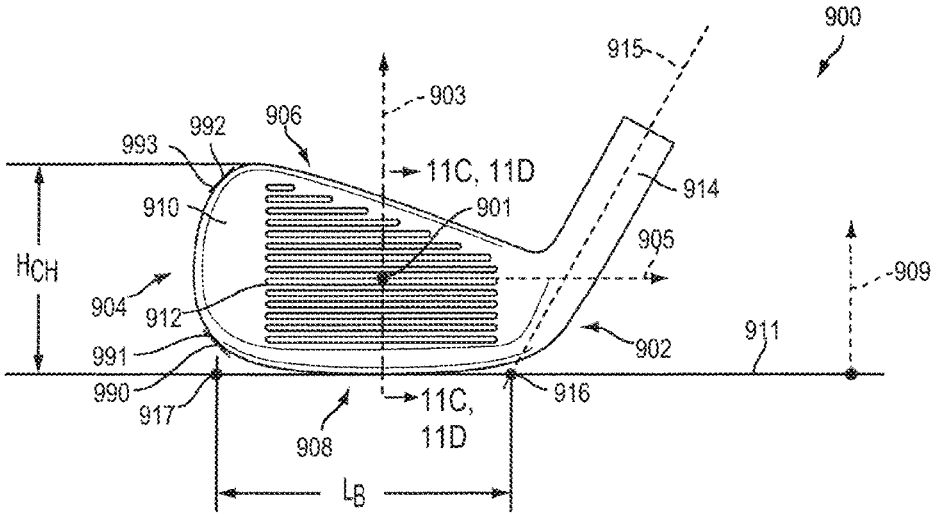
FIG. 11A is a front view of an embodiment of a golf club head.

FIG. 11A illustrates an iron type golf club head 900 including a body 913 (FIG. 11B) having a heel 902, a toe portion 904, a sole portion 908, a top line portion 906, and a hosel 914. The golf club head 900 is shown in FIG. 11A in a normal address position with the sole portion 908 resting upon a ground plane 111, which is assumed to be perfectly flat. As used herein, "normal address position" means the club head position wherein a vector normal to the center of the club face substantially lies in a first vertical plane (i.e., a vertical plane is perpendicular to the ground plane 911), a centerline axis 915 of the hosel 914 substantially lies in a second vertical plane, and the first vertical plane and the second vertical plane substantially perpendicularly intersect. The center of the club face is determined using the procedures described in the USGA "Procedure for Measuring the Flexibility of a Golf Club head," Revision 2.0, Mar. 25, 2005.

A lower tangent point 990 on the outer surface of the club head 900 of a line 991 forming a 45° angle relative to the ground plane 911 defines a demarcation boundary between the sole portion 908 and the toe portion 904. Similarly, an upper tangent point 992 on the outer surface of the club head 900 of a line 993 forming a 45° angle relative to the ground plane 911 defines a demarcation boundary between the top line portion 906 and the toe portion 904. In other words, the portion of the club head that is above and to the left (as viewed in FIG. 11A) of the lower tangent point 990 and below and to the left (as viewed in FIG. 11A) of the upper tangent point 992 is the toe portion 904.

The striking face 910 (FIG. 11B) defines a face plane 925 and includes grooves 912 that are designed for impact with the golf ball. It should be noted that, in some embodiments, the toe portion 904 may be understood to be any portion of the golf club head 900 that is toeward of the grooves 912. In some embodiments, the golf club head 900 can be a single unitary cast piece, while in other embodiments, a striking plate can be formed separately to be adhesively or mechanically attached to the body 913 (FIG. 11B) of the golf club head 900.

Figure 11B:
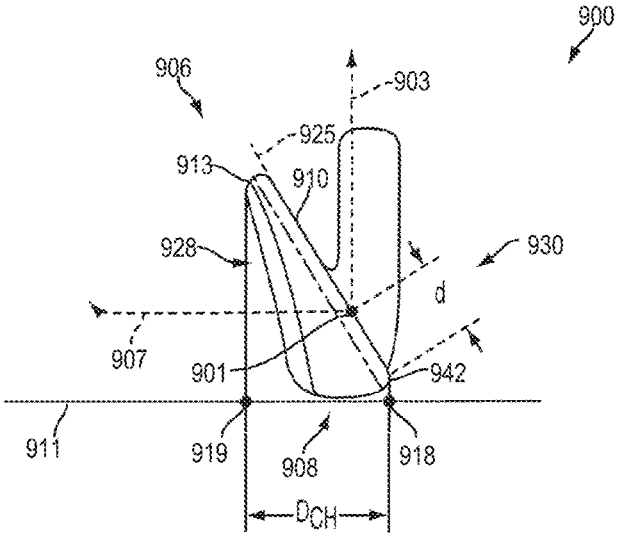
FIG. 11B is an elevated toe perspective view of a golf club head.

FIGS. 11A and 11B also show an ideal striking location 901 on the striking face 910 and respective orthogonal CG axes. As used herein, the ideal striking location 901 is located within the face plane 925 and coincides with the location of the center of gravity (CG) of the golf club head along the CG x-axis 905 (i.e., CG-x) and is offset from the leading edge 942 (defined as the midpoint of a radius connecting the sole portion 908 and the face plane 925) by a distance d of 16.5 mm within the face plane 925, as shown in FIG. 11B. A CG x-axis 905, CG y-axis 907, and CG z-axis 903 intersect at the ideal striking location 901, which defines the origin of the orthogonal CG axes. With the golf club head 900 in the normal address position, the CG x-axis 905 is parallel to the ground plane 911 and is oriented perpendicular to a normal extending from the striking face 910 at the ideal striking location 901. The CG y-axis 907 is also parallel to the ground plane and is perpendicular to the CG x-axis 905. The CG z-axis 903 is oriented perpendicular to the ground plane. In addition, a CG z-up axis 909 is defined as an axis perpendicular to the ground plane 911 and having an origin at the ground plane 911.

In certain embodiments, a desirable CG-y location is between about 0.25 mm to about 20 mm along the CG y-axis 907 toward the rear portion of the club head. Additionally, a desirable CG-z location is between about 12 mm to about 25 mm along the CG z-up axis 909, as previously described.

Figure 1:
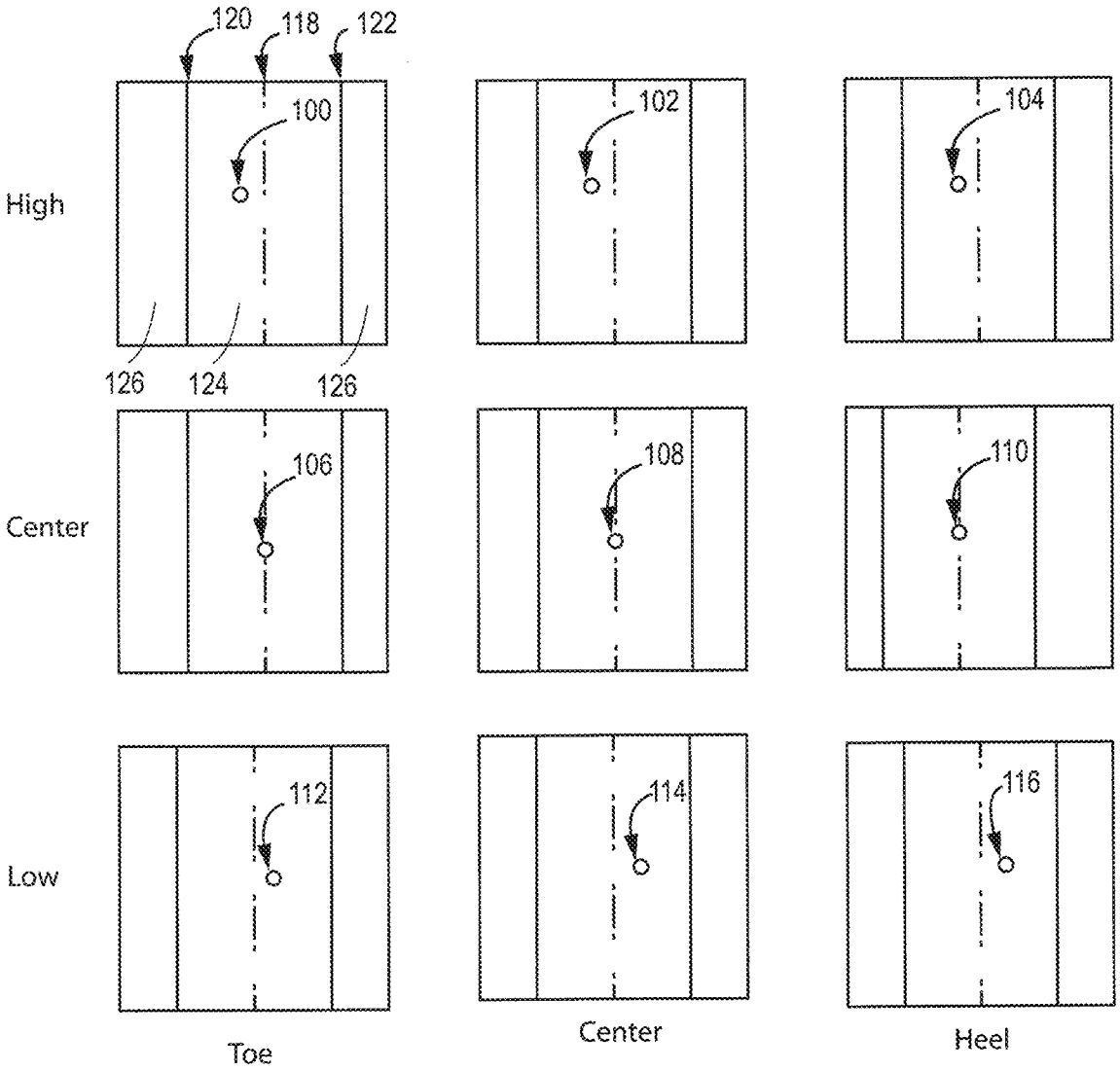
FIG. 1 is an illustration of different ball locations relative to the impact location on a golf club face.
Figure 11C:
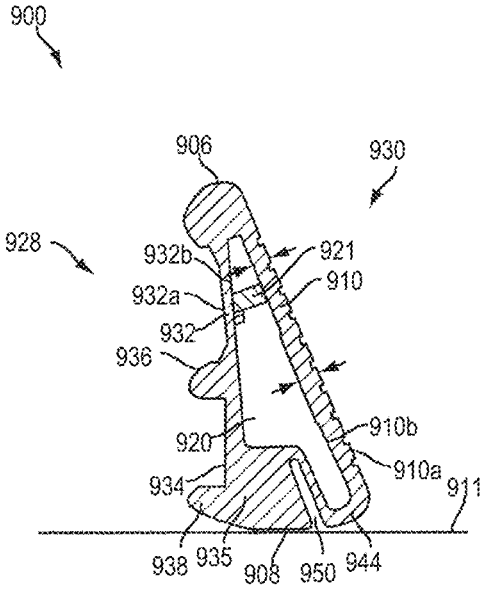
FIG. 11C is a cross-sectional view taken along section lines 11B-11B in FIG. 11A, showing an embodiment of a hollow club head.

The golf club head may be of solid (also referred to as "blades" and/or "musclebacks"), hollow, cavity back, or other construction. FIG. 11C shows a cross sectional side view along the cross-section lines 11C-11C shown in FIG. 11A of an embodiment of the golf club head having a hollow construction. FIG. 1D shows a cross sectional side view along the cross-section lines 11D-11D of an embodiment of a golf club head having a cavity back construction. The cross-section lines 11C, 11D-11C, 11D are taken through the ideal striking location 901 on the striking face 910. The striking face 910 includes a front surface 910*a* and a rear surface 910*b*. Both the hollow iron golf club head and cavity back iron golf club head embodiments further include a back portion 928 and a front portion 930.

In the embodiments shown in FIGS. 11A-11D, the grooves 912 are located on the striking face 910 such that they are centered along the CG x-axis about the ideal striking location 901, i.e., such that the ideal striking location 901 is located within the striking face plane 925 on an imaginary line that is both perpendicular to and that passes through the midpoint of the longest score-line groove 912. In other embodiments (not shown in the drawings), the grooves 912 may be shifted along the CG x-axis to the toe side or the heel side relative to the ideal striking location 901, the grooves 912 may be aligned along an axis that is not parallel to the ground plane 911, the grooves 912 may have discontinuities along their lengths, or the grooves may not be present at all. Still other shapes, alignments, and/or orientations of grooves 912 on the surface of the striking face 910 are also possible.

In reference to FIG. 11A, the club head 100 has a sole length, $L_B$, and a club head height, $HC_H$. The sole length, $L_B$, is defined as the distance between two points projected onto the ground plane 911. A heel side 916 of the sole is defined as the intersection of a projection of the hosel axis 915 onto the ground plane 911. A toe side 917 of the sole is defined as the intersection point of the vertical projection of the lower tangent point 990 (described above) onto the ground plane 911. The distance between the heel side 916 and toe side 917 of the sole is the sole length $L_B$ of the club head. The club head height, $HC_H$, is defined as the distance between the ground plane 911 and the uppermost point of the club head as projected in the x-z plane, as illustrated in FIG. 11A.

FIG. 11B illustrates an elevated toe view of the golf club head 900 including a back portion 128, a front portion 930, a sole portion 908, a top line portion 106, and a striking face 910, as previously described. A leading edge 942 is defined by the midpoint of a radius connecting the face plane 925 and the sole portion 908. The club head includes a club head front-to-back depth, $D_{CH}$, which is the distance between two points projected onto the ground plane 911. A forward end 918 of the club head is defined as the intersection of the projection of the leading edge 942 onto the ground plane 911. A rearward end 919 of the club head is defined as the intersection of the projection of the rearward-most point of the club head (as viewed in the y-z plane) onto the ground plane 911. The distance between the forward end 918 and rearward end 919 of the club head is the club head depth $D_{CH}$.

In certain embodiments of iron type golf club heads having hollow construction, such as the embodiment shown in FIG. 11C, a recess 934 is located above the rear protrusion 938 in the back portion 928 of the club head. A back wall 932 encloses the entire back portion 928 of the club head to define an interior cavity 920. The interior cavity 920 may be completely or partially hollow, or it optionally may be filled with a filler material. In the embodiment shown in FIG. 11C, the interior cavity 920 includes a vibration dampening plug 921 that is retained between the rear surface 910*b* of the striking face and the inner surface 932*b* of the back wall. Suitable filler materials and details relating to the nature and materials comprising the plug 921 are described in US Patent Application Publication No. 2011/0028240, which is incorporated herein by reference in its entirety.

FIG. 11C further shows an optional ridge 936 extending across a portion of the outer back wall surface 932*a* forming an upper concavity and a lower concavity. An inner back wall surface 932*b* defines a portion of the cavity 920 and forms a thickness between the outer back wall surface 932*a* and the inner back wall surface 932*b*. In some embodiments, the back wall thickness varies between a thickness of about 0.5 mm to about 4 mm. A sole bar 935 is located in a low, rearward portion of the club head 900. The sole bar 935 has a relatively large thickness in relation to the striking plate and other portions of the club head 900, thereby accounting for a significant portion of the mass of the club head 900, and thereby shifting the center of gravity (CG) of the club head 900 relatively lower and rearward. A channel 950—described more fully below—is formed in the sole bar 935. Furthermore, the sole portion 908 has a forward portion 944 that is located immediately rearward of the striking face 910. In the embodiment shown in FIG. 11C, the forward portion 944 of the sole is a relatively thin-walled section of the sole that extends within a region between the channel 950 and the striking face 910.

Figure 11D:
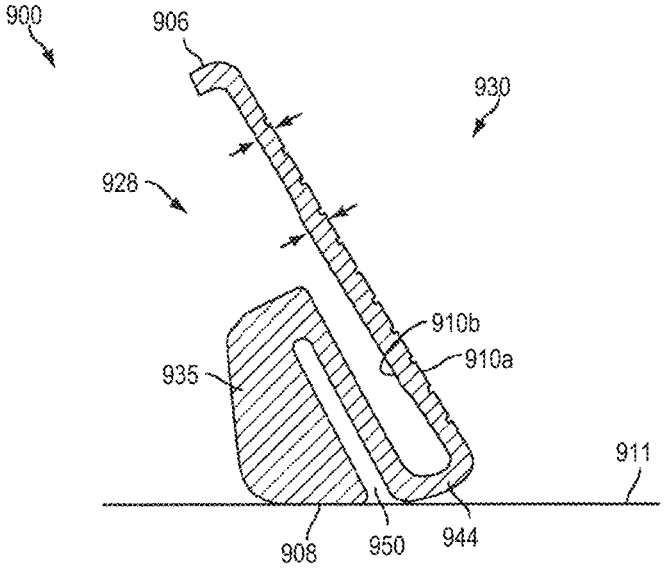
FIG. 11D is a cross-sectional view taken along section lines 11B-11B in FIG. 11A, showing an embodiment of a cavity back club head.

FIG. 11D further shows a sole bar 935 of the cavity back golf club head 900. The sole bar 935 has a relatively large thickness in relation to the striking plate and other portions of the golf club head 900, thereby accounting for a significant portion of the mass of the golf club head 900, and thereby shifting the center of gravity (CG) of the golf club head 900 relatively lower and rearward. The embodiment shown in FIG. 11D also includes a forward portion 944 of the sole that has a reduced sole thickness and that extends within between the sole bar 935 and the striking face 910. A channel 950—described more fully below—is located in a forward region of the sole bar 935.

Figure 11E:
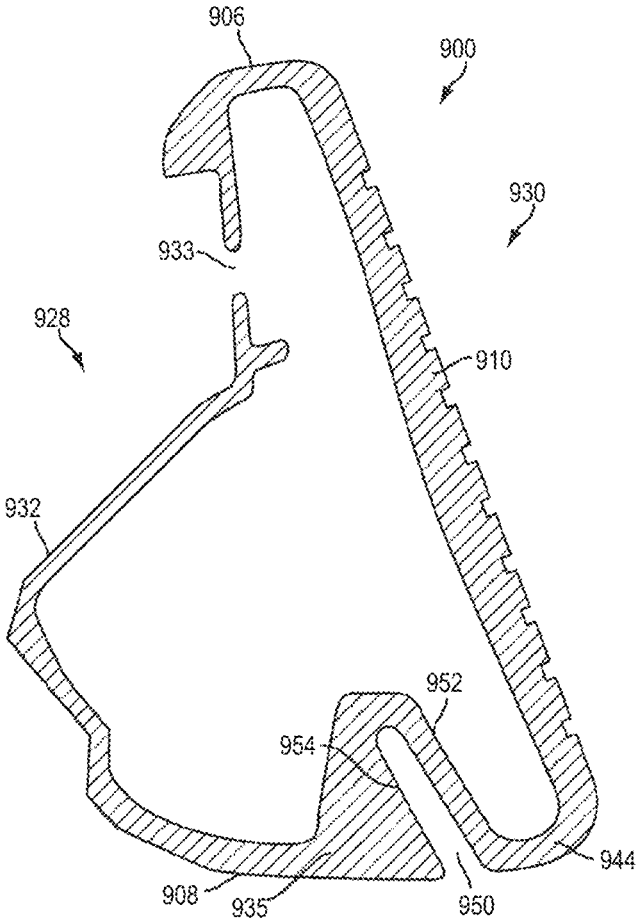
FIG. 11E is a cross-sectional view taken along section lines 11B-11B in FIG. 11A, showing another embodiment of a hollow club head.
Figure 11F:
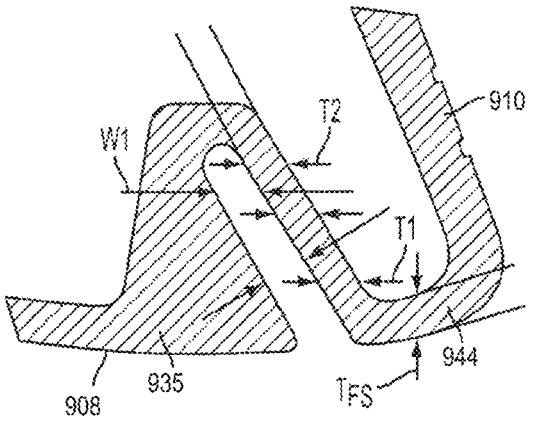
FIG. 11F is a cross-sectional view showing a portion of the embodiment of the hollow club head shown in FIG. 11E.

FIG. 11E shows another embodiment of a hollow iron club head 900 having a channel 950. As with the embodiment shown in FIG. 11C, the club head 900 includes a striking face 910, a top line 906, a sole 908, and a back wall 932. The sole includes a sole bar 935 having a channel 950 defined by a forward wall 952 and rear wall 954. A forward portion 944 of the sole is located between the striking face 910 and the forward wall 952 of the slot. The hollow club head 900 includes an aperture 933 that is suitable for installing a vibration dampening plug 921 like that shown in FIG. 11C, and which is described in more detail in US Patent Application Publication No. 2011/0028240, which is incorporated by reference in its entirety. Installation of the vibration dampening plug 921 effectively seals the aperture 933.

In some embodiments, the volume of the hollow iron club head 900 may be between about 10 cubic centimeters (cc) and about 120 cc. For example, in some embodiments, the hollow iron club head 900 may have a volume between about 20 cc and about 110 cc, such as between about 30 cc and about 100 cc, such as between about 40 cc and about 90 cc, such as between about 50 cc and about 80 cc, or such as between about 60 cc and about 80 cc. In some embodiments, the club head 900 may have a volume less than about 110 cc. In addition, in some embodiments, the hollow iron club head 900 has a club head depth, $D_{CH}$, that is between about 15 mm and about 100 mm. For example, in some embodiments, the hollow iron club head 900 may have a club head depth, $D_{CH}$, of between about 20 mm and about 90 mm, such as between about 30 mm and about 80 mm, such as between about 40 mm and about 70 mm, or such as between about 30 mm and 50 mm. In particular embodiments, the club head depth $D_{CH}$ may be between about 10 mm and about 50 mm.

In certain embodiments of the golf club head 900 that include a separate striking plate attached to the body 913 of the golf club head, the striking plate can be formed of forged maraging steel, maraging stainless steel, or precipitation-hardened (PH) stainless steel. In general, maraging steels have high strength, toughness, and malleability. Being low in carbon, they derive their strength from precipitation of inter-metallic substances other than carbon. The principle alloying element is nickel (15% to nearly 30%). Other alloying elements producing inter-metallic precipitates in these steels include cobalt, molybdenum, and titanium. In one embodiment, the maraging steel contains 18% nickel. Maraging stainless steels have less nickel than maraging steels but include significant chromium to inhibit rust. The chromium augments hardenability despite the reduced nickel content, which ensures the steel can transform to martensite when appropriately heat-treated. In another embodiment, a maraging stainless steel C455 is utilized as the striking plate. In other embodiments, the striking plate is a precipitation hardened stainless steel such as 17-4, 15-5, or 17-7.

The striking plate can be forged by hot press forging using any of the described materials in a progressive series of dies. After forging, the striking plate is subjected to heat-treatment. For example, 17-4 PH stainless steel forgings are heat treated by 1040° C. for 90 minutes and then solution quenched. In another example, C455 or C450 stainless steel forgings are solution heat-treated at 830° C. for 90 minutes and then quenched.

In some embodiments, the body 913 of the golf club head is made from 17-4 steel. However another material such as carbon steel (e.g., 1020, 1030, 8620, or 1040 carbon steel), chrome-molybdenum steel (e.g., 4140 Cr—Mo steel), Ni—Cr—Mo steel (e.g., 8620 Ni—Cr—Mo steel), austenitic stainless steel (e.g., 304, N50, or N60 stainless steel (e.g., 410 stainless steel) can be used.

In addition to those noted above, some examples of metals and metal alloys that can be used to form the components of the parts described include, without limitation: titanium alloys (e.g., 3-2.5, 6-4, SP700, 15-3-3-3, 10-2-3, or other alpha/near alpha, alpha-beta, and beta/near beta titanium alloys), aluminum/aluminum alloys (e.g., 3000 series alloys, 5000 series alloys, 6000 series alloys, such as 6061-T6, and 7000 series alloys, such as 7075), magnesium alloys, copper alloys, and nickel alloys.

In still other embodiments, the body 913 and/or striking plate of the golf club head are made from fiber-reinforced polymeric composite materials, and are not required to be homogeneous. Examples of composite materials and golf club components comprising composite materials are described in U.S. Patent Application Publication No. 2011/0275451, which is incorporated herein by reference in its entirety.

The body 913 of the golf club head can include various features such as weighting elements, cartridges, and/or inserts or applied bodies as used for CG placement, vibration control or damping, or acoustic control or damping. For example, U.S. Pat. No. 6,811,496, incorporated herein by reference in its entirety, discloses the attachment of mass altering pins or cartridge weighting elements.

After forming the striking plate and the body 913 of the golf club head, the striking plate 910 and body portion 913 contact surfaces can be finish-machined to ensure a good interface contact surface is provided prior to welding. In some embodiments, the contact surfaces are planar for ease of finish machining and engagement.

2. Iron Type Golf Club Heads Having a Flexible Boundary Structure

In some embodiments of the iron type golf club heads described herein, a flexible boundary structure ("FBS") is provided at one or more locations on the club head. The flexible boundary structure may comprise, in several embodiments, at least one slot, at least one channel, at least one gap, at least one thinned or weakened region, and/or at least one other structure that enhances the capability of an adjacent or related portion of the golf club head to flex or deflect and to thereby provide a desired improvement in the performance of the golf club head. For example, in several embodiments, the flexible boundary structure is located proximate the striking face of the golf club head in order to enhance the deflection of the striking face upon impact with a golf ball during a golf swing. The enhanced deflection of the striking face may result, for example, in an increase or in a desired decrease in the coefficient of restitution ("COR") of the golf club head. In other embodiments, the increased perimeter flexibility of the striking face may cause the striking face to deflect in a different location and/or different manner in comparison to the deflection that occurs upon striking a golf ball in the absence of the channel, slot, or other flexible boundary structure.

Turning to FIGS. 12A-12H, an embodiment of a cavity back golf club head 1000 having a flexible boundary structure is shown. In the embodiment, the flexible boundary structure is a channel 1050 that is located on the sole of the club head. It should be noted that, as described above, the flexible boundary structure may comprise a slot, a channel, a gap, a thinned or weakened region, or other structure. For clarity, however, the descriptions herein will be limited to embodiments containing a channel, such as the channel 1050 illustrated in FIGS. 12A-12H, or a slot, included in several embodiments described below, with it being understood that other flexible boundary structures may be used to achieve the benefits described herein.

Figure 12A:
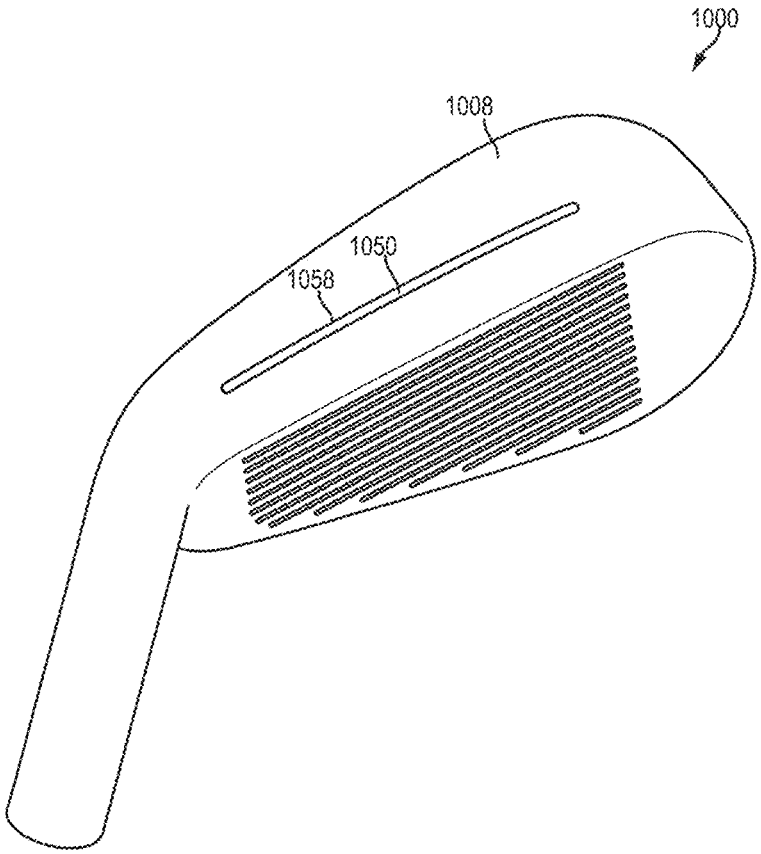
FIG. 12A is a bottom perspective view of an embodiment of a golf club head.
Figure 12B:
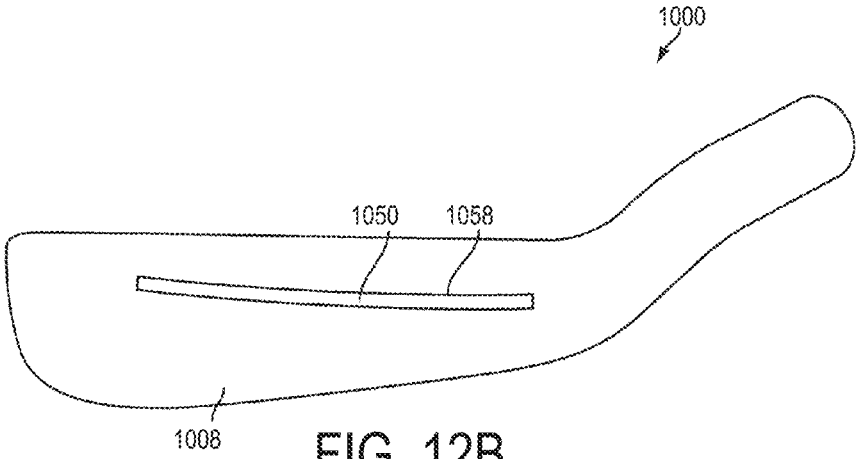
FIG. 12B is a bottom view of the sole of the golf club head shown in FIG. 12A.
Figure 12C:
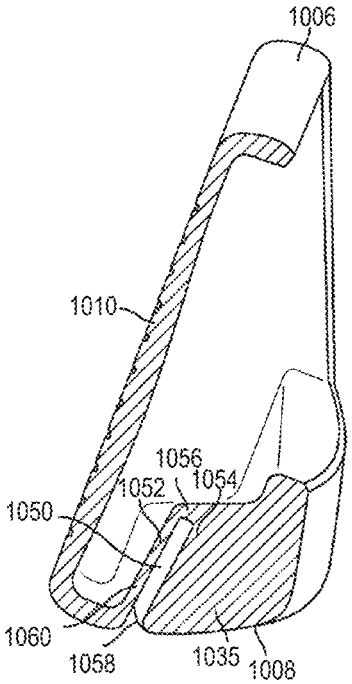
FIG. 12C is a cross-sectional view of the golf club head shown in FIG. 12A.
Figure 12D:
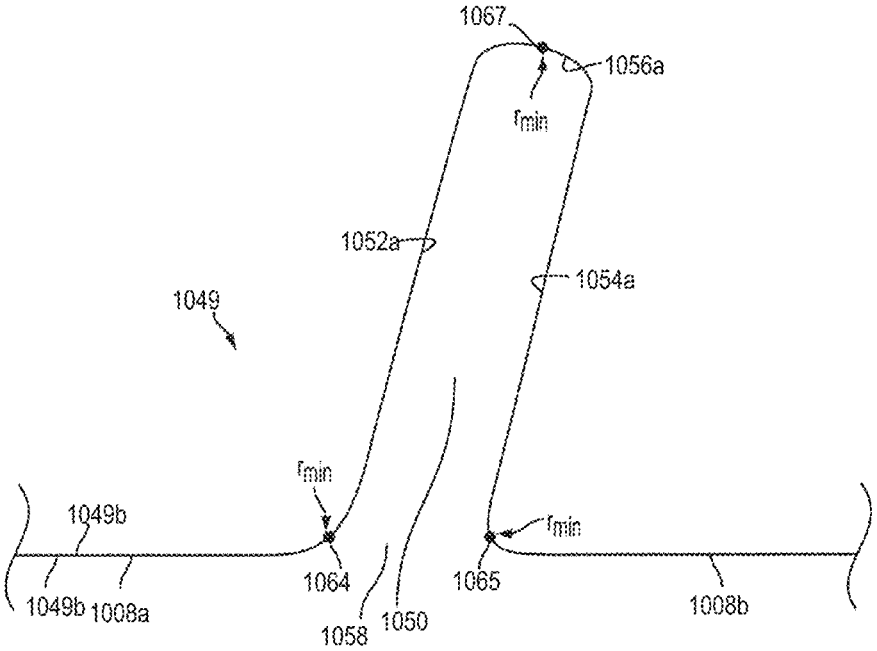
FIGS. 12D-E are schematic representations of a profile of the outer surface of a portion of a club head that surrounds and includes the region of a channel.
Figure 12E:
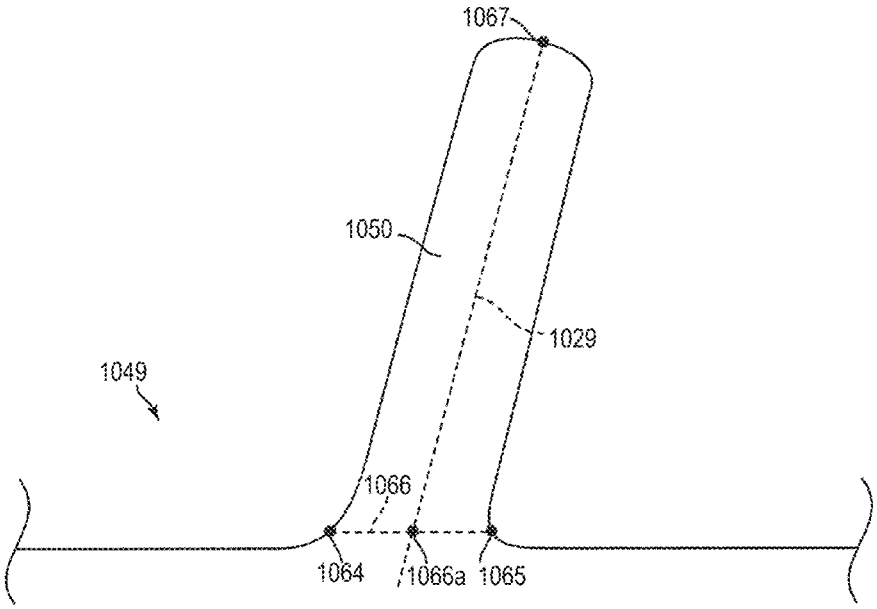
Figure 12F:
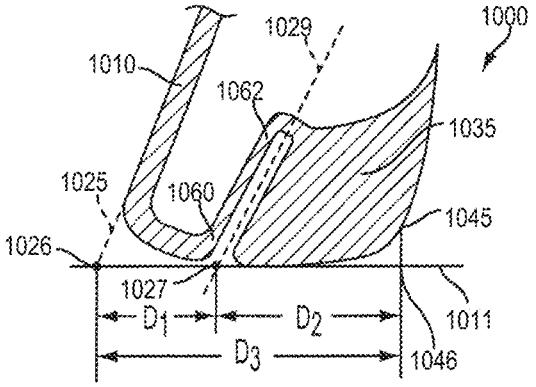
FIGS. 12F-H are cross-sectional views of a channel region of an embodiment of a golf club head.
Figure 12G:
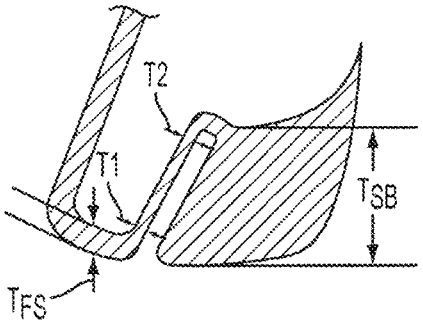
Figure 12H:
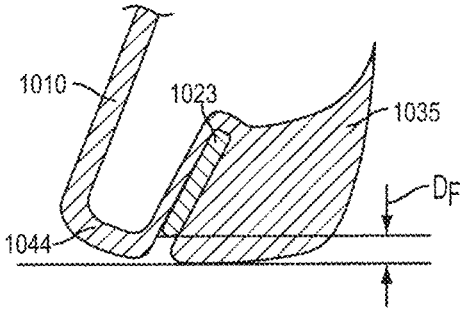
Figure 13:
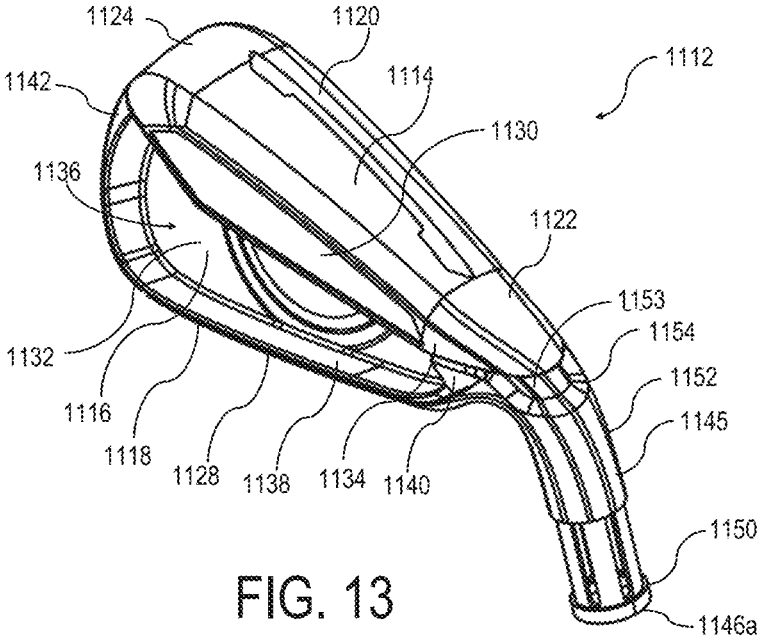
FIG. 13 is a perspective view of an iron type golf club head.
Figure 14:
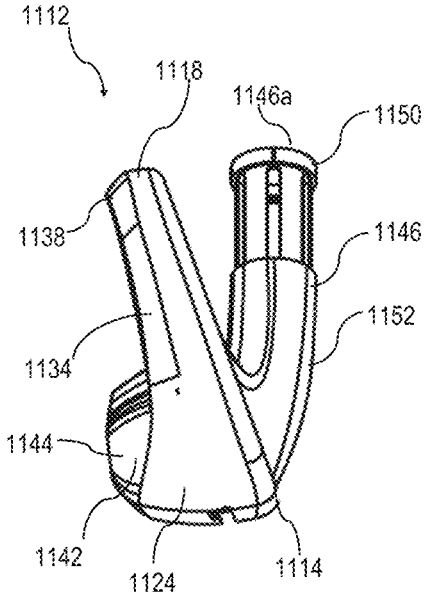
FIG. 14 is a toe end view of the golf club head of FIG. 13.
Figure 15:
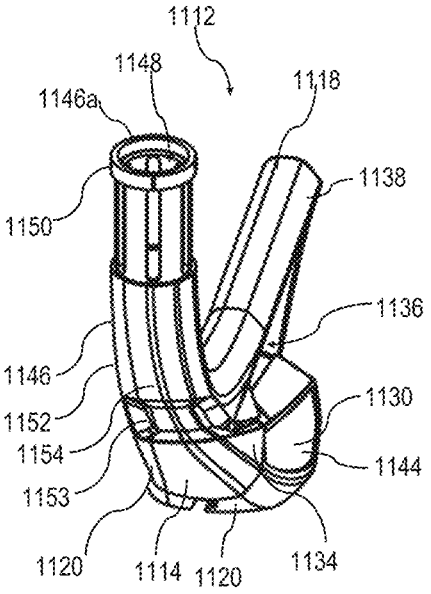
FIG. 15 is a heel end view of the golf club head of FIG. 13.
Figure 16:
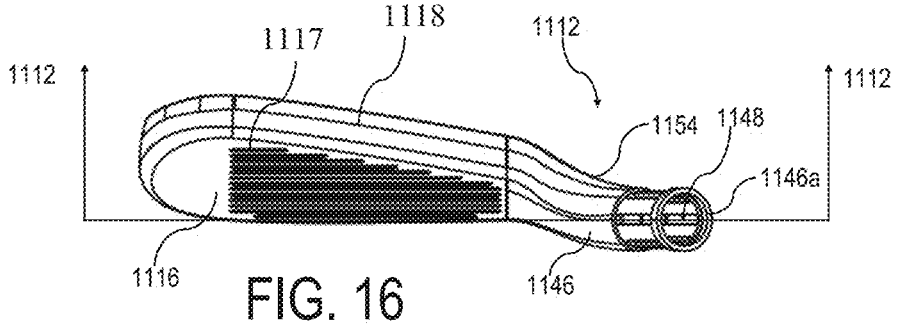
FIG. 16 is top view of the golf club head of FIG. 13.
Figure 17:
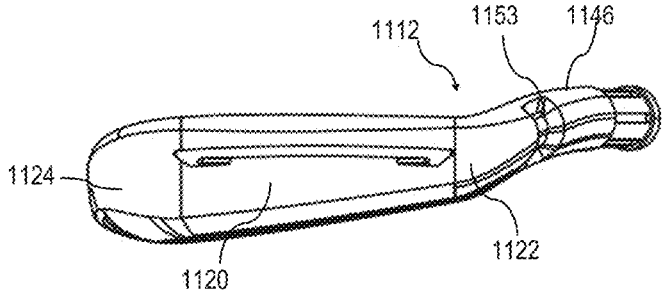
FIG. 17 is a bottom view of the golf club head of FIG. 13.

The channel 1050 extends over a region of the sole 1008 generally parallel to and spaced rearwardly from the striking face plane 1025 (FIG. 12F). The channel extends into and is defined by a forward portion of the sole bar 1035, defining a forward wall 1052, a rear wall 1054, and an upper wall 1056. A channel opening 1058 is defined on the sole portion 1008 of the club head. The forward wall 1052 further defines, in part, a first hinge region 1060 located at the transition from the forward portion of the sole 1044 (FIG. 12H) to the forward wall 1052, and a second hinge region 1062 (FIG. 12F) located at a transition from the upper region of the forward wall 1052 to the sole bar 1035. The first hinge region 1060 and second hinge region 1062 (FIG. 12F) are portions of the golf club head that contribute to the increased deflection of the striking face 1010 of the golf club head due to the presence of the channel 1050. In particular, the shape, size, and orientation of the first hinge region 1060 and second hinge region 1062 (FIG. 12F) are designed to allow these regions of the golf club head to flex under the load of a golf ball impact. The flexing of the first hinge region 1060 and second hinge region 1062 (FIG. 12F), in turn, creates additional deflection of the striking face 1010.

Several aspects of the size, shape, and orientation of the club head 1000 and channel 1050 are illustrated in the embodiment shown in FIGS. 12A-H. For example, for each cross-section of the club head defined within the y-z plane, the face to channel distance D1 is the distance measured on the ground plane 1011 between a face plane projection point 1026 and a channel centerline projection point 1027. (See FIG. 12F). The face plane projection point 1026 is defined as the intersection of a projection of the striking face plane 1025 onto the ground plane 1011. The channel centerline projection point 1027 is defined as the intersection of a projection of a channel centerline 1029 onto the ground plane 1011. The channel centerline 1029 is determined according to the following.

Referring to FIGS. 12D-E, a schematic profile 1049 of the outer surface of a portion of the club head 1000 that surrounds and includes the region of the channel 10050 is shown. The schematic profile has an interior side 1049*a* and an exterior side 1049*b*. A forward sole exterior surface 1008*a* extends on a forward side of the channel 1050, and a rearward sole exterior surface 1008*b* extends on a rearward side of the channel 1050. The channel has a forward wall exterior surface 1052*a*, a rear wall exterior surface 1054*a*, and an upper wall exterior surface 1056*a*. A forward channel entry point 1064 is defined as the midpoint of a curve having a local minimum radius ($r_{min}$, measured from the interior side 1049*a* of the schematic profile 1049) that is located between the forward sole exterior surface 1008*a* and the forward wall exterior surface 1052*a*. A rear channel entry point 1065 is defined as the midpoint of a curve having a local minimum radius ($r_{min}$, also measured from the interior side 1049*a* of the schematic profile 1049) that is located between the rearward sole exterior surface 1008*b* and the rear wall exterior surface 1054*a*.

An imaginary line 1066 that connects the forward channel entry point 1064 and the rear channel entry point 1065 defines the channel opening 1058. A midpoint 1066*a* of the imaginary line 1066 is one of two points that define the channel centerline 1029. The other point defining the channel centerline 1029 is an upper channel peak 1067, which is defined as the midpoint of a curve having a local minimum radius ($r_{min}$, as measured from the exterior side 1049*b* of the schematic profile 1049) that is located between the forward wall exterior surface 1052*a* and the rear wall exterior surface 1054*a*. In an embodiment having one or more flat segment (s) or flat surface(s) located at the upper end of the channel between the forward wall 1052 and rear wall 1054, the upper channel peak 1067 is defined as the midpoint of the flat segment(s) or flat surface(s).

Another aspect of the size, shape, and orientation of the club head 1000 and channel 1050 is the sole width. For example, for each cross-section of the club head defined within the y-z plane, the sole width, D3, is the distance measured on the ground plane 1011 between the face plane projection point 1026 and a trailing edge projection point 1046. (See FIG. 12F). The face plane projection point 1026 is defined above. The trailing edge projection point 1046 is the intersection with the ground plane 1011 of an imaginary vertical line passing through the trailing edge 1045 of the club head 1000. The trailing edge 1045 is defined as a midpoint of a radius or a point that constitutes a transition from the sole portion 1008 to the back wall 1032 or other structure on the back portion 1028 of the club head.

Still another aspect of the size, shape, and orientation of the club head 1000 and channel 1050 is the channel to rear distance, D2. For example, for each cross-section of the club head defined within the y-z plane, the channel to rear distance D2 is the distance measured on the ground plane 1011 between the channel centerline projection point 1027 and a vertical projection of the trailing edge 1045 onto the ground plane 1011. (See FIG. 12F). As a result, for each such cross-section, D1+D2=D3.

General Iron Information

Turning to FIGS. 13-22, an iron-type golf club head 1112 includes a club head body 1114 having a striking face 1116 with a plurality of scorelines 1117, a top line 1118 defining the upper limit of the striking face 1116, a sole portion 20 defining the lower limit of the striking face 1116, a heel portion 1122, a toe portion 1124 and a rear surface opposite the striking face 1116. The rear surface 1126 has a cavity back construction and includes an upper section 1128 adjacent the top line 1118, a lower section 1130 adjacent the sole portion 1120 and a middle section 1132 between the upper section 1128 and the lower section 1130.

As mentioned above, the iron-type golf club head 1112 has the general configuration of a cavity back club head and, consequently, the rear surface 1126 includes a flange 1134 extending rearwardly around the periphery of the club head body 1114. The rearwardly extending flange 1134 defines a cavity 1136 within the rear surface 1126 of the club head body 1114. The flange 1134 includes a top flange 1138 extending rearwardly along the top line 1118 of the club head body 1114 adjacent the upper section 1128. The top flange 1138 extends the length of the top line 1118 from the heel portion 1122 of the club head body 1114 to the toe portion 1124 of the club head body 1114. The club head body 1114 is further provided with rearwardly extending flanges 1140, 1142 along the heel portion 1122 (that is, a heel flange 1140) and the toe portion 1124 (that is, a toe flange 1142) of the club head body 1114. These rearwardly extending flanges 1138, 1140, 1142 extend through the upper section 1128, lower section 1130 and middle section 1132 of the rear surface 26 of the iron-type golf club head 1112. Additionally, the club head body 1114 is provided with a bottom flange 1144 extending along the sole portion 1120 of the club head body 1114.

The iron-type golf club head 1112 is preferably cast from suitable metal such as stainless steel. Although shown as a cavity-back iron, the iron-type golf club head 1112 could be a "muscle back" or a "hollow" iron-type club and may be any iron-type club head from a one-iron to a wedge.

The iron type golf club head 1112 further includes a hosel 1146. The hosel 1146 has a hosel top edge 1146*a*, a hosel bore 1148, a hosel outer diameter top 1150, and a hosel outer diameter bottom 1152 (if the hosel is tapered). The hosel bore 1148 includes a proximal end 1148*a* and a distal end 1148*b*. The proximal end 1148*a* of the hosel bore 1148 is proximate the hosel top edge 1146*a*. Proximate the distal end 1148*b* of the hosel bore 1148 is a weight cartridge port or simply a cartridge port 1149 (See FIG. 22). The cartridge port 1149 has a proximal end 1149*a* and a distal end 1149*b*. The hosel 1146 further includes a neck 1154 connected to the heel portion 1122 of the body 1114.

The hosel bore 1148 ranges from about 8-12 mm, such as about 9.0 mm to about 9.6 mm. The hosel outer diameter top 1150 ranges from about 12-15 mm, such as about 13.0 mm to about 13.6 mm. The hosel outer diameter bottom 1152 ranges from about 12-17 mm, such as about 13.0 mm to about 13.6 mm.

The cartridge port 1149 allows for addition of a weight adjustment member (not shown) having a shape and size similar to the cartridge port 1149, which may optionally be used to adjust the swing weight of the iron type golf club. This may help with overcoming manufacturing tolerances or adjusting the iron type club to a player's preferred swing weight. The weight adjustment member may be formed of metal or plastic. Since the weight adjustment member is located near the center of gravity of the iron type club head 1112, the club head center of gravity will not change significantly when selecting any of the plurality of weight adjustment members.

Figure 18:
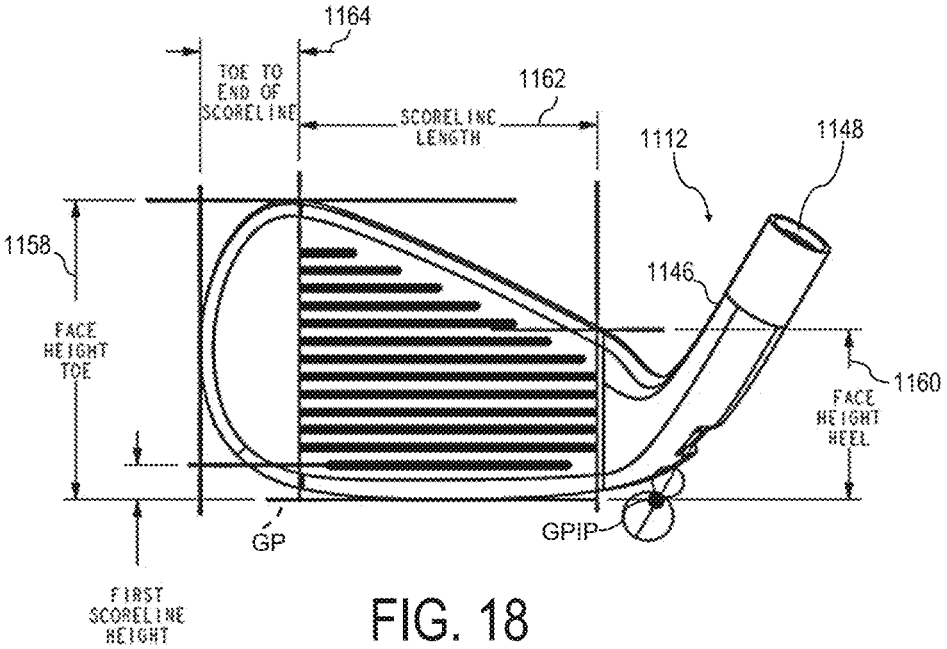
FIG. 18 is a front elevation view of the golf club head of FIG. 13.
Figure 19:
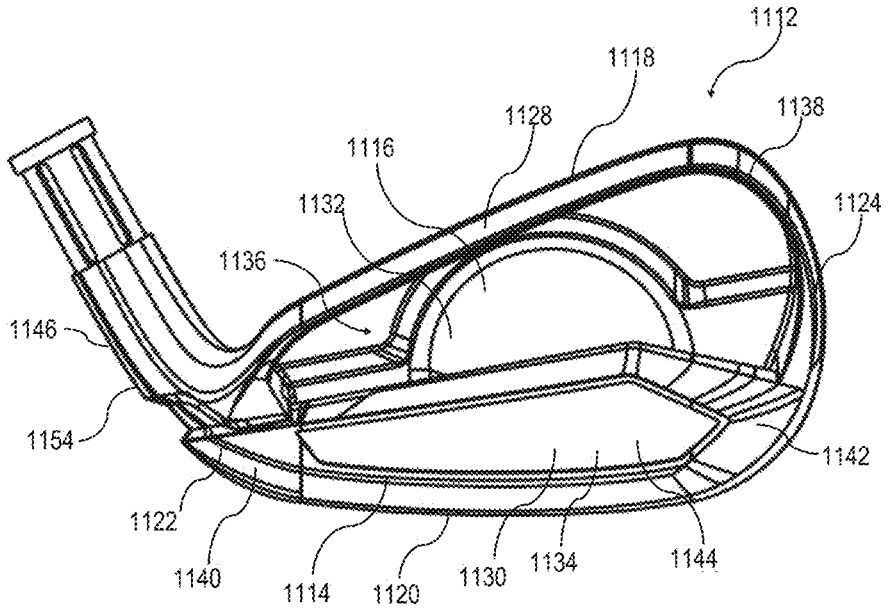
FIG. 19 is a rear elevation view of the golf club head of FIG. 13.
Figure 26A:
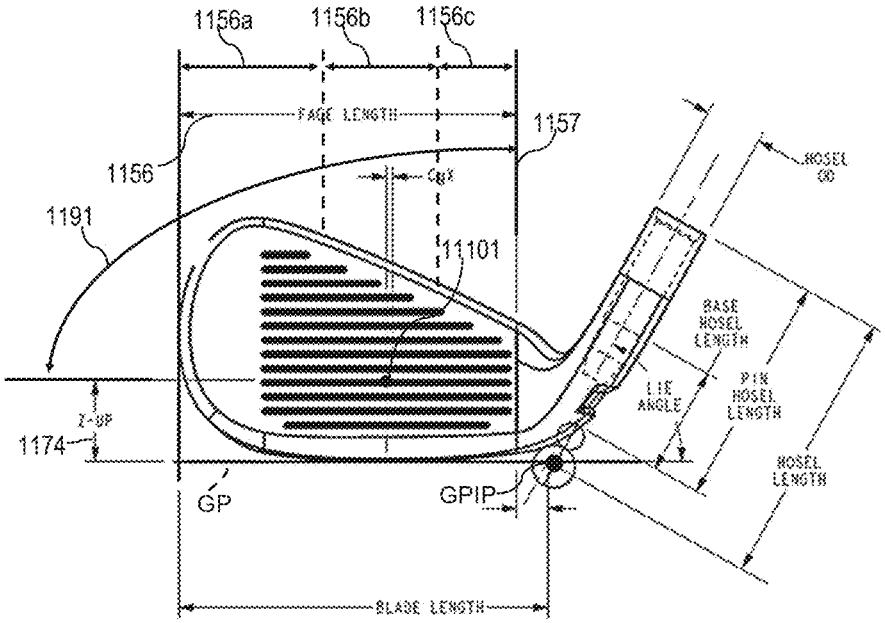
FIG. 26*a* is a front elevation view of one embodiment of an iron type golf club head embodying a lightweight topline design.

Turning to FIGS. 18 and 26*a*, iron type golf club head 1112 includes a face length 1156, a par line 1157, a toe face height 1158, a heel face height 1160, a scoreline length 1162, and a toe to end of scorelines length 1164. The par line 1157 is at the transition point between the flat striking face 1116 and the organically shaped region that attaches the club head body 1114 to the hosel 1146. The scorelines 1117 end just before the par line 1157. The face length 1156 extends from the par line 1157 to toe portion 1124 of the iron type golf club head 1112. As shown the toe face height 1158 and the heel face height 1160 sandwich the scorelines. Accordingly, the toe face height 1158 is measured proximate the scorelines 1117 near the toe portion 1124, and the heel face height 1160 is measured proximate the scorelines 1117 near the heel portion 1122. The toe face height 1158 is at least 40 mm, such as at least 45 mm, such as at least 50 mm, or such as at least 60 mm. The heel face height 1160 ranges from about 20-60 mm, such as about 25-45 mm, such as about 25-40 mm, or such as about 25-35 mm. The toe to end of scorelines length 1164 is the maximum distance measuring from the scorelines to the toe portion 1124, and the toe to end of scorelines length 1164 is at least 5 mm, such as at least 10 mm, or such as at least 15 mm. The scorelines length 1162 is the maximum length of the scorelines, and the scorelines length 1162 is at least 40 mm, such as at least 45 mm, such as at least 50 mm, or such as at least 60 mm.

Figure 20:
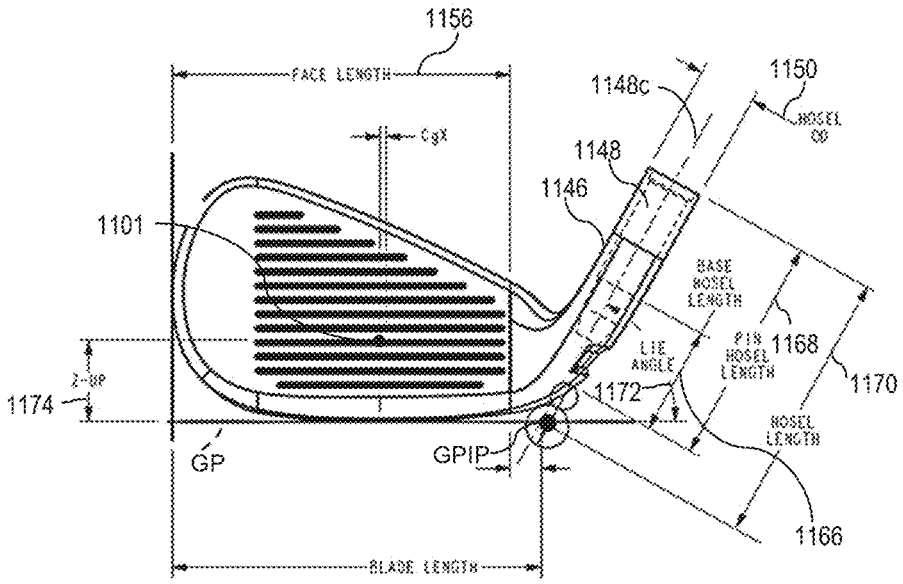
FIG. 20 is another front elevation view of the golf club head of FIG. 13.
Figure 21:
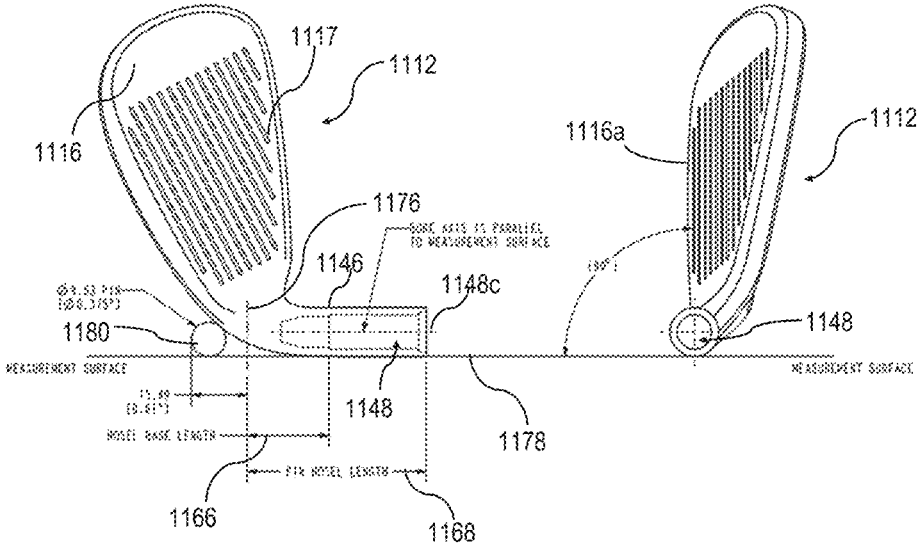
FIG. 21 is a front view demonstrating pin hosel and base hosel length measurements of the golf club head of FIG. 13.

Turning to FIGS. 20 and 21, iron type golf club head 1112 includes a base hosel length 1166, a pin hosel length 1168, a hosel length 1170, a lie angle 1172, and a Z-up 1174. In some embodiments, the hosel bore 1146 may be generally symmetric about a longitudinal hosel bore axis 1148 *c*. As shown, the hosel bore axis 1148*c* is at an angle relative to a ground plane (GP), and this angle is commonly referred to as a lie angle 1172 of the club head. The ground plane is the plane onto which the iron type golf club head 1112 may be properly soled i.e. arranged so that the sole portion 1120 is in contact with the GP. The intersection of the ground plane and the hosel bore axis 1148*c* creates a ground plane intersection point (GPIP) (See FIG. 22). The GPIP may be used to measure or reference features of the iron type golf club head 1112.

The hosel length 1170 is measured from the GPIP to hosel top edge 1146*a* along the hosel bore axis 1148*c*. A hosel bore length 1148*d* is measured from the hosel top edge 1146*a* along the hosel bore axis 1148*c* to the hosel bore distal end 1148*b*. For reference and as shown in FIG. 21, a hosel measurement datum 1176 is used for making the base hosel length and the pin hosel length measurements 1166, 1168. The hosel measurement datum 1176 is created by first placing the iron type golf club head 1112 on a generally planar measurement surface 1178, second the hosel bore axis 1148 *c* is aligned parallel to the measurement surface 1178 and the heel portion 1122 of the iron type golf club head 1112 is pressed against a pin 1180 having a 0.375 inch diameter, next the hosel measurement datum 1176 is created perpendicular to the measurement surface and offset 15.49 mm from a plane tangent to a distal end of the pin and perpendicular to the measurement surface. Additionally, as shown a leading edge 1116*a* of the striking face 1116 is aligned at 90 degrees relative to the measurement surface 1178.

The base hosel length 1166 is measured parallel to the measurement surface from the hosel measurement datum 1176 to the distal end 1148*b* of the hosel bore 1148. The pin hosel length 1168 is measured parallel to the measurement surface 1178 from the hosel measurement datum 1176 to the hosel top edge 1146*a*. Generally, the hosel bore axis 1148*c* passes through the center of the hosel. The hosel bore axis can be found by inserting a cylindrically shaped pin or dowel having a diameter substantially similar to the hosel bore in the hosel bore. The axis of the pin or dowel should be substantially aligned with the hosel bore axis. If the hosel bore is tapered then the pin or dowel should have a substantially similar taper to determine the hosel bore axis. Another method of determining the hosel bore axis would be to measure the diameter of the hosel bore at two or more locations along the hosel bore and then construct an axis through the center points of the two or more diameters measured.

The base hosel length 1166 is at least 15 mm, such as at least 20 mm, such as at least 25 mm, such as at least 30 mm, or such as at least 35 mm. Typically in a lower lofted iron (e.g. 17 degrees to 48 degrees) the base hosel length may range from about 20 mm to about 30 mm. For wedges 50 degrees and greater, such as gap wedge, sand wedge, and lob wedge, the base hosel length is generally at least 40 mm.

The pin hosel length 1168 is at least 40 mm, such as at least 45 mm, such as at least 50 mm, such as at least 55 mm, such as at least 60 mm, such as at least 65 mm, such as at least 70 mm, or such as at least 75 mm. Although, this measurement may vary, generally the pin hosel length will be about 23 mm to about 33 mm greater than the base hosel length, or preferably about 25 mm to about 28 mm. Typically in a lower lofted iron e.g. 17 degrees to 48 degrees the pin hosel length may range from about 45 mm to about 60 mm, or preferably about 50 mm to about 60 mm. For wedges 50 degrees and greater, such as gap wedge, sand wedge, and lob wedge, the base hosel length is generally at least 40 mm.

The hosel length 1170 is at least 40 mm, such as at least 45 mm, such as at least 50 mm, such as at least 55 mm, such as at least 60 mm, such as at least 65 mm, such as at least 70 mm, such as at least 75 mm, such as at least 80 mm, such as at least 85 mm, such as at least 90 mm, or such as at least 95 mm.

The portion of the shaft that bonds to the hosel bore of the iron type golf club head is referred to as the bond length. In many instances, the bond length is the same as the hosel bore length 1148*d*, however in some instances there is a difference of about 1 mm to about 4 mm between the bond length and the hosel bore length. This is because a ferrule may be used that snaps into the hosel bore, which requires about 1 mm to about 4 mm for engagement. The bond length is generally about 20 mm to about 35 mm, preferably about 25 mm to about 30 mm. The bond length may also be approximated by finding the difference between the pin hosel length 1168 and the base hosel length 1166, which is typically between about 25 mm to about 30 mm.

Light Weight Iron-Type Hosel Construction

Figure 22:
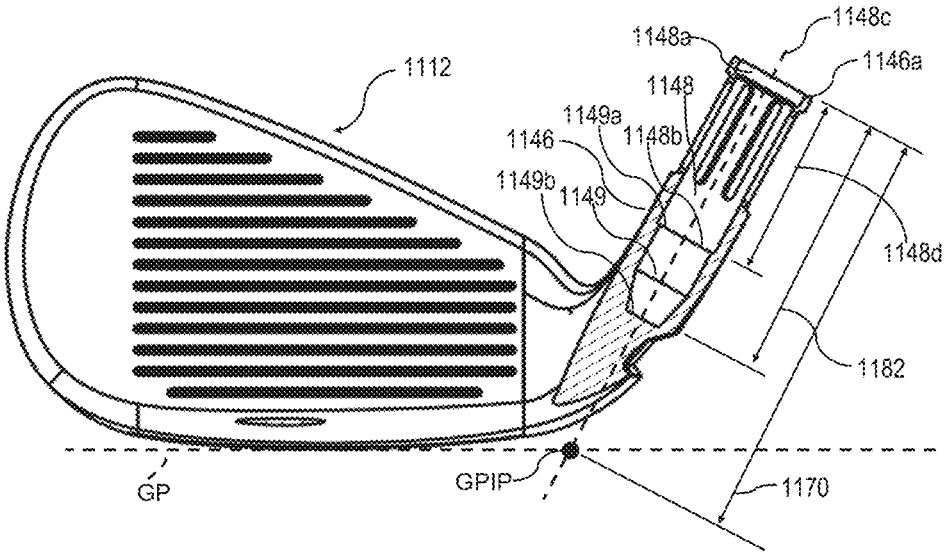
FIG. 22 is another front elevation view showing a section of the golf club head of FIG. 13.

Turning attention to FIGS. 23-25, several designs are shown for achieving a lighter weight hosel by employing a weight reducing feature over a hosel weight reduction zone 1182. As shown in FIG. 22, the hosel weight reduction zone 1182 extends from about the hosel top edge 1146*a* to about the cartridge port distal end 1149*b*. Each of weight reducing designs maintains a "traditional" length hosel for bending while offering a savings from about 1 g to about 4 g in the hosel area, and provides a downward CG-Z shift of at least 0.4 mm to at least 1.2 mm. This large downward CG-Z shift is the result of mass being removed from locations far from the club head CG and repositioned to a position at or below the club head CG, such as, for example, the sole of the club. Furthermore, the additional structural material removed from the hosel can be relocated to another location on the club, such as the toe portion of the club, to provide a lower center of gravity, increased moments of inertia, or other properties that result in enhanced ball striking performance for the club head.

The weight reducing designs generally have a hosel outside diameter ranging from about 11.6 mm to about 13.6 mm. Several of the designs selectively thin portions of the hosel resulting in a third outside diameter or a hosel outer diameter 51. Additionally, several of the designs offset the weight reducing feature from the hosel top edge 1146*a* by a hosel offset distance 83 ranging from about 1 mm to about 4 mm. The hosel bore 1148 diameter ranges from about 9.0 mm to about 9.6 mm. As a result, a hosel wall thickness 1184 ranges from of about 1.0 mm to about 2.3 mm. The hosel weight reduction zone 1182 extends from about 10 mm to about 30 mm. However, the hosel weight reduction zone 1182 pattern may extend further or less depending on the hosel length and desire to adjust the weight savings. For example, a club with a longer hosel length, such as a sand wedge, the pattern may extend about 20 mm to about 50 mm.

Figure 23A:
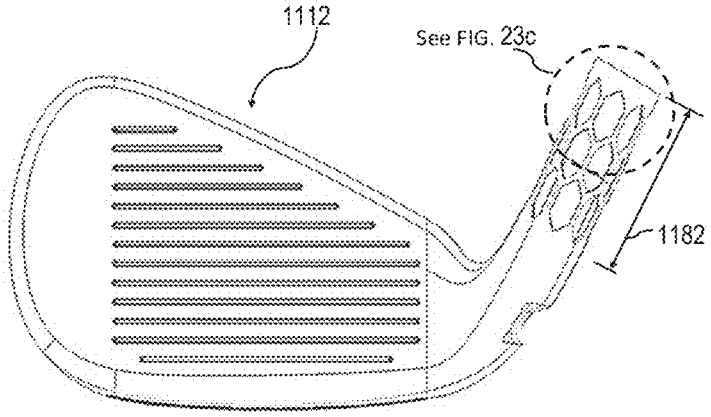
FIG. 23*a* is front elevation view of an iron type golf club head embodying another lightweight hosel design.
Figure 23B:
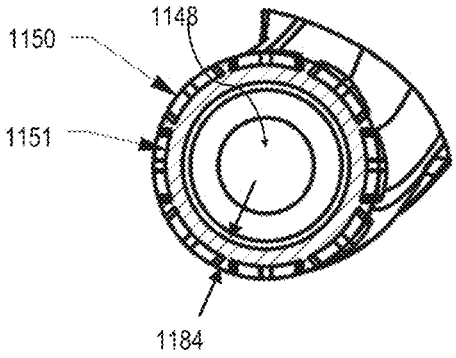
FIG. 23*b* is top elevation detail view of the golf club head of FIG. 23*a*.
Figure 23C:
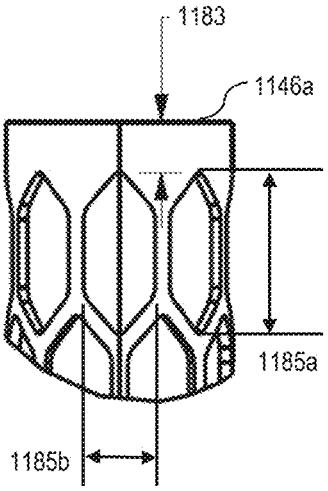
FIG. 23*c* is front elevation detail view of the golf club head of FIG. 23*a*.

As shown in FIGS. 23*a-c* the design uses a weight reducing feature that has a honeycomb-like pattern to selectively reduce the wall thickness around the hosel. The honeycomb-like pattern is an efficient way of removing mass from the hosel wall thickness. The honeycomb design removes at least 1 g, such as at least 2 g, such as at least 3 g, such as at least 4 g of mass from the hosel. In the design shown, about 4 g was removed from the hosel and reallocated to a lower point on the club head resulting in a downward Zup shift of about 0.6 mm while maintaining the same overall head weight.

FIGS. 23*b*-23*c* are detail views of the honeycomb design. Specifically, FIG. 23*b* is a top detail view of the design shown in FIG. 23*a* showing the hosel bore 1148, the hosel outer diameter 1150, hosel outer diameter 1151, and the hosel wall thickness 1184. FIG. 23*c* is a detail view of the honeycomb pattern showing the hosel offset distance 1183, a honeycomb height 1185*a* and a honeycomb width 1185*b* of the individual honeycomb-like features. As shown, there are three rows of honeycomb-like features that encircle the hosel. More or less rows may be used, and the height 1185*a* and width 1185*b* may be varied. The honeycomb height 85*a* may range from about 2 mm to about 30 mm and the width 1185*b* may range from about 1 mm to about 42 mm. The honeycomb pattern extends from about 10 mm to about 30 mm. However, the honeycomb pattern may extend further or less depending on the hosel length and desire to adjust the weight savings. Additionally and/or alternatively, the honeycomb-like pattern may take on other geometric shapes, such as, for example, a triangle, square, pentagon, hexagon, octagon, or a circle, and/or a combination of shapes.

Figure 24A:
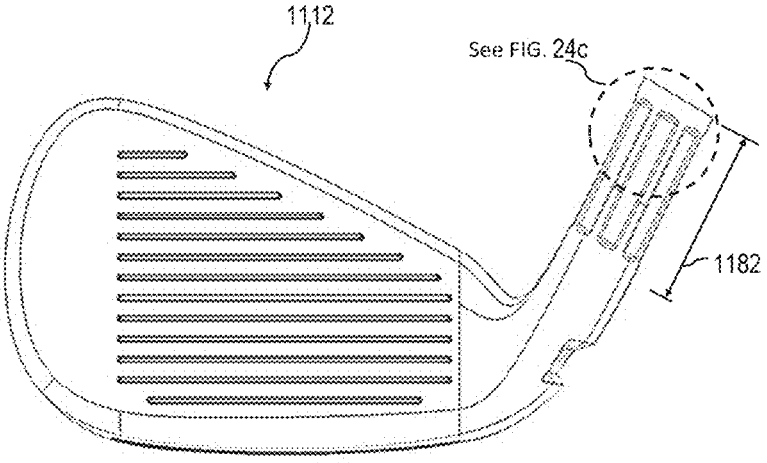
FIG. 24*a* is front elevation view of an iron type golf club head embodying another lightweight hosel design.
Figure 24B:
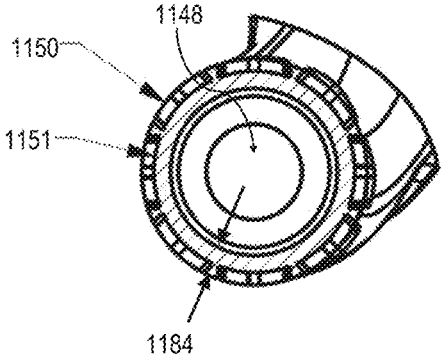
FIG. 24*b* is top elevation detail view of the golf club head of FIG. 24*a*.
Figure 24C:
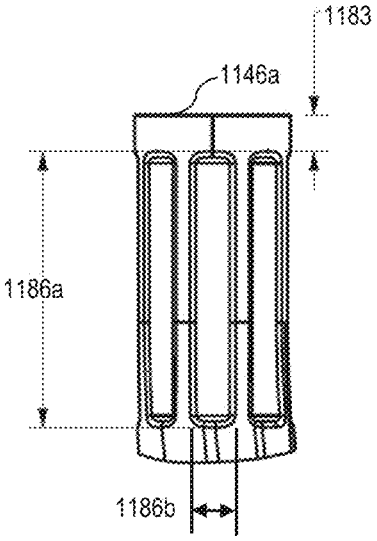
FIG. 24*c* is front elevation detail view of the golf club head of FIG. 24*a*.

Turning to FIGS. 24*a-c*, an alternative weight reducing feature is shown for removing hosel material. This design is a variation on the honeycomb pattern design. Similarly, this design selectively removes material from the hosel creating flutes around the hosel perimeter and along the longitudinal axis of the hosel. The flutes allow for a mass savings of at least 1 g, such as at least 2 g, such as at least 3 g, such as at least 4 g. The design may incorporate multiple flutes, such as 2 or more flutes, such as 3 or more flutes, such as 4 or more flutes, such as 5 or more flutes, such as 6 or more flutes, such as 7 or more flutes, such as 8 or more flutes. The flute design and number of flutes has a direct effect on the amount of mass savings.

In the design shown in FIGS. 24*a* and 24*c*, eight flutes are used to remove about 3 g from the hosel. The 3 g mass savings was reallocated to a lower point on the club head resulting in a downward Zup shift of about 0.6 mm while maintaining the same overall head weight. Accordingly, this fluted design removes about 1 g less material compared to the honeycomb design, but results in the same Zup shift as the honeycomb design. This is because material removed from points relatively far from the CG have a greater impact on Zup.

FIGS. 24*b*-24*c* are detail views of the flute design. Specifically, FIG. 24*b* is a top detail view of the design shown in FIG. 24*a* showing the hosel bore 1148, the hosel outer diameter 1150, hosel outer diameter 1151, and the hosel wall thickness 1184. FIG. 24*c* is a detail view of the flute pattern showing the hosel offset distance 1183, a flute height 1186*a* and a flute width 1186*b* of the individual flute features. As shown, there is a single row of flute features that encircle the hosel. More rows may be used, and the height 1186*a* and width 1186*b* may be varied. The flute height 1186*a* may range from about 2 mm to about 30 mm and the width 1186*b* may range from about 1 mm to about 42 mm. The flute pattern extends from about 10 mm to about 30 mm. However, the flute pattern may extend further or less depending on the hosel length and desire to adjust the weight savings.

The flute design selectively reduces the hosel wall thickness by varying the outer hosel wall diameter. The outer hosel wall diameter ranges from about 11.6 mm to about 13.6 mm. The flute design like the honeycomb design is offset from hosel top edge 1146*a* by about 2 mm to about 4 mm. The hosel bore diameter ranges from about 9.0 mm to about 9.6 mm resulting in a hosel wall thickness ranging from about 1.0 mm to about 2.3 mm. The flute pattern may have a length along the longitudinal axis of the hosel ranging from about 10 mm to about 30 mm. The pattern may extend further or less along the longitudinal axis of the hosel to adjust the weight savings. For example, a club with a longer hosel length, such as a sand wedge, the pattern may extend about 20 mm to about 50 mm.

The flute design may be angled relative to longitudinal axis of the hosel or it may be aligned with the longitudinal axis of the hose. The flute widths and flute heights may all be the same or vary along the hosel depending on the desired weight savings. The flute width is the horizontal distance measured from a first flute edge to a second flute edge, and the flute width is at least 1 mm and may range from about 1 mm to about 20 mm, preferably about 3 mm to about 5 mm. The flute length is the vertical distance measured from a top of the flute to a bottom of the flute, and the flute length is at least 4 mm and may range from about 5 mm to about 50 mm, such as about 10 mm to about 35 mm, or such as about 15 mm to about 25 mm. Alternatively, a pattern of flutes having smaller flute lengths may be used instead of long flutes. For example, two or more flutes may be stacked on top of one another to create a flute pattern similar to the honeycomb pattern discussed above.

Turning to FIGS. 25*a-d*, an alternative weight reducing feature is shown for removing hosel material Like the previous design, this design selectively removes material from the hosel by creating thru-slots around the hosel perimeter and along the longitudinal axis of the hosel. The thru-slots allow for a mass savings of at least 1 g, such as at least 2 g, such as at least 3 g, or such as at least 4 g. The design may incorporate multiple thru-slots, such as 2 or more thru-slots, such as 3 or more thru-slots, such as 4 or more thru-slots, such as 5 or more thru-slots, such as 6 or more thru-slots, such as 7 or more thru-slots, or such as 8 or more thru-slots. The thru-slots design and number of thru-slots has a direct effect on the amount of mass savings.

In the design shown in FIGS. 25*a-d*, six thru-slots are used to remove about 2 g from the hosel. The 2 g mass savings was reallocated to a lower point on the club head resulting in a downward Zup shift of about 0.7 mm while maintaining the same overall head weight. Accordingly, the thru-slot design removed about 2 g less material compared to the honeycomb design, and resulted in an improved Zup shift over the honeycomb design.

Figure 25A:
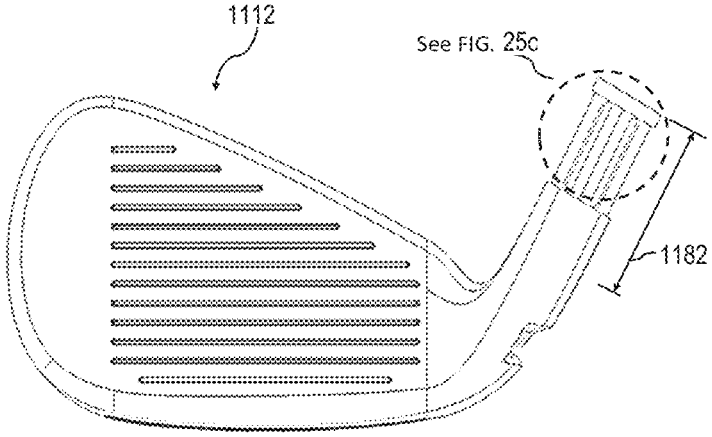
FIG. 25*a* is front elevation view of an iron type golf club head embodying another lightweight hosel design.
Figure 25B:
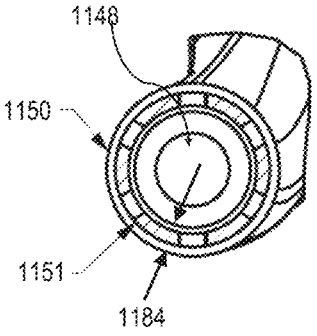
FIG. 25*b* is top elevation detail view of the golf club head of FIG. 25*a*.
Figure 25C:
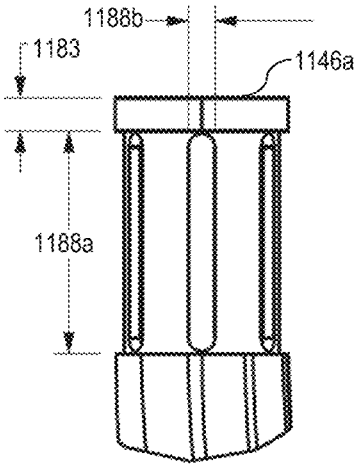
FIG. 25*c* is front elevation detail view of the golf club head of FIG. 25*a*.

FIGS. 25*b*-25*c* are detail views of the slot design. Specifically, FIG. 25*b* is a top detail view of the design shown in FIG. 25*a* showing the hosel bore 1148, the hosel outer diameter 1150, hosel diameter 1151, and the hosel wall thickness 1184. FIG. 25*c* is a detail view of the slot pattern showing the hosel offset distance 1183, a slot height 88*a* and a slot width 1188*b* of the individual slot features. As shown, there is a single row of slot features that encircle the hosel. More rows may be used, and the height 88*a* and width 1188*b* may be varied. The slot height 1188*a* may range from about 2 mm to about 30 mm and the width 1188*b* may range from about 1 mm to about 42 mm. The slot pattern extends from about 10 mm to about 30 mm. However, the slot pattern may extend further or less depending on the hosel length and desire to adjust the weight savings.

The thru-slot design selectively reduces the hosel wall thickness around the perimeter of the hosel. As shown in FIG. 25*c*, the slot pattern is offset from the hosel top edge 1146*a* by about 2 mm to about 5 mm. Where the slot pattern begins, the hosel diameter reduces to about 11.6 mm and continues to be reduced over the hosel weight reduction zone 1182.

Figure 25D:
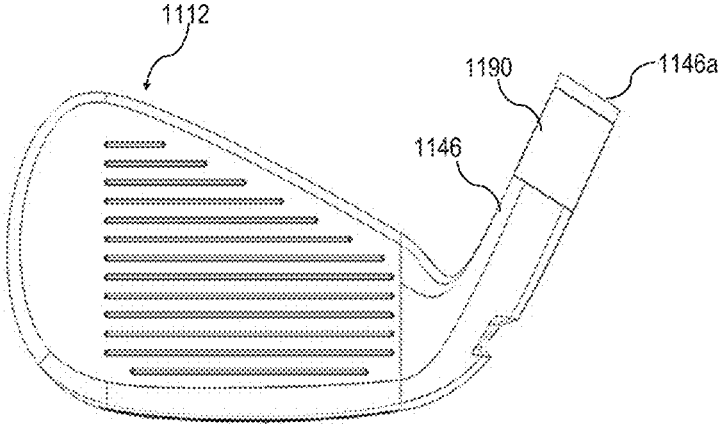
FIG. 25*d* is a front elevation view of an iron type golf club head embodying another lightweight hosel design.

Turning to FIG. 25*d*, the thru-slot design includes a sleeve 90 to cover the slots. The sleeve helps prevent the adhesive used to secure the golf club shaft to the iron type golf club from flowing out of the slots. Additionally, the sleeve helps maintain a traditional hosel outer diameter of about 13.0 mm to about 13.6 mm, which helps accommodate traditional bending tools. Without the sleeve, the bond of the shaft to the iron-type golf club head may be insufficient to withstand repeated use, and bending tools would cause greater stress on the hosel due to the slop. The sleeve is made of plastic, but may be made of any material preferably having a density less than the material being removed.

The slot design selectively reduces the hosel wall thickness by varying the outer hosel wall diameter. The outer hosel wall diameter ranges from about 11.6 mm to about 13.6 mm. The slot design like the honeycomb design is offset from hosel top edge 1146*a* by about 2 mm to about 4 mm. The hosel bore diameter ranges from about 9.0 mm to about 9.6 mm resulting in a hosel wall thickness ranging from about 1.0 mm to about 2.3 mm. The slot pattern may have a length along the longitudinal axis of the hosel ranging from about 10 mm to about 30 mm. The pattern may extend further or less along the longitudinal axis of the hosel to adjust the weight savings. For example, for a club with a longer hosel length, such as a sand wedge, the pattern may extend about 20 mm to about 50 mm.

The slot design may be angled relative to longitudinal axis of the hosel or it may be aligned with the longitudinal axis of the hose. Additionally, each slot has a slot width and a slot length. The slot widths and slot lengths may all be the same or vary along the hosel depending on weight savings. The slot width is the horizontal distance measured from a first slot edge to a second slot edge, and the slot width is at least 1 mm and may range from about 1 mm to about 8 mm, preferably about 3 mm to about 5 mm. The slot length is the vertical distance measured from a top of the slot to a bottom of the slot, and the slot length is at least 5 mm and may range from about 5 mm to about 50 mm, such as about 10 mm to about 35 mm, such as about 15 mm to about 25 mm. Alternatively, a pattern of slots having smaller slot heights or widths may be used instead of long slots. For example, two or more slots may be stacked on top of one another to create a slot pattern.

For each of the above designs, by increasing the depth, width, and/or length of the weight reducing features even more mass savings may be had due to more material being removed. However, it is most beneficial to remove material that is furthest away from the club head CG because this has the most substantial effect on shifting Z-up downward. As discussed above, a lower Z-up promotes a higher launch and allows for increased ball speed depending on impact location.

By using the weight reducing features discussed above, a mass of at least 2 g to at least 4 g may be removed from the hosel and positioned elsewhere on the club to promote better ball speed. For a club that does not include the weight reducing features discussed above the mass of the hosel in the bond length region is about 12.7 g to about 13.0 g. Where the bond length region is about 25.4 mm plus about 2.5 mm of offset from the hosel top edge, or about 28 mm. By employing the weight reducing features, a traditional length hosel can be maintained while reducing the overall mass of the hosel. Over approximately 28 mm of hosel length the hosel mass can be reduced to less than about 11.0 g, such as less than about 10.5 g, such as less than about 10.0 g, such as less than about 9.5 g, such as less than about 9.0 g, such as less than about 8.7 g.

Similarly, by employing the weight reducing features the mass per unit length of the hosel can be reduced compared to a club without the weight reducing features. A club without the weight reducing features discussed above has a mass per unit length of about 0.454 g/mm, whereas a club employing the weight reducing features discussed above has a mass per unit length of less than about 0.40 g/mm, such as less than about 0.35 g/mm, such as less than about 0.30 g/mm, or such as less than about 0.26 g/mm. The weight reducing features may be applied over a hosel length of at least 10 mm, such as at least 15 mm, at least 20 mm, at least 25 mm, at least 30 mm, at least 35 mm, or at least 40 mm.

As discussed above, the iron type golf club head has a certain CG location. The CG location can be measured relative to the x, y, and z-axes. An additional measurement may be taken referred to as Z-up. The Z-up measurement is the vertical distance to the club head CG taken relative to the ground plane when the club head is soled and in the normal address position. It is important to understand that the hosel is a large chunk of mass that greatly impacts the CG location of the club head. Accordingly, removing mass from the hosel and repositioning the mass at or below the CG, such as, the sole of the club, can significantly impact the CG location of the club head. For example, by employing the weight reducing features, the Z-up shifted downward at least 0.5 mm and in some instances at least 1.5 mm. This Z-up shift was accomplished while maintaining a traditional hosel length and hosel diameter.

Light Weight Topline Construction

Turning attention to FIGS. 26-30, several designs are shown for achieving a lighter weight topline by employing a weight reducing feature over a topline weight reduction zone 1191. As shown in FIG. 26*a*, the topline weight reduction zone 1191 extends over the entire face length 1156 from the par line 1157 to the toe portion 1124 ending at approximately the Z-up location of the iron type golf club head 1112. However, the topline weight reduction zone 1191 may be made into smaller zones, such as, for example, two, three, or four different zones. As shown in FIG. 26*a*, the face length 1156 is broken into three zones, a first zone 1156*a*, a second zone 1156*b*, and a third zone 1156*c*. The zones may be equal in length or of variable length. The first zone 1156*a* will have the most drastic impact on shifting Z-up because it is furthest from the CG, but it will not have a substantial impact on shifting the CG-x towards the toe. The third zone 1156*c* will have the least impact on shifting Z-up, but mass removed from the third zone 1156*c* may be used to shift CG-x towards the toe. The middle zone may be used to shift both Z-up and CG-x, but will have a lesser impact on Z-up than first zone 1156*a* and a lesser impact on CG-x than third zone 1156*c* because the mass located in this zone is already near the Z-up location and the CG-x location.

Each of weight reducing designs maintains a "traditional" face height for maintain a traditional profile while offering a savings from about 2 g to about 18 g in the topline weight reduction zone 1191, and provides a downward CG-Z shift of at least 0.4 mm to at least 2.0 mm. This large downward CG-Z shift is the result of mass being removed from locations away from the club head CG and repositioned to a position at or below the club head CG, such as, for example, the sole of the club. Furthermore, the additional structural material removed from the hosel can be relocated to another location on the club, such as the toe portion of the club, to provide a lower center of gravity, increased moments of inertia, or other properties that result in enhanced ball striking performance for the club head.

The weight reducing designs generally have a topline thickness ranging from about 3 mm to about 12 mm. Several of the designs selectively thin portions of the topline resulting in a thinner topline. As a result, a topline wall thickness ranges from of about 1.0 mm to about 8 mm. The topline weight reduction zone 1191 extends from about 10 mm to about 80 mm. However, the topline weight reduction zone 91 may extend further or less depending on the face length and desire to adjust the weight savings. For example, a club with a longer face length may have a larger weight reduction zone.

Figure 26B:
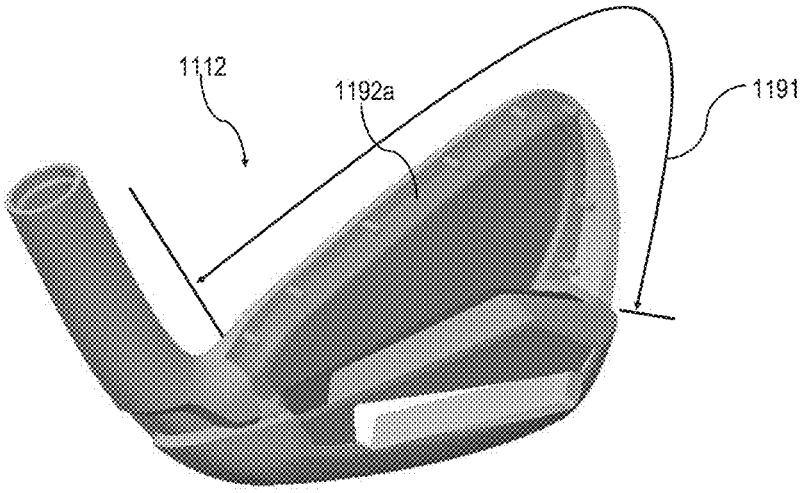
FIG. 26*b* is a rear perspective view of the golf club head of FIG. 23*a*.
Figure 26C:
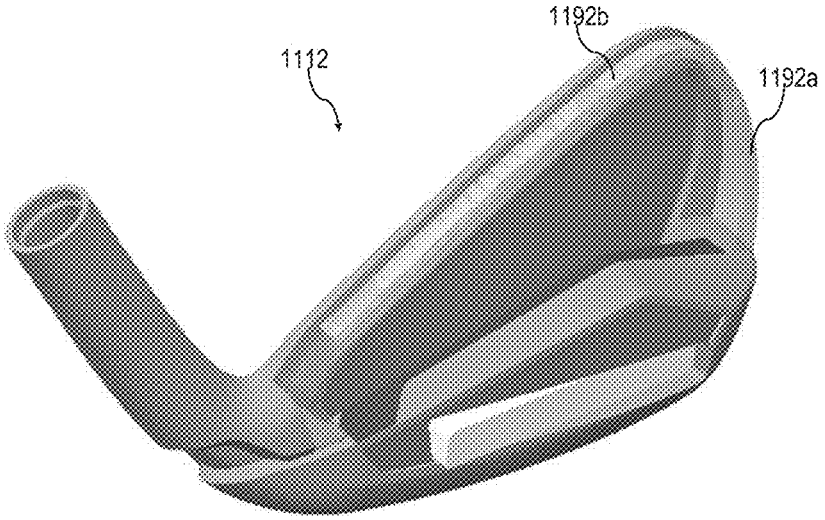
FIG. 26*c* is a rear perspective view of an alternative embodiment to the golf club head of FIG. 23*a*.

As shown, in FIGS. 26*a-c* the design uses a plastic topline 1192*a* as a weight reducing feature to reduce the weight across the entire topline weight reduction zone 1191. The plastic topline is an efficient way of removing mass from the topline. The plastic topline 1192*a* design removes at least 10 g, such as at least 15 g, such as at least 17 g, or such as at least 20 g of mass from the topline. In the design shown, about 18 g was removed from the topline and reallocated to a lower point on the club head resulting in a downward Zup shift of about 1.8 mm while maintaining the same overall head weight.

The plastic material may be made from any suitable plastic including structural plastics. For the designs shown, the parts were modeled using Nylon-66 having a density of 1.3 g/cc, and a modulus of 3500 megapascals. However, other plastics may be perfectly suitable and may obtain better results. For example, a polyamide resin may be used with or without fiber reinforcement. For example, a polyamide resin may be used that includes at least 35% fiber reinforcement with long-glass fibers having a length of at least 10 millimeters premolding and produce a finished plastic topline having fiber lengths of at least 3 millimeters. Other embodiments may include fiber reinforcement having short-glass fibers with a length of at least 0.5-2.0 millimeters premolding. Incorporation of the fiber reinforcement increases the tensile strength of the primary portion, however it may also reduce the primary portion elongation to break therefore a careful balance must be struck to maintain sufficient elongation. Therefore, one embodiment includes 35-55% long fiber reinforcement, while an even further embodiment has 40-50% long fiber reinforcement.

One specific example is a long-glass fiber reinforced polyamide 66 compound with 40% carbon fiber reinforcement, such as the XuanWu 5 XW5801 resin having a tensile strength of 245 megapascal and 7% elongation at break. Long fiber reinforced polyamides, and the resulting melt properties, produce a more isotropic material than that of short fiber reinforced polyamides, primarily due to the three dimensional network formed by the long fibers developed during injection molding.

Another advantage of long-fiber material is the almost linear behavior through to fracture resulting in less deformation at higher stresses. In one particular embodiment the plastic topline is formed of a polycaprolactam, a polyhexamethylene adipinamide, or a copolymer of hexamethylene diamine adipic acid and caprolactam. However, other embodiments may include polypropylene (PP), nylon 6 (polyamide 6), polybutylene terephthalates (PBT), thermoplastic polyurethane (TPU), PC/ABS alloy, PPS, PEEK, and semi-crystalline engineering resin systems that meet the claimed mechanical properties.

In another embodiment the plastic topline is injection molded and is formed of a material having a high melt flow rate, namely a melt flow rate (275°/2.16 Kg), per ASTM D1238, of at least 10 g/10 min. A further embodiment is formed of a non-metallic material having a density of less than 1.75 grams per cubic centimeter and a tensile strength of at least 200 megapascal; while another embodiment has a density of less than 1.50 grams per cubic centimeter and a tensile strength of at least 250 megapascal.

FIGS. 26*b*-26*c* are rear views of two different plastic topline designs. Specifically, FIG. 26*b* is a rear view of a purely plastic topline 1192 *a* design that is adhesive secured to the iron type golf club. Additionally and/or alternatively, the plastic topline may be co-molded onto the iron type golf club. FIG. 26*c* is a rear view of a second plastic topline 1192*b* design that includes a steel rib inside of the topline for added stiffness. The design shown in FIG. 26*b* had a mass savings of about 18 g, a Zup shift of about 1.8 mm, a first mode frequency of 1828 Hz, and tau time (frequency duration) of 7.5 ms. The design shown in FIG. 26*c* made a slight improvement to sound and tau time with a frequency of 1882 Hz, and a duration of 6.5 ms. However, the mass saving was reduced to about 13 g and, a Zup shift of about 1.5 mm.

Although, the mass savings and Zup shift is impressive for these two designs, the frequency far below 3000 Hz is unacceptable for most golfers, and the frequency duration is borderline acceptable. For comparison, the baseline club without any weight reduction done to the topline has a first mode frequency of 3213 Hz and a frequency duration of 4.4 ms. Accordingly the next several designs focus on improving the frequency while still achieving a modest weight savings and Zup shift. The frequency of these designs would likely be improved if weight reduction was targeted to only zone 1156*a*, or zones 1156*a* and 1156*c*.

Figure 27A:
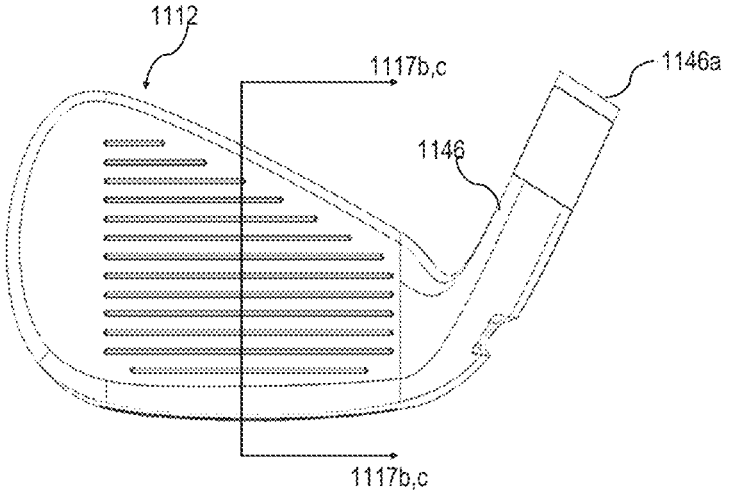
FIG. 27*a* is a front elevation view of another embodiment of an iron type golf club head embodying a lightweight topline design.
Figure 27B:
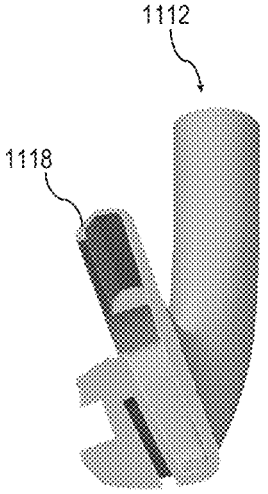
FIG. 27*b* is a section view of the golf club head of FIG. 27*a*.
Figure 27C:
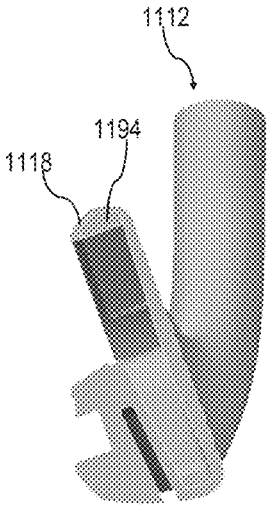
FIG. 27*c* is a section view of an alternative embodiment to the golf club head of FIG. 27*a*.

Turning to FIGS. 27*a*-*c*, alternative designs are shown for removing topline material. These designs selectively remove material from the existing topline to create a rib like structure along the entire topline weight reduction zone 1191, however the traditional look of the topline is maintained and the weight reduction is not visible to the golfer. Thinning the topline allows for a mass savings of at least 5 g, such as at least 7 g, such as at least 9 g, such as at least 11 g.

Turning to FIGS. 27*b* and 27*c*, section views are shown so that the thin topline is visible. The design shown in FIG. 27*b* had a mass savings of about 10 g, a Zup shift of about 1.3 mm, a first mode frequency of 3092 Hz, and tau time (frequency duration) of 6.6 ms. The design shown in FIG. 27*c* put back some of the material removed in the form of a plastic topline insert 1194 made of Nylon-66. This was done in an attempt to dampen the frequency and frequency duration. The frequency duration decreased to 5.9 ms, but surprisingly the frequency stayed about the same at 3086 Hz. The mass saving was reduced to about 8 g and, and the Zup shift decreased to about 1.2 mm. Although, the mass savings and Zup shift is more modest for these two designs, the frequency is above 3000 Hz, which is acceptable for most golfers, and the frequency duration being below 7 ms is also acceptable.

As already discussed above, instead of reducing weight across the entire topline weight reduction zone 1191, a more targeted approach that targets different zones, such as, for example, the first zone 1156*a*, the second zone 1156*b*, and the third zone 1156*c*, may be a better approach to balancing mass reduction and acoustic performance. As already discussed, removing material from the first zone 1156*a* allows for a greater impact on Zup, while removing material from the third zone 1156*c* allows for a greater impact to CG-x with only a minor impact to Z-up. Accordingly, if the goal is to shift Zup, then removing mass from the first zone 1156*a* is more modest approach that would provide better acoustic properties.

Figure 28A:
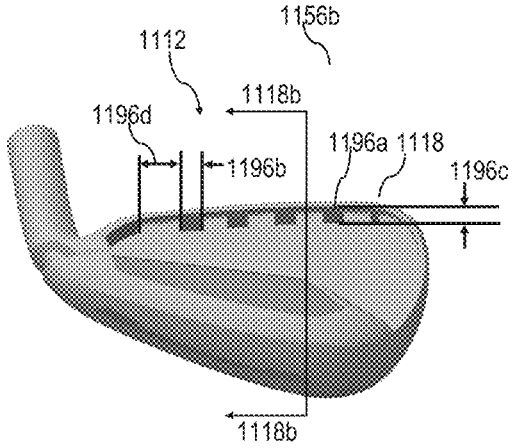
FIG. 28*a* is a rear perspective view of another embodiment of an iron type golf club head embodying a lightweight topline design.
Figure 28B:
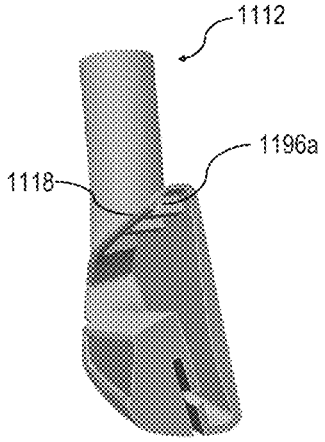
FIG. 28*b* is a section view of the golf club head of FIG. 28*a*.

Turning to FIGS. 28*a*-*b*, an alternative weight reducing feature is shown for removing topline material. Like the previous design, this design selectively removes material from the topline. However, instead of using a plastic insert to increase stiffness steel ribs 1196*a* are spaced along the entire topline weight reduction zone 1191. The steel ribs 1196*a* have a rib width 1196*b*, a rib height 1196*c*, and a rib spacing 1196*d*. The ribs may range in width from about 3 mm to about 10 mm, preferably about 4.5 mm to about 7 mm. The ribs may range in height from about 2 mm to about 10 mm, or preferably about 3 mm to about 7 mm. The rib spacing is measured from the end of one rib to beginning of the next rib and may range from about 3 mm to about 10 mm, preferably about 5 mm to about 8 mm.

The design shown in FIGS. 28*a*, 28*b* have a mass savings of about 5 g, a Zup shift of about 0.9 mm, a first mode frequency of 3122 Hz, and tau time (frequency duration) of 5.7 ms. Although, the mass savings and Zup shift is more modest for this design, the frequency is above 3100 Hz, which is acceptable for most golfers, and the frequency duration being below 6 ms is also acceptable.

Figure 29A:
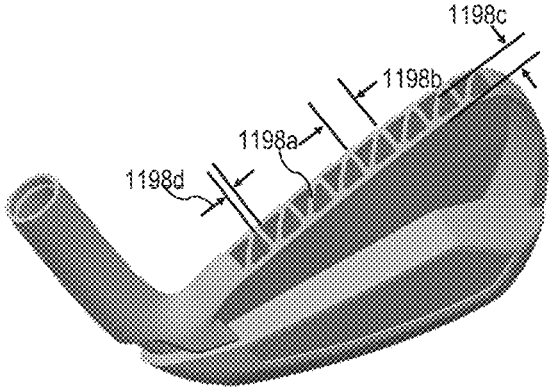
FIG. 29*a* is a rear perspective view of another embodiment of an iron type golf club head embodying a lightweight topline design.
Figure 29B:
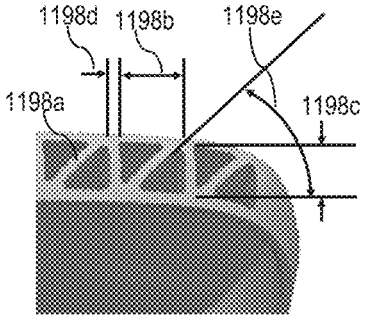
FIG. 29*b* is a detailed view of the golf club head of FIG. 29*a*.
Figure 30A:
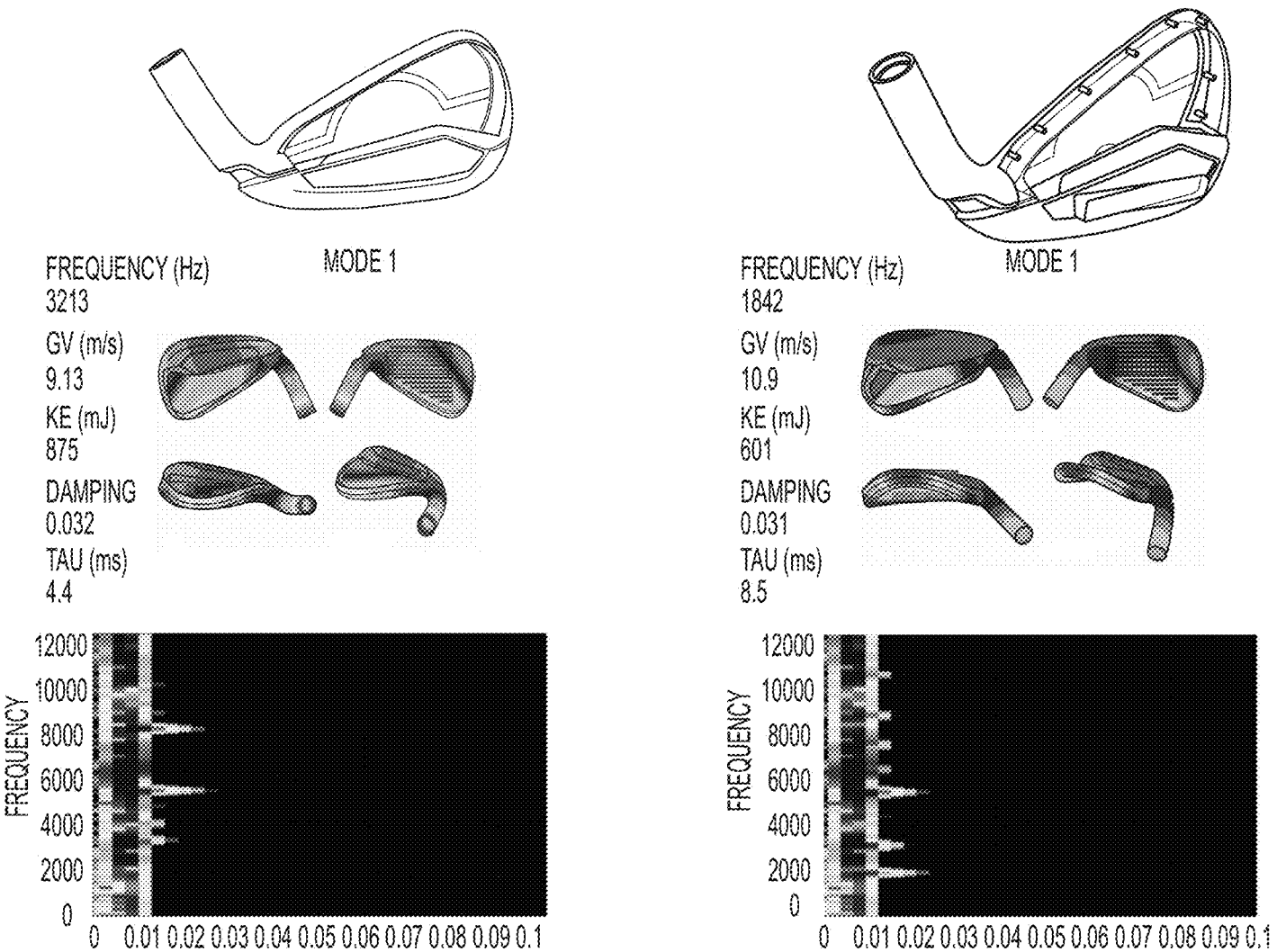
FIG. 30*a* are first modal FEA results of various golf club heads including the golf club head of FIG. 26*b*.
Figure 30B:
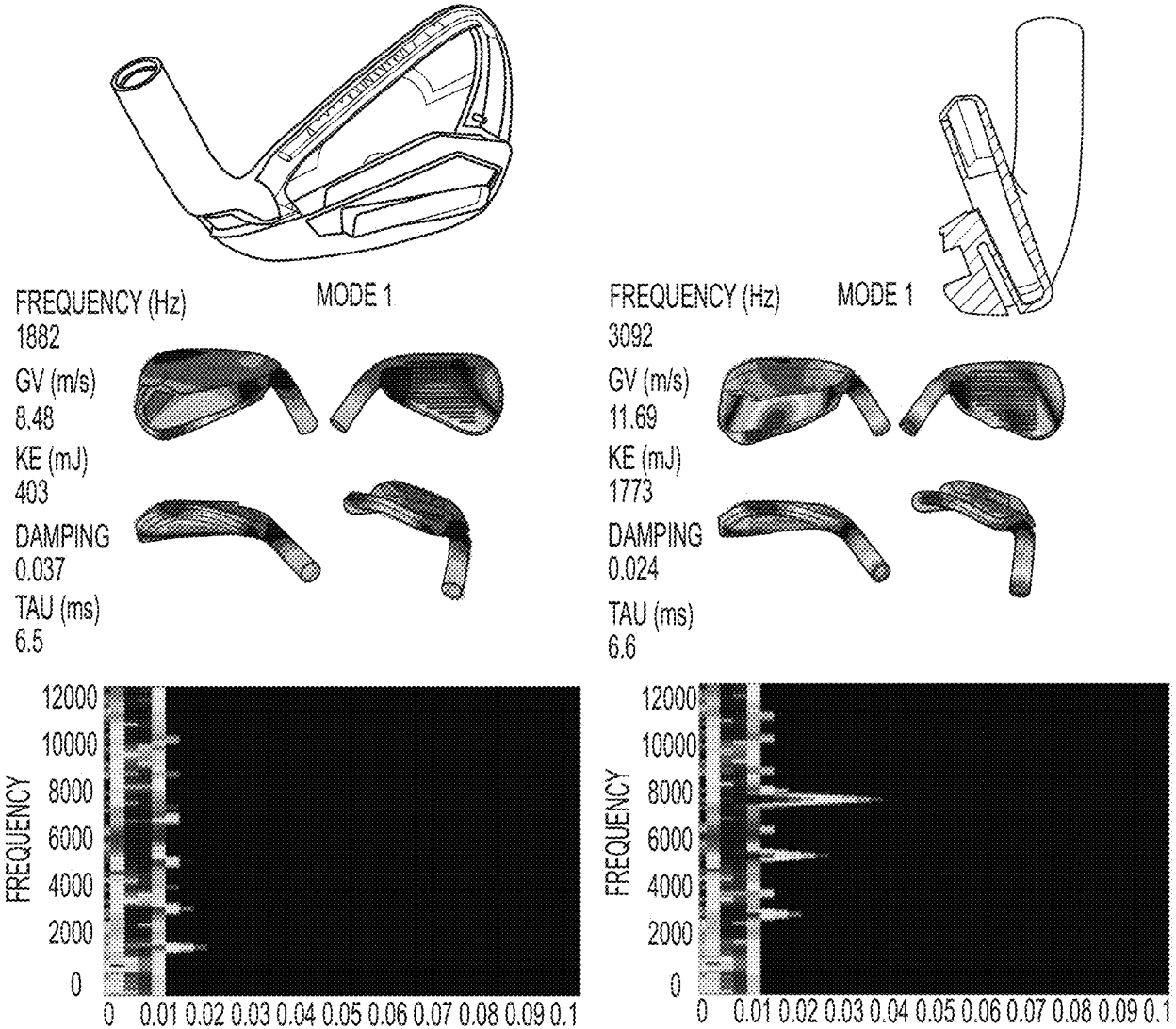
FIG. 30*b* are first modal FEA results of the golf club heads of FIG. 26*c* and FIG. 27*b*.
Figure 30C:
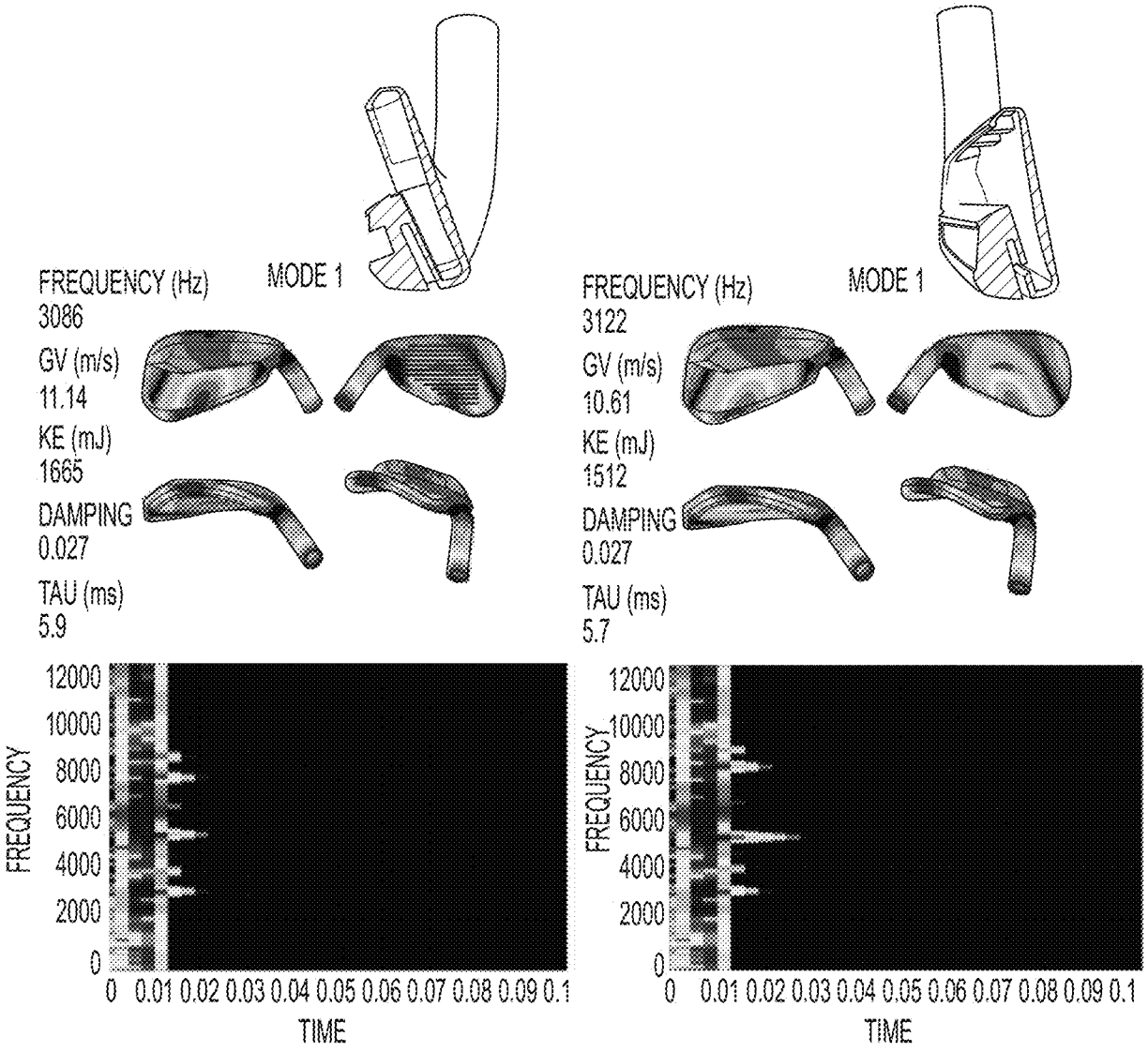
FIG. 30*c* are first modal FEA results of the golf club heads of FIG. 27*c* and FIG. 28*b*.
Figure 30D:
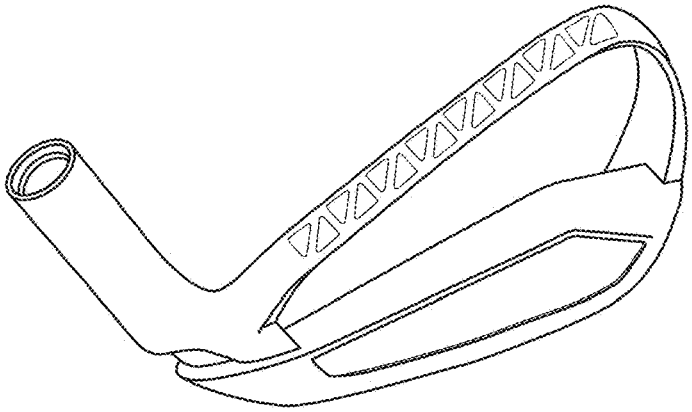
FIG. 30*d* is first modal FEA results of the golf club head of FIG. 29.
Figure 30D:
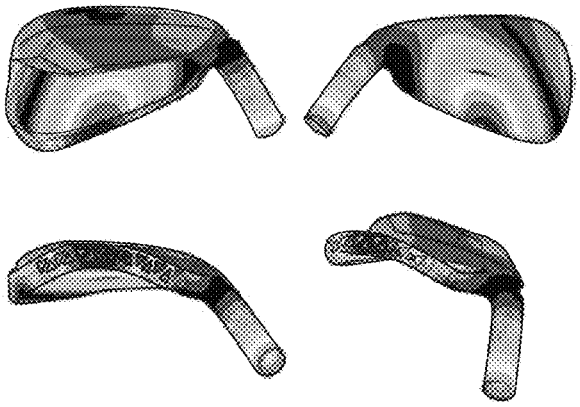
Figure 30D:
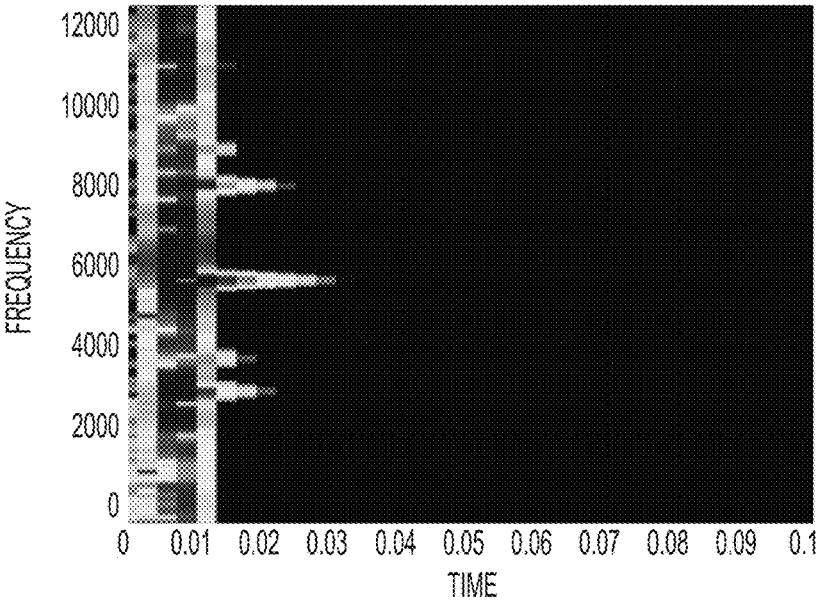

Turning to FIG. 29*a*, 29*b*, an alternative weight reducing feature is shown for removing topline material. Like the previous designs, this design selectively removes material from the topline creating. However, instead of using ribs to increase stiffness truss members 1198*a* are spaced along the entire topline weight reduction zone 1191. As best seen in FIG. 29*b*, the truss members 1198*a* have a member width 1198*b*, a member height 1198*c*, a member spacing 1198*d*, and have an angle 1198*e* ranging from about 15 degrees to about 75 degrees relative to the topline. The members may range in width from about 0.75 mm to about 3 mm, preferably about 1.0 mm to about 1.5 mm. The members may range in height from about 2 mm to about 10 mm, preferably about 3 mm to about 7 mm. The member spacing is measured from the end of one truss to beginning of the next truss and may range from about 0.75 mm to about 5 mm, preferably about 1 mm to about 3 mm.

The design shown in FIG. 29*a*, 29*b*, has a mass savings of about 4 g, a Zup shift of about 0.9 mm, a first mode frequency of 3056 Hz, and tau time (frequency duration) of 6.5 ms. Although, the mass savings and Zup shift is more modest for this design, the frequency is above 3000 Hz, which is acceptable for most golfers, and the frequency duration being below 7 ms is also acceptable.

FIGS. 30*a*-30*d* show first modal results for each of the designs discussed above. Table 6 below summarizes the results of the first modal analysis for each of the designs.

Table 6 lists several exemplary values for each of the weight reducing designs including mass savings, Zup, Zup shift, First Mode Frequency, and First Mode Duration. The measurements reported in Table 6 are without a badge, which may be used to impact the frequency and or duration, such as for example, to dampen the frequency duration.

TABLE 6

| Design | Mass Savings (g) | Zup (mm) | Zup Shift (mm) | First Mode Frequency (Hz) | First Mode Duration (ms) |
|---|---|---|---|---|---|
| Baseline | — | 18.4 | — | 3213 | 4.4 |
| 13b | 18 | 16.6 | 1.8 | 1828 | 7.5 |
| 13c | 13 | 17 | 1.5 | 1882 | 6.5 |
| 14b | 10 | 17.1 | 1.3 | 3092 | 6.6 |
| 14c | 8 | 17.2 | 1.2 | 3086 | 5.9 |
| 15b | 5 | 17.5 | 0.9 | 3122 | 5.7 |
| 16 | 4 | 17.5 | 0.9 | 3056 | 6.5 |

Each iron type golf club head design was modeled using commercially available computer aided modeling and meshing software, such as Pro/Engineer by Parametric Technology Corporation for modeling and Hypermesh by Altair Engineering for meshing. The golf club head designs were analyzed using finite element analysis (FEA) software, such as the finite element analysis features available with many commercially available computer aided design and modeling software programs, or stand-alone FEA software, such as the ABAQUS software suite by ABAQUS, Inc.

For each of the above designs, by increasing the depth, width, and/or length of the weight reducing features even more mass savings may be had due to more material being removed. However, it is most beneficial to remove material that is furthest away from the club head CG because this has the most substantial effect on shifting Z-up downward. As discussed above, a lower Z-up promotes a higher launch and allows for increased ball speed depending on impact location.

By using the weight reducing features discussed above, a mass of at least 2 g to at least 20 g may be removed from the hosel and positioned elsewhere on the club to promote better ball speed. By employing the weight reducing features the mass per unit length of the topline can be reduced compared to a club without the weight reducing features. Employing the weight reducing features over a topline length may yield a mass per unit length within the weight reduction zone of between about 0.09 g/mm to about 0.40 g/mm, such as between about 0.09 g/mm to about 0.35 g/mm, such as between about 0.09 g/mm to about 0.30 g/mm, such as between about 0.09 g/mm to about 0.25 g/mm, such as between about 0.09 g/mm to about 0.20 g/mm, or such as between about 0.09 g/mm to about 0.17 g/mm. In some embodiments, the topline weight reduction zone yields a mass per unit length within the weight reduction zone less than about 0.25 g/mm, such as less than about 0.20 g/mm, such as less than about 0.17 g/mm, such as less than about 0.15 g/mm, such as less than about 0.10 g/mm. The mass per unit length values given are for a topline made from a metallic material having a density between about 7,700 $kg/m^3$ and about 8,100 $kg/m^3$, e.g. steel. If a different density material is selected for the topline construction that could either increase or decrease the mass per unit length values. The weight reducing features may be applied over a topline length of at least 10 mm, such as at least 20 mm, such as at least 30 mm, such as at least 40 mm, such as at least 45 mm, such as at least 50 mm, such as at least 55 mm, or such as at least 60 mm.

As discussed above, the iron type golf club head has a certain CG location. The CG location can be measured relative to the x, y, and z-axis. An additional measurement may be taken referred to as Z-up. The Z-up measurement is the vertical distance to the club head CG taken relative to the ground plane when the club head is soled and in the normal address position. It is important to understand that the topline is a large chunk of mass that greatly impacts the CG location of the club head. Accordingly, removing mass from the topline and repositioning the mass at or below the CG, such as, the sole of the club, can significantly impact the CG location of the club head. For example, by employing the weight reducing features, the Z-up shifted downward at least 0.5 mm and in some instances at least 2 mm. This Z-up shift was accomplished while maintaining a traditional profile and traditional heel and toe face heights.

Adjustable Iron-Type Golf Club Construction

Figure 31:
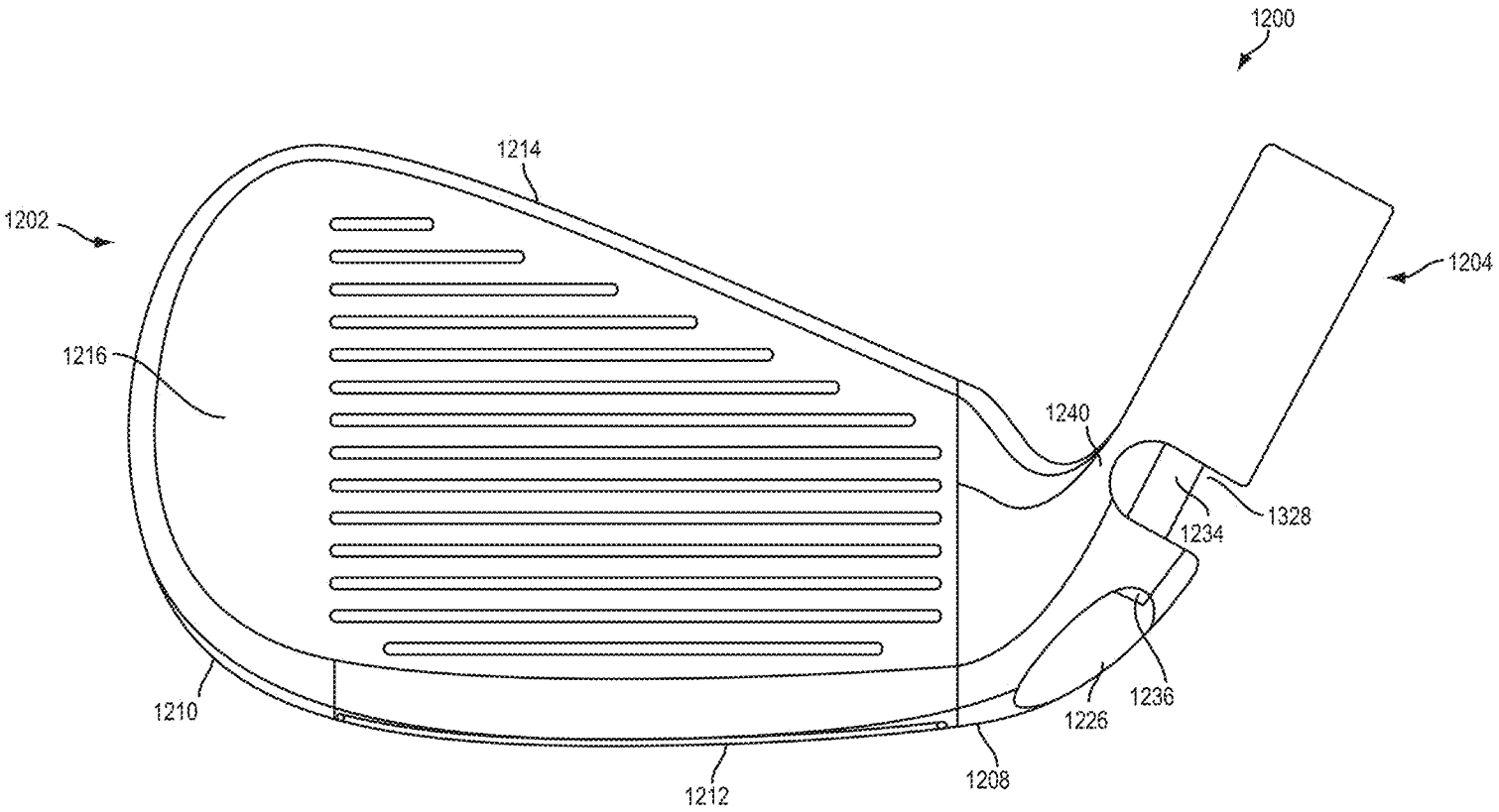
FIG. 31 shows an exemplary embodiment of an adjustable golf club head.
Figure 32:
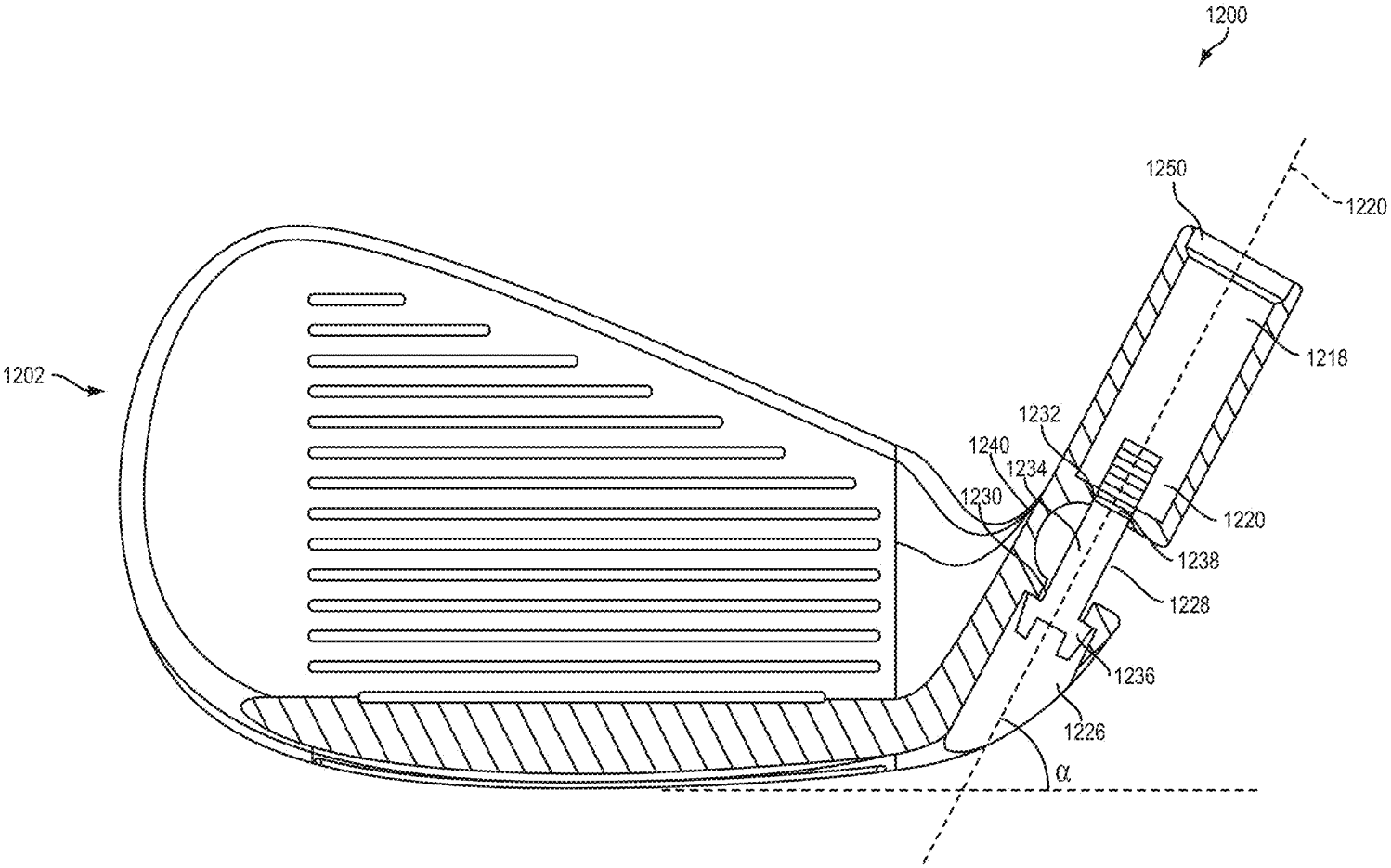
FIG. 32 shows a cross sectional view of the adjustable golf club head of FIG. 31.
Figure 33:
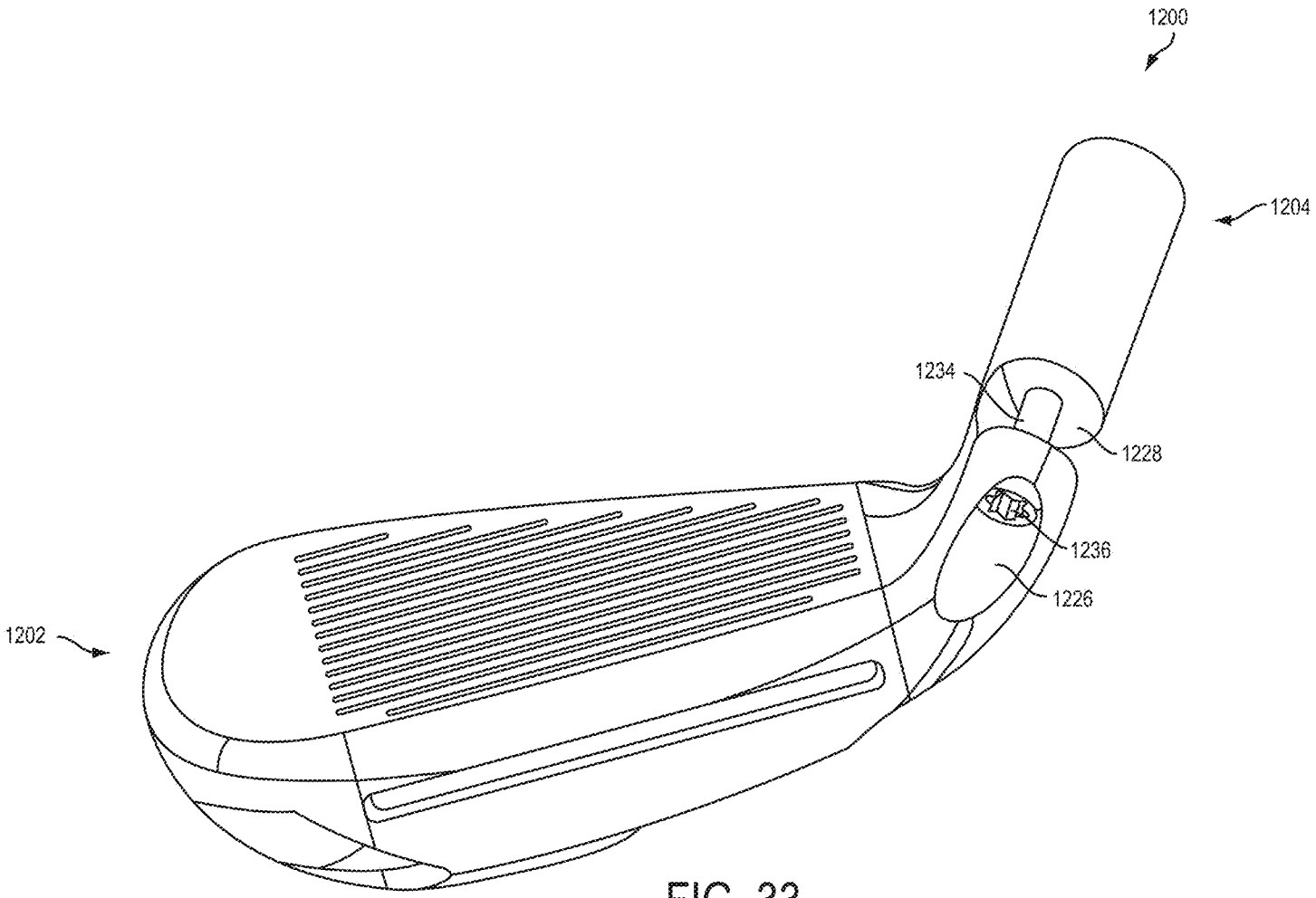
FIG. 33 shows a perspective view of the adjustable golf club head of FIG. 31.

FIGS. 31-33 show an exemplary golf club head 1200 which includes a body 1202 and a hosel 1204 configured to allow the club head 1200 to be coupled to a shaft (not pictured). The golf club head 1200 can include a heel portion 1208, a toe portion 1210, a sole portion 1212, a topline portion 1214, and a striking face portion 1216 configured for striking golf balls.

The hosel 1204 can include a shaft bore 1218 formed within the hosel 1204 that extends to a distal end portion 1220 of the shaft bore 1218. The shaft bore 1218 can have a generally cylindrical shape, and can have a central longitudinal axis 1222. The shaft bore 1218 can be configured to receive a distal end portion of the shaft, which can be secured in the shaft bore 1218 in various manners, such as with epoxy adhesive or glue. The hosel 1204 can also include a recess 1250, which can facilitate the securing of the shaft to the hosel 1204, for example, by allowing the use of a sealing ring (not pictured) in the recess 1250. In such a configuration, a central longitudinal axis of the shaft can be aligned with the central longitudinal axis 1222.

For purposes of this description, the "hosel" of a golf club head includes the portion of the club head which encloses the shaft bore and extends to within the region of the heel portion of the body. Thus, the hosel of the golf club heads described herein includes the adjustment bore, notch, openings, and other components described more fully below. Thus, the hosel of the golf club heads described herein includes what is sometimes referred to in the industry as a "hosel blend." For purposes of this description, an "upper portion of the hosel" refers to the portion of the hosel which encloses the shaft bore.

The geometry of the golf club head 1200 can be adjusted and thus a golf club can be tailored to an individual golfer. That is, the geometry of the body 1202 and hosel 1204 of the golf club head 1200 can be adjusted based on a golfer's anatomy and/or golfing technique, in order to improve the reliability and/or quality of the golfer's shot. Generally, the geometry of the golf club head 1200 can be adjusted to help ensure that when a golfer swings a golf club, the striking face portion 1216 of the club head 1200 strikes a golf ball in a consistent and desired manner (e.g., in a way that minimizes "slice" and/or "hook," as those terms are generally understood in the game of golf).

Figure 34:
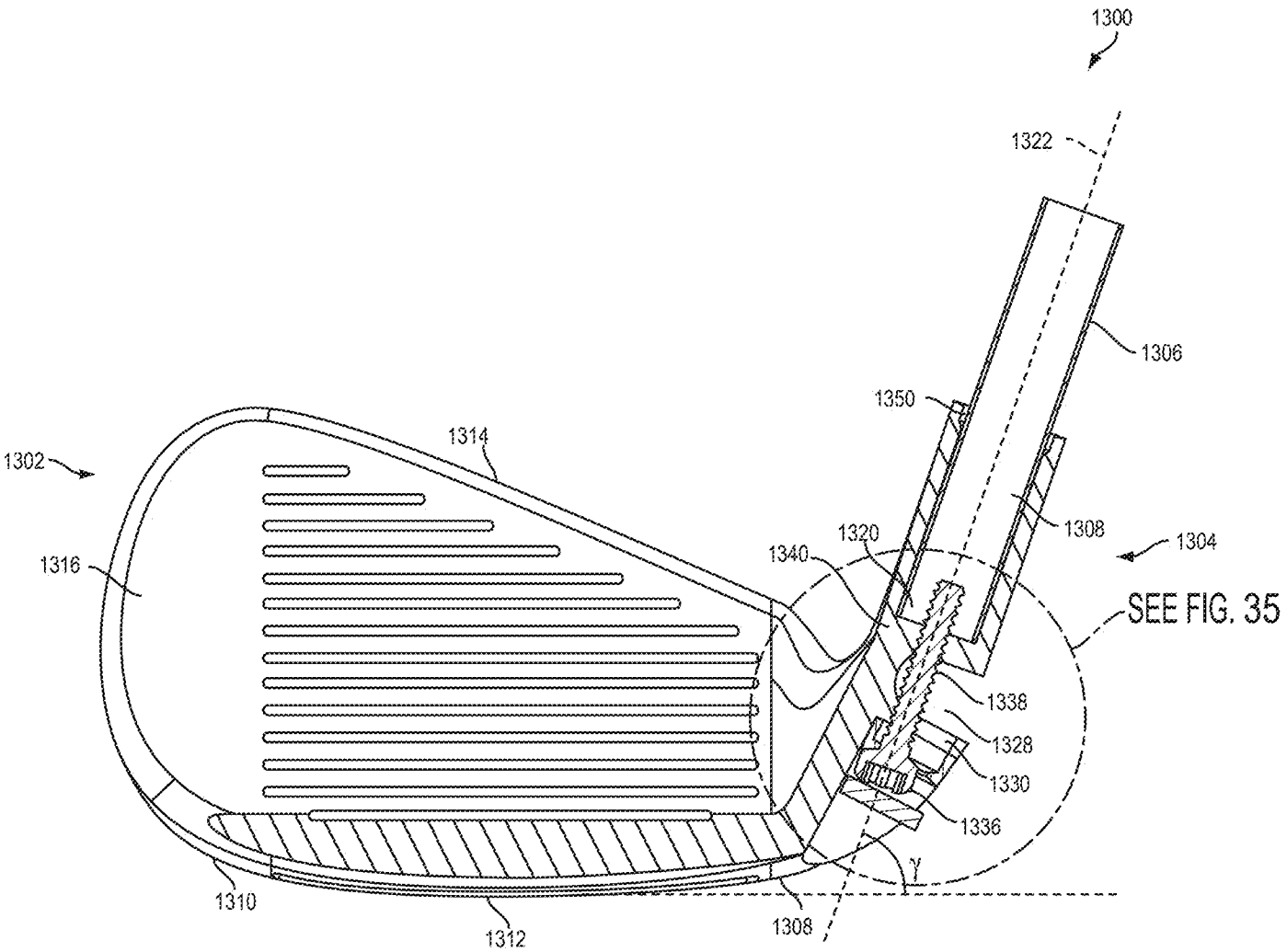
FIG. 34 shows a cross sectional view of an alternative exemplary embodiment of an adjustable golf club.

The terms "lie angle" and "loft angle" have well-understood meanings within the game of golf and the golf club industry. As used herein, these terms are intended to carry this conventional meaning. For purposes of illustration, the term "lie angle" can refer to an angle formed between the central longitudinal axis 1222 of the shaft bore 1218 and the ground when the sole portion 1212 of the golf club head 1200 rests on flat ground. For example, lie angle α is shown in FIG. 32 and lie angle γ is shown in FIG. 34. Also for purposes of illustration, the term "loft angle" can refer to the angle formed between a line normal to the surface of the striking face portion 1216 and the ground when the sole portion 1212 of the golf club head 1200 rests on flat ground. Thus, the loft and lie angles are geometrically independent of one another, and thus in various golf clubs can be adjusted either independently or in combination with one another. As one particular example, the loft and lie angles of club head 1200 can each be independently adjusted by appropriately deforming the hosel 1204.

FIGS. 31-33 show that a golf club head 1200 can include an adjustment bore 1226 and an adjustment notch 1228 in the hosel 1204. The adjustment bore 1226 can be generally cylindrically shaped, and can open in a direction opposite that of the shaft bore 1218. As discussed further below, a central longitudinal axis of the adjustment bore can be generally aligned with the axis 1222 of the shaft bore 1218, but can be displaced from such alignment as the geometry of the golf club head 1200 is adjusted. As shown, the bores 1218, 1226 can have differing diameters, but in alternative embodiments, each of the bores can have any of various appropriate diameters and in some embodiments can have the same diameter. As shown, the hosel 1204 can have a narrow portion, or living hinge 1240, in the region of the hosel 1204 opposing the notch 1228. The living hinge 1240 can be formed as a continuous piece of material, formed integrally with the remainder of the hosel 1204, and can be configured to provide a relatively flexible location about which the club head 1200 can be bent.

A first opening 1230 can be provided in the hosel 1204 which can connect a distal end portion of the adjustment bore 1226 and the notch 1228. A second opening 1232 can be provided in the hosel 1204 which can connect a distal end portion of the shaft bore 1218 with the notch 1228. As shown, the openings 1230 and 1232 can have diameters which are smaller than the diameters of the adjustment bore 1226 and the shaft bore 1218. In some embodiments, the openings 1230 and 1232 can be generally aligned with one another, and can have central longitudinal axes which are generally aligned with the central longitudinal axis 1222 of the shaft bore 1218. The opening 1232 can be provided with mechanical threads extending radially inward into the opening 1232.

FIGS. 31-33 show an adjustment screw 1234 having a head portion 1236 and a threaded portion 1238 having threads complementing those of the second opening 1232. As shown, the head 1236 of the screw 1234 can be situated in the adjustment bore 1226, and the threaded portion 1238 can extend from the head 1236, through the first opening 1230 and notch 1228, be threaded through the second opening 1232, and extend into the shaft bore 1218. As shown, the first opening 1230 can have a diameter which is smaller than a diameter of the screw head 1236 but larger than a diameter of the threaded portion 1238. Thus, the threaded portion 1238 can move freely through the opening 1230, but the screw head 1236 cannot.

In this configuration, the screw 1234 can be used as an actuator which can cause adjustment of the golf club head at the hinge to control geometric properties of the golf club head 1200. Specifically, in the illustrated embodiment, the screw 1234 can be used to modify the lie angle of the golf club head 1200. When the screw 1234 is tightened (e.g., threaded through the threads in the second opening 1232 toward the shaft bore 1218), the hosel 1204 bends at the living hinge 1240 such that the body 1202 of the club head 1200 rotates away from the hosel 1204 about the hinge 1240. Thus, when the screw 1234 is tightened, the topline portion 1214 and toe 1210 of the head 1200 rotate away from the hosel 1204 and the lie angle α decreases.

A retaining ring (not pictured) can be provided within the adjustment bore 1226 such that when the screw 1234 is loosened (e.g., threaded through the threads in the second opening 1232 away from the shaft bore 1218), the hosel 1204 bends at the living hinge 1240 such that the body 1202 of the club head 1200 rotates toward the hosel 1204 about the hinge 1240. Thus, when the screw 1234 is loosened, the topline portion 1214 and toe 1210 of the head 1202 rotate toward the hosel 1204 and the lie angle α increases. These features are described in more detail below.

A golf club can be fabricated, sold, and/or delivered with the golf club head 1200 in a neutral configuration. That is, the configuration in which it is anticipated that the fewest golfers will need to adjust the lie angle, or in which it is anticipated that the average amount by which golfers need to adjust the lie angle is minimized. This neutral configuration can be determined, for example, based on expert knowledge or empirical studies. The golf club head 1200 can be fabricated such that this neutral configuration is achieved by positioning the screw 1234 within the adjustment bore 1226 and tightening it to a predetermined degree, which can include not tightening it at all. When an individual golfer commences the process of adjusting, or "tuning," the golf club, the screw can be further tightened to decrease the lie angle, or the screw can be loosened to increase the lie angle.

By fabricating and/or selling the golf club head 1200 in the neutral configuration, the number of golfers who adjust the club head 1200 can be decreased, and the degree to which many golfers adjust the golf club head 1200 can be reduced. This can help to reduce the stresses induced in the golf club head 1200 and/or reduce the potential for developing problems of fatigue in the hinge 1240. Further, a screw 1234 which has been tightened to a predetermined degree can carry a net tension force, which can increase frictional forces between the screw 1234 and the rest of the club head 1200. Increased frictional forces can in turn help to ensure that the screw 1234 is not unintentionally tightened, loosened, or removed from the openings 1230 and 1232, and the adjustment bore 1226.

It can be desirable to design the hinge 1240 to be relatively flexible so that it can be more easily bent by tightening or loosening the screw 1234. This can be accomplished by reducing the cross sectional area of the hinge 1240 or by forming the hinge 1240 from a relatively flexible material. The hinge 1240 can be made to be sufficiently flexible to allow adjustment while retaining sufficient strength to withstand stresses caused by using the club head 1200 to hit a golf ball. For example, striking a golf ball with the striking face portion 1216 of the club head 1200 can induce torque in the hosel 1204. Thus, the strength of the hinge 1240, in combination with the screw 1234 (which can provide additional strength) can be capable of resisting the torque experienced when the club head 1200 is used to hit a golf ball. That is, the screw can act as a secondary member which increases the rigidity of the golf club head in the region of the hinge. Further, the hinge 1240, in combination with the screw 1234, can be capable of resisting the stresses caused by repetitive use of the club head 1200 to strike golf balls, that is, they can be resistant to fatigue failure due to repetitive, cyclic stresses, for example, the stresses caused by hitting a golf ball several thousand times.

The features illustrated in FIGS. 31-33 allow the lie angle of the golf club head 1200 to be adjusted more easily than the lie angle of many other known golf club heads. The lie angle of the golf club head 1200 can be adjusted simply by tightening or loosening a single screw 1234. For example, a golfer can adjust the lie angle α by hand or with a single hand tool (e.g., a screwdriver). This can allow repeatable, reversible, and/or rapid adjustment of the golf club head. This allows significant improvement over previous known methods in which a golf club head is plastically bent in a post manufacturing process. It also allows significant improvement over previously known systems which use an adjustable shaft attachment system, as these systems allow only incremental adjustment between predetermined, discrete angles, rather than continuous adjustment over a continuous range of angles, as in golf club head 1200.

As best shown in FIGS. 31 and 32, the notch 1228 can extend inward from the periphery of the hosel 1204 opposite the club head body 1202, through the hosel 1204 toward the body 1202, and stop short of the opposing periphery of the hosel 1204, thus forming the hinge 1240. Thus, the notch 1228, the screw 1234, and the hinge 1240 can be aligned with each other so that tightening or loosening the screw 1234 can cause a corresponding change primarily in the lie angle α, without significantly changing the loft angle, of the club head 1200.

In alternative embodiments, the alignment of the notch, screw, and hinge can be displaced angularly about the central longitudinal axis of the hosel bore from the alignment of the notch 1228, screw 1234, and hinge 1240 shown in FIGS. 31-33. In one exemplary alternative embodiment, the alignment can be angularly displaced from that illustrated in FIGS. 31-33 by about ninety degrees. In this alternative embodiment, tightening or loosening the screw can cause a corresponding change primarily in the loft angle, without significantly changing the lie angle of the golf club head. In another exemplary alternative embodiment, the alignment can be angularly displaced from that shown in FIGS. 31-33 by more than zero but less than ninety degrees. In this alternative embodiment, tightening or loosening the screw can cause a significant corresponding change in both the lie angle and the loft angle.

Figure 35:
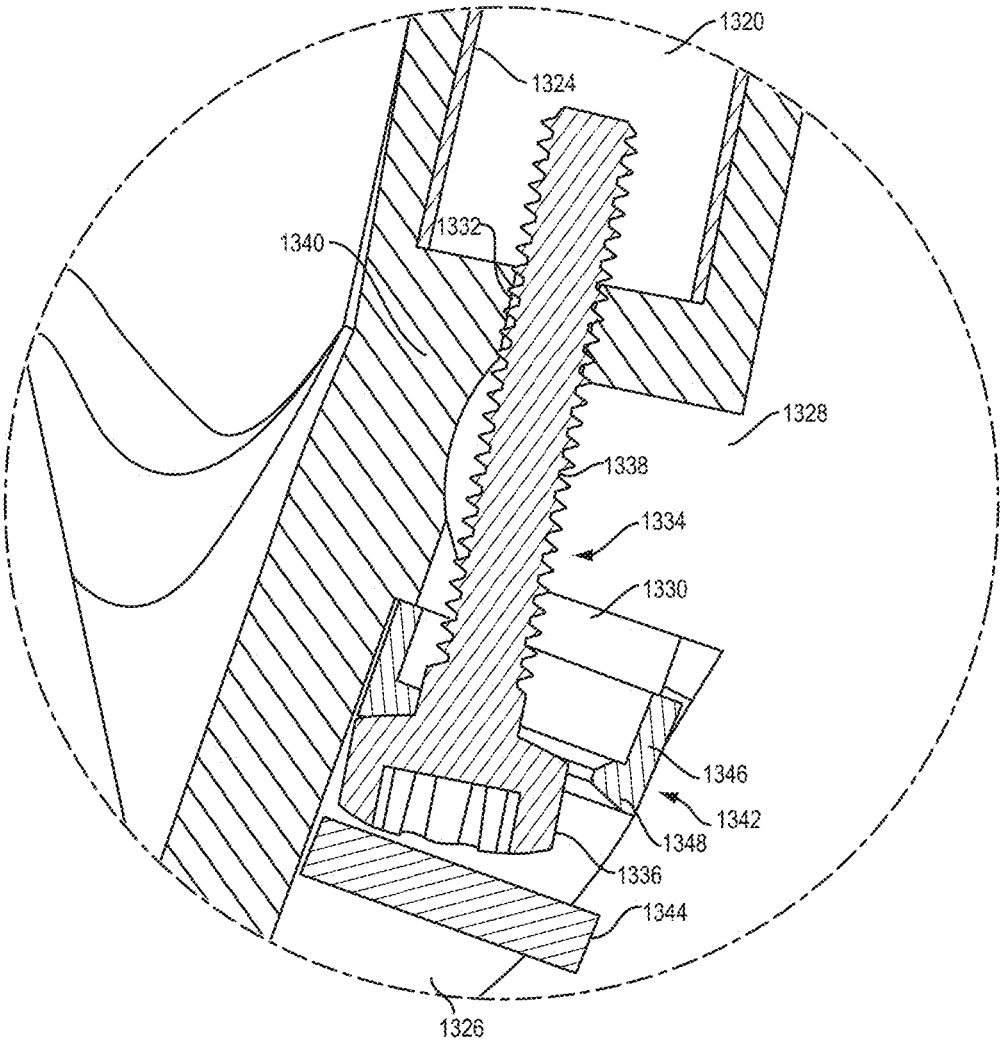
FIG. 35 shows an enlarged detailed partial cross sectional view of the adjustable golf club of FIG. 34.

FIGS. 34 and 35 show that an alternative golf club head 1300 can include a body 1302 and a hosel 1304. The body 1302 can include a heel portion 1308, a toe portion 1310, a sole portion 1312, a topline portion 1314, and a striking face portion 1316. The hosel 1304 can include a shaft bore 1318 having a recess 1350, a central longitudinal axis 1322, and a distal end portion 1320 which can receive and be secured to a distal end portion 1324 (FIG. 35) of a shaft 1306. The hosel 1304 can also include an adjustment bore 1326, an adjustment notch 1328, a living hinge 1340, a first opening 1330 connecting a distal end of the adjustment bore 1326 with the notch 1328, and a second opening 1332 connecting a distal end of the shaft bore 1318 with the notch 1328. An adjustment screw 1334, having a head portion 1336 and a threaded portion 1038, can extend through the adjustment bore 1326, first opening 1330, notch 1328, threaded opening 1332, and into the shaft bore 1318.

Golf club head 1300 can also include a screw bearing pad 1342. The bearing pad 1042 can be configured to support the screw head 1336 within the adjustment bore 1326, separating the screw head 1336 from the first opening 1330. The bearing pad 1342 can include a first hollow portion 1346 formed integrally with a second hollow portion 1348. The first hollow portion 1346 can be configured to avoid interference with the screw 1334 (that is, to allow the screw 1334 to pass through it without contacting it), and can be positioned adjacent to the first opening 1330. The second hollow portion 1348 can be configured for mating with the screw head 1336, in a way that facilitates some degree of lateral movement and/or rotation of the screw head 1336 relative to the bearing pad 1342, for example, as needed as the screw 1334 is loosened or tightened.

Thus, as best shown in FIG. 35, an inside diameter of the second hollow portion 1048 can be smaller than an inside diameter of the first hollow portion 1346, smaller than a diameter of the screw head 1336, and larger than a diameter of the threaded portion 1338 of the screw 1334. Thus, the screw 1334 can extend through the bearing pad 1342, with the screw head 1336 resting on the second hollow portion 1348. Tightening of the screw 1334 can cause it to come into contact with the bearing pad 1342, bearing against the second hollow portion 1348.

Further tightening of the screw 1334 through the threaded opening 1332 can thus cause the screw 1334 to pull the bearing pad 1342 generally toward the threaded opening 1332, thereby causing the golf club head 1300 to bend at the living hinge 1340. That is, tightening the screw 1334 can cause the topline portion 1314 and toe 1310 of the head 1300 to rotate away from the hosel 1302, thereby decreasing the lie angle γ (FIG. 34) of the golf club head 1300.

The bearing pad 1342 can be formed integrally with the rest of the hosel 1304, or can be formed separately and coupled to the hosel 1304 after each has been independently formed. Thus, use of the bearing pad 1342 can allow the surface on which the screw head 1336 bears to be formed from a material different from that used to form the rest of the golf club head 1300. Use of the bearing pad 1342 can also allow the surface on which the screw head 1336 bears to be replaced periodically without a golfer needing to replace the entire golf club head 1300.

Golf club head 1300 can also include a retaining ring 1344. The retaining ring 1344 can be positioned within the adjustment bore 1326 and can serve to partially enclose the screw 1334 within the bore 1326. The retaining ring 1344 can include an opening (not pictured) through which a golfer or other person can reach the screw head 1336 and thereby tighten or loosen the screw 1334. The retaining ring 1344 can comprise an annular piece of material coupled to the hosel 1304 within the bore 1326. The retaining ring 1344 can in some cases prevent the screw 1334 from falling out of the adjustment bore 1326, and can provide a bearing surface configured for mating with the screw head 1336.

Loosening of the screw 1334 can cause it to come into contact with and bear against the retaining ring 1344. Further loosening of the screw 1334 through the threaded opening 1332 can thus cause the screw 1334 to push the retaining ring 1344 generally away from the threaded opening 1332, thereby causing the golf club head 1300 to bend at the living hinge 1340. That is, loosening the screw 1334 can cause the topline portion 1314 and toe 1310 of the head 1300 to rotate toward the hosel 1302, thereby increasing the lie angle γ of the golf club head 1300.

The retaining ring 1344 can be coupled to the hosel 1304 by casting, welding, bonding or any other method known in the art. Use of the retaining ring 1344 can allow the surface on which the screw head 1336 bears to be formed from a material different from that used to form the rest of the golf club head 1300. Use of the retaining ring 1344 can also allow the surface on which the screw head 1336 bears to be replaced periodically without a golfer needing to replace the entire golf club head 1300.

FIGS. 34 and 35 show that the shaft 1306 can be hollow, and can extend to the distal end portion 1320 of the shaft bore 1318 and be secured therein. Thus, as shown, the threaded portion 1038 of the screw 1334, which extends through the second opening 1332 and into the distal end portion 1320 of the shaft bore 1318, can also extend into the distal end portion 1324 of the hollow shaft 1306. In some alternative embodiments, the shaft of a golf club need not extend all the way to the distal end portion of the shaft bore of the hosel. Thus, in some alternative embodiments, a solid piece of material can separate the shaft bore into two sections, with the screw extending into one section and the shaft extending into the other portion. In such an embodiment, the screw need not extend within the hollow shaft.

Figure 36:
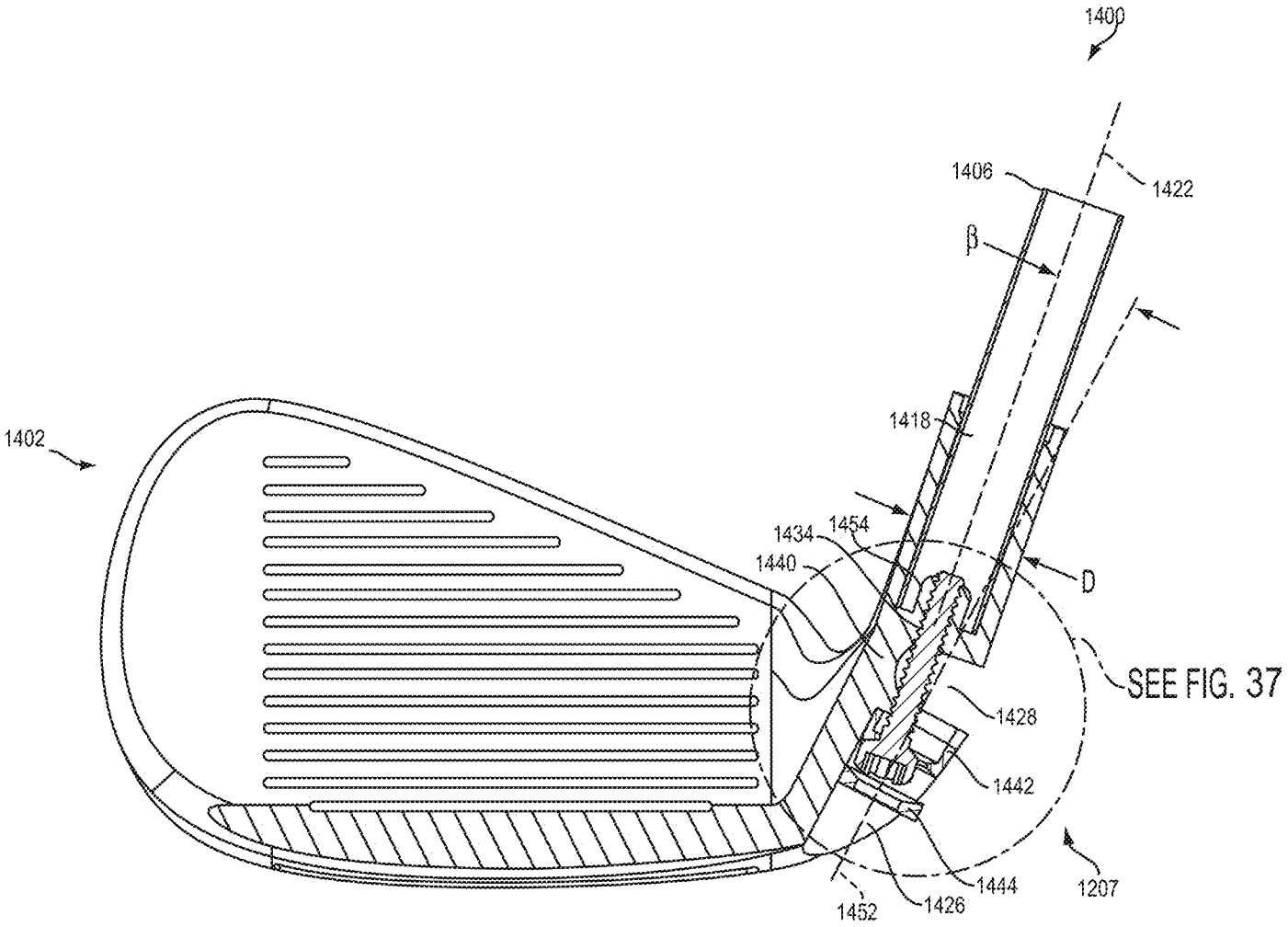
FIG. 36 shows a cross sectional view of another alternative exemplary embodiment of an adjustable golf club.
Figure 37:
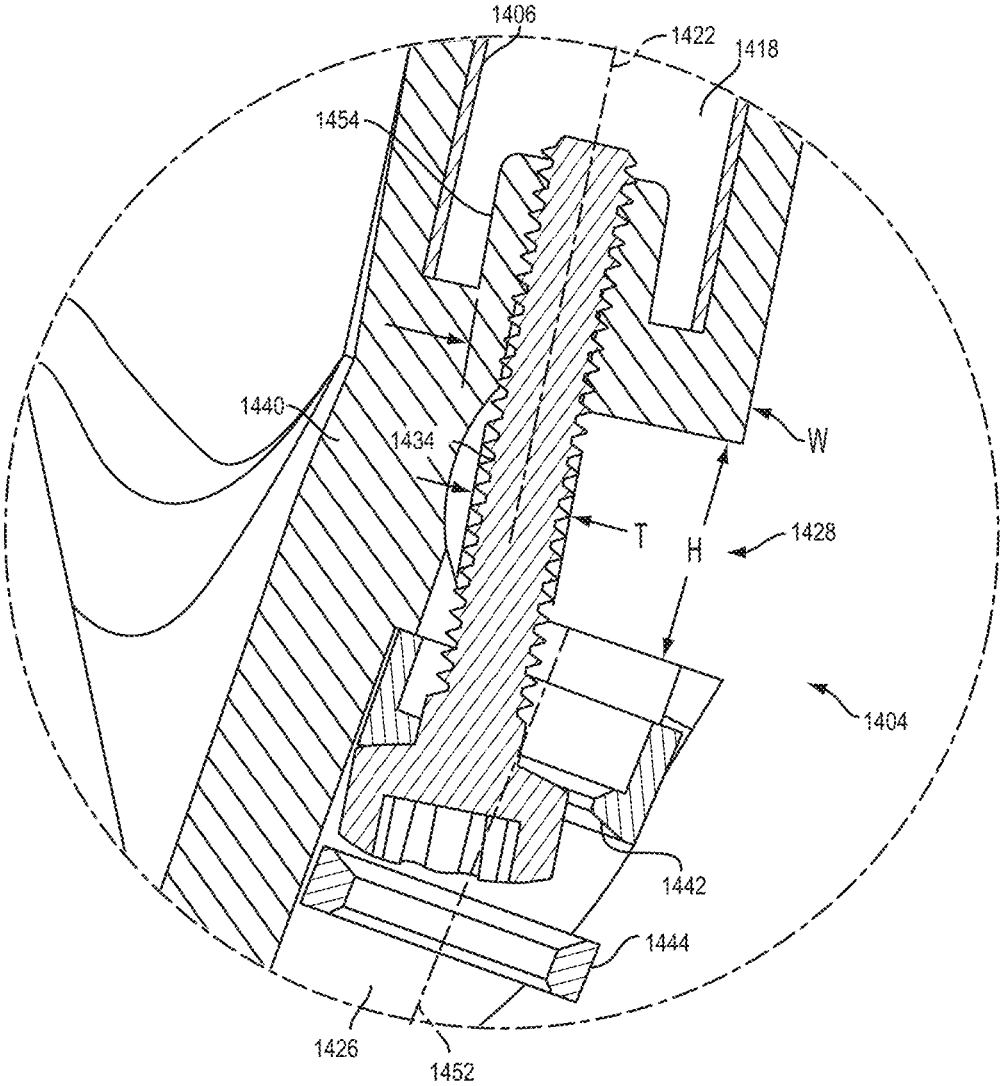
FIG. 37 shows an enlarged detailed partial cross sectional view of the adjustable golf club of FIG. 36.

FIGS. 36 and 37 show golf club head 1400 as an alternative embodiment which includes a body 1402 and a hosel 1404. The hosel 1404 has a shaft bore 1418 having a central longitudinal axis 1422 and which can accommodate a golf club shaft 1406. The club head 1400 also includes an adjustment bore 1426 having a central longitudinal axis 1452, which can accommodate a bearing pad 1442 and a retaining ring 1444. The club head 1400 also includes a boss element 1454 located at a distal end of the shaft bore 1418 which can provide additional threads for engaging a threaded portion of an adjustment screw 1434. The boss element 1454 can be formed integrally with the rest of the hosel 1404. For example, the boss element 1454 can be formed as the hosel 1404 is cast, or the boss element 1454 can be machine cut from the hosel 1404 after the hosel 1404 is cast.

The golf club head 1400 can be bent about a living hinge 1440 by tightening or loosening the screw 1434 in a manner similar to that described with respect to golf club head 1400. Changes in angle β (FIG. 36), measuring the angular displacement between the longitudinal axis 1422 of the shaft bore 1418 and the longitudinal axis 1452 of the adjustment bore 1426, can indicate the degree to which the lie angle of the club head 1400 has been adjusted. For example, a golf club can be fabricated, sold, and/or delivered with the golf club head 1400 in a neutral configuration wherein the angle β is zero. In such a configuration, the angle β indicates the degree the lie angle has been adjusted from the neutral configuration.

FIGS. 36-37 illustrate that the hosel 1404 can have a diameter D and can include a notch 1428 having a height H and a width W. The screw 1434 can be of a standardized size, and can be, for example, between a size M3 and a size M8 screw. The screw 1434 can have a maximum thread diameter T of between about 3 and 8 mm. In some embodiments, the diameter D can be between about 12.3 mm and about 14.0 mm, or more specifically, between about 12.5 mm and 13.6 mm. The notch height H can be between 0.9 mm and 20.0 mm, between 0.9 mm and 15 mm, between 0.9 mm and 10 mm, between 0.9 mm and 5 mm, between 0.9 mm and 4 mm, between 0.9 mm and 3 mm, or between 0.9 mm and 2.5 mm. In some embodiments, the notch width W can be between 2.0 mm and 8.0 mm, between 3.0 mm and 6.0 mm, between 4.0 mm and 6.0 mm. In other embodiments, the notch width W can be greater than 6.25 mm, greater than 6.5 mm, greater than 6.75 mm, or greater than 7.00 mm. In some embodiments, the notch width W can be greater than half the hosel outer diameter D (W>0.5*D). In some embodiments, the width W can be greater than half the sum of the thread diameter T and the hosel diameter D. In some embodiments, the width W can be greater than the sum of the thread diameter T and half the hosel diameter D. Thus, the width W can be governed in different embodiments by the following equations:

$$W>0.5*D \quad \text{(Eq. 7)}$$

$$W>0.5*(D+T) \quad \text{(Eq. 8)}$$

$$W>T+(0.5*D) \quad \text{(Eq. 9)}$$

The greater the distance W is, the less material is present in the living hinge 1440, and thus less force is required to adjust the golf club head 1400. In addition, the greater the distance W is, the longer the moment arm is between the screw 1434 and the hinge 1440, and thus less force is required to adjust the golf club head 1400.

In some embodiments, the hosel outer diameter D can be between about 12.3 mm and about 14.0 mm, or more specifically, between about 12.5 mm and 13.6 mm. The notch height H can be between 0.9 mm and 20.0 mm, between 0.9 mm and 15 mm, between 0.9 mm and 10 mm, between 0.9 mm and 5 mm, between 0.9 mm and 4 mm, between 0.9 mm and 3 mm, or between 0.9 mm and 2.5 mm. In some embodiments, the notch width W can be between 2.0 mm and 8.0 mm, between 3.0 mm and 6.0 mm, between 4.0 mm and 6.0 mm. In other embodiments, the notch width W can be greater than 6.25 mm, greater than 6.5 mm, greater than 6.75 mm, or greater than 7.00 mm. In some embodiments, the notch width W can be greater than half the hosel outer diameter D(W>0.5*D).

Figure 40:
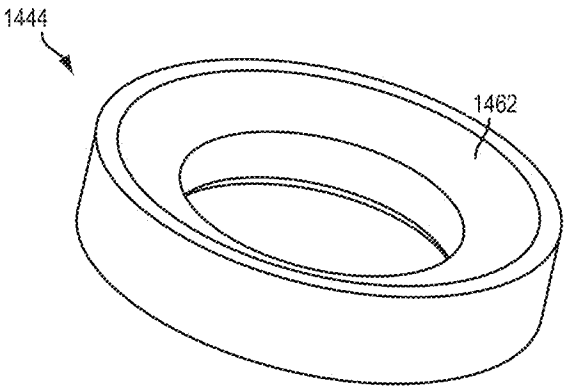
FIG. 40 shows one view of an exemplary retaining ring which can be used with adjustable golf club heads disclosed herein.
Figure 41:
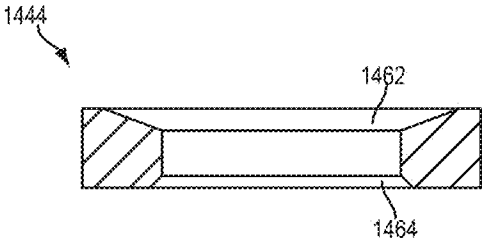
FIG. 41 shows a cross sectional view of the retaining ring of FIG. 30.
Figure 38:
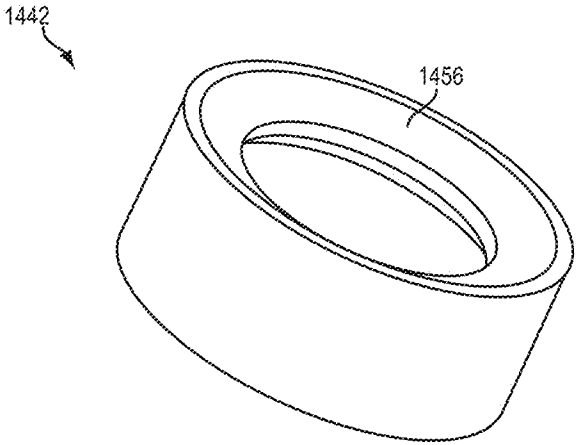
FIG. 38 shows one view of an exemplary bearing pad which can be used with adjustable golf club heads disclosed herein.
Figure 39:
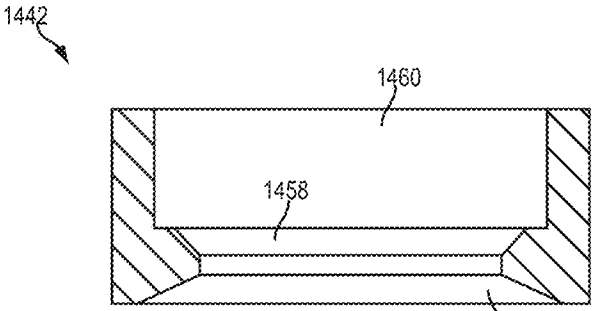
FIG. 39 shows a cross sectional view of the bearing pad of FIG. 38.

FIGS. 38 and 39 illustrate the bearing pad 1442 in greater detail. As shown, the bearing pad 1442 can include a spherical bearing or mating surface 1456 for mating with the head of the screw 1434. The bearing pad 1442 can also include a chamfered edge 1458 and a relief area 1460. FIGS. 40 and 41 illustrate the retaining ring 1444 in greater detail. As shown, the retaining ring 1444 can include a spherical bearing or mating surface 1462 for mating with the head of the screw 1434 and a chamfered edge 1464. The surfaces of the head of the screw that mate with the bearing pad and the retaining ring can have various shapes, for example, these surfaces can be generally spherically shaped.

Spherical surfaces such as bearing surfaces 1456 and 1462 are especially advantageous because they can help to ensure proper loading of the bearing pad 1442 and retaining ring 1444 as the club head 1400 bends about hinge 1440. That is, regardless of the degree to which bending at the hinge 1440 causes the head of the screw 1434 to move with respect to the bearing pad 1442 or retaining ring 1444, the head of the screw 1434 will always have a complementary mating surface for bearing against either the bearing pad 1442 or the retaining ring 1444. For example, bearing pad 1442 and retaining ring 1444 can be desirable for use with embodiments of adjustable golf club heads in which both the lie angle and the loft angle are intended to be adjustable.

Figure 42:
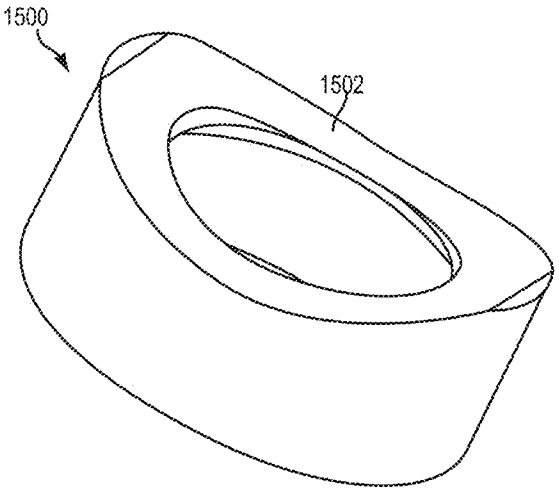
FIG. 42 shows one view of another exemplary bearing pad which can be used with adjustable golf club heads disclosed herein.
Figure 43:
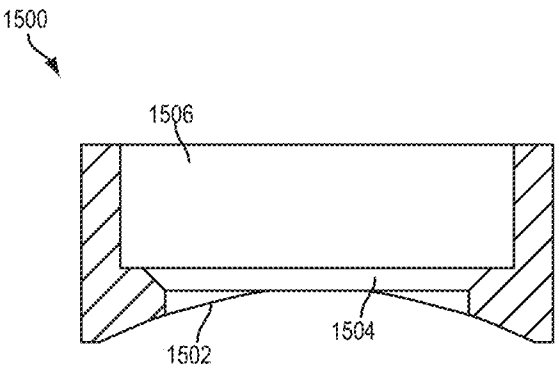
FIG. 43 shows a cross sectional view of the bearing pad of FIG. 42.
Figure 44:
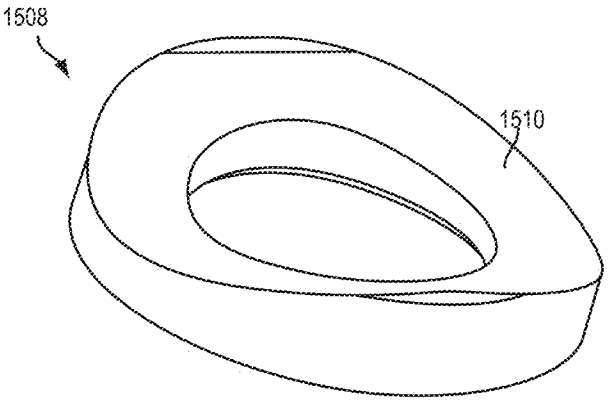
FIG. 44 shows one view of another exemplary retaining ring which can be used with adjustable golf club heads disclosed herein.
Figure 45:
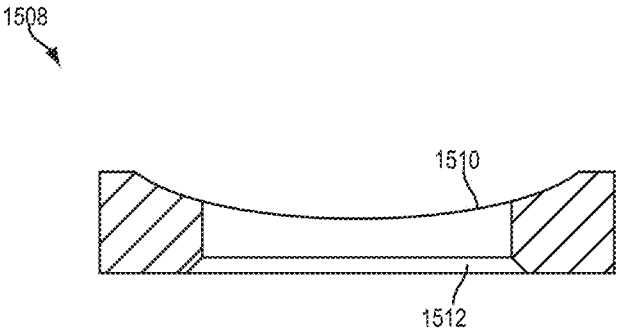
FIG. 45 shows a cross sectional view of the retaining ring of FIG. 44.

FIGS. 42 and 43 illustrate an alternative bearing pad 1500 which can be used with golf club head 1400 in place of bearing pad 1442. As shown, the alternative bearing pad 1500 can include a cylindrical bearing or mating surface 1502 for mating with the head of the screw 1434. The bearing pad 1500 can also include a chamfered edge 1504 and a relief area 1506. FIGS. 44 and 45 illustrate an alternative retaining ring 1508 which can be used with golf club head 1400 in place of retaining ring 1444. As shown, the retaining ring 1508 can include a cylindrical bearing or mating surface 1510 and a chamfered edge 1512.

Cylindrical surfaces such as bearing surfaces 1502 and 1510 are advantageous in cases where movement of the head of the screw 1534 is confined to a single dimension. In such cases, the dimension along which the head of the screw 1434 is anticipated to move can be aligned with the cylindrical shape of the surfaces 1502 and 1510. In such a configuration, the head of the screw 1434 will always have a complementary mating surface for bearing against either the bearing pad 1500 or the retaining ring 1508. For example, bearing pad 1500 and retaining ring 1508 can be desirable for use with embodiments of adjustable golf club heads in which only the lie angle is intended to be adjustable, with the cylindrical shape of surfaces 1502 and 1510 being aligned with an axis extending through the notch, screw, and hinge of the adjustable golf club head.

In some embodiments, the bearing pad and/or the retaining ring of a golf club head can be provided with a conical, rather than cylindrical or spherical bearing or mating surface for mating with the head of an adjustment screw. Such a surface can provide a different profile for contacting the head of the screw than spherical or cylindrical surfaces can provide.

In one alternative embodiment, a golf club head can have a threaded first opening connecting the adjustment bore to the notch, and an unthreaded second opening connecting the shaft bore to the notch. In such an embodiment, the head of the screw can be positioned within the adjustment bore, and the screw can thread through the first opening, extend across the notch and through the second opening, and terminate at a relatively wide or expanded tip situated within the shaft bore. The shaft bore can have a retaining ring situated therein, thus trapping the expanded tip of the screw at the distal end portion of the shaft bore. Thus, in a manner similar to that described above, by turning the screw in the threads of the first opening, the tip of the screw can be caused to either pull on the distal end of the shaft bore or push against the retaining ring situated within the shaft bore, thereby causing adjustments in the geometry of the golf club head. In one specific implementation, a set screw can be used in this alternative embodiment, in which case the head of the screw can be flush with its shaft.

In some embodiments, a filler element or cap can be inserted into the notch, in order to fill or enclose the space therein. In some cases, the filler element can be non-functional. In some cases, the filler element can improve the aesthetic properties of the adjustable golf club head by providing a flush surface or in other ways. In some cases, the filler element can provide additional rigidity and/or strength to the golf club head. Filler elements can be compliant, one-size fits all components which can be used with a golf club head as it is adjusted, or can come in a set of varying sizes such that as the golf club head is adjusted, different filler elements can be used to cover the notch based on the degree to which the club head has been adjusted. Filler elements are desirably configured to not interfere with the adjustability of the golf club head, and in some cases can be easily removable and replaceable.

In some embodiments, a golf club head can include adjustment range limiters which can limit the range of angles through which the lie or loft angles of the club head can be adjusted. An adjustment range limiter can prevent the living hinge being bent beyond a predetermined range and can thus help to prevent damage to and reduce fatigue in the hinge. As one example, a solid piece of material secured within the shaft bore can help to prevent an adjustment screw being tightened beyond a predetermined level. As another example, an adjustment screw can be configured so that it is impossible to loosen it beyond a predetermined level, for example, because it will run out of the threads in the opening between the notch and the shaft bore. In one specific embodiment, a golf club head can be fabricated in a neutral configuration and can be configured such that its lie angle is adjustable through a range of 5° in either direction, i.e., through a total range of 10°.

In some embodiments, a golf club head can include visual indicators which can indicate to a golfer the level to which the screw is tightened and thus the level to which the lie angle of the club head has been adjusted. For example, tabs, notches, or other indicators can be provided on each of the screw head and the hosel, the relative positions of which can indicate each degree, or each half degree, or each quarter degree of adjustment of the lie angle of the golf club head. In some cases, tabs, notches, or other indicators can be provided on the screw head, which can indicate how far the screw head has been turned. In some cases, notches or other indicators can be provided on the shaft of the screw in order to indicate the distance the shaft of the screw has traveled relative to other components of the golf club head.

The screws described herein can be either right-handed or left-handed screws. That is, depending on the particular screw used, turning the head of the screw clockwise can either tighten or loosen the screw.

FIGS. 31-37 illustrate an adjustable golf club head having a living hinge. A living hinge can be advantageous as a hinging mechanism because it experiences minimal friction and wear, and because it is relatively simple and cost effective to manufacture. Notably, the living hinge addresses current brute force methods using substantial force to plastically deform structurally strong hosel designs. While the disclosed embodiments significantly weaken the hosel itself by removing material to form a living hinge, the adjustment mechanism (which may be a screw in some embodiments) reinforces the structural integrity and strength of the hosel. In alternative embodiments, the principles, methods, and mechanisms described with regard to the living hinge of FIGS. 31-37 can be applied to other mechanisms for allowing a golf club head to be bent, including, for example, a rack and pinion system, a cam system, or any other mechanical hinging mechanism.

Adjustable golf club heads as described herein can be adjusted to improve a golfer's performance. For example, one method of adjusting a golf club head includes determining that a player's swing may benefit from an adjustment of the lie angle of one or more of their golf clubs, determining the amount of adjustment of the lie angle for the golf club to be adjusted, adjusting the golf club by turning a screw to cause the hosel to move toward or away from the club face, and ending the adjustment once the desired lie angle is obtained. In some cases, the adjustment can be ended when a visual indicator reveals that the desired lie angle has been achieved.

Various components of the golf club heads described herein can be formed from any of various appropriate materials. For example, components described herein can be formed from steel, titanium, or aluminum. Significant frictional forces can be developed between the surfaces of various components described herein as a golf club head is adjusted. Thus it can be advantageous if various components are fabricated from brass or other relatively lubricious materials, or if any of various surfaces are treated with any of various lubricants, including any of various wet or dry lubricants, with molybdenum disulfide being one exemplary lubricant. Frictional forces can help to ensure that the screw is not unintentionally tightened, loosened, or removed from the openings and the adjustment bore. Thus, various means can be used to advantageously increase frictional forces between various components. For example, chemical compounds or other thread locking components can be used for this purpose.

FIGS. 31-37 show adjustable iron-type golf club heads. In alternative embodiments, however, the features and methods described herein can also be used with a metalwood-type golf club head, or any type of golf club head generally. FIGS. 31-37 show a golf club head intended for use by a right-handed golfer. In alternative embodiments, however, any of the features and methods disclosed herein can also be used with a golf club head intended for use by a left handed golfer.

The components of the golf club heads described herein can be fabricated in any of various ways, as are known in the art of fabricating golf club heads. Features and advantages of any embodiment described herein can be combined with the features and advantages of any other embodiment described herein except where such combination is structurally impossible.

Figure 46:
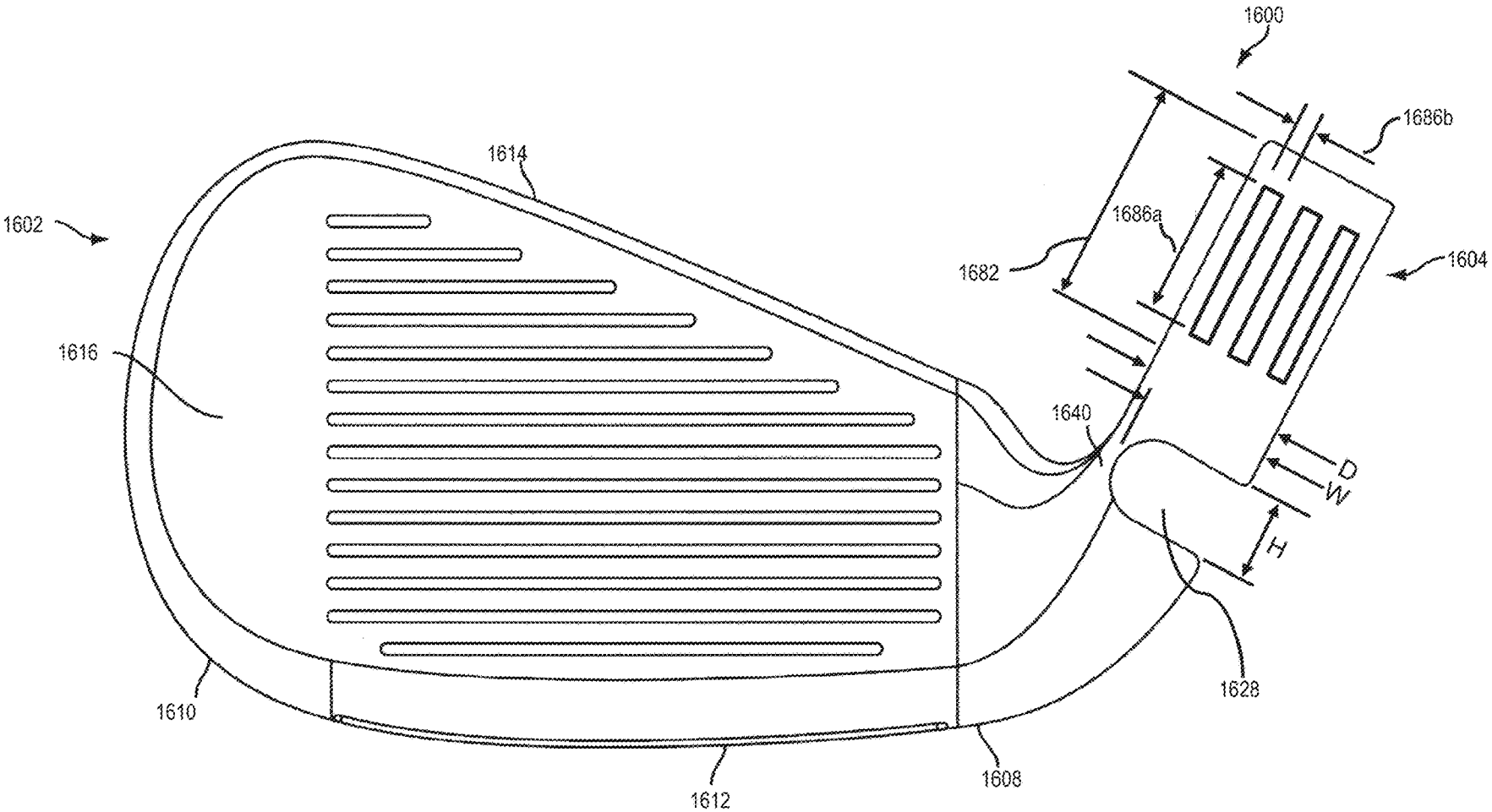
FIG. 46 shows an exemplary embodiment of an iron-type golf club head embodying another lightweight hosel design.

FIG. 46 shows an exemplary iron-type golf club head 1600 which includes a body 1602 and a hosel 1604 configured to allow the club head 1600 to be coupled to a shaft (not pictured). The golf club head 1600 can include a heel portion 1608, a toe portion 1610, a sole portion 1612, a topline portion 1614, and a striking face portion 1616 configured for striking golf balls. The iron-type golf club head 1600 can further include a notch 1628 in a hosel 1604. As shown, the hosel 1604 can have a narrow portion, or living hinge 1640, in the region of the hosel 1604 opposing the notch 1628. The living hinge 1640 can be formed as a continuous piece of material, formed integrally with the remainder of the hosel 1604, and can be configured to provide a relatively flexible location about which the club head 1600 can be bent.

The hosel 1604 can further include a hosel weight reduction zone 1682. This design is similar to the flute design shown in FIGS. 24*a*-24*c* and described by the corresponding text. Additionally, the iron-type golf club head 1602 includes a notch 1628. The notch 1628 reduces the load required for bending of the loft angle and/or lie angle of the iron-type golf club head, which allows for even further mass savings in the hosel weight reduction zone 1682. Notably, it was discovered on some designs that the hosel would fail during bending to adjust the loft angle and/or lie angle. This problem was solved by combining the notch 1628 with the lightweight hosel design. The notch 1628 is shown combined with the fluted hosel design for exemplary purposes. The notch 1628 could be combined with any of the above lightweight hosel designs to achieve a similar function.

Similar to the discussion above, the design shown in FIG. 46 selectively removes material from the hosel creating flutes around the hosel perimeter and along the longitudinal axis of the hosel. The flutes allow for a mass savings of at least 1 g, such as at least 2 g, such as at least 3 g, such as at least 4 g. The design may incorporate multiple flutes, such as 2 or more flutes, such as 3 or more flutes, such as 4 or more flutes, such as 5 or more flutes, such as 6 or more flutes, such as 7 or more flutes, such as 8 or more flutes. The flute design and number of flutes has a direct effect on the amount of mass savings.

As shown, the flutes have a flute height 1686*a* and a flute width 1686*b*. As shown, there is a single row of flute features that encircle the hosel. More rows may be used, and the height 1686*a* and width 1686*b* may be varied. The flute height 1686*a* may range from about 2 mm to about 30 mm and the width 1686*b* may range from about 1 mm to about 42 mm. The flute pattern extends from about 10 mm to about 30 mm. However, the flute pattern may extend further or less depending on the hosel length and desire to adjust the weight savings.

The flute design selectively reduces the hosel wall thickness by varying the outer hosel wall diameter. The outer hosel wall diameter ranges from about 11.6 mm to about 13.6 mm. The flute design like the honeycomb design is offset from the hosel top edge by about 2 mm to about 4 mm. The hosel bore diameter ranges from about 9.0 mm to about 9.6 mm resulting in a hosel wall thickness ranging from about 1.0 mm to about 2.3 mm. The flute pattern may have a length along the longitudinal axis of the hosel ranging from about 10 mm to about 30 mm. The pattern may extend further or less along the longitudinal axis of the hosel to adjust the weight savings. For example, a club with a longer hosel length, such as a sand wedge, the pattern may extend about 20 mm to about 50 mm.

The flute design may be angled relative to longitudinal axis of the hosel or it may be aligned with the longitudinal axis of the hose. The flute widths and flute heights may all be the same or vary along the hosel depending on the desired weight savings. The flute width is the horizontal distance measured from a first flute edge to a second flute edge, and the flute width is at least 1 mm and may range from about 1 mm to about 20 mm, preferably about 3 mm to about 5 mm. The flute length is the vertical distance measured from a top of the flute to a bottom of the flute, and the flute length is at least 4 mm and may range from about 5 mm to about 50 mm, such as about 10 mm to about 35 mm, such as about 15 mm to about 25 mm. Alternatively, a pattern of flutes having smaller flute lengths may be used instead of long flutes. For example, two or more flutes may be stacked on top of one another to create a flute pattern similar to the honeycomb pattern discussed above.

As shown in FIG. 46, the notch 1628 has a height and a width similar to the notch discussed above in relation to FIGS. 31-37. The notch height H can range between 0.9 mm and 20.0 mm, between 0.9 mm and 15 mm, between 0.9 mm and 10 mm, between 0.9 mm and 5 mm, between 0.9 mm and 4 mm, between 0.9 mm and 3 mm, or between 0.9 mm and 2.5 mm. In some embodiments, the notch width W can range between 2.0 mm and 8.0 mm, between 3.0 mm and 6.0 mm, or between 4.0 mm and 6.0 mm. In other embodiments, the notch width W can be greater than 6.25 mm, greater than 6.5 mm, greater than 6.75 mm, or greater than 7.00 mm. In some embodiments, the notch width W can be greater than half the hosel outer diameter D ($W>0.5*D$).

The iron-type golf club head 1602 further includes a bond length region of at least 10 mm and within the bond length region the hosel includes weight reducing features such that within the bond length region the hosel has a mass per unit length of less than about 0.45 g/mm. In other embodiments, the iron-type golf club head 1602 hosel has a mass per unit length within the bond length region between 0.45 g/mm and 0.40 g/mm, between 0.40 g/mm and 0.35 g/mm, between 0.35 g/mm and 0.30 g/mm, or between 0.30 g/mm and 0.26 g/mm within the bond length region. In some embodiments, the iron-type golf club head and/or the hosel has a density between about 7,700 $kg/m^3$ and about 8,100 $kg/m^3$.

Third Representative Embodiment

The striking faces of any of the iron type golf clubs described above can comprise twisted striking surfaces having degrees of twist according to any of the embodiments described herein. For example, the plane of the striking surface can be twisted relative to a center face location such that the portion of the striking surface above a line extending through the center face location is twisted open with respect to an intended target (and optionally including increased loft), and the portion of the striking surface below the line is twisted closed with respect to the intended target (and optionally including decreased loft).

Figure 47:
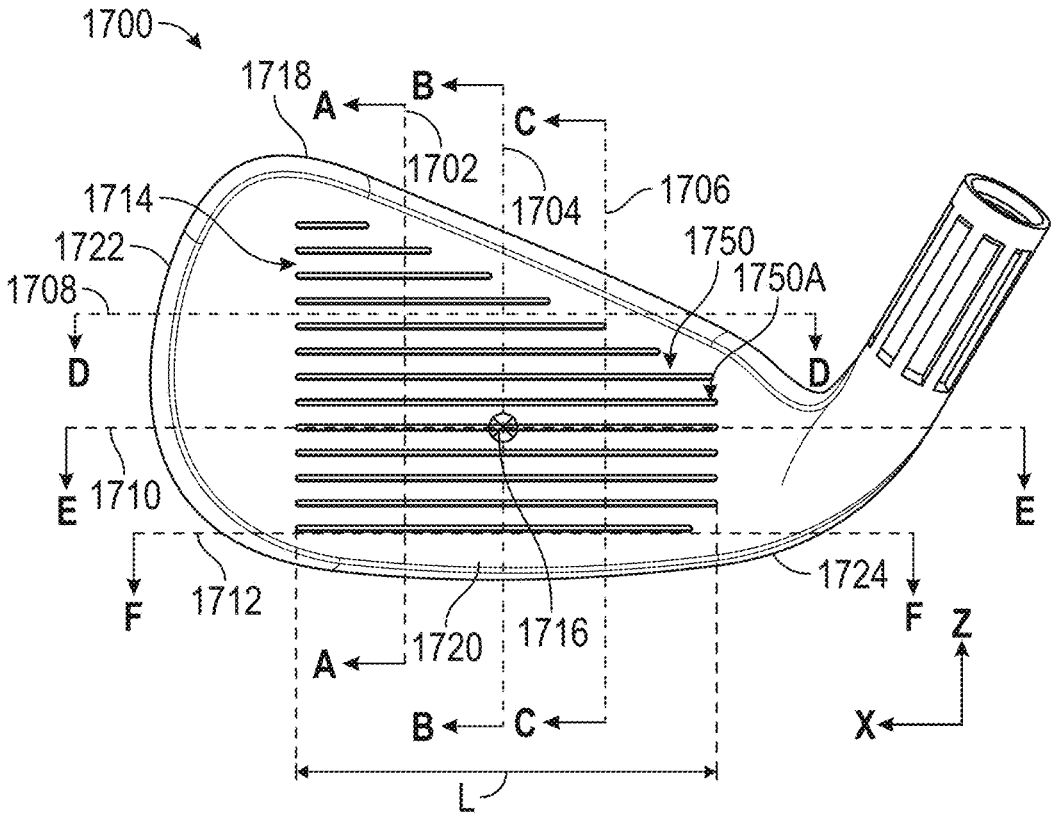
FIG. 47 is a front elevation view of another embodiment of an iron-type golf club head.

More particularly, the "twisted" horizontal and vertical striking face contours described above with reference to FIGS. 1-10 can be applicable to the iron-type golf clubs described with reference to FIGS. 11A-46. For example, FIG. 47 illustrates a iron-type golf club head 1700 similar to the club head 900 of FIG. 11A with a plurality of representative vertical planes 1702, 1704, 1706 and horizontal planes 1708, 1710, 1712 superimposed thereon. The striking face 1714 can have a center face location indicated at 1716, and a plurality of horizontally-extending scorelines 1750.

In certain embodiments, the center face location 1716 can correspond to the geometric center of the striking face 1714 as determined by the U.S. Golf Association (USGA) "Procedure for Measuring the Flexibility of a Golf Clubhead," Revision 2.0, Mar. 25, 2005, described in U.S. Pat. No. 10,052,530, which is incorporated herein by reference. In some embodiments, the center face location 1716 can correspond to the CG location projected onto the striking face, and/or to an ideal impact location on the striking face. In some embodiments, the center face location 1716 can be determined on a per-club basis based on the particular club's design and geometry, and where on the striking face players tend to strike the ball most frequently. Wherever the center face location is located on the striking face, it can be the location about which the plane of the striking face is "twisted," as described below. In the illustrated embodiment, the center face location 1716 can be located at a position 20.5 mm above the ground plane when the club is in the address position and oriented at loft. The golf club head 1700 can also comprise a topline portion 1718, a sole portion 1720, a toe portion 1722, and a heel portion 1724. However, in other embodiments the center face location 1716 may be located at 15 mm above the ground plane to 25 mm above the ground plane depending upon the club design and the particular characteristics desired.

In the illustrated embodiment, the toe-side vertical plane 1702, the center vertical plane 1704 (passing through center face location 1716), and the heel-side vertical plane 1706 extend from adjacent the topline portion 1718 to adjacent the sole portion 1720, and are separated by a distance of 14 mm as measured from the center face location 1716. The upper horizontal plane 1708, the center horizontal plane 1710 (passing through the center face 1716), and the lower horizontal plane 1712 extend from adjacent the toe portion 1722 to adjacent the heel portion 1724, and are spaced from each other by 15 mm as measured from the center face location 1716.

The vertical planes 1702, 1704, and 1706 can define striking face surface topline-to-sole contours A, B, and C extending from the topline portion 1718, similar to FIG. 4*b* above. Because the iron-type golf club head 1700 does not a include roll radius, the vertical topline-to-sole contours A, B, and C can be straight line contours, or substantially straight line contours, extending parallel to the plane of the striking face 1714. Similarly, because the iron-type golf club head 1700 does not a include bulge radius, the horizontal toe-to-heel contours D, E, and F can be straight line contours, or substantially straight line contours, extending parallel to the plane of the striking face 1714.

Figure 48:
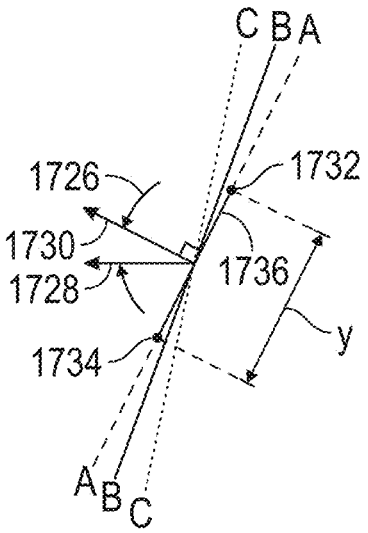
FIG. 48 is an exaggerated comparative view of face surface contours taken along section lines A-A, B-B, and C-C of FIG. 47 as seen from a heel view.

For example, FIG. 48 illustrates all three striking face surface topline-to-sole contours A, B, and C are overlaid on top of one another as viewed from the heel side of the golf club. The three face surface contours are defined as face contours that intersect the three vertical planes 1702, 1704, and 1706. Specifically, the toe side contour A, represented by a dashed line, is defined by the intersection of the striking face surface and the vertical plane 1702 located on the toe side of the striking face 1714. The center face vertical contour B, represented by a solid line, is defined by the intersection of the striking face surface and the center face vertical plane 1704 located at the center of the striking face 1714. The heel side contour C, represented by a finely dashed line, is defined by the intersection of the striking face surface and the vertical plane 1706 located on the heel side of the striking face 1714. The topline-to-sole contours A, B, C are considered three different contours across the striking face taken at three different locations to show the variability of the loft angle across the face. The toe side vertical contour A is more lofted (having positive LA° Δ) relative to the center face vertical contour B. The heel side vertical contour C is less lofted (having a negative LA° Δ) relative to the center face vertical contour B.

FIG. 48 shows a loft angle change 1726 that is measured between a center face vector 1728 located at the center face 1716 and the toe side topline-to-sole contour A having a loft angle vector 1730. The vertical pin distance y is measured along the toe-side straight line contour A from a center location to a topline side and a sole side to locate a topline side measurement point 1732 and a sole side measurement point 1734. In certain embodiments, the measurement points 1732 and 1734 can correspond to the distance between the two vertical pins of a Golf Instruments Co. "black gauge" for measuring the loft angle of a selected point (e.g., 15 mm, 13.5 mm, 12.7 mm), as described above. A segment line 1736 connects the two points of measurement 1732 and 1734. The loft angle vector 1732 is perpendicular to the segment line 1736. The loft angle vector 1732 defines a loft angle 1726 with the center face vector 1728 located at the center face point 1716. As described, a more lofted angle indicates that the loft angle change (LA° Δ) is positive relative to the center face vector 1728 and points above or higher relative to the center face vector 1728, as is the case for the topline-to-sole straight line contour A.

Figure 49:
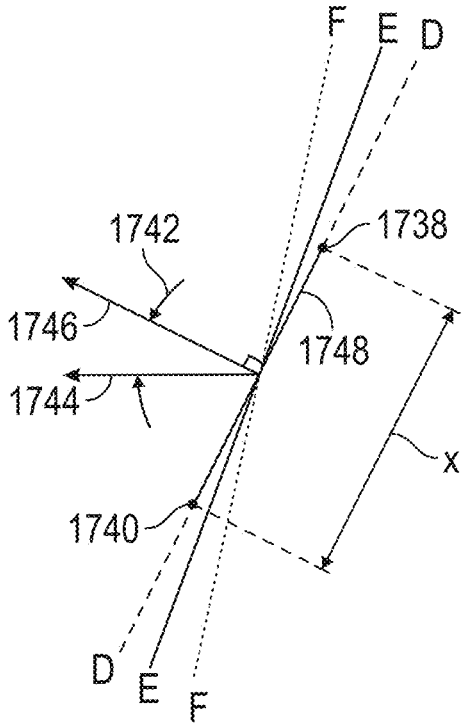
FIG. 49 is an exaggerated comparative view of face surface contours taken along section lines D-D, E-E, and F-F of FIG. 47 as seen from a top view.

FIG. 49 further illustrates the three striking face surface horizontal or toe-to-heel contours D, E, and F are overlaid on top of one another as viewed from the topline side of the golf club. The three face surface contours are defined as face contours that intersect the three horizontal planes 1708, 1710, and 1712. Specifically, the topline-side contour D, represented by a dashed line, is defined by the intersection of the striking face surface and the upper horizontal plane 1708 located on the upper side of the striking face toward the topline portion 1718. The horizontal pin distance x is measured along the toe-to-heel contour D from a center location to a toe side measurement point 1738 and a heel side measurement point 1740. In certain embodiments, the distance between a toe side measurement point 1738 and a heel side measurement point 1740 can be 36.5 mm, corresponding to the horizontal distance between the respective measurement pins of a Golf Instruments Co. black gauge described above.

The center face contour E, represented by a solid line, is defined by the intersection of the striking face surface and horizontal plane 1710 located at the center of the striking face 1714. The sole-side contour F, represented by a finely dashed line, is defined by the intersection of the striking face surface and the horizontal plane 1712 located on the lower side of the striking face 1714. The straight line toe-to-heel contours D, E, and F are considered three different horizontal contours across the striking face 1714 taken at three different locations to show the variability of the face angle across the face. The topline-side toe-to-heel contour D is more open (having a positive FA° Δ, as defined above) when compared to the center face toe-to-heel contour E. The sole-side toe-to-heel contour F is more closed (having a negative FA° Δ when measured relative to the center vertical plane).

For example, FIG. 49 shows a face angle 1742 that is measured between a center face vector 1744 that is located at the center face 1714 and parallel to the ground plane, and the topline side toe-to-heel contour D having a face angle vector 1746. A segment line 1748 connects the two points of measurement 1738 and 1740. The face angle vector 1746 is perpendicular to the segment line 1748. The face angle vector 1746 defines the face angle 1742 with the center face vector 1744 located at the center face point 1714. As described above, an open face angle indicates that the face angle change (FA° Δ) is positive relative to the center face vector 1744 and points to the right, as is the case for the topline side toe-to-heel contour D.

With the type of "twisted" toe-to-heel and topline-to-sole contours defined above, a ball that is struck in the upper portion of the face will be influenced by horizontal contour D, which provides a general curvature that points to the right to counter the left tendency of a typical upper face shot, as described above. Likewise, the "twisted" toe-to-heel contour F can provide a general curvature that points to the left to counter the right tendency of a typical lower face shot. It is understood that the contours illustrated in FIGS. 48 and 49 are severely distorted for explanation purposes. Additionally, any of the methods described above, including laser scanning, surface profile extraction from a CAD model, and/or use of a manual measurement device such as a black gauge, may be used to determine whether a 2-D contour, such as A, B, C, D, E, or F, is pointing left, right, up, or down, as described above.

Figure 50:
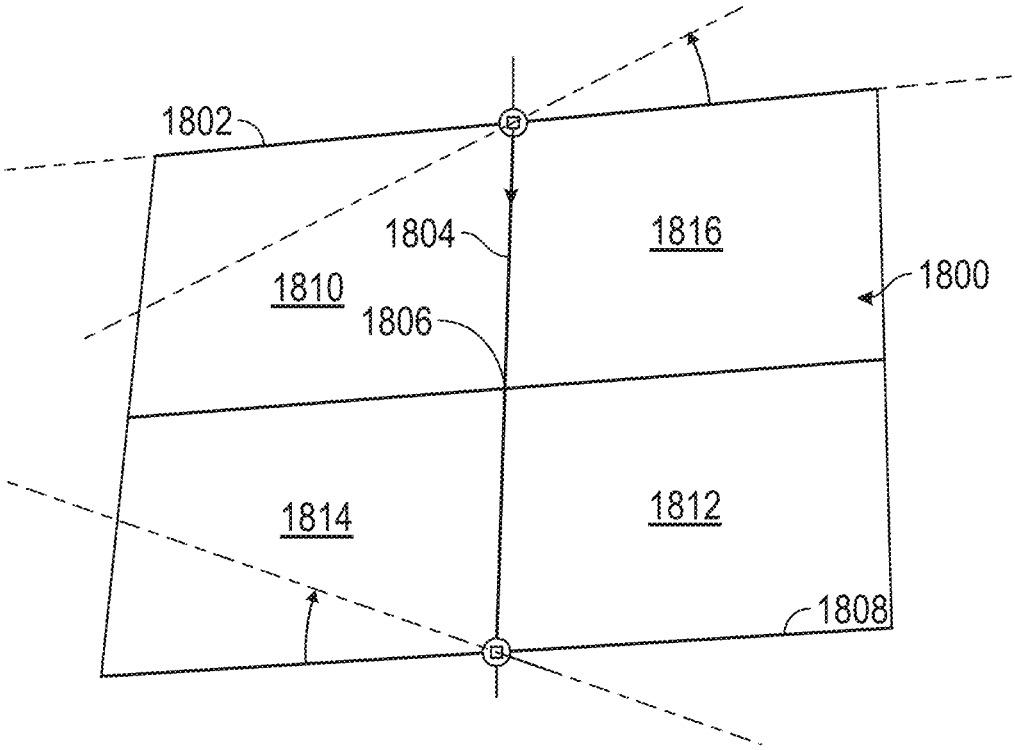
FIG. 50 is a perspective view of a twisted striking surface plane, according to one embodiment.

To further the understanding of what is meant by a "twisted face" on an iron-type golf club, FIG. 50 provides a perspective view of a plane 1800 representative of a striking face. The plane 1800 can comprise a swept blend in which a first horizontal line or axis 1802 is rotated open about a scoreline mid-plane axis 1804. In certain embodiments, the scoreline mid-plane axis 1804 can pass through a center face location 1806. In certain embodiments, the center face location 1806 may be an empirically determined location on the face where players most frequently strike a golf ball. For certain types of irons, the center face location 1806 can be located 20.5 mm above the ground plane when the club is at address and positioned at loft. The first horizontal axis 1802 may be spaced apart from the scoreline mid-plane axis 1804 by 15 mm, and a second horizontal axis 1808 may be located 15 mm below the scoreline mid-plane axis 1804. The second horizontal axis 1808 may be rotated closed about the scoreline mid-plane axis 1804, thereby producing the surface profile described above in which an upper toe quadrant 1810 is relatively more lofted and more open than a lower heel quadrant 1812, and in which a lower toe quadrant 1814 is relatively more closed and more lofted than an upper heel quadrant 1816. The surface of the plane 1800 can be extended to the edges of the perimeter of any striking face shape such that the loft angle and face angle parameters continue to change with increasing distance from the center face location 1806.

Figure 51:
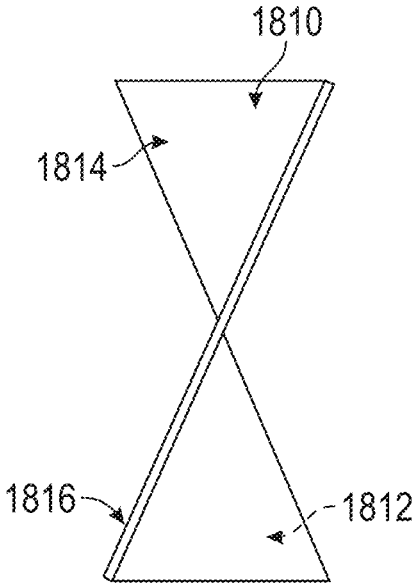
FIG. 51 is a top view of the twisted striking surface plane of FIG. 50.
Figure 52:
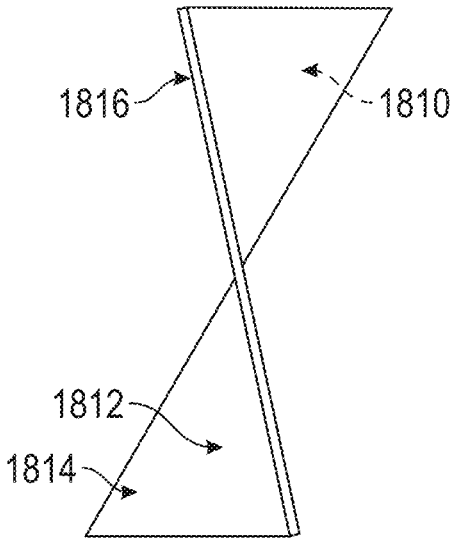
FIG. 52 is a heel-side view of the twisted striking surface plane of FIG. 50.

FIG. 51 provides a top view of the twisted striking surface plane 1800 over-exaggerated to illustrate the concept as applied to an iron-type golf club striking face, with the general location of the quadrants 1810-1816 indicated. FIG. 52 illustrates a side-elevation view as viewed from the heel side of the striking surface plane 1800, with the general location of the quadrants 1810-1816 indicated.

Figure 53:
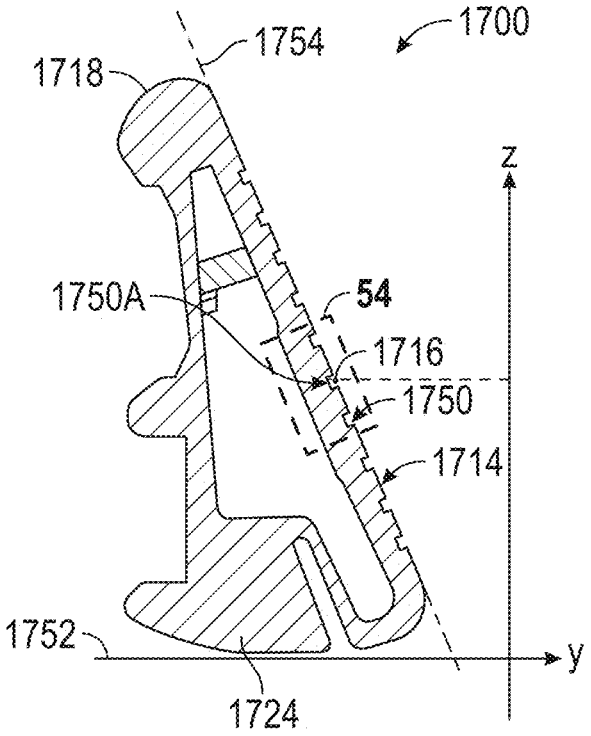
FIG. 53 is a cross-sectional side elevation view of the iron-type golf club head of FIG. 47.

Because iron-type golf club heads typically do not have the bulge or roll radii associated with wood-type golf clubs, quantities such as FA° Δ and/or LA° Δ can be measured relative to the center face location directly, rather than along bands of bulge and/or roll curvature. For example, FIG. 53 illustrates a cross-section of the iron-type golf club head 1700 taken along line B-B of FIG. 47. In FIG. 53, the iron-type golf club head 1700 is shown at "scoreline lie," the lie angle at which the substantially horizontal face scorelines 1750 are parallel to a perfectly flat ground plane 1752. At scoreline lie, the striking face 1714 can define a striking face plane 1754. Thus, the position of points on the striking face 1714, including the center face location 1716, can be denoted by coordinates along the x-axis (FIG. 47) (extending into the plane of the page in FIG. 53) and along the z-axis (FIG. 53), which can be perpendicular to the ground plane 1752.

As noted above, in certain embodiments the center face location 1716 can be empirically determined based on the location on the striking face 1714 where players most frequently strike a golf ball. Accordingly, in certain embodiments the center face location 1716 can be located at a z-axis coordinate of 20.5 mm above the ground plane 1752. The center face location 1716 can have an x-axis coordinate of 0 mm. In the illustrated embodiment, the center face location 1716 can be located at the midpoint of a scoreline 1750A. The scoreline 1750A can be a "center scoreline," meaning that its length L (FIG. 47) is the longest, or among the longest, of all the scorelines 1750 on the striking face 1714. For example, in the illustrated embodiment the striking face 1714 includes six "center scorelines" including the center scoreline 1750A having the length L, with two center scorelines being located above the scoreline 1750A (e.g., in the positive z direction) and three center scorelines being located below the scoreline 1750A (e.g., in the negative z direction). In other words, the center face location 1716 can be positioned along the x-axis at L/2.

Figure 54:
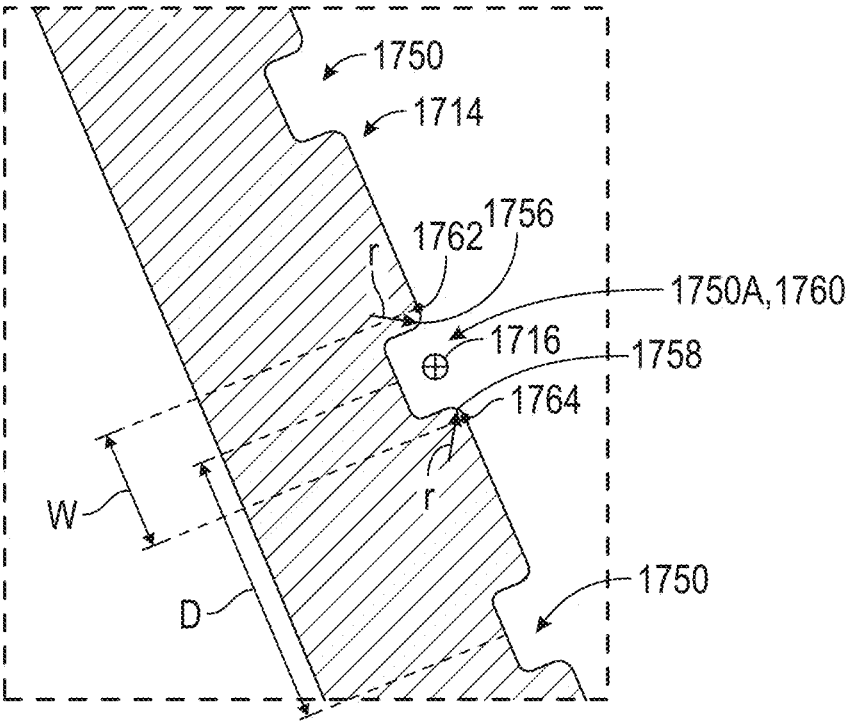
FIG. 54 is a magnified view of portion 54 of the striking face of the golf club head of FIG. 53.

In the illustrated embodiment, the center face location 1716 also falls within the scoreline 1750A. FIG. 54 illustrates a portion of the scoreline 1750A in greater detail. Typically, scorelines such as the scoreline 1750A include curved or rounded edges 1756 and 1758 having radii r. Scorelines such as the scoreline 1750A may have a scoreline width W, defined as the distance across the groove 1760 of the scoreline from a point 1762 where the radiused edge 1756 begins to a point 1764 where the radiused edge 1758 ends. Thus, as used herein, a location or point that falls "within a scoreline" refers to a location or point that falls within the groove 1760 of the scoreline itself, and/or on either of the radiused edges 1756 and 1758 between the points 1762 and 1764.

Where a desired measurement point on a striking face falls "within the scoreline" as defined above, the desired measurement point may be moved or offset up or down along the striking face by a distance of W/2, and the measurement taken at that location. Alternatively, the desired measurement point may be offset along the striking face by a distance D/2, where D is the center-to-center distance between the groove of a scoreline into which a desired measurement point falls, and the groove of the next scoreline on the striking face above or below the desired measurement point. In yet other embodiments, where the radius r of the scoreline edges is known, the desired measurement point can be offset up or down along the striking face by an appropriate distance such that it no longer falls on a radiused scoreline edge. Any of these methods may be used to determine the center face location, and/or points on the face where FA° Δ and/or LA° Δ are to be measured.

Figure 55:
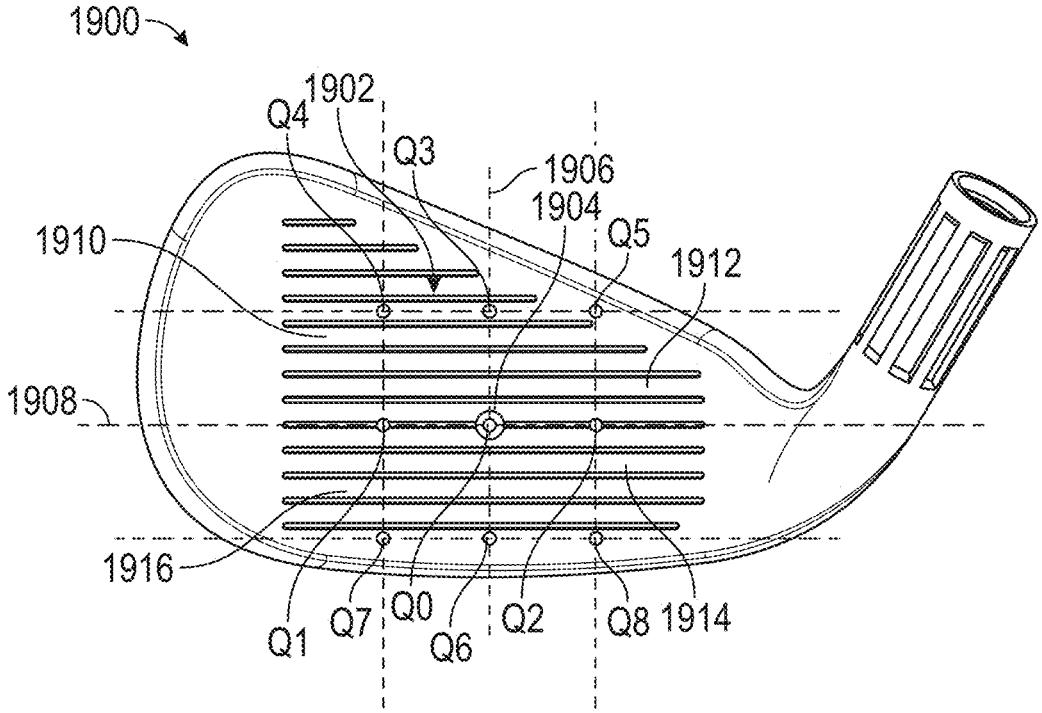
FIG. 55 is a front elevation view of another embodiment of an iron-type golf club head including a plurality of grid measurement points indicated thereon.

FIG. 55 shows an iron-type golf club head 1900 including a twisted striking face 1902 as described above. A plurality of points Q0-Q8 are shown spaced apart across the striking face 1902 in a grid pattern, including two "critical points" Q3 and Q6. In the illustrated embodiment, the desired measurement point Q0 can be located at the center face location 1904. A vertical axis 1906 (e.g., perpendicular to the ground plane) and a horizontal axis 1908 intersect at the desired measurement point Q0 and divide the striking face 1902 into four quadrants. The upper toe quadrant 1910, the upper heel quadrant 1912, the lower heel quadrant 1914, and the lower toe quadrant 1916 all form the striking face 1902, collectively. In certain embodiments, the upper toe quadrant 1910 can be more "open" than all the other quadrants, and the lower heel quadrant 1914 can be more "closed" than all the other quadrants, as described above.

In the illustrated embodiment, the critical points Q3 and Q6 can be located at (x, z) coordinates (0 mm, 15 mm) and (0 mm, −15 mm), respectively, and the total face angle change between these two critical locations Q3 and Q6 as an absolute value defines the amount of "twist" or "total twist" of the striking face, as described above. For example, a "1° twist" indicates that the Q3 point has a 0.5° twist relative to the center face location Q0, and the Q6 point has a −0.5° twist relative to the center face location Q0.

In the embodiment illustrated in FIG. 55, the heel side points Q5, Q2, and Q8 are spaced 14 mm away from the vertical axis 1906 passing through the center face location 1904. Toe side points Q4, Q1, and Q7 are spaced 14 mm away from the vertical axis 1906 passing through the center face. Crown side points Q3, Q4, and Q5 are spaced 15 mm away from the horizontal axis 1908 passing through the center face location 1904. Sole side points Q6, Q7, and Q8 are spaced 15 mm away from the horizontal axis 1908. Point Q5 is located in the upper heel quadrant 1912 at a coordinate location (−14 mm, 15 mm) while point Q7 is located in the lower toe quadrant 1916 at a coordinate location (14 mm, −15 mm). Point Q4 is located in the upper toe quadrant 1910 at a coordinate location (14 mm, 15 mm), while point Q8 is located in the lower heel quadrant 1914 at a coordinate location (−14 mm, −15 mm).

The iron-type golf club heads described herein may have any of the degrees of twist or twist ranges described herein, such as "0.2° twist", "0.5° twist", "0.6° twist", "1° twist", "1.5° twist", "2° twist", "3° twist", "4° twist", "5° twist", "6° twist", "8° twist", etc. For a given amount of "twist," the FA° Δ is given by Equation 10 below, where Δz is the distance along the z-axis by which the measurement point is spaced from the center face location. The actual face angle at the measurement location is given by Equation 11.

$$FA°\Delta = \frac{\text{Twist}}{30} \cdot \Delta z \quad \text{(Eq. 10)}$$

$$FA(z) = \frac{\text{Twist}}{30} \cdot z \quad \text{(Eq. 11)}$$

For a given amount of "twist," the LA° Δ is given by Equation 12 below, which may be algebraically simplified to Equation 13.

$$LA°\Delta = \tan^{-1}\left(\frac{\Delta x \cdot \tan\left(\frac{\text{Twist}}{30} \cdot \Delta z\right)}{\Delta z}\right) \quad \text{(Eq. 12)}$$

$$LA°\Delta = \frac{\text{Twist}}{30} \cdot \Delta x \quad \text{(Eq. 13)}$$

The actual loft angle for a specified measurement location is given by Equation 14, where "static loft" is the nominal loft angle of the iron-type club when positioned on the ground at scoreline lie.

$$LA(x) = \left(\frac{\text{Twist}}{30} \cdot x\right) + \text{static loft} \quad \text{(Eq. 14)}$$

Thus, in certain embodiments the point Q3 may have a FA° Δ, of from 0.09° (corresponding to a "0.2° twist") to 4° (corresponding to an "8° twist"), and the point Q6 may have corresponding values of −0.09° to −4°. In certain embodiments the point Q3 may have a FA° Δ, of from 0.25° (corresponding to a "0.5° twist") to 3° (corresponding to a "6° twist"), and the point Q6 may have corresponding values of −0.25° to −3°. In certain embodiments, the point Q4 may have a LA° Δ, of 0.09° (corresponding to a "0.2° twist") to 3.75°, such as about 3.73° (corresponding to a "8° twist"), and the point Q8 may have corresponding values of −0.09° to −3.75°, such as about −3.73°. In certain embodiments, the point Q4 may have a LA° Δ of 0.23° (corresponding to a "0.5° twist") to 2.8° (corresponding to a "6° twist"), and the point Q8 may have corresponding LA° Δ, values of −0.23° to −2.8°.

Figure 56:
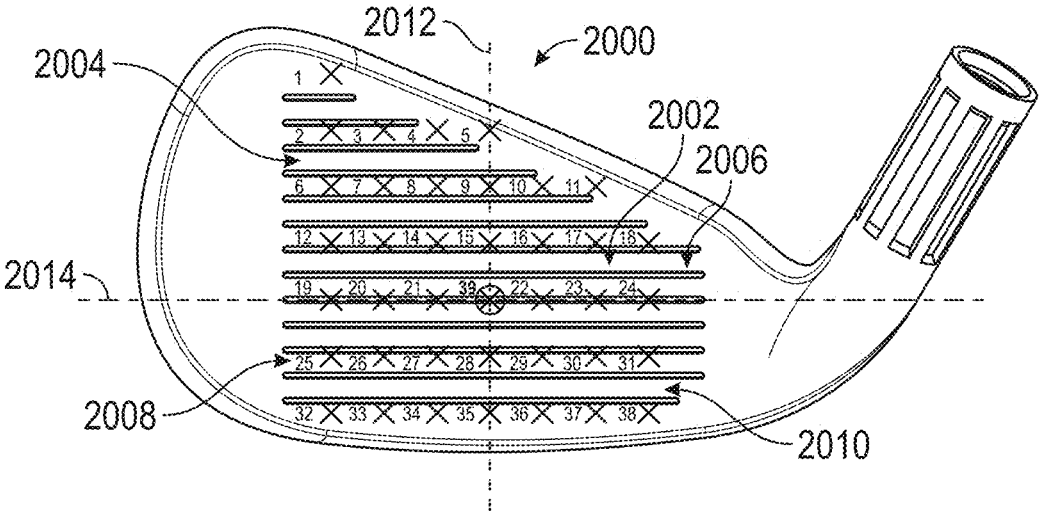
FIG. 56 is a front elevation view of another embodiment of an iron-type golf club head including a plurality of measurement points indicated thereon.

FIG. 56 illustrates an iron-type golf club head 2000 including a twisted striking face 2002 similar to the club head 1900 described above, and including a plurality of points 1-39 spaced apart across the striking face 2002 in a grid pattern, where point 39 is the center face location. Table 7 below provides the x- and z-coordinates of the points 1-39, along with the FA° Δ and LA° Δ for each point relative to the center face location 39, for a striking face having 2° of twist.

TABLE 7

Relative to Center Face for 2° Twist

| Point | x-axis (mm) | z-axis (mm) | FA° Δ | LA° ΔA |
|---|---|---|---|---|
| 1 | 21 | 30 | 2.0 | 1.40 |
| 2 | 21 | 22.5 | 1.5 | 1.40 |
| 3 | 14 | 22.5 | 1.5 | 0.93 |
| 4 | 7 | 22.5 | 1.5 | 0.47 |
| 5 | 0 | 22.5 | 1.5 | 0.00 |
| 6 | 21 | 15 | 1 | 1.40 |
| 7 | 14 | 15 | 1 | 0.93 |
| 8 | 7 | 15 | 1 | 0.47 |
| 9 | 0 | 15 | 1 | 0.00 |
| 10 | −7 | 15 | 1 | −0.47 |
| 11 | −14 | 15 | 1 | −0.93 |
| 12 | 21 | 7.5 | 0.5 | 1.40 |
| 13 | 14 | 7.5 | 0.5 | 0.93 |
| 14 | 7 | 7.5 | 0.5 | 0.47 |
| 15 | 0 | 7.5 | 0.5 | 0.00 |
| 16 | −7 | 7.5 | 0.5 | −0.47 |
| 17 | −14 | 7.5 | 0.5 | −0.93 |

TABLE 7-continued

| Relative to Center Face for 2° Twist | | | | |
|---|---|---|---|---|
| Point | x-axis (mm) | z-axis (mm) | FA° Δ | LA° ΔA |
| 18 | −21 | 7.5 | 0.5 | −1.40 |
| 19 | 21 | 0 | 0 | 0.00 |
| 20 | 14 | 0 | 0 | 0.00 |
| 21 | 7 | 0 | 0 | 0.00 |
| 39 | 0 | 0 | 0 | 0.00 |
| 22 | −7 | 0 | 0 | 0.00 |
| 23 | −14 | 0 | 0 | 0.00 |
| 24 | −21 | 0 | 0 | 0.00 |
| 25 | 21 | −7.5 | −0.5 | 1.40 |
| 26 | 14 | −7.5 | −0.5 | 0.93 |
| 27 | 7 | −7.5 | −0.5 | 0.47 |
| 28 | 0 | −7.5 | −0.5 | 0.00 |
| 29 | −7 | −7.5 | −0.5 | −0.47 |
| 30 | −14 | −7.5 | −0.5 | −0.93 |
| 31 | −21 | −7.5 | −0.5 | −1.40 |
| 32 | 21 | −15 | −1 | 1.40 |
| 33 | 14 | −15 | −1 | 0.93 |
| 34 | 7 | −15 | −1 | 0.47 |
| 35 | 0 | −15 | −1 | 0.00 |
| 36 | −7 | −15 | −1 | −0.47 |
| 37 | −14 | −15 | −1 | −0.93 |
| 38 | −21 | −15 | −1 | −1.40 |

Figure 57:
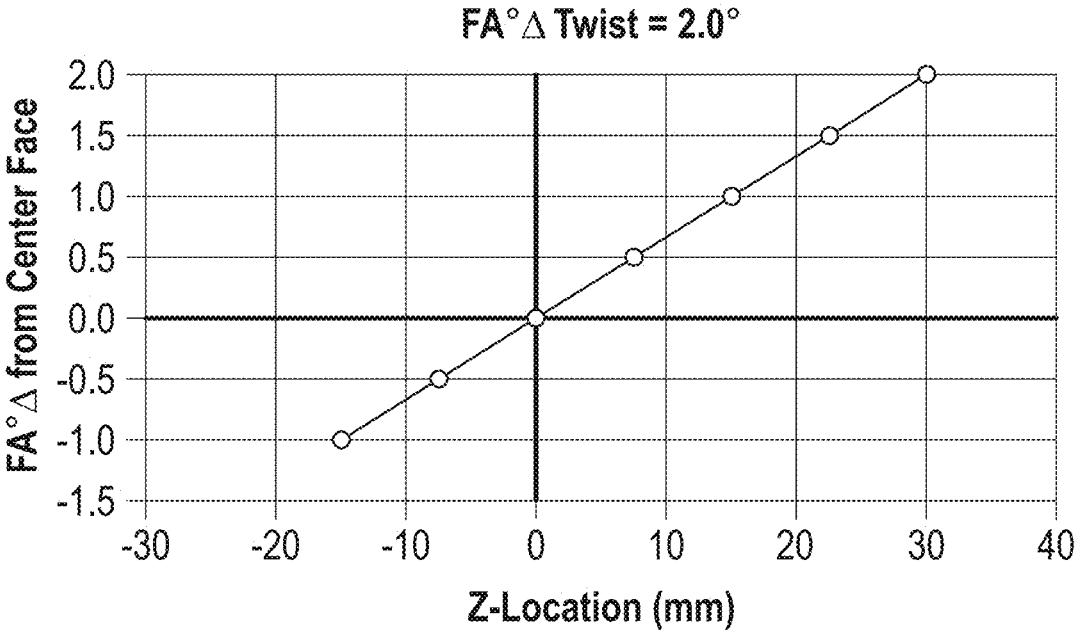
FIGS. 57-72 are graphs illustrating FA° Δ, and LA° Δ, values for selected points on striking faces having twist amounts varying from 2.0° to 0.33°.
Figure 58:
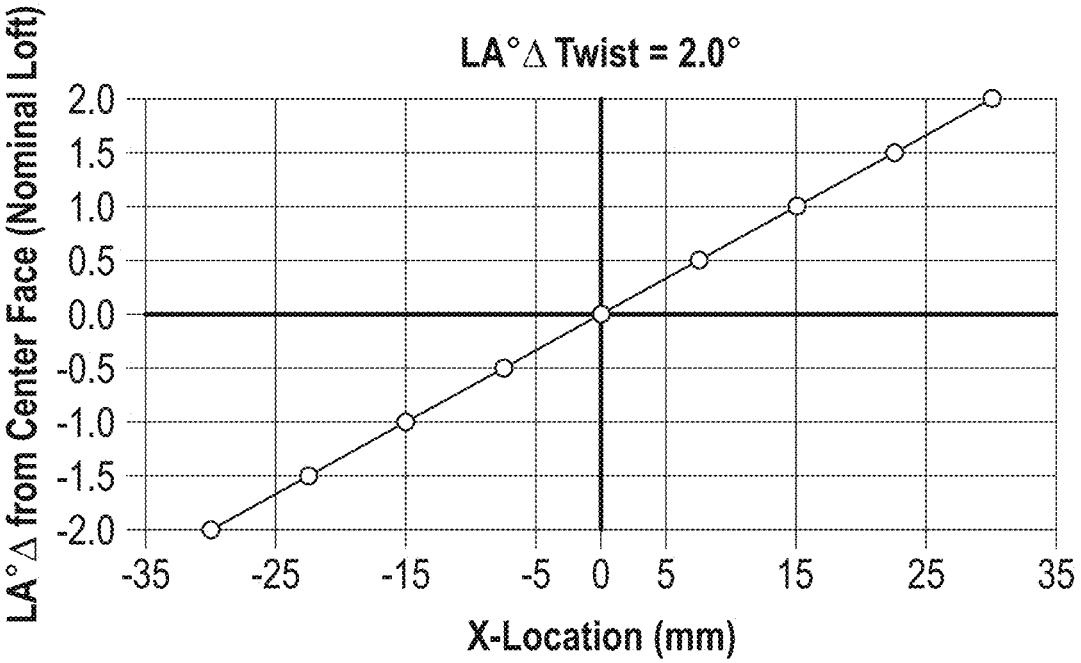

FIGS. 57 and 58 are graphs illustrating the variation of FA° Δ (FIG. 57) and LA° Δ (FIG. 58) at selected points along the z-axis across the striking face 2002 for the golf club head 2000 with 2° of twist. As illustrated in FIG. 57, the FA° Δ can vary from −1.0° at z=−15 mm to 2° at z=30 mm. Meanwhile, as illustrated in FIG. 58, the LA° Δ can vary from −2.0° at x=−30 mm to 2.0° at x=30 mm.

Figure 59:
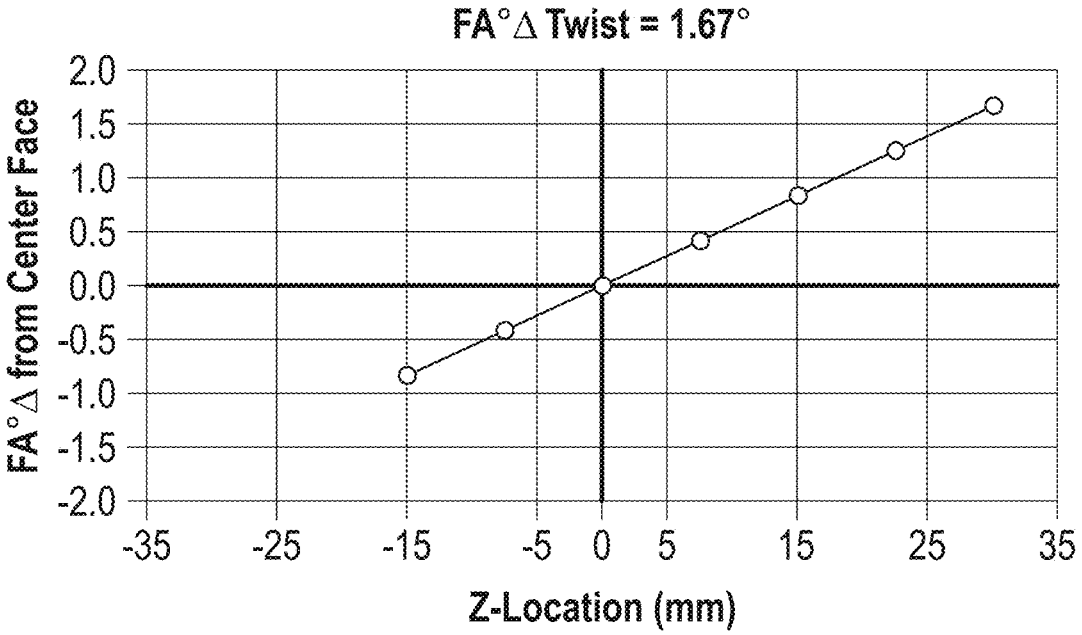
Figure 60:
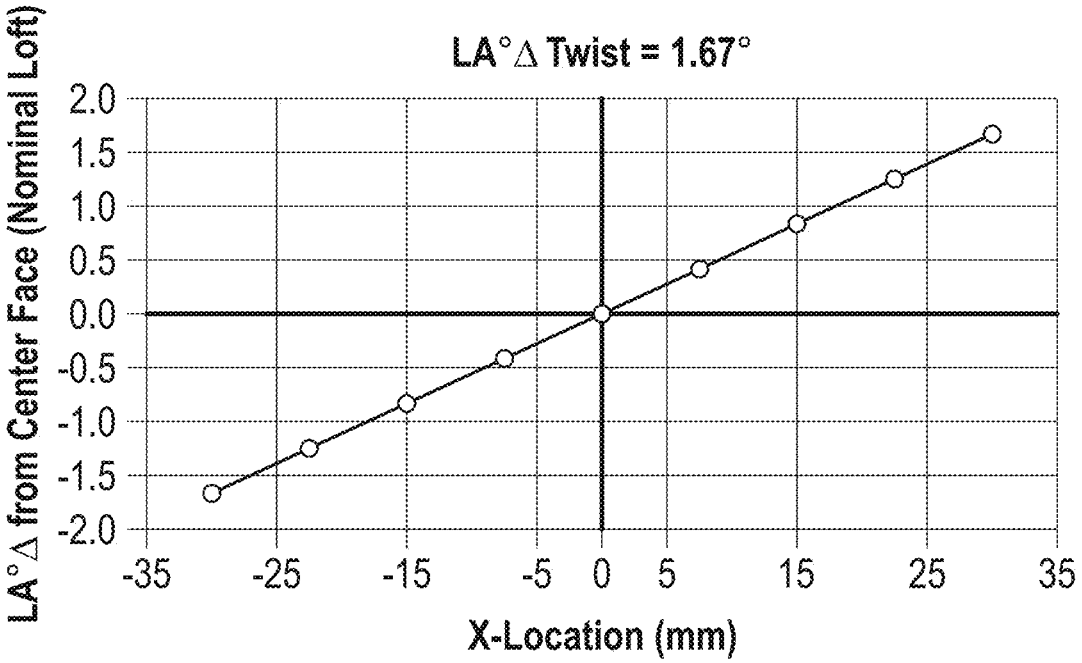
Figure 61:
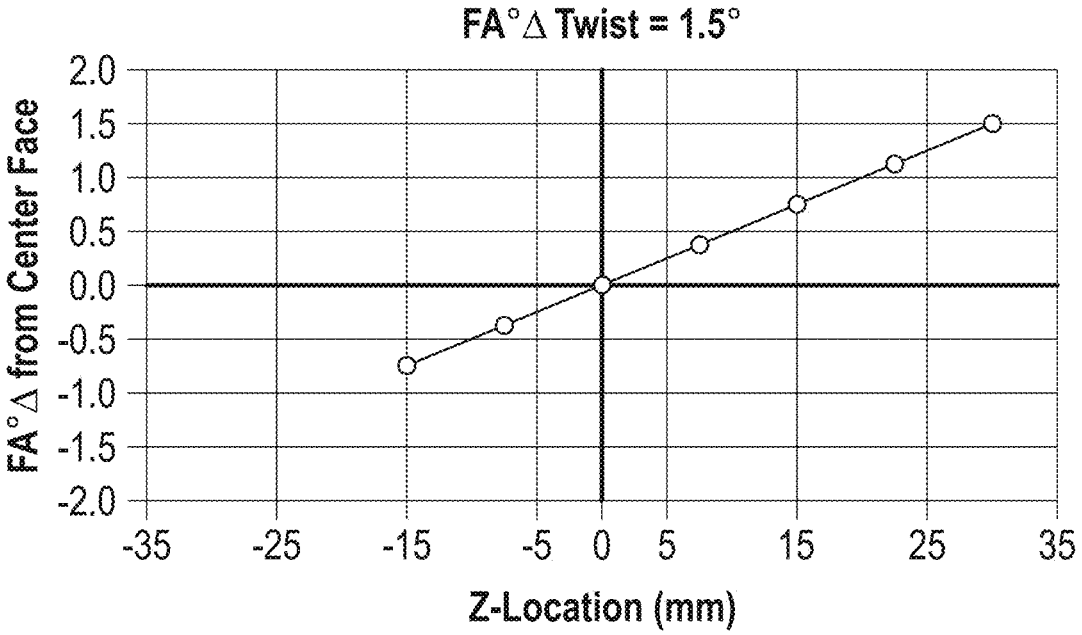
Figure 62:
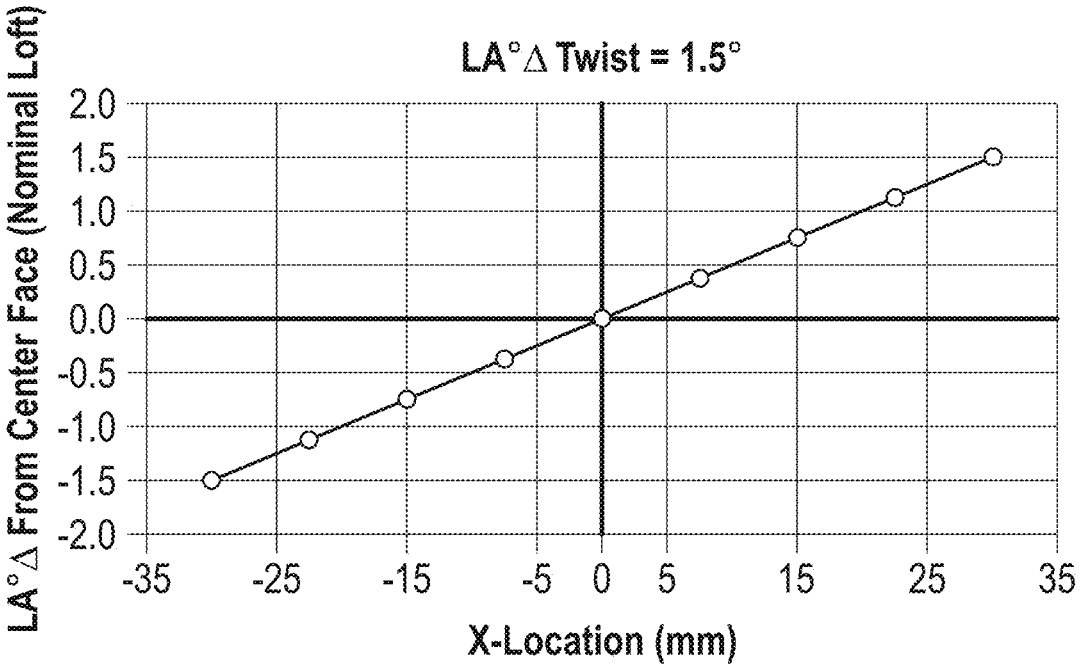
Figure 63:
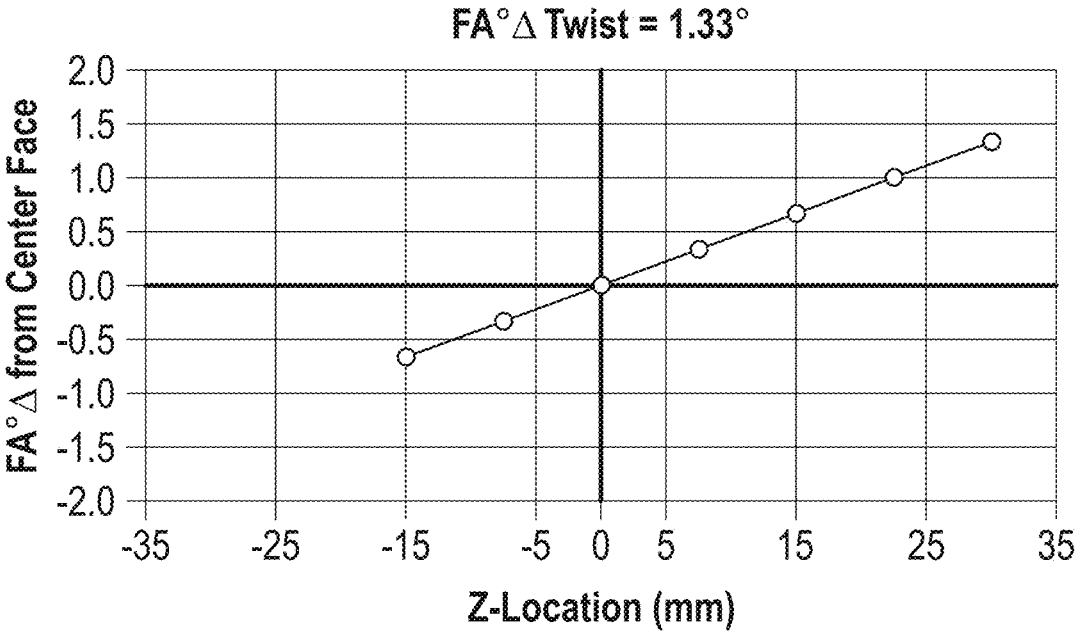
Figure 64:
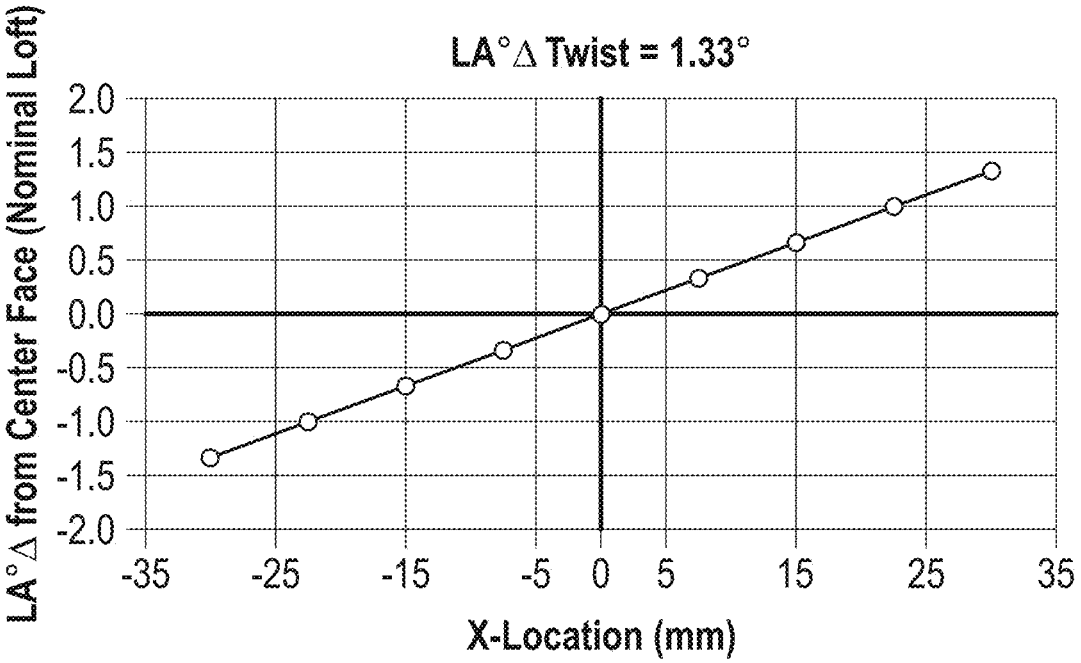
Figure 65:
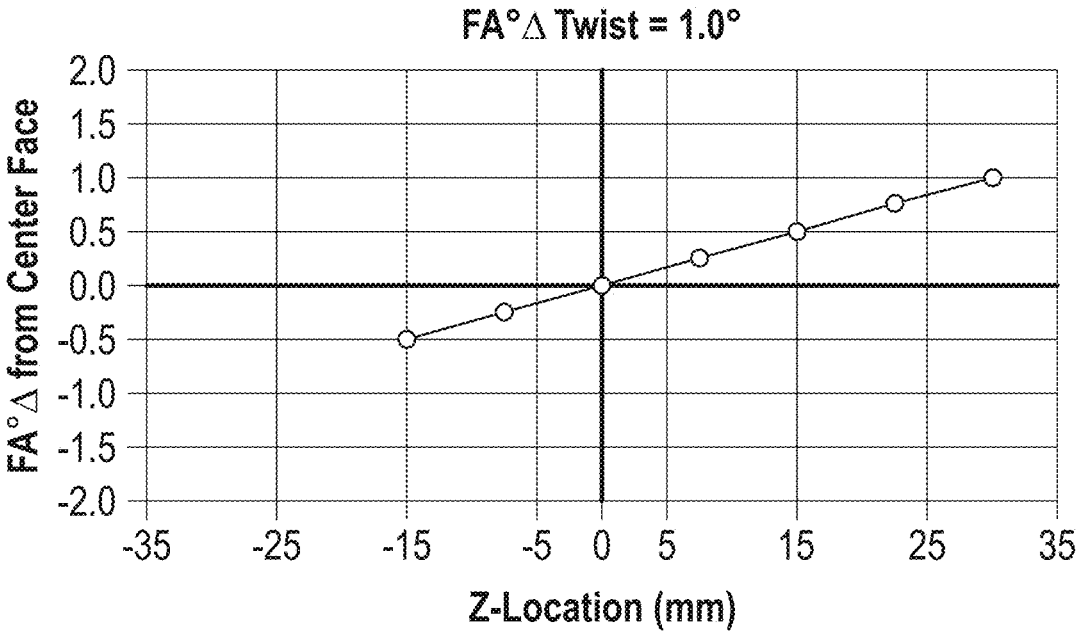
Figure 66:
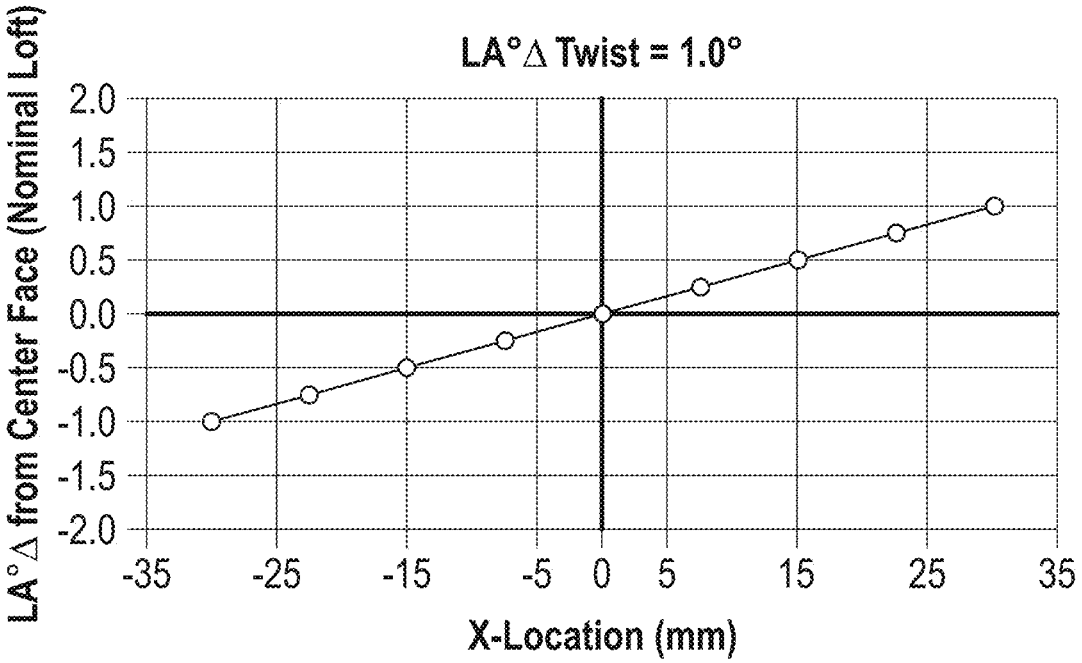
Figure 67:
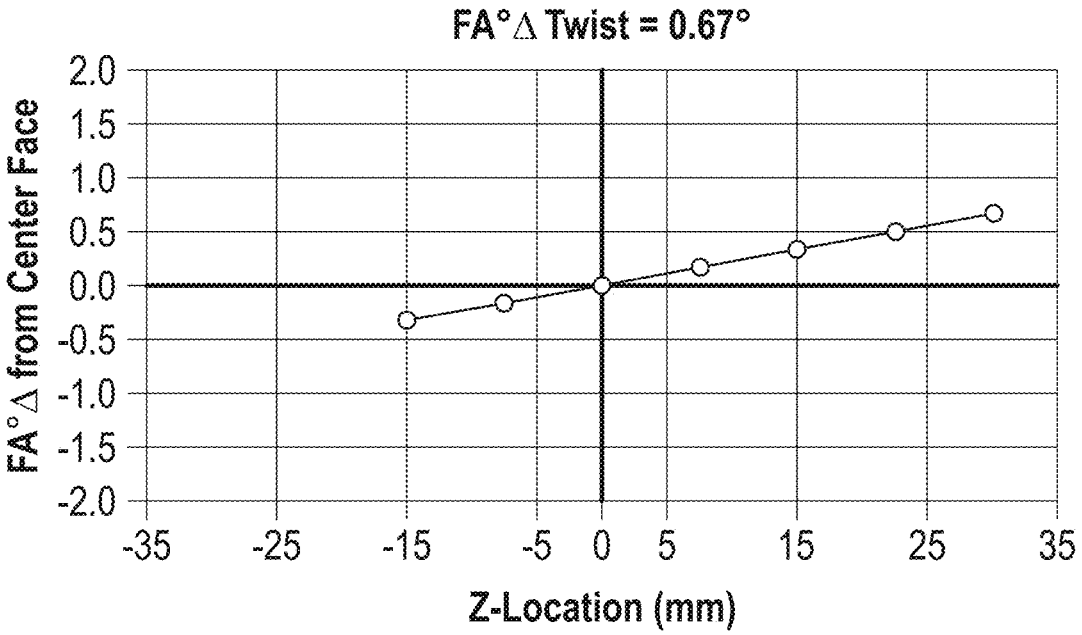
Figure 68:
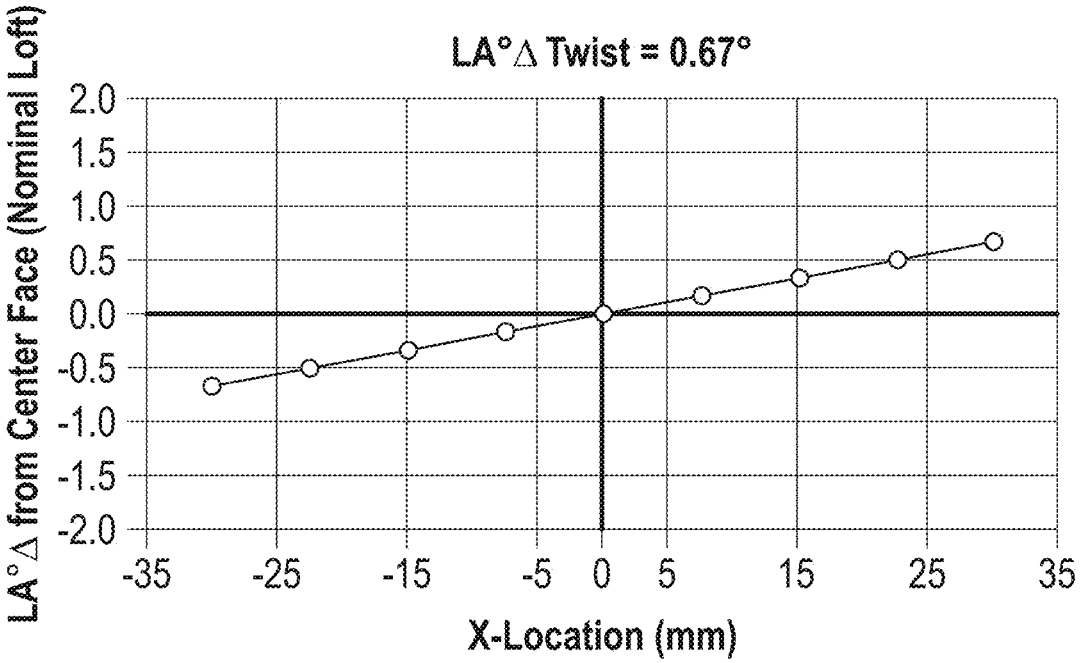
Figure 69:
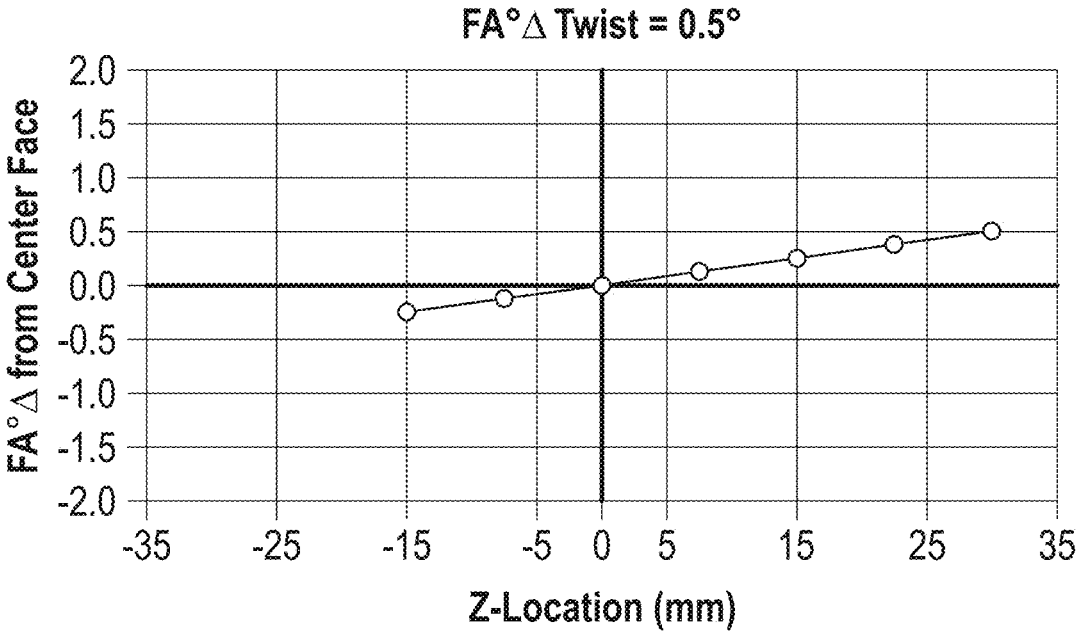
Figure 70:
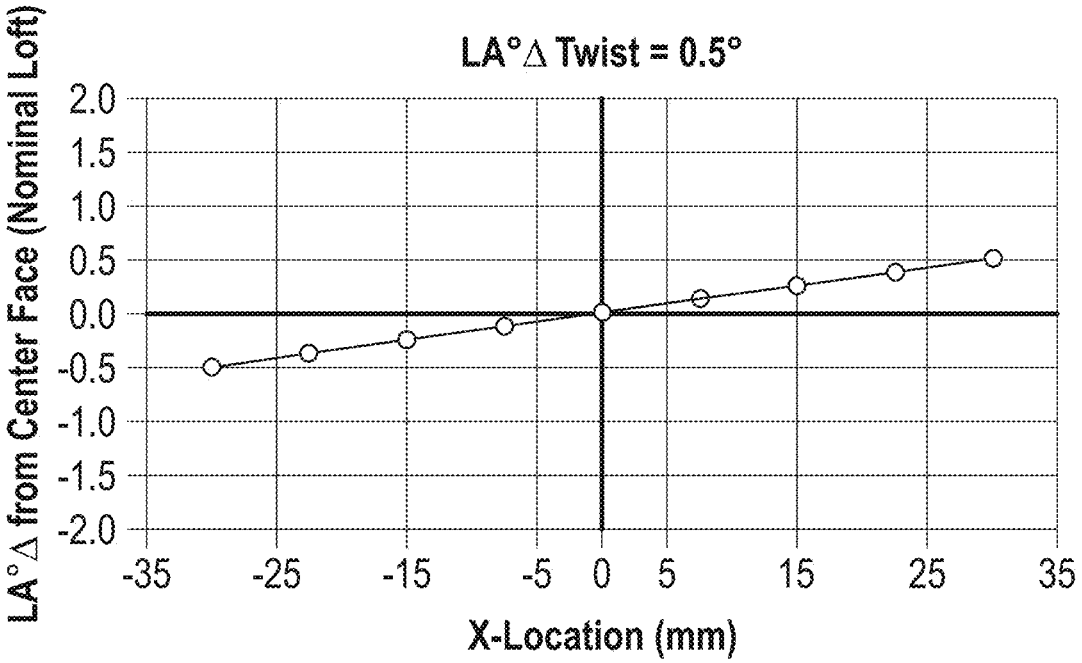
Figure 71:
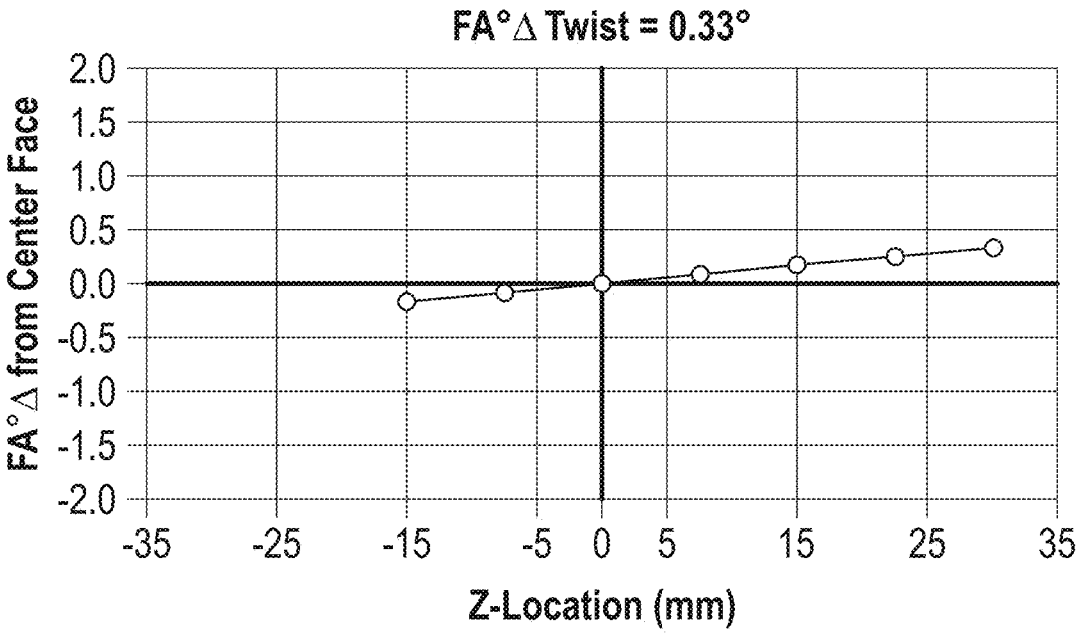
Figure 72:
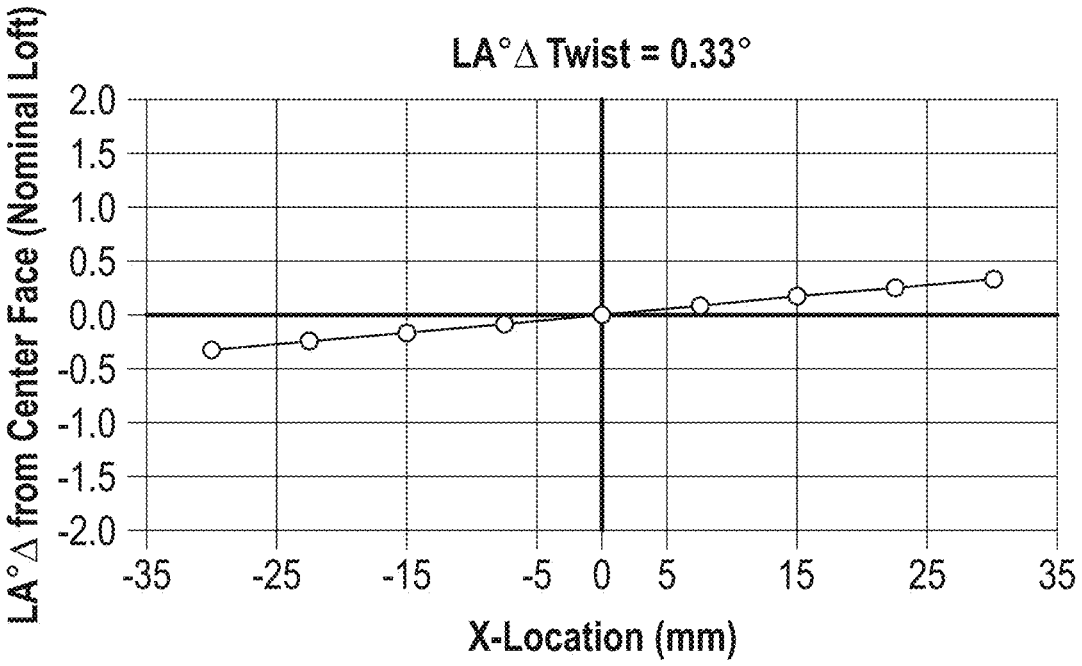

FIGS. 59-72 are graphs illustrating representative FA° Δ and LA° Δ values for iron-type golf clubs having degrees of twist varying from 1.67° (FIGS. 59 and 60) to 0.33° (FIGS. 71 and 72). With reference to FIG. 59, for an iron-type club with 1.67° of twist, the FA° Δ can vary between about −0.83° at a z=−15 mm to about 1.67° at z=30 mm, and the LA° Δ (FIG. 60) can vary from about −1.67° at x=−30 mm to about 1.67° at x=30 mm. With reference to FIG. 61, for an iron-type club with 1.5° of twist, the FA° Δ can vary between about −0.75° at a z=−15 mm to about 1.5° at z=30 mm, and the LA° Δ (FIG. 62) can vary from about −1.5° at x=−30 mm to about 1.5° at x=30 mm. With reference to FIG. 63, for an iron-type club with 1.33° of twist, the FA° Δ can vary between about −0.66° at a z=−15 mm to about 1.33° at z=30 mm, and the LA° Δ (FIG. 64) can vary from about −1.33° at x=−30 mm to about 1.33° at x=30 mm. With reference to FIG. 65, for an iron-type club with 1.0° of twist, the FA° Δ can vary between about −0.5° at a z=−15 mm to about 1.0° at z=30 mm, and the LA° Δ (FIG. 66) can vary from about −1.0° at x=−30 mm to about 1.0° at x=30 mm. With reference to FIG. 67, for an iron-type club with 0.67° of twist, the FA° Δ can vary between about −0.33° at a z=−15 mm to about 0.67° at z=30 mm, and the LA° Δ (FIG. 68) can vary from about −0.67° at x=−30 mm to about 0.67° at x=30 mm. With reference to FIG. 69, for an iron-type club with 0.5° of twist, the FA° Δ can vary between about −0.25° at a z=−15 mm to about 0.5° at z=30 mm, and the LA° Δ (FIG. 70) can vary from about −0.5° at x=−30 mm to about 0.5° at x=30 mm. With reference to FIG. 71, for an iron-type club with 0.33° of twist, the FA° Δ can vary between about −0.16° at a z=−15 mm to about 0.33° at z=30 mm, and the LA° Δ (FIG. 72) can vary from about −0.33° at x=−30 mm to about 0.33° at x=30 mm.

The iron-type golf clubs described herein may have any suitable loft angle. For example, iron-type golf clubs are typically provided in sets ranging from a 1-iron, a 2-iron, or a 3-iron to a 9-iron and/or a pitching wedge. In such sets, the lower-numbered clubs have lower loft angles than higher-numbered clubs in the set. For example, a 3-iron may have a loft angle of 17° to 22° or 18° to 21°. In particular embodiments, a 3-iron may have a loft angle of 19° or 20°. Meanwhile, a 9-iron can have a loft angle of 35° to 45°, or 38° to 42°. In particular embodiments, a 9-iron can have a loft angle of 40°, and a pitching wedge may have a loft angle of 45°.

In some embodiments, the amount of twist can be different for different irons in a set. For example, in certain embodiments each iron club may have a different amount of twist, with the lowest number iron having the highest amount of twist and the highest iron having the lowest amount of twist, or no twist. Table 8 below provides two representative examples. In Example 1, a 3-iron has 2.33° of twist, and the amount of twist of each successive club in the set decreases by 0.33°, and the wedge has 0° or no twist. In Example 2, the 3-iron and the 4-iron may both have 2.0° of twist. In yet other embodiments, the difference or increment in the amount of twist between successive clubs in a set may be 0.1°, 0.2°, 0.25°, 0.3°, 0.33°, 0.4°, 0.5°, 0.67°, 0.75°, 1.0°, 1.25°, 1.5°, 2.0°, etc.

TABLE 8

| Degrees of Twist in Iron Set | | | | | | | | |
|---|---|---|---|---|---|---|---|---|
| | 3-iron | 4-iron | 5-iron | 6-iron | 7-iron | 8-iron | 9-iron | Wedge |
| Twist - Example 1 | 2.33° | 2.0° | 1.67° | 1.33° | 1.0° | 0.67° | 0.33° | 0° |
| Twist - Example 2 | 2.0° | 2.0° | 1.67° | 1.33° | 1.0° | 0.67° | 0.33° | 0° |

In some embodiments, two or more clubs in a set may have the same degree of twist. In such sets, the clubs may be grouped according to the amount of twist applied. For example, in one representative example given in Table 9, the 3-iron, 4-iron, 5-iron, and/or 6-iron may have 2.0° of twist, the 7-iron and 8-iron may have 1.0° of twist, and the 9-iron and the wedge may have 0° of twist.

TABLE 9

| Degrees of Twist in Iron Set | | | |
|---|---|---|---|
| | 3-/4-/5-/6-iron | 7-/8-iron | 9-iron/Wedge |
| Twist - Example 3 | 2.0° | 1.0° | 0° |

Table 10 below provides yet another example, in which the irons are grouped in sets of two clubs with a 0.5° increment in the amount of twist between groups. For example, the 3-iron and 4-iron have 2.0° of twist, the 5-iron and the 6-iron have 1.5° of twist, the 7-iron and the 8-iron have 1.0° of twist, and the 9-iron and the wedge may have 0.5° or 0° of twist. Any of the twist values and increments described herein may also be applied to other types of irons, such as "better player's" irons or "game improvement" irons, and/or driving irons.

TABLE 10

| Degrees of Twist in Iron Set | | | | |
|---|---|---|---|---|
| | 3-/4-iron | 5-/6-iron | 7-/8-iron | 9-iron/Wedge |
| Twist - Example 4 | 2.0° | 1.5° | 1.0° | 0.5° or 0° |

Representative average FA° Δ and LA° Δ values for various quadrants of iron-type club heads similar to the club head 2000 of FIG. 56 having 0.5°, 1.0°, 1.5°, 2.0°, 2.5°, and 3.0° of twist are given in Table 11 below. With reference to FIG. 56, the striking face 2002 can be divided into an upper toe quadrant 2004, an upper heel quadrant 2006, a lower toe quadrant 2008, and a lower heel quadrant 2010 by axes 2012 and 2014 having an origin at the center face location coinciding with point 39. In certain embodiments, the average FA° Δ of the upper toe quadrant 2004 can be determined by calculating the average FA° Δ value of points 1-4, 6-8, and 12-14. The average FA° Δ of the upper heel quadrant 2006 can be determined by calculating the average FA° Δ value of points 10, 11, and 16-18. The average FA° Δ of the lower heel quadrant 2010 can be determined by calculating the average FA° Δ value of points 29-31 and 36-38. The average FA° Δ of the lower toe quadrant 2008 can be determined by calculating the average FA° Δ value of points 25-27 and 32-34.

Thus, in the example in Table 11 below in which the striking face 2004 has 2.0° of twist, the upper toe quadrant 2004 can have an average FA° Δ of 1.1° relative to the center face location, the upper heel quadrant 2006 can have an average FA° Δ of 0.70° relative to the center face location, the lower heel quadrant 2010 can have an average FA° Δ of −0.75° relative to the center face location, and the lower toe quadrant 2008 can have an average FA° Δ of −0.75° relative to the center face location.

Still referring to FIG. 56 and Table 11, the upper toe quadrant 2004 can have an average LA° Δ of 0.98° relative to the center face location, the upper heel quadrant 2006 can have an average LA° Δ of −0.84° relative to the center face location, the lower heel quadrant 2010 can have an average LA° Δ of −0.93° relative to the center face location, and the lower toe quadrant 2010 can have an average LA° Δ of 0.93° relative to the center face location. The average LA° Δ values of the various quadrants can be determined by calculating the average LA° Δ values of the points identified above for each quadrant. Average FA° Δ and average LA° Δ values for each of the upper toe, upper heel, lower heel, and lower toe quadrants are also given in Table 11 for club heads with 0.5°, 1.0°, 1.5°, 2.5°, and 3.0° of twist.

In some embodiments, the average FA° Δ of the upper toe quadrant 2004 can be from 0.275° (corresponding to a "0.5° twist") to 4.4° (corresponding to a "8° twist"). In some embodiments, the average FA° Δ of the upper toe quadrant 2004 can be from 0.275° to 3.3° (corresponding to a "6° twist"). In some embodiments, the average FA° Δ of the upper toe quadrant 2004 can be from 0.275° to 2.2° (corresponding to a "4° twist"). In some embodiments, the average FA° Δ of the upper toe quadrant 2004 can be from 0.275° to 1.1° (corresponding to a "2° twist"). In some embodiments, the average FA° Δ of the upper toe quadrant 2004 can be from 0.275° to 0.55° (corresponding to a "1° twist").

In some embodiments, the average LA° Δ of the upper toe quadrant 2004 can be from 0.245° (corresponding to a "0.5° twist") to about 4°, such as 3.92° (corresponding to an "8° twist"). In some embodiments, the average LA° Δ of the upper toe quadrant 2004 can be from 0.245° to about 3°, such as 2.94° (corresponding to a "6° twist"). In some embodiments, the average LA° Δ of the upper toe quadrant 2004 can be from 0.245° to about 2°, such as 1.96° (corresponding to a "4° twist"). In some embodiments, the average LA° Δ of the upper toe quadrant 2004 can be from 0.245° to about 1°, such as 0.98° (corresponding to a "2° twist"). In some embodiments, the average LA° Δ of the upper toe quadrant 2004 can be from 0.245° to about 0.5°, such as 0.49° (corresponding to a "1° twist").

TABLE 11

| Average in Quadrants | | | |
|---|---|---|---|
| Twist | Quadrant | FA° Δ | LA° Δ |
| 3.0° | Upper Toe | 1.7° | 1.47° |
| | Upper Heel | 1.05° | −1.26° |
| | Lower Toe | −1.13° | 1.40° |
| | Lower Heel | −1.13° | −1.40° |
| 2.5° | Upper Toe | 1.4° | 1.23° |
| | Upper Heel | 0.88° | −1.05° |
| | Lower Toe | −0.94° | 1.17° |
| | Lower Heel | −0.94° | −1.17° |
| 2.0° | Upper Toe | 1.1° | 0.98° |
| | Upper Heel | 0.70° | −0.84° |
| | Lower Toe | −0.75° | 0.93° |
| | Lower Heel | −0.75° | −0.93° |
| 1.5° | Upper Toe | 0.8° | 0.74° |
| | Upper Heel | 0.53° | −0.63° |
| | Lower Toe | −0.56° | 0.70° |
| | Lower Heel | −0.56° | −0.70° |
| 1.0° | Upper Toe | 0.6° | 0.49° |
| | Upper Heel | 0.35° | −0.42° |
| | Lower Toe | −0.38° | 0.47° |
| | Lower Heel | −0.38° | −0.47° |
| 0.5° | Upper Toe | 0.3° | 0.25° |
| | Upper Heel | 0.18° | −0.21° |
| | Lower Toe | −0.19° | 0.23° |
| | Lower Heel | −0.19° | −0.23° |

Club Heads Comprising Titanium Alloy Body/Face

In certain embodiments, any of the club heads described herein can include striking face plates and/or club head bodies made from one or more cast or machined titanium alloys. Compared to titanium golf club faces formed for sheet machining or forging processes, cast faces can have the advantage of lower cost and complete freedom of design. However, golf club faces cast from conventional titanium alloys, such as 6-4 Ti, need to be chemically etched to remove the alpha case on one or both sides so that the faces are durable. Such etching requires application of hydrofluoric (HF) acid, a chemical etchant that is difficult to handle, extremely harmful to humans and other materials, an environmental contaminant, and expensive.

Faces or club bodies cast from titanium alloys comprising aluminum (e.g., 8.5-9.5% Al), vanadium (e.g., 0.9-1.3% V), and molybdenum (e.g., 0.8-1.1% Mo), optionally with other minor alloying elements and impurities, herein collectively referred to a "9-1-1 Ti", can have less significant alpha case, which renders HF acid etching unnecessary or at least less necessary compared to faces or bodies made from conventional 6-4 Ti and other titanium alloys.

Further, 9-1-1 Ti can have minimum mechanical properties of 820 MPa yield strength, 958 MPa tensile strength, and 10.2% elongation. These minimum properties can be significantly superior to typical cast titanium alloys, such as 6-4 Ti, which can have minimum mechanical properties of 812 MPa yield strength, 936 MPa tensile strength, and −6% elongation.

Golf club heads, such as many types of irons, that are cast including the face as an integral part of the body (e.g., cast at the same time as a single cast object) can provide superior structural properties compared to club heads where the face is formed separately and later attached (e.g., welded or bolted) to a front opening in the club head body. However, the advantages of having an integrally cast Ti face are mitigated by the need to remove the alpha case on the surface of cast Ti faces.

With the herein disclosed club heads comprising an integrally cast 9-1-1 Ti face and body unit, the drawback of having to remove the alpha case can be eliminated, or at least substantially reduced. For a cast 9-1-1 Ti face, using a conventional mold pre-heat temperature of 1000 C or more, the thickness of the alpha case can be about 0.15 mm or less, or about 0.20 mm or less, or about 0.30 mm or less, such as between 0.10 mm and 0.30 mm in some embodiments, whereas for a cast 6-4 Ti face the thickness of the alpha case can be greater than 0.15 mm, or greater than 0.20 mm, or greater than 0.30 mm, such as from about 0.25 mm to about 0.30 mm in some examples.

Another titanium alloy that can be used to form any of the striking faces and/or club heads described herein can comprise titanium, aluminum, molybdenum, chromium, vanadium, and/or iron. For example, in one representative embodiment the alloy may be an alpha-beta titanium alloy comprising 6.5% to 10% Al by weight, 0.5% to 3.25% Mo by weight, 1.0% to 3.0% Cr by weight, 0.25% to 1.75% V by weight, and/or 0.25% to 1% Fe by weight, with the balance comprising Ti.

In another representative embodiment, the alloy may comprise 6.75% to 9.75% Al by weight, 0.75% to 3.25% or 2.75% Mo by weight, 1.0% to 3.0% Cr by weight, 0.25% to 1.75% V by weight, and/or 0.25% to 1% Fe by weight, with the balance comprising Ti.

In another representative embodiment, the alloy may comprise 7% to 9% Al by weight, 1.75% to 3.25% Mo by weight, 1.25% to 2.75% Cr by weight, 0.5% to 1.5% V by weight, and/or 0.25% to 0.75% Fe by weight, with the balance comprising Ti.

In another representative embodiment, the alloy may comprise 7.5% to 8.5% Al by weight, 2.0% to 3.0% Mo by weight, 1.5% to 2.5% Cr by weight, 0.75% to 1.25% V by weight, and/or 0.375% to 0.625% Fe by weight, with the balance comprising Ti.

In another representative embodiment, the alloy may comprise 8% Al by weight, 2.5% Mo by weight, 2% Cr by weight, 1% V by weight, and/or 0.5% Fe by weight, with the balance comprising Ti. Such titanium alloys can have the formula Ti-8Al-2.5Mo-2Cr-1V-0.5Fe. As used herein, reference to "Ti-8Al-2.5Mo-2Cr-1V-0.5Fe" refers to a titanium alloy including the referenced elements in any of the proportions given above. Certain embodiments may also comprise trace quantities of K, Mn, and/or Zr, and/or various impurities.

Ti-8Al-2.5Mo-2Cr-1V-0.5Fe can have minimum mechanical properties of 1150 MPa yield strength, 1180 MPa ultimate tensile strength, and 8% elongation. These minimum properties can be significantly superior to other cast titanium alloys, including 6-4 Ti and 9-1-1 Ti, which can have the minimum mechanical properties noted above. In some embodiments, Ti-8Al-2.5Mo-2Cr-1V-0.5Fe can have a tensile strength of from about 1180 MPa to about 1460 MPa, a yield strength of from about 1150 MPa to about 1415 MPa, an elongation of from about 8% to about 12%, a modulus of elasticity of about 110 GPa, a density of about 4.45 g/cm$^3$, and a hardness of about 43 on the Rockwell C scale (43 HRC). In particular embodiments, the Ti-8Al-2.5Mo-2Cr-1V-0.5Fe alloy can have a tensile strength of about 1320 MPa, a yield strength of about 1284 MPa, and an elongation of about 10%.

In some embodiments, striking faces can be cast from Ti-8Al-2.5Mo-2Cr-1V-0.5Fe, and/or stamped from Ti-8Al-2.5Mo-2Cr-1V-0.5Fe sheet stock. In some embodiments, striking surfaces and club head bodies can be integrally formed or cast together from Ti-8Al-2.5Mo-2Cr-1V-0.5Fe, depending upon the particular characteristics desired.

The mechanical parameters of Ti-8Al-2.5Mo-2Cr-1V-0.5Fe given above can provide surprisingly superior performance compared to other existing titanium alloys. For example, due to the relatively high tensile strength of Ti-8Al-2.5Mo-2Cr-1V-0.5Fe, cast and/or stamped sheet metal striking faces comprising this alloy can exhibit less deflection per unit thickness compared to other alloys when striking a golf ball. This can be especially beneficial for clubs configured for striking a ball at high speed, as the higher tensile strength of Ti-8Al-2.5Mo-2Cr-1V-0.5Fe results in less deflection of the striking face, and reduces the tendency of the striking face to flatten with repeated use. This allows the striking face to retain its original bulge, roll, and "twist" dimensions over prolonged use, including by advanced and/or professional golfers who tend to strike the ball at particularly high club velocities.

Iron Clubs Comprising Hollow Cavity

Figure 73:
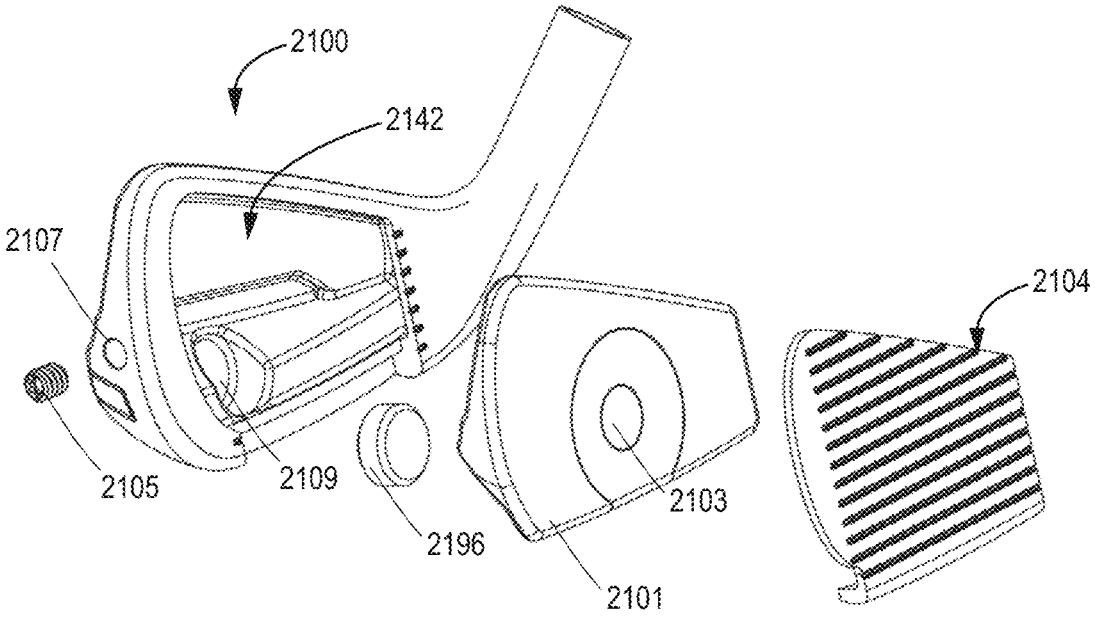
FIG. 73 is an exploded perspective view of a golf club head, according to another embodiment.

In some embodiments, any of the iron-type golf club heads described herein can be configured as cavity-backed, muscle-back, and/or hollow cavity iron-type gold club heads. An exemplary embodiment of an iron-type golf club head 2100 comprising an internal cavity 2142 that is partially or entirely filled with a filler material 2101 is shown in FIG. 73.

In some implementations, the filler material 2101 is made from a non-metal, such as a thermoplastic material, thermoset material, and the like, in some implementations. In other implementations, the internal cavity 2142 is not filled with a filler material 2101, but rather maintains an open, vacant, cavity within the club head.

According to one embodiment, the filler material 2101 is initially a viscous material that is injected or otherwise inserted into the club head through an injection port 2107 located on the toe portion of the club head. The injection port 2107 can be located anywhere on the club head 2100 including the topline, sole, heel, or toe. Examples of materials that may be suitable for use as a filler material 2101 to be placed into a club head include, without limitation: viscoelastic elastomers; vinyl copolymers with or without inorganic fillers; polyvinyl acetate with or without mineral fillers such as barium sulfate; acrylics; polyesters; polyurethanes; polyethers; polyamides; polybutadienes; polystyrenes; polyisoprenes; polyethylenes; polyolefins; styrene/isoprene block copolymers; hydrogenated styrenic thermoplastic elastomers; metallized polyesters; metallized acrylics; epoxies; epoxy and graphite composites; natural and synthetic rubbers; piezoelectric ceramics; thermoset and thermoplastic rubbers; foamed polymers; ionomers; low-density fiber glass; bitumen; silicone; and mixtures thereof. The metallized polyesters and acrylics can comprise aluminum as the metal. Commercially available materials include resilient polymeric materials such as Scotchweld™ (e.g., DP105™) and Scotchdamp™ from 3M, Sorbothane™ from Sorbothane, Inc., DYAD™ and GP™ from Soundcoat Company Inc., Dynamat™ from Dynamat Control of North America, Inc., NoViFlex™ Sylomer™ from Pole Star Maritime Group, LLC, Isoplast™ from The Dow Chemical Company, Legetolex™ from Piqua Technologies, Inc., and Hybrar™ from the Kuraray Co., Ltd. In still other embodiments, the filler 2101 material may be placed into the club head 2100 and sealed in place with a plug 2105, or resilient cap or other structure formed of a metal, metal alloy, metallic, composite, hard plastic, resilient elastomeric, or other suitable material.

In one embodiment, the plug 2105 is a metallic plug that can be made from steel, aluminum, titanium, or a metallic alloy. In one embodiment, the plug 2105 is an anodized aluminum plug that is colored a red, green, blue, gray, white, orange, purple, black, clear, yellow, or metallic color. In one embodiment, the plug 2105 is a different or contrasting color from the majority color located on the club head body 2100.

In some embodiments, the filler material includes a slight recess or depression 2103 that accommodates the variable face thickness of the striking plate 2104. In other words, the recess or depression 2103 located in the filler material 2101 mates or is keyed with a thickened portion of the striking plate 2104. In one embodiment, the thickened portion of the striking plate 2104 occurs at the center of the striking plate 2104.

In one embodiment, the golf club head 2100 includes a recess 2109 that allows the weight 2196 to be located. Once the weight 2196 is positioned within the recess 2109 and the strike plate 2104 has been attached, the filler material 2101 is injected through the port 2107 and sealed with the plug 2105. In certain embodiments, the weight 2196 can be positioned below the center face location (e.g., closer to the ground plane than the center face location). Certain embodiments may comprise one or more weights such as weight 2196, such as two or more weights, three or more weights, etc., positioned below the center face location and located toward a toe-ward end of the golf club head.

In one embodiment, the filler material 2101 has a minor impact on the coefficient of restitution (herein "COR") as measured according to the United States Golf Association (USGA) rules set forth in the Procedure for Measuring the Velocity Ratio of a Club Head for Conformance to Rule 4-1e, Appendix II Revision 2 Feb. 8, 1999, herein incorporated by reference in its entirety.

Table 12 below provides examples of the COR change relative to a calibration plate of multiple club heads of the construction shown in FIG. 73 in both a filled and unfilled state. The calibration plate dimensions and weight are described in section 4.0 of the Procedure for Measuring the Velocity Ratio of a Club Head for Conformance to Rule 4-1e.

Due to the slight variability between different calibration plates, the values described below are described in terms of a change in COR relative to a calibration plate base value. For example, if a calibration plate has a 0.831 COR value, Example 1 for an un-filled head has a COR value of −0.019 less than 0.831 which would give Example 1 (Unfilled) a COR value of 0.812. The change in COR for a given head relative to a calibration plate is accurate and highly repeatable.

TABLE 12

| COR Values Relative to a Calibration Plate | | | |
|---|---|---|---|
| Example No. | Unfilled COR Relative to Calibration Plate | Filled COR Relative to Calibration Plate | COR Change Between Filled and Unfilled |
| 1 | −0.019 | −0.022 | −0.003 |
| 2 | −0.003 | −0.005 | −0.002 |

TABLE 12-continued

| COR Values Relative to a Calibration Plate | | | |
|---|---|---|---|
| Example No. | Unfilled COR Relative to Calibration Plate | Filled COR Relative to Calibration Plate | COR Change Between Filled and Unfilled |
| 3 | −0.006 | −0.010 | −0.004 |
| 4 | −0.006 | −0.017 | −0.011 |
| 5 | −0.026 | −0.028 | −0.002 |
| 6 | −0.007 | −0.017 | −0.01 |
| 7 | −0.013 | −0.019 | −0.006 |
| 8 | −0.007 | −0.007 | 0 |
| 9 | −0.012 | −0.014 | −0.002 |
| 10 | −0.020 | −0.022 | −0.002 |
| Average | −0.0119 | −0.022 | −0.002 |

Table 12 illustrates that before the filler material 2101 is introduced into the cavity 2142 of golf club head 2100, an Unfilled COR drop off relative to the calibration plate (or first COR drop off value) is between 0 and −0.05, between 0 and −0.03, between −0.00001 and −0.03, between −0.00001 and −0.025, between −0.00001 and −0.02, between −0.00001 and −0.015, between −0.00001 and −0.01, or between −0.00001 and −0.005.

In one embodiment, the average COR drop off or loss relative to the calibration plate for a plurality of Unfilled COR golf club head within a set of irons is between 0 and −0.05, between 0 and −0.03, between −0.00001 and −0.03, between −0.00001 and −0.025, between −0.00001 and −0.02, between −0.00001 and −0.015, or between −0.00001 and −0.01.

Table 12 further illustrates that after the filler material 2101 is introduced into the cavity 2142 of golf club head 2100, a Filled COR drop off relative to the calibration plate (or second COR drop off value) is more than the Unfilled COR drop off relative to the calibration plate. In other words, the addition of the filler material 2101 in the Filled COR golf club heads slows the ball speed (Vout—Velocity Out) after rebounding from the face by a small amount relative to the rebounding ball velocity of the Unfilled COR heads.

In some embodiments shown in Table 12, the COR drop off or loss relative to the calibration plate for a Filled COR golf club head is between 0 and −0.05, between 0 and −0.03, between −0.00001 and −0.03, between −0.00001 and −0.025, between −0.00001 and −0.02, between −0.00001 and −0.015, between −0.00001 and −0.01, or between −0.00001 and −0.005.

In one embodiment, the average COR drop off or loss relative to the calibration plate for a plurality of Filled COR golf club head within a set of irons is between 0 and −0.05, between 0 and −0.03, between −0.00001 and −0.03, between −0.00001 and −0.025, between −0.00001 and −0.02, between −0.00001 and −0.015, between −0.00001 and −0.01, or between −0.00001 and −0.005.

However, the amount of COR loss or drop off for a Filled COR head is minimized when compared to other constructions and filler materials. The last column of Table 12 illustrates a COR change between the Unfilled and Filled golf club heads which are calculated by subtracting the Unfilled COR from the Filled COR table columns. The change in COR (COR change value) between the Filled and Unfilled club heads is between 0 and −0.1, between 0 and −0.05, between 0 and −0.04, between 0 and −0.03, between 0 and −0.025, between 0 and −0.02, between 0 and −0.015, between 0 and −0.01, between 0 and −0.009, between 0 and −0.008, between 0 and −0.007, between 0 and −0.006, between 0 and −0.005, between 0 and −0.004, between 0 and −0.003, or between 0 and −0.002. Remarkably, one club head was able to achieve a change in COR of zero between a filled and unfilled golf club head. In other words, no change in COR between the Filled and Unfilled club head state. In some embodiments, the COR change value is greater than −0.1, greater than −0.05, greater than −0.04, greater than −0.03, greater than −0.02, greater than −0.01, greater than −0.009, greater than −0.008, greater than −0.007, greater than −0.006, greater than −0.005, greater than −0.004, or greater than −0.003.

In some embodiments, at least one, two, three or four iron golf clubs out of an iron golf club set has a change in COR between the Filled and Unfilled states of between 0 and −0.1, between 0 and −0.05, between 0 and −0.04, between 0 and −0.03, between 0 and −0.02, between 0 and −0.01, between 0 and −0.009, between 0 and −0.008, between 0 and −0.007, between 0 and −0.006, between 0 and −0.005, between 0 and −0.004, between 0 and −0.003, or between 0 and −0.002.

In yet other embodiments, at least one pair or two pair of iron golf clubs in the set have a change in COR between the Filled and Unfilled states of between 0 and −0.1, between 0 and −0.05, between 0 and −0.04, between 0 and −0.03, between 0 and −0.02, between 0 and −0.01, between 0 and −0.009, between 0 and −0.008, between 0 and −0.007, between 0 and −0.006, between 0 and −0.005, between 0 and −0.004, between 0 and −0.003, or between 0 and −0.002.

In other embodiments, an average of a plurality of iron golf clubs in the set has a change in COR between the Filled and Unfilled states of between 0 and −0.1, between 0 and −0.05, between 0 and −0.04, between 0 and −0.03, between 0 and −0.02, between 0 and −0.01, between 0 and −0.009, between 0 and −0.008, between 0 and −0.007, between 0 and −0.006, between 0 and −0.005, between 0 and −0.004, between 0 and −0.003, or between 0 and −0.002.

Figure 74:
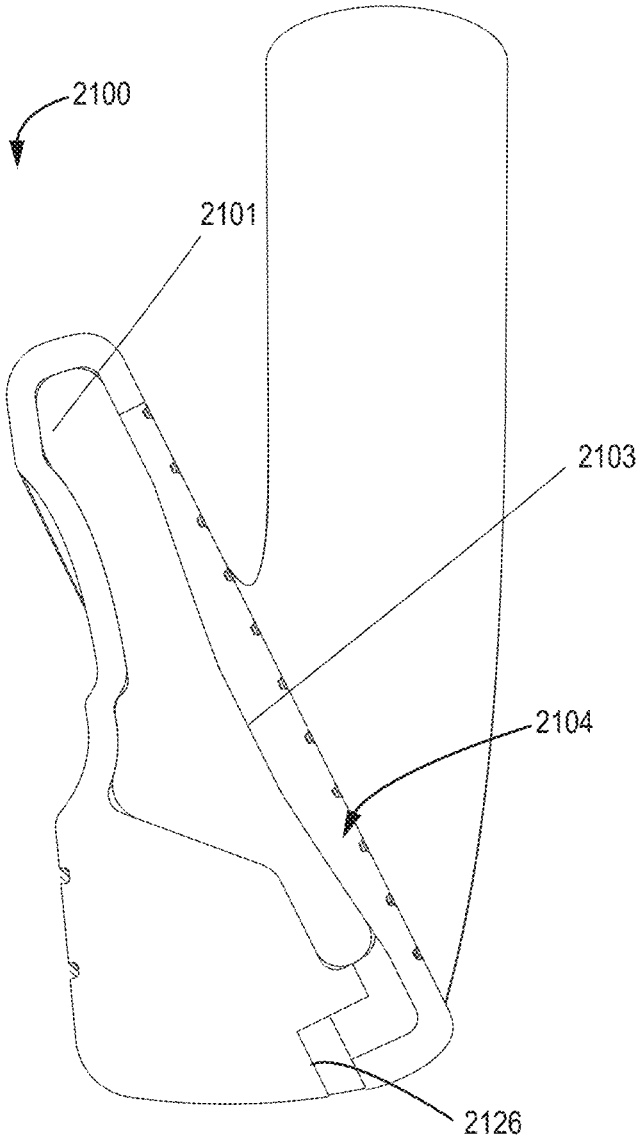
FIG. 74 is a cross-sectional view through the center face of the golf club head of FIG. 24.

FIG. 74 illustrates a cross-sectional view through the center face of the golf club head shown in FIG. 73. The filler material 2101 fills the cavity 2142 located above the sole slot 2126. The recess or depression 2103 engages with the thickened portion of the striking plate 2104.

In some embodiments, the filler material 2101 is a two part polyurethane foam that is a thermoset and is flexible after it is cured. In one embodiment, the two part polyurethane foam is any methylene diphenyl diisocyanate (a class of polyurethane prepolymer) or silicone based flexible or rigid polyurethane foam.

Additional examples of cavity-backed, muscle-back, and hollow cavity iron-type gold club heads are described in U.S. Publication No. 2016/0193508, which is incorporated by reference herein. Additional examples of various foam-filled iron-type golf club heads and flexible boundary structures are described in greater detail in U.S. Publication No. 2018/0185717, U.S. Publication No. 2018/0185715, U.S. Pat. Nos. 8,088,025, 6,811,496, 8,535,177, and 8,932,150, which are all incorporated herein by reference.

General Considerations

For purposes of this description, certain aspects, advantages, and novel features of the embodiments of this disclosure are described herein. The disclosed methods, apparatuses, and systems should not be construed as limiting in any way. Instead, the present disclosure is directed toward all novel and nonobvious features and aspects of the various disclosed embodiments, alone and in various combinations and sub-combinations with one another. The methods, apparatuses, and systems are not limited to any specific aspect or feature or combination thereof, nor do the disclosed embodiments require that any one or more specific advantages be present or problems be solved.

As used herein, the terms "a", "an" and "at least one" encompass one or more of the specified element. That is, if two of a particular element are present, one of these elements is also present and thus "an" element is present. The terms "a plurality of" and "plural" mean two or more of the specified element. As used herein, the term "and/or" used between the last two of a list of elements means any one or more of the listed elements. For example, the phrase "A, B, and/or C" means "A," "B," "C," "A and B," "A and C," "B and C" or "A, B and C." As used herein, the term "coupled" generally means physically coupled or linked and does not exclude the presence of intermediate elements between the coupled items absent specific contrary language.

In some examples, values, procedures, or apparatus may be referred to as "lowest," "best," "minimum," or the like. It will be appreciated that such descriptions are intended to indicate that a selection among many alternatives can be made, and such selections need not be better, smaller, or otherwise preferable to other selections.

In the description, certain terms may be used such as "up," "down," "upper," "lower," "horizontal," "vertical," "left," "right," and the like. These terms are used, where applicable, to provide some clarity of description when dealing with relative relationships. But, these terms are not intended to imply absolute relationships, positions, and/or orientations. For example, with respect to an object, an "upper" surface can become a "lower" surface simply by turning the object over. Nevertheless, it is still the same object.

In view of the many possible embodiments to which the principles of the disclosed technology may be applied, it should be recognized that the illustrated embodiments are only preferred examples and should not be taken as limiting the scope of the disclosure. It will be evident that various modifications may be made thereto without departing from the broader spirit and scope of the disclosure as set forth. The specification and drawings are, accordingly, to be regarded in an illustrative sense rather than a restrictive sense.

The invention claimed is:

1. An iron-type golf club head comprising:

a hosel portion, a heel portion, a sole portion, a toe portion, a topline portion, and a striking face, the striking face having a center face location;

a center face vertical plane passing through the center face location, the center face vertical plane extending from adjacent the topline portion to adjacent the sole portion and intersecting with the striking face surface to define a center face topline-to-sole contour;

a toe side vertical plane being spaced away from the center face vertical plane by 14 mm toward the toe portion, the toe side vertical plane extending from adjacent the topline portion to adjacent the sole portion and intersecting with the striking face surface to define a toe side topline-to-sole contour;

a heel side vertical plane being spaced away from the center face vertical plane by 14 mm toward the heel portion, the heel side vertical plane extending from adjacent the topline portion to adjacent the sole portion and intersecting with the striking face surface to define a heel side topline-to-sole contour;

a center face horizontal plane passing through the center face location, the center face horizontal plane extending from adjacent the toe portion to adjacent the heel portion and intersecting with the striking face surface to define a center face toe-to-heel contour;

a topline side horizontal plane being spaced away from the center face horizontal plane by 15 mm toward the topline portion, the topline side horizontal plane extending from adjacent the toe portion to adjacent the heel portion and intersecting with the striking face surface to define a topline side toe-to-heel contour;

a sole side horizontal plane being spaced away from the center face horizontal plane by 15 mm toward the sole portion, the sole side horizontal plane extending from adjacent the toe portion to adjacent the heel portion and intersecting with the striking face surface to define a sole side toe-to-heel contour;

wherein the toe side topline-to-sole contour is more lofted than the center face topline-to-sole contour, the heel side topline-to-sole contour is less lofted than the center face topline-to-sole contour, the topline side toe-to-heel contour is more open than the center face toe-to-heel contour, and the sole side toe-to-heel contour is more closed than the center face toe-to-heel contour; and wherein the toe side topline-to-sole contour, the center face topline-to-sole contour, the heel side topline-to-sole contour, the topline side toe-to-heel contour, the center face toe-to-heel contour, and the sole side toe-to-heel contour are straight line contours.

2. The iron-type golf club head of claim 1, wherein a critical point located at 15 mm above the center face location has a LA° Δ that is substantially unchanged relative to a 0° twist golf club head.

3. The iron-type golf club head of claim 1, wherein a critical point located at 15 mm above the center face location has a FA° Δ of between 0.1° and 4° relative to the center face location.

4. The iron-type golf club head of claim 1, wherein a critical point located at 15 mm above the center face location has a FA° Δ of between 0.25° and 3° relative to the center face location.

5. The iron-type golf club head of claim 1, wherein a critical point located at 15 mm below the center face location has a FA° Δ of between −0.1° and −4° relative to the center face location.

6. The iron-type golf club head of claim 1, wherein a critical point located at 15 mm below the center face location has a FA° Δ of between −0.25° and −3° relative to the center face location.

7. The iron-type golf club head of claim 1, wherein an average FA° Δ of an upper toe quadrant of the striking face is between 0.275° to 4.4°.

8. The iron-type golf club head of claim 1, wherein:

a toe side point located at a x-z coordinate of (14 mm, 15 mm) has a LA° Δ relative to the center face location that is between 0.23° and 2.8°; and wherein a heel side point located at a x-y coordinate of (−14 mm, −15 mm) has a LA° Δ relative to the center face location that is between 0.23° and −2.8°.

9. The iron-type golf club head of claim 1, wherein an average LA° Δ of an upper toe quadrant of the striking face is between 0.245° to 3°.

10. The iron-type golf club head of claim 1, wherein the striking face has a degree of twist that is between 0.1° and 5° when measured between two critical locations located at 15 mm above the center face location and 15 mm below the center face location.

11. The iron-type golf club head of claim 1, wherein the club head comprises a titanium alloy including 6.75% to 9.75% aluminum by weight and 0.75% to 3.25% molybdenum by weight.

12. An iron-type golf club head comprising:

a hosel portion, a heel portion, a sole portion, a toe portion, a topline portion, and a striking face, the striking face having a center face location;

a center face vertical plane passing through the center face location, the center face vertical plane extending from adjacent the topline portion to adjacent the sole portion and intersecting with the striking face surface to define a center face topline-to-sole contour;

a toe side vertical plane being spaced away from the center face vertical plane by 14 mm toward the toe portion, the toe side vertical plane extending from adjacent the topline portion to adjacent the sole portion and intersecting with the striking face surface to define a toe side topline-to-sole contour;

a heel side vertical plane being spaced away from the center face vertical plane by 14 mm toward the heel portion, the heel side vertical plane extending from adjacent the topline portion to adjacent the sole portion and intersecting with the striking face surface to define a heel side topline-to-sole contour;

a center face horizontal plane passing through the center face location, the center face horizontal plane extending from adjacent the toe portion to adjacent the heel portion and intersecting with the striking face surface to define a center face toe-to-heel contour;

a topline side horizontal plane being spaced away from the center face horizontal plane by 15 mm toward the topline portion, the topline side horizontal plane extending from adjacent the toe portion to adjacent the heel portion and intersecting with the striking face surface to define a topline side toe-to-heel contour;

a sole side horizontal plane being spaced away from the center face horizontal plane by 15 mm toward the sole portion, the sole side horizontal plane extending from adjacent the toe portion to adjacent the heel portion and intersecting with the striking face surface to define a sole side toe-to-heel contour;

wherein the toe side topline-to-sole contour is more lofted than the center face topline-to-sole contour, the heel side topline-to-sole contour is less lofted than the center face topline-to-sole contour, the topline side toe-to-heel contour is more open than the center face toe-to-heel contour, and the sole side toe-to-heel contour is more closed than the center face toe-to-heel contour; and wherein a club head depth of the of the iron-type golf club head is between about 10 mm and about 50 mm.

13. The iron-type golf club head of claim 12, wherein a critical point located at 15 mm above the center face location has a LA° Δ that is substantially unchanged relative to a 0° twist golf club head.

14. The iron-type golf club head of claim 12, wherein a critical point located at 15 mm above the center face location has a FA° Δ of between 0.1° and 4° relative to the center face location.

15. The iron-type golf club head of claim 12, wherein a critical point located at 15 mm above the center face location has a FA° Δ of between 0.25° and 3° relative to the center face location.

16. The iron-type golf club head of claim 12, wherein an average FA° Δ of an upper toe quadrant of the striking face is between 0.275° to 4.4°.

17. The iron-type golf club head of claim 12, wherein:

a toe side point located at a x-z coordinate of (14 mm, 15 mm) has a LA° Δ relative to the center face location that is between 0.23° and 2.8°; and wherein a heel side point located at a x-y coordinate of (−14 mm, −15 mm) has a LA° Δ relative to the center face location that is between 0.23° and −2.8°.

18. The iron-type golf club head of claim 12, wherein an average LA° Δ of an upper toe quadrant of the striking face is between 0.245° to 3°.

19. The iron-type golf club head of claim 12, wherein the striking face has a degree of twist that is between 0.1° and 5° when measured between two critical locations located at 15 mm above the center face location and 15 mm below the center face location.

20. An iron-type golf club head comprising:

a hosel portion, a heel portion, a sole portion, a toe portion, a topline portion, and a striking face, the striking face having a center face location;

a center face vertical plane passing through the center face location, the center face vertical plane extending from adjacent the topline portion to adjacent the sole portion and intersecting with the striking face surface to define a center face topline-to-sole contour;

a toe side vertical plane being spaced away from the center face vertical plane by 14 mm toward the toe portion, the toe side vertical plane extending from adjacent the topline portion to adjacent the sole portion and intersecting with the striking face surface to define a toe side topline-to-sole contour;

a heel side vertical plane being spaced away from the center face vertical plane by 14 mm toward the heel portion, the heel side vertical plane extending from adjacent the topline portion to adjacent the sole portion and intersecting with the striking face surface to define a heel side topline-to-sole contour;

a center face horizontal plane passing through the center face location, the center face horizontal plane extending from adjacent the toe portion to adjacent the heel portion and intersecting with the striking face surface to define a center face toe-to-heel contour;

a topline side horizontal plane being spaced away from the center face horizontal plane by 15 mm toward the topline portion, the topline side horizontal plane extending from adjacent the toe portion to adjacent the heel portion and intersecting with the striking face surface to define a topline side toe-to-heel contour;

a sole side horizontal plane being spaced away from the center face horizontal plane by 15 mm toward the sole portion, the sole side horizontal plane extending from adjacent the toe portion to adjacent the heel portion and intersecting with the striking face surface to define a sole side toe-to-heel contour;

wherein the toe side topline-to-sole contour is more lofted than the center face topline-to-sole contour, the heel side topline-to-sole contour is less lofted than the center face topline-to-sole contour, the topline side toe-to-heel contour is more open than the center face toe-to-heel contour, and the sole side toe-to-heel contour is more closed than the center face toe-to-heel contour; and wherein the iron-type golf club head has a volume less than 110 cc.

21. The iron-type golf club head of claim 20, wherein the iron-type golf club head has a volume of between about 30 cc and about 100 cc.

* * * * *